US011803134B2

(12) United States Patent
Kikuchi et al.

(10) Patent No.: US 11,803,134 B2
(45) Date of Patent: Oct. 31, 2023

(54) POWDER CONTAINER

(71) Applicant: Ricoh Company, Ltd., Tokyo (JP)

(72) Inventors: Kenji Kikuchi, Kanagawa (JP); Shinji Tamaki, Tokyo (JP); Hiroshi Hosokawa, Kanagawa (JP); Shunji Katoh, Kanagawa (JP); Michiharu Suzuki, Kanagawa (JP); Hideo Yoshizawa, Kanagawa (JP); Shingo Kuboki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/730,237

(22) Filed: Apr. 27, 2022

(65) Prior Publication Data

US 2022/0253001 A1 Aug. 11, 2022

Related U.S. Application Data

(63) Continuation of application No. 17/110,340, filed on Dec. 3, 2020, now Pat. No. 11,372,347, which is a (Continued)

(30) Foreign Application Priority Data

Mar. 15, 2013 (JP) ..... 2013-054371
Mar. 15, 2013 (JP) ..... 2013-054372
(Continued)

(51) Int. Cl.
*G03G 15/08* (2006.01)
*G03G 15/20* (2006.01)

(52) U.S. Cl.
CPC ..... *G03G 15/0877* (2013.01); *G03G 15/087* (2013.01); *G03G 15/0865* (2013.01);
(Continued)

(58) Field of Classification Search
CPC ..... G03G 15/087; G03G 15/0872
See application file for complete search history.

(56) References Cited

U.S. PATENT DOCUMENTS 122,205 A 12/1871 Westbrook
4,949,123 A 8/1990 Takashima
(Continued)

FOREIGN PATENT DOCUMENTS

CA 2973610 A1 6/2012
CA 2782610 C 8/2017
(Continued)

OTHER PUBLICATIONS

JP_2011076064_A_T Machin Translation, Japan, Apr. 2011, Kikuchi et al.*
(Continued)

*Primary Examiner* — Victor Verbitsky
(74) *Attorney, Agent, or Firm* — XSENSUS LLP

(57) ABSTRACT

A powder container contains powder and is attached to an image forming apparatus including: a conveying nozzle to convey the powder; a powder receiving hole of the conveying nozzle to receive the powder from the powder container; an apparatus main-body gear to transmit a driving force to the powder container; and a container receiving section including the conveying nozzle and receiving the powder container. The powder container includes: an opening at one end of the powder container in a longitudinal direction; a nozzle receiver at the opening to receive the conveying nozzle; a conveyor to convey the powder; and a container gear to drive the conveyor by meshing with the apparatus main-body gear. The container gear is to mesh with the apparatus main-body gear at a position closer to the opening than the powder receiving hole in the longitudinal direction. The opening is to mate with the container receiving section.

32 Claims, 108 Drawing Sheets

Related U.S. Application Data continuation of application No. 17/023,430, filed on Sep. 17, 2020, now Pat. No. 10,935,905, which is a continuation of application No. 16/705,276, filed on Dec. 6, 2019, now Pat. No. 10,809,648, which is a continuation of application No. 15/342,014, filed on Nov. 2, 2016, now Pat. No. 10,534,290, which is a continuation of application No. 14/854,882, filed on Sep. 15, 2015, now Pat. No. 9,513,576, which is a continuation of application No. PCT/JP2014/057949, filed on Mar. 14, 2014.

(30) Foreign Application Priority Data

| | | |
|---|---|---|
| May 24, 2013 | (JP) | 2013-110330 |
| May 24, 2013 | (JP) | 2013-110443 |
| Jul. 12, 2013 | (JP) | 2013-146882 |
| Jul. 24, 2013 | (JP) | 2013-153815 |
| Nov. 26, 2013 | (JP) | 2013-244411 |
| Feb. 4, 2014 | (JP) | 2014-019469 |

(52) U.S. Cl.
CPC ..... *G03G 15/0872* (2013.01); *G03G 15/2028* (2013.01); *G03G 15/0879* (2013.01); *G03G 2215/0678* (2013.01)

(56) References Cited

U.S. PATENT DOCUMENTS

| | | | |
|---|---|---|---|
| 5,345,297 | A | 9/1994 | Katakabe et al. |
| 5,495,323 | A | 2/1996 | Meetze, Jr. |
| 5,576,816 | A | 11/1996 | Staudt et al. |
| 5,890,040 | A | 3/1999 | Matsuoka et al. |
| 5,995,782 | A | 11/1999 | Isobe et al. |
| 6,091,912 | A | 7/2000 | Kitajima et al. |
| 6,104,902 | A | 8/2000 | Meyer et al. |
| 6,118,951 | A | 9/2000 | Kato et al. |
| 6,169,864 | B1 | 1/2001 | Baxendell et al. |
| 6,405,011 | B1 | 6/2002 | Wang et al. |
| 6,665,505 | B2 | 12/2003 | Meetze et al. |
| 6,898,405 | B2 | 5/2005 | Matsumoto et al. |
| 7,065,313 | B2 | 6/2006 | Matsumoto et al. |
| 7,079,788 | B2 | 7/2006 | Ban et al. |
| 7,248,825 | B2 | 7/2007 | Nishitani et al. |
| 7,321,744 | B2 | 1/2008 | Hosokawa et al. |
| 7,480,476 | B2 | 1/2009 | Hosokawa et al. |
| 7,519,317 | B2 | 4/2009 | Hosokawa et al. |
| 7,697,870 | B2 | 4/2010 | Hosokawa et al. |
| 7,720,417 | B2 | 5/2010 | Taguchi et al. |
| 7,751,737 | B2 | 7/2010 | Ishida et al. |
| 7,835,673 | B2 | 11/2010 | Hosokawa et al. |
| 7,853,184 | B2 | 12/2010 | Taguchi et al. |
| 8,005,406 | B2 | 8/2011 | Hosokawa et al. |
| 8,060,003 | B2 | 11/2011 | Yoshizawa |
| 8,095,049 | B2 | 1/2012 | Ishiguro et al. |
| 8,195,070 | B2 | 6/2012 | Hosokawa et al. |
| 8,577,277 | B2 | 11/2013 | Yoshizawa |
| D743,400 | S | 11/2015 | Takahashi et al. |
| D757,161 | S | 5/2016 | Takahashi et al. |
| D758,482 | S | 6/2016 | Takahashi et al. |
| 2001/0021326 | A1 | 9/2001 | Yanagisawa et al. |
| 2002/0106215 | A1 | 8/2002 | Ban et al. |
| 2002/0114646 | A1 | 8/2002 | Sudo et al. |
| 2002/0122676 | A1 | 9/2002 | Yamada et al. |
| 2002/0127029 | A1 | 9/2002 | Yamada et al. |
| 2003/0116923 | A1 | 6/2003 | Meetze et al. |
| 2003/0170049 | A1 | 9/2003 | Itoh et al. |
| 2003/0185579 | A1 | 10/2003 | Nishino et al. |
| 2004/0131389 | A1 | 7/2004 | Tazawa et al. |
| 2004/0223790 | A1 | 11/2004 | Hosokawa et al. |
| 2004/0223791 | A1 | 11/2004 | Yamada et al. |
| 2004/0228641 | A1 | 11/2004 | Rommelmann et al. |
| 2004/0247343 | A1 | 12/2004 | Matsumoto et al. |
| 2005/0180782 | A1 | 8/2005 | Matsumoto et al. |
| 2006/0034642 | A1 | 2/2006 | Taguchi et al. |
| 2006/0228127 | A1 | 10/2006 | Miyabe et al. |
| 2007/0077100 | A1 | 4/2007 | Suzuki et al. |
| 2007/0092302 | A1 | 4/2007 | Koyama |
| 2007/0122205 | A1 | 5/2007 | Taguchi et al. |
| 2007/0147900 | A1 | 6/2007 | Taguchi et al. |
| 2007/0147902 | A1 | 6/2007 | Taguchi et al. |
| 2007/0154244 | A1 | 7/2007 | Taguchi et al. |
| 2007/0160394 | A1 | 7/2007 | Taguchi et al. |
| 2007/0177886 | A1 | 8/2007 | Taguchi et al. |
| 2007/0177905 | A1 | 8/2007 | Hosokawa et al. |
| 2007/0212119 | A1 | 9/2007 | Kurenuma et al. |
| 2007/0242982 | A1 | 10/2007 | Sudo et al. |
| 2008/0003021 | A1 | 1/2008 | Hosokawa et al. |
| 2008/0124133 | A1 | 5/2008 | Yoshizawa et al. |
| 2008/0286013 | A1 | 11/2008 | Hosokawa et al. |
| 2009/0047037 | A1 | 2/2009 | Miyabe et al. |
| 2009/0129813 | A1 | 5/2009 | Nagashima et al. |
| 2009/0175660 | A1 | 7/2009 | Hosokawa et al. |
| 2010/0158556 | A1 | 6/2010 | Miyabe et al. |
| 2010/0189470 | A1 | 7/2010 | Yoshizawa et al. |
| 2010/0226690 | A1 | 9/2010 | Kadota et al. |
| 2010/0239325 | A1 | 9/2010 | Asai |
| 2010/0278564 | A1 | 11/2010 | Nagashima et al. |
| 2010/0296847 | A1 | 11/2010 | Kurenuma et al. |
| 2011/0002713 | A1 | 1/2011 | Taguchi et al. |
| 2011/0026973 | A1 | 2/2011 | Hosokawa et al. |
| 2011/0044717 | A1 | 2/2011 | Miyabe et al. |
| 2011/0123232 | A1 | 5/2011 | Takashima |
| 2011/0249991 | A1 | 10/2011 | Hosokawa et al. |
| 2012/0033998 | A1 | 2/2012 | Hori et al. |
| 2012/0042504 | A1 | 2/2012 | Fowler |
| 2012/0099887 | A1 | 4/2012 | Shokaku |
| 2012/0106985 | A1 | 5/2012 | Tanaka |
| 2012/0134717 | A1 | 5/2012 | Nagashima et al. |
| 2012/0134718 | A1 | 5/2012 | Nagashima et al. |
| 2012/0134719 | A1 | 5/2012 | Nagashima et al. |
| 2012/0134720 | A1 | 5/2012 | Nagashima et al. |
| 2012/0141169 | A1 | 6/2012 | Yamane et al. |
| 2012/0163877 | A1 | 6/2012 | Kikuchi et al. |
| 2012/0177395 | A1 | 7/2012 | Miyabe et al. |
| 2012/0177414 | A1 | 7/2012 | Ikeguchi et al. |
| 2012/0200871 | A1 | 8/2012 | Takahashi et al. |
| 2012/0213555 | A1 | 8/2012 | Komatsu et al. |
| 2012/0301188 | A1 | 11/2012 | Yamabe et al. |
| 2013/0011166 | A1 | 1/2013 | Yamaguchi et al. |
| 2013/0129391 | A1 | 5/2013 | Kadota et al. |
| 2013/0136505 | A1 | 5/2013 | Nagashima et al. |
| 2013/0188985 | A1 | 7/2013 | Takahashi et al. |
| 2013/0223877 | A1 | 8/2013 | Takahashi et al. |
| 2013/0259545 | A1 | 10/2013 | Hata |
| 2013/0272750 | A1 | 10/2013 | Matsumoto et al. |
| 2013/0336680 | A1 | 12/2013 | Nagashima et al. |
| 2014/0037325 | A1 | 2/2014 | Takahashi et al. |
| 2014/0050509 | A1 | 2/2014 | Kadota et al. |
| 2014/0169838 | A1 | 6/2014 | Nagashima et al. |
| 2014/0270859 | A1 | 9/2014 | Hosokawa et al. |
| 2014/0286670 | A1 | 9/2014 | Takahashi et al. |
| 2014/0314443 | A1 | 10/2014 | Takahashi et al. |
| 2014/0341602 | A1 | 11/2014 | Takahashi et al. |
| 2015/0293485 | A1 | 10/2015 | Takahashi et al. |
| 2015/0338775 | A1 | 11/2015 | Hosokawa et al. |

FOREIGN PATENT DOCUMENTS

| | | | |
|---|---|---|---|
| CN | 1445624 | A | 10/2003 |
| CN | 2615706 | Y | 5/2004 |
| CN | 1573604 | A | 2/2005 |
| CN | 101103315 | A | 1/2008 |
| CN | 102645875 | A | 8/2012 |
| CN | 202378424 | U | 8/2012 |
| CN | 103782243 | A | 5/2014 |
| CN | 104067180 | A | 9/2014 |
| EP | 1229402 | A2 | 8/2002 |
| EP | 1890201 | A1 | 2/2008 |
| EP | 1921512 | A2 | 5/2008 |
| EP | 1927898 | A2 | 6/2008 |

(56) References Cited

FOREIGN PATENT DOCUMENTS

| | | | | |
|---|---|---|---|---|
| EP | 2474864 | A1 | 7/2012 | |
| EP | 2856265 | A1 | 4/2015 | |
| JP | 61-182071 | A | 7/1986 | |
| JP | 63-178271 | A | 7/1988 | |
| JP | 1-130159 | U | 9/1989 | |
| JP | 04-009061 | A | 1/1992 | |
| JP | 04-168459 | A | 6/1992 | |
| JP | 04-368965 | A | 12/1992 | |
| JP | 10-020642 | A | 1/1993 | |
| JP | 05-249825 | A | 9/1993 | |
| JP | 05-075767 | A | 10/1993 | |
| JP | 06-059572 | A | 3/1994 | |
| JP | 07-020705 | A | 1/1995 | |
| JP | 07-181788 | A | 7/1995 | |
| JP | 07-199632 | A | 8/1995 | |
| JP | 07-281492 | A | 10/1995 | |
| JP | 8-95361 | A | 4/1996 | |
| JP | 09-197819 | A | 7/1997 | |
| JP | 09-211977 | A | 8/1997 | |
| JP | 10-153911 | A | 6/1998 | |
| JP | 10-171230 | A | 6/1998 | |
| JP | 10-198147 | A | 7/1998 | |
| JP | 08-220857 | A | 8/1998 | |
| JP | 10-254229 | A | 9/1998 | |
| JP | 10-260575 | A | 9/1998 | |
| JP | 10-280574 | A | 9/1998 | |
| JP | 11-295972 | A | 10/1999 | |
| JP | 2000-187382 | A | 7/2000 | |
| JP | 2000-267420 | A | 9/2000 | |
| JP | 2001-034053 | A | 2/2001 | |
| JP | 2001-083785 | A | 3/2001 | |
| JP | 2001-271912 | A | 10/2001 | |
| JP | 2001-312130 | A | 11/2001 | |
| JP | 2002-031943 | A | 1/2002 | |
| JP | 2002-196629 | A | 7/2002 | |
| JP | 2002-202656 | A | 7/2002 | |
| JP | 2002-244417 | A | 8/2002 | |
| JP | 2002-302189 | A | 10/2002 | |
| JP | 2002-357946 | A | 12/2002 | |
| JP | 3353194 | B2 | 12/2002 | |
| JP | 2003-057931 | A | 2/2003 | |
| JP | 2003-066703 | A | 3/2003 | |
| JP | 2003-066704 | A | 3/2003 | |
| JP | 2003-191497 | A | 7/2003 | |
| JP | 2003-195616 | A | 7/2003 | |
| JP | 2003-233247 | A | 8/2003 | |
| JP | 2003-241496 | A | 8/2003 | |
| JP | 2004-012687 | A | 1/2004 | |
| JP | 3509053 | B2 | 3/2004 | |
| JP | 2004-280064 | A | 10/2004 | |
| JP | 2004338405 | A | 12/2004 | |
| JP | 2005-099434 | A | 4/2005 | |
| JP | 3665376 | B2 | 6/2005 | |
| JP | 2005-193575 | A | 7/2005 | |
| JP | 2005-221825 | A | 8/2005 | |
| JP | 2005-242185 | A | 9/2005 | |
| JP | 2005-331622 | A | 12/2005 | |
| JP | 2006-058698 | A | 3/2006 | |
| JP | 2006-072166 | A | 3/2006 | |
| JP | 2006-84755 | A | 3/2006 | |
| JP | 2006-209060 | A | 8/2006 | |
| JP | 2006-235641 | A | 9/2006 | |
| JP | 2006-293003 | A | 10/2006 | |
| JP | 2006-309016 | A | 11/2006 | |
| JP | 2007-065271 | A | 3/2007 | |
| JP | 2007-065613 | A | 3/2007 | |
| JP | 2007-102133 | A | 4/2007 | |
| JP | 2007-140433 | A | 6/2007 | |
| JP | 2007-148320 | A | 6/2007 | |
| JP | 2007-178969 | A | 7/2007 | |
| JP | 2008-298907 | A | 12/2008 | |
| JP | 2009-008698 | A | 1/2009 | |
| JP | 2009-069231 | A | 4/2009 | |
| JP | 2009-069417 | A | 4/2009 | |
| JP | 2009-116120 | A | 5/2009 | |
| JP | 2009-210615 | A | 9/2009 | |
| JP | 2009-223351 | A | 10/2009 | |
| JP | 4342958 | B2 | 10/2009 | |
| JP | 2009-276659 | A | 11/2009 | |
| JP | 2010-014763 | A | 1/2010 | |
| JP | 2010-020343 | A | 1/2010 | |
| JP | 2010-66638 | A | 3/2010 | |
| JP | 4441581 | B2 | 3/2010 | |
| JP | 2011-76064 | A | 4/2011 | |
| JP | 2011076064 | A * | 4/2011 | ..... G03G 15/0868 |
| JP | 2011-107606 | A | 6/2011 | |
| JP | 2011-118160 | A | 6/2011 | |
| JP | 2011-150121 | A | 8/2011 | |
| JP | 2011-197159 | A | 10/2011 | |
| JP | 2011-215473 | A | 10/2011 | |
| JP | 4794892 | B2 | 10/2011 | |
| JP | 4843112 | B1 | 12/2011 | |
| JP | 2012-018377 | A | 1/2012 | |
| JP | 2012-37752 | A | 2/2012 | |
| JP | 4958325 | B2 | 3/2012 | |
| JP | 2012-093460 | A | 5/2012 | |
| JP | 2012-133349 | A | 7/2012 | |
| JP | 2012-137740 | A | 7/2012 | |
| JP | 2012-226289 | A | 11/2012 | |
| JP | 2012-226295 | A | 11/2012 | |
| JP | 2012226289 | A | 11/2012 | |
| JP | 2013-113945 | A | 8/2013 | |
| KR | 2007-0021202 | A | 2/2007 | |
| KR | 10-2010-0070365 | A | 6/2010 | |
| KR | 10-2011-0056207 | A | 5/2011 | |
| KR | 10-2012-0081617 | A | 7/2012 | |
| RU | 2367016 | A | 4/2009 | |
| RU | 2372635 | C2 | 11/2009 | |
| RU | 2398257 | C2 | 8/2010 | |
| TW | 201011480 | A | 3/2010 | |
| TW | 201135378 | A | 10/2011 | |
| TW | 201205209 | A | 2/2012 | |
| TW | 201232199 | A | 8/2012 | |
| TW | 201243524 | A | 11/2012 | |
| WO | 2006/132259 | A1 | 12/2006 | |
| WO | 2011/155642 | A1 | 12/2011 | |
| WO | 2012/074139 | A1 | 6/2012 | |
| WO | 2013/077474 | A1 | 5/2013 | |
| WO | 2014/142362 | A1 | 9/2014 | |

OTHER PUBLICATIONS

Extended European Search Report dated Mar. 19, 2021 in European Patent Application No. 21157128.6, 10 pages.

Office Action dated May 26, 2021 in Korean Patent Application No. 10-2020-7021940, 8 pages.

Office Action dated May 26, 2021 in Australian Patent Application No. 2020230314, 6 pages.

Office Action dated Aug. 11, 2021 in Chinese Patent Application No. 201911010456.5, 25 pages.

Office Action dated Sep. 18, 2021 in Chinese Patent Application No. 201911010367.0, 16 pages.

Combined Taiwanese Office Action and Search Report dated Apr. 26, 2016 in Patent Application No. 103131631 (with partial English language translation and English translation of categories of cited documents).

Combined Taiwanese Office Action and Search Report dated Jan. 28, 2016 in Patent Application No. 103106106 with English language translation.

Combined Office Action and Search Report dated Dec. 10, 2018 in Chinese Patent Application No. 201480015296.2, 19 pages with English Translation.

Decision on Grant dated Jun. 26, 2014 in Russian Patent Application No. 2013130231/28 with English translation.

Extended European Search Report dated Feb. 8, 2016 for European Patent Application No. 14762332.6.

Extended European Search Report dated Apr. 1, 2015 in Patent Application No. 12651714.1.

Extended European Search Report dated Jun. 18, 2014 in Patent Application No. 11845366.1.

(56) References Cited

OTHER PUBLICATIONS

International Search Report dated Aug. 13, 2013 in PCT/JP2013/065901.
International Search Report dated Jan. 17, 2012 in PCT/JP2011/078626.
International Written Opinion dated Jan. 8, 2013 in PCT/JP2012/081219 filed Nov. 26, 2012.
JP 04368965_A_T Machine Translation.
JP 2011215473 A T Machine Translation, Oshikawa, Japan, 2011.
International Search Report dated Jan. 8, 2013 in PCT/JP2012/081219 filed Nov. 26, 2012.
Office Action dated Jun. 19, 2019, issued in corresponding Korean Patent Application No. 10-2019-7009380 with English Translation, 14 pages.
Office Action dated Jun. 21, 2017 for corresponding Korean Patent Application No. 10-2015-7025262 with an English transition thereof.
Office Action dated Jun. 8, 2017 for corresponding Singaporean Patent Application No. 10201603637 Y.
Office Action dated Apr. 21, 2015 in Japanese Patent Application No. 2011-197303.
Office Action dated Apr. 22, 2014 in Japanese Patent Application No. 2013-153815.
Office Action dated Apr. 25, 2014 in Taiwanese Patent Application No. 100144415.
Office Action dated Apr. 27, 2015 in Russian Patent Application No. 2014106826128 with English translation.
Office Action issued in Russian Patent Application No. 2017111233 dated Mar. 15, 2018 with English translation.
Office Action dated Jan. 17, 2019,in Indian Patent Application No. 3005/KOLNP/2015, 6 pages with English translation.
Office Action dated Jan. 2, 2019 in Korean Patent Application No. 10-2018-7014538, 8 pages with English translation.
Office Action dated Jan. 15, 2014 in Canadian Patent Application No. 2,795,123.
Office Action dated Jan. 20, 2015 in Australian Patent Application No. 2011337578.
Office Action dated Jan. 6, 2016 in Korean Patent Application No. 10-2014-7032139 (with English language translation).
Office Action dated Jul. 23, 2013 in Japanese Patent Application No. 2011-262561.
Office Action dated Jul. 7, 2015 in Japanese Patent Application No. 2013-116876.
Office Action dated Nov. 26, 2013 in Japanese Patent Application No. 2013-153815.
Office Action dated Nov. 28, 2016 in Korean Patent Application No. 10-2015-7025262 with English language translation.
Office Action dated Nov. 5, 2013 in Japanese Patent Application 2011-262861.
Office Action dated Sep. 10, 2013 in Japanese Patent Application No. 2013-110330.
Office Action dated Sep. 3, 2013 in Japanese Patent Application No. 2013-034830.
Russian Decision on Grant dated Mar. 10, 2016 with an English translation thereof for Russian Application No. 2014125562.
Search Report dated Apr. 1, 2015 in European Patent Application No. 13800861.0.
Taiwanese Office Action dated May 11, 2016 in corresponding Taiwanese Application No. 103109722 with English translation to relevant portions thereof.
U.S. Office Action dated May 16, 2016 in corresponding U.S. Appl. No. 15/041,232 (21 pages).
Office Action dated Dec. 26, 2019, issued in corresponding Korean Patent Application No. 10-2019-7009380, with English Translation, 13 pages.
Office Action dated Mar. 17, 2020, issued in corresponding Australian Patent Application No. 2019202358, 5 pages.
Brazilian Office Action dated Feb. 11, 2020, issued in corresponding Brazilian Patent Application No. 112015023410-0, with English Translation, 9 pages.
Notice of Allowance dated Apr. 14, 2022 in Korean Patent Application No. 10-2021-7027556, 5 pages.
Office Action dated Jun. 6, 2023 in Taiwanese Patent Application No. 111127016, 9 pages.

* cited by examiner (EXAMPLE 1)

(EXAMPLE 2)

(EXAMPLE 3)

(EXAMPLE 4)

| | GAP OF CARTRIDGE | | |
|---|---|---|---|
| | GAP 1 | GAP 2 | GAP 3 |
| EXAMPLE 1 | ABSENT | 3 mm | ABSENT |
| EXAMPLE 2 | ABSENT | 7 mm | ABSENT |
| EXAMPLE 3 | ABSENT | 11 mm | ABSENT |
| EXAMPLE 4 | PRESENT | ABSENT | ABSENT |
| EXAMPLE 5 | ABSENT | ABSENT | PRESENT |

POWDER CONTAINER

CROSS-REFERENCE TO RELATED APPLICATIONS

This application is a continuation of U.S. application Ser. No. 17/110,340, filed Dec. 3, 2020, which is a continuation of U.S. application Ser. No. 17/023,430, filed Sep. 17, 2020 (now U.S. Pat. No. 10,935,905), which is a continuation of U.S. application Ser. No. 16/705,276, filed Dec. 6, 2019 (now U.S. Pat. No. 10,809,648), which is a continuation of U.S. application Ser. No. 15/342,014, filed Nov. 2, 2016 (now U.S. Pat. No. 10,534,290), which is a continuation of U.S. application Ser. No. 14/854,882, filed Sep. 15, 2015 (now U.S. Pat. No. 9,513,576), which is a continuation of PCT International Application No. PCT/JP2014/057949, filed Mar. 14, 2014, which designates the United States, and which claims the benefit of priority from Japanese Patent Application Nos. 2013-054371, filed Mar. 15, 2013, 2013-054372, filed Mar. 15, 2013, 2013-110330, filed May 24, 2013, 2013-110443, filed May 24, 2013, 2013-146882, filed Jul. 12, 2013, 2013-153815, filed Jul. 24, 2013, 2013-244411, filed Nov. 26, 2013, and 2014-019469, filed Feb. 4, 2014, the entire contents of each of the above are incorporated herein by reference.

BACKGROUND OF THE INVENTION

1. Field of the Invention

The present invention relates to a powder container for storing toner that is powder used by an image forming apparatus, such as a printer, a facsimile machine, a copier, or a multifunction peripheral with multiple functions of the printer, the facsimile machine, and the copier, and also relates to an image forming apparatus including the powder container.

2. Description of the Related Art

In electrophotographic image forming apparatuses, a powder replenishing device supplies (replenishes) toner that is powder from a toner container serving as a powder container containing the toner to a developing device. A toner container described in Japanese Patent Application Laid-open No. 2012-133349 includes an opening arranged on one end of the toner container, a nozzle receiver provided at the opening to receive a conveying nozzle that includes a powder receiving hole for receiving toner from the toner container, a rotary conveyor that rotates to convey the toner toward the powder receiving hole, and a gear that meshes with a container driving gear of a main-body of the image forming apparatus to transmit a driving force to the rotary conveyor. When the toner container is attached to the powder replenishing device, the gear meshes with the container driving gear on the opening side relative to the powder receiving hole in the longitudinal direction of the toner container. In this configuration, the influence of the arrangement of the gear can be reduced when the toner is transferred to the powder receiving hole of the conveying nozzle, and the toner can be transferred more smoothly than in a conventional configuration.

However, if the gear of the container is driven, a pressure generated at a position where the gear and the container driving gear of the main-body mesh with each other is applied to the toner container or the conveying nozzle. Therefore, if an attached position of the toner container with respect to the powder replenishing device is not determined, a load on the conveying nozzle or the nozzle receiver increases, so that the conveying nozzle or the nozzle receiver may be broken or a gap may be generated between the conveying nozzle and the nozzle receiver resulting in toner leakage.

SUMMARY OF THE. INVENTION

The present invention has been made in view of the abovementioned issues, and it is an object of the present invention to provide a powder container and an image forming apparatus that are capable of improving the performance to transfer powder from the powder container to the toner replenishing device and capable of reducing a load due to the drive transmitted by the container driving gear.

According to an embodiment, a powder container contains powder used for forming an image and to be attached to an image forming apparatus. The image forming apparatus includes: a conveying nozzle to convey the powder; a powder receiving hole of the conveying nozzle to receive the powder from the powder container; an apparatus main-body gear to transmit a driving force to the powder container; and a container receiving section that includes the conveying nozzle and receives the powder container. The powder container includes: an opening that is at one end of the powder container in a longitudinal direction; a nozzle receiver at the opening to receive the conveying nozzle; a conveyor to convey the powder; and a container gear to drive the conveyor by meshing with the apparatus main-body gear. The container gear is to mesh with the apparatus main-body gear at a position closer to the opening than the powder receiving hole in the longitudinal direction, and the opening is to mate with the container receiving section.

BRIEF DESCRIPTION OF THE DRAWINGS

FIG. 86E is a schematic diagram illustrating a sixth restricted state in which the powder container is held in the final setting position;

FIG. 87A is a right side view of the powder container including an IC chip;

FIG. 87B is a left side view of the powder container including the IC chip;

FIG. 87C is a front view of the powder container including the IC chip;

FIG. 87D is a back view of the powder container including the IC chip;

FIG. 87E is a plan view of the powder container including the IC chip;

FIG. 87F is a bottom view of the powder container including the IC chip;

FIG. 88A is a perspective view illustrating the entire configuration of the powder container according to an eighth embodiment viewed from a container front end cover side;

FIG. 88B is a perspective view of the entire configuration of the powder container according to the eighth embodiment viewed from the container body side;

FIG. 89 is an enlarged perspective view illustrating configurations of the container front end cover of the powder container and a front end of the container body according to the eighth embodiment;

FIG. 90 is an explanatory front view of the powder container according to the eighth embodiment;

FIG. 91A is an explanatory front view illustrating a configuration of the container front end cover of the powder container according to the eighth embodiment;

Figure 91A:
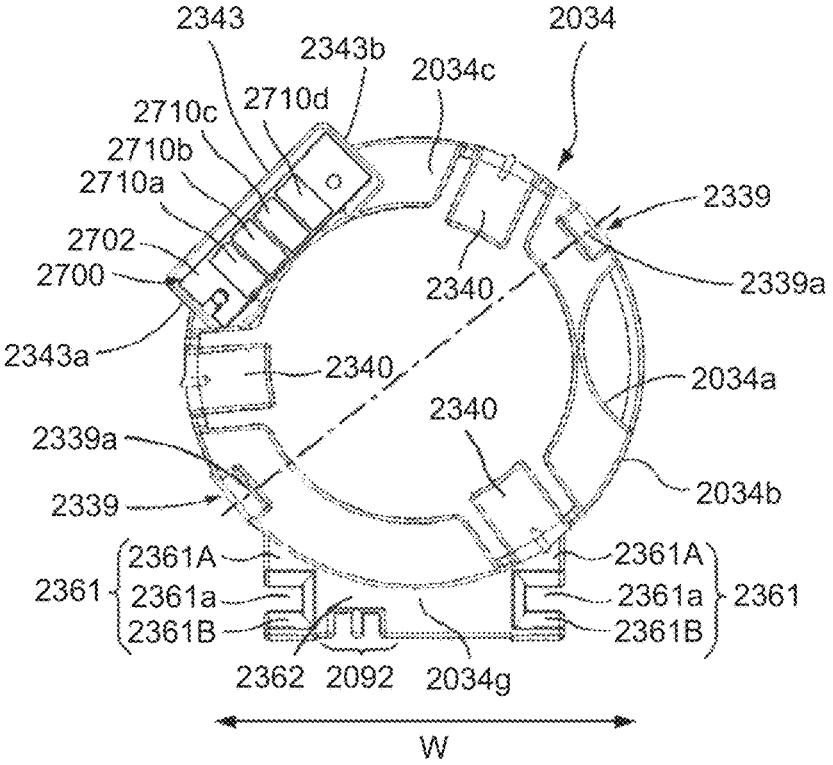
Figure 91B:
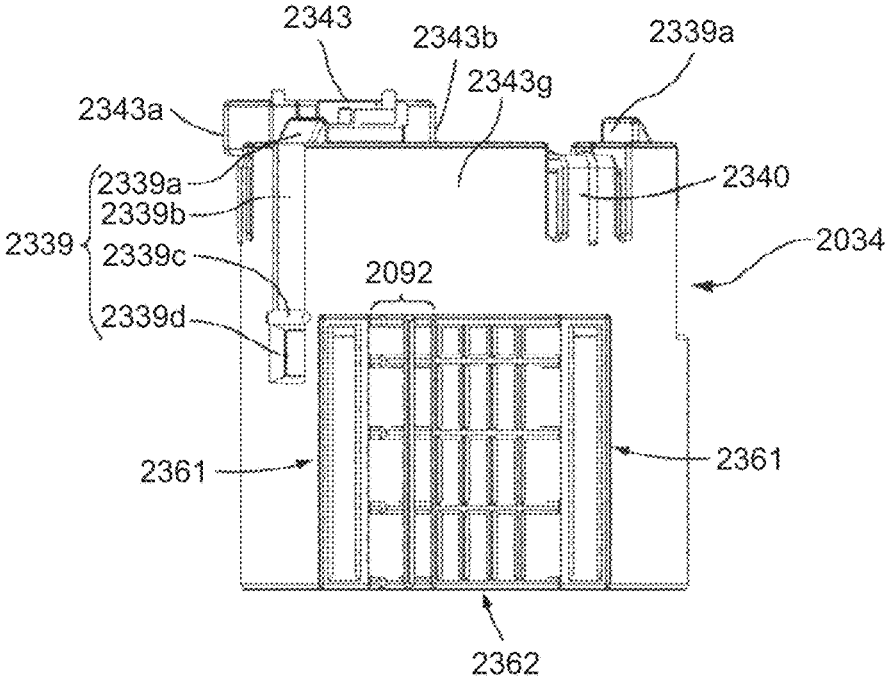
Figure 92:
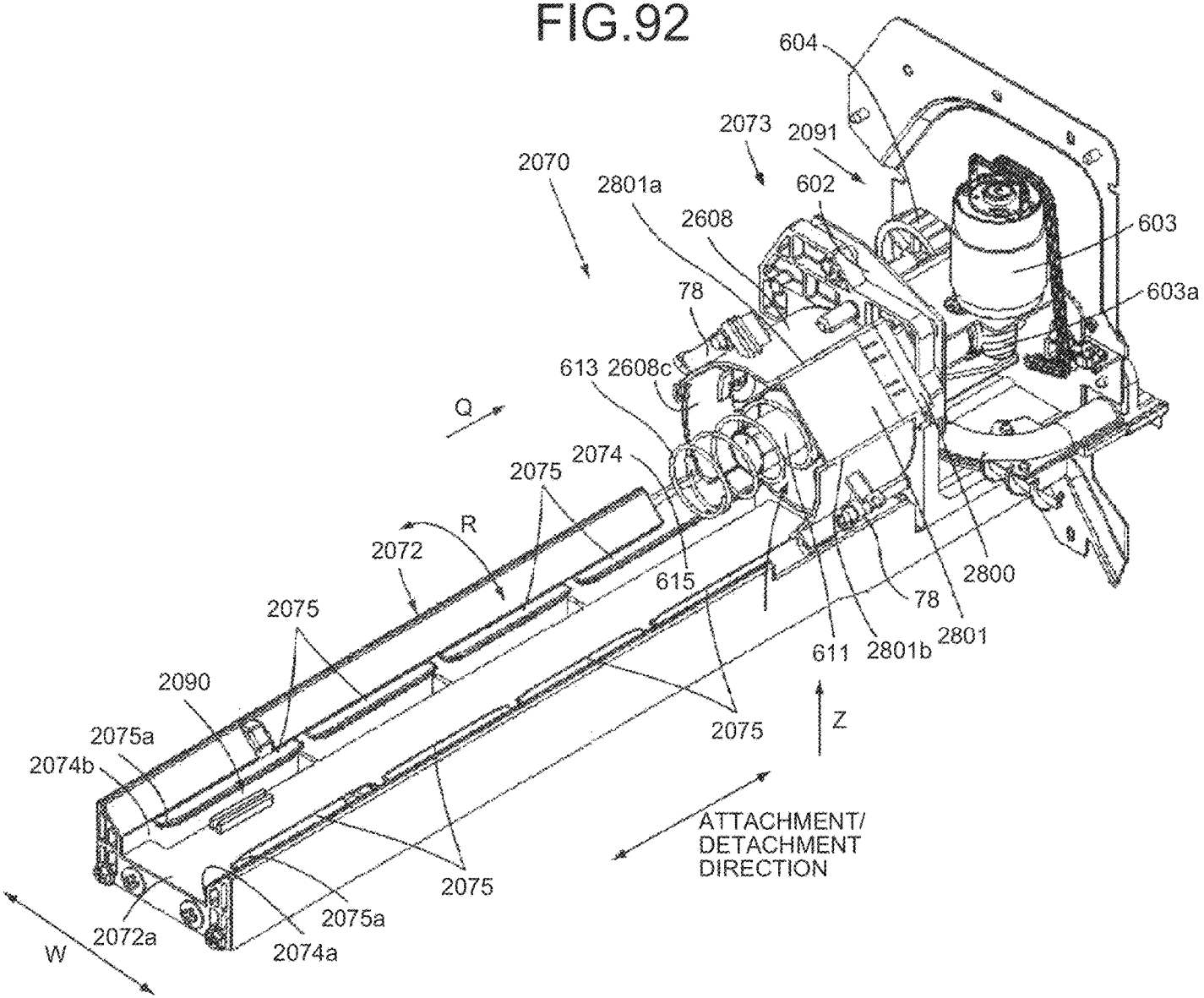
Figure 93:
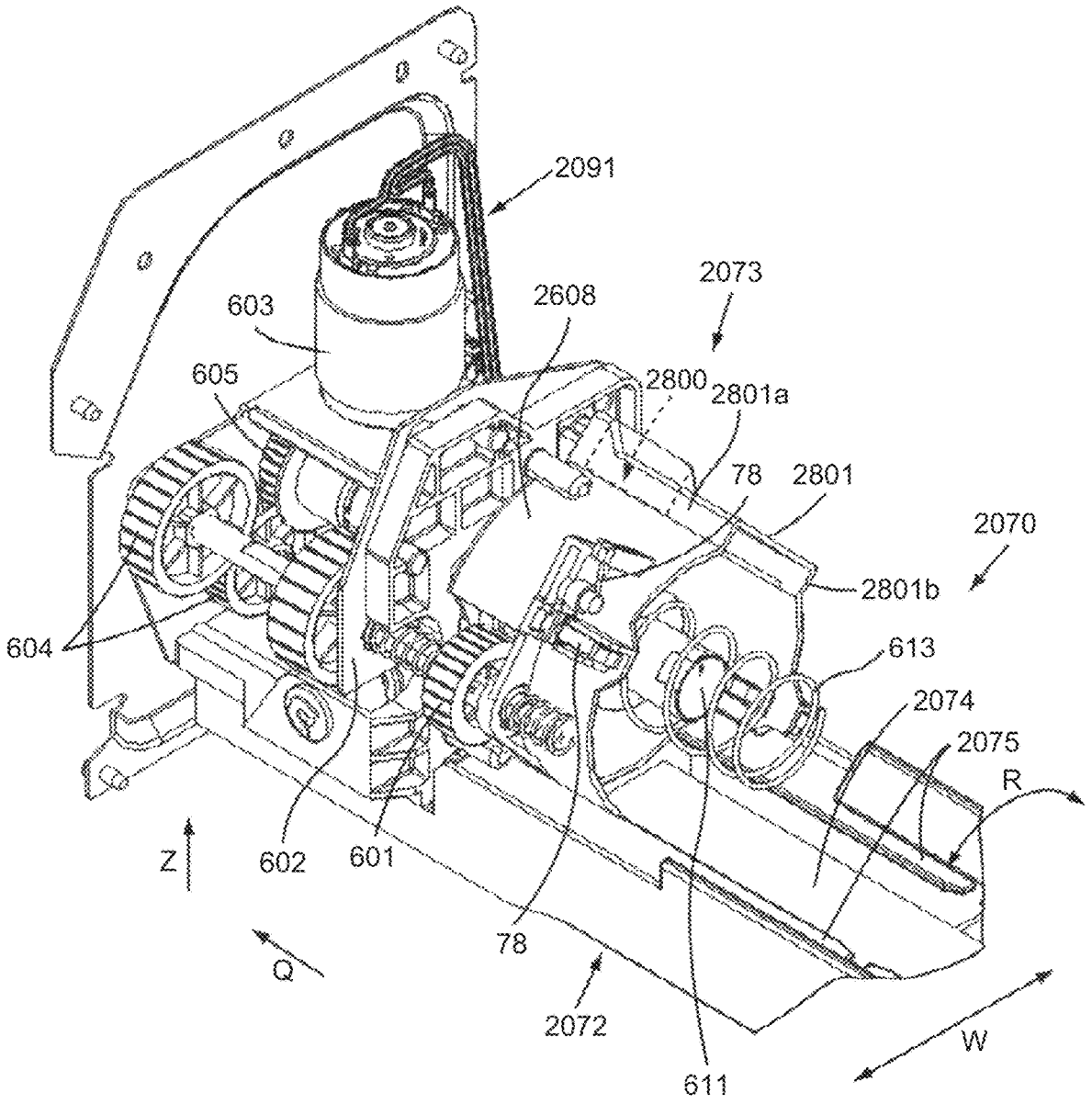
Figure 94:
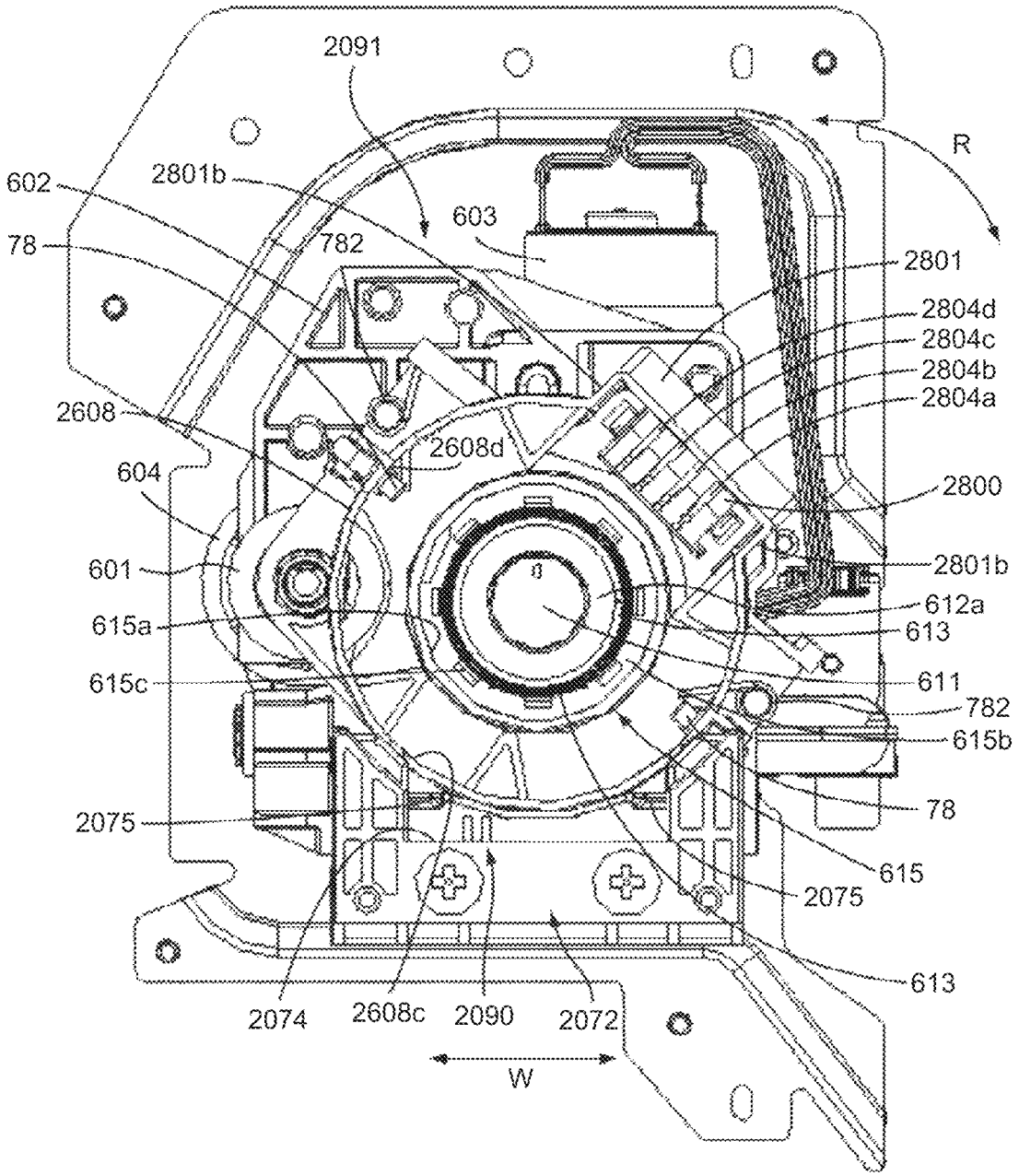
Figure 95:
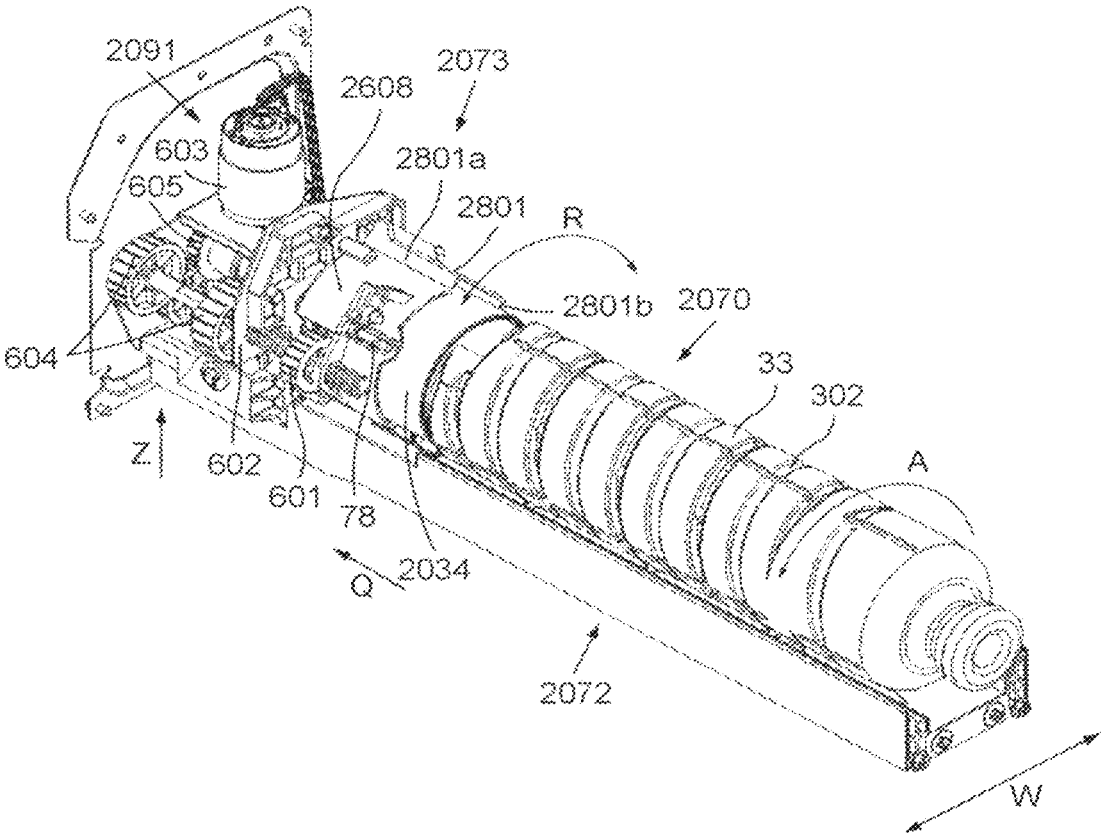
Figure 96:
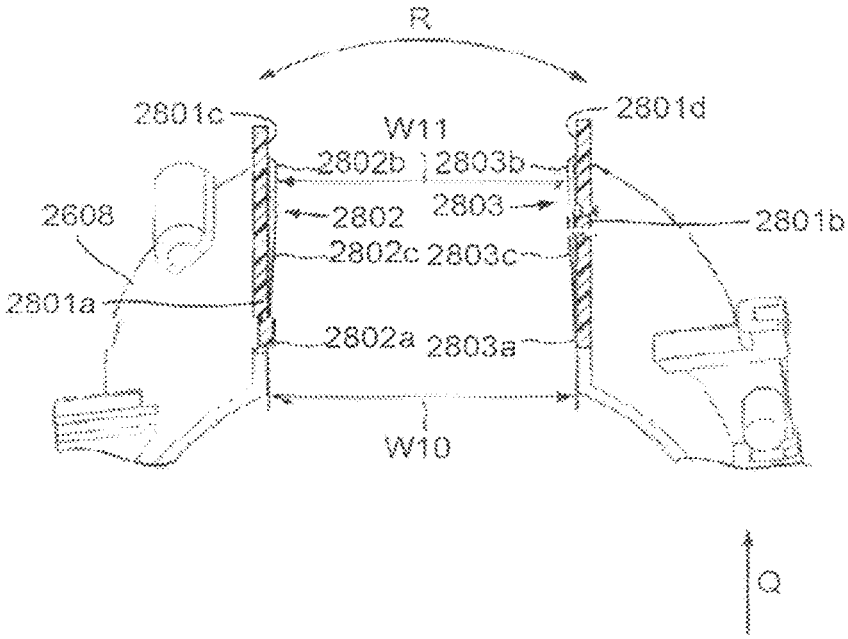
Figure 97:
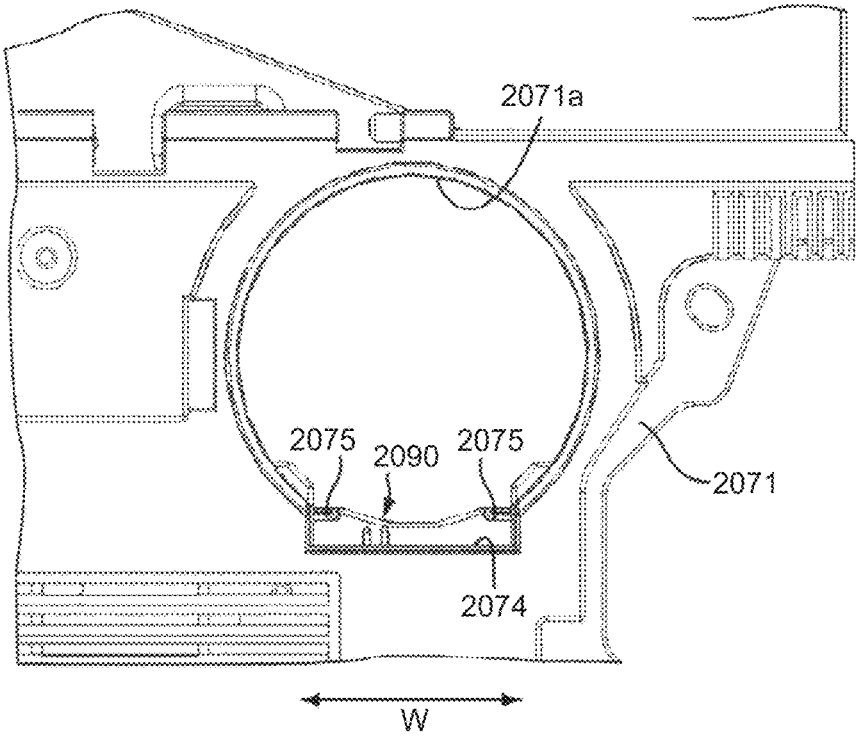
Figure 98:
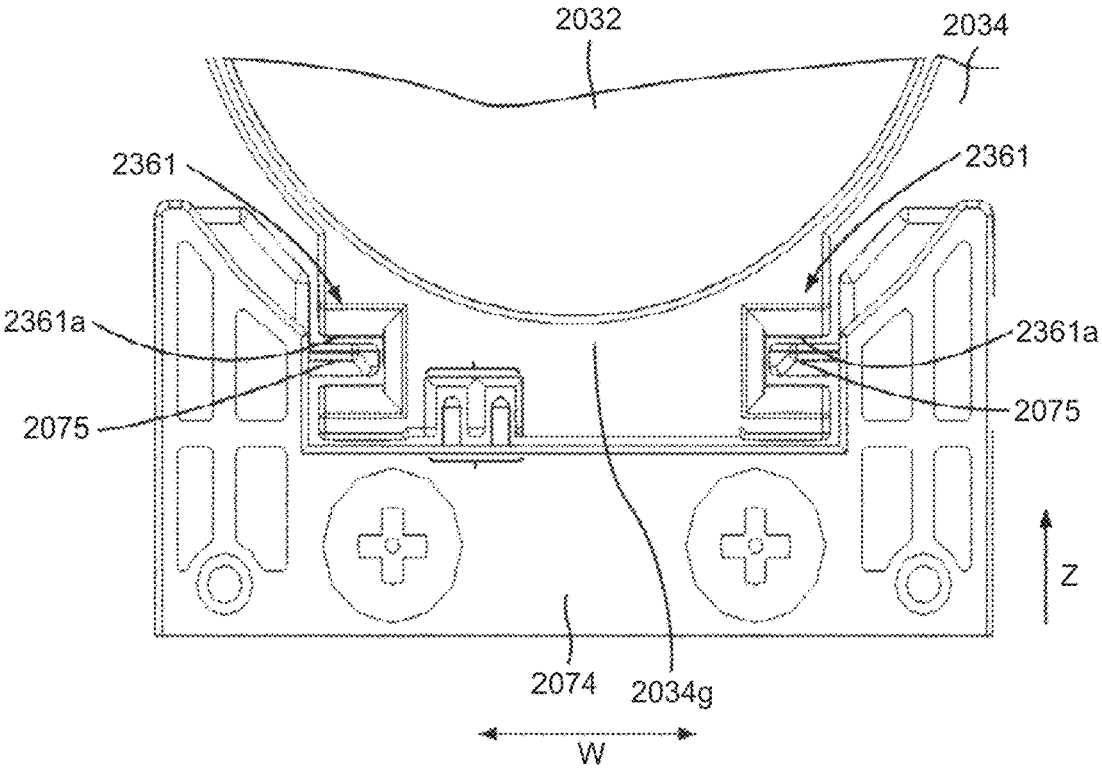
Figure 99A:
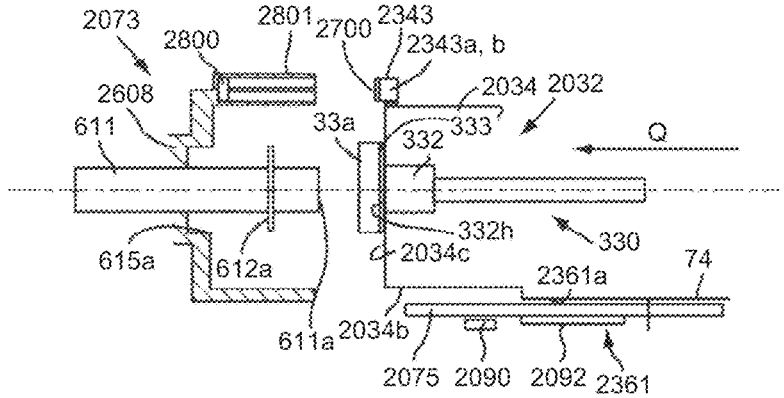
Figure 99B:
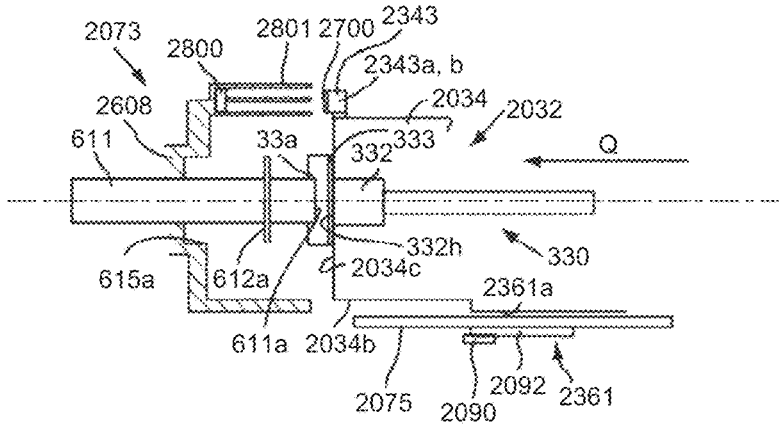
Figure 99C:
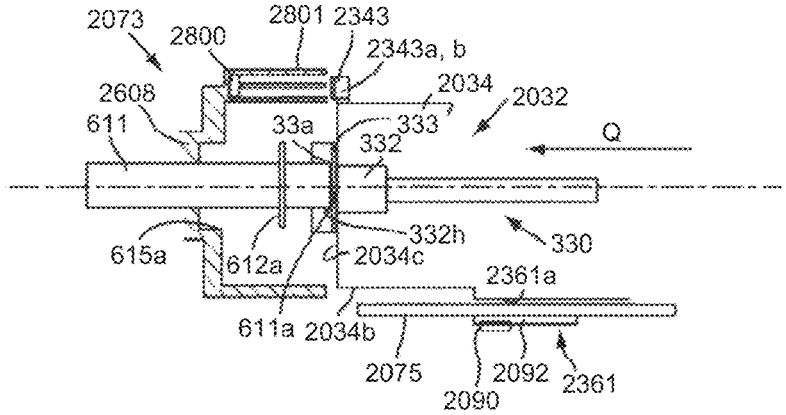
Figure 99D:
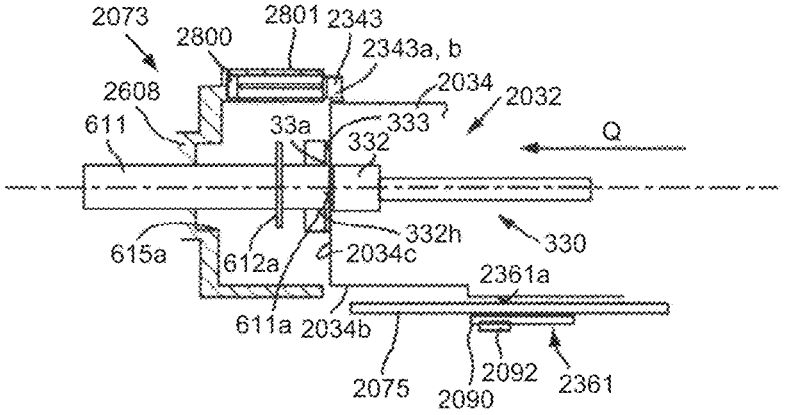
Figure 100A:
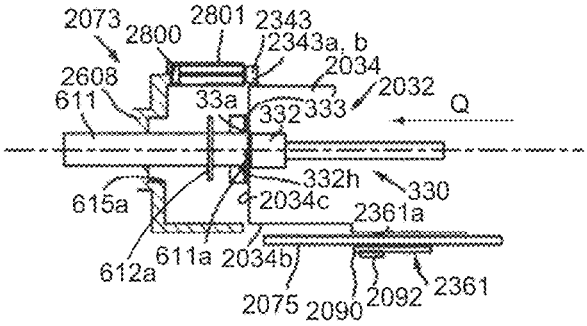
Figure 100B:
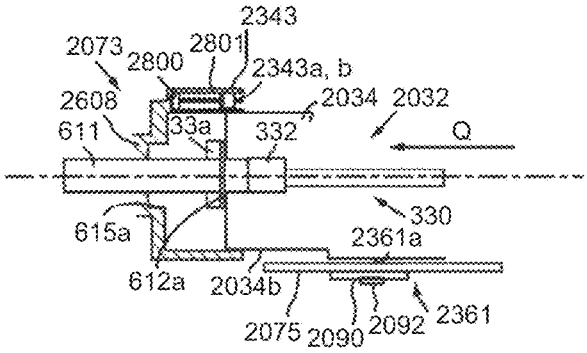
Figure 100C:
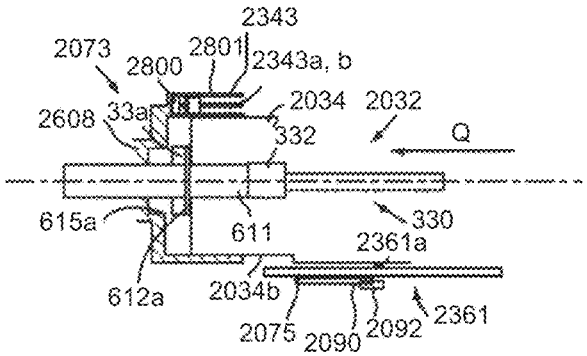
Figure 100D:
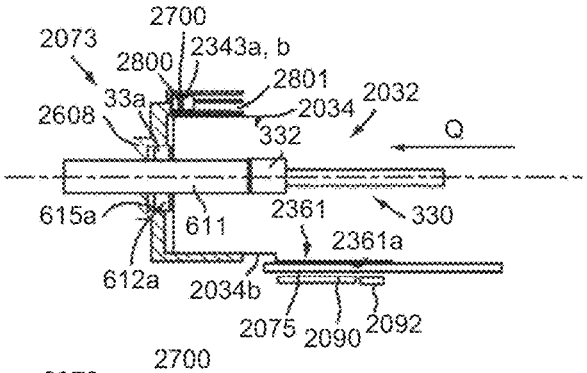
Figure 100E:
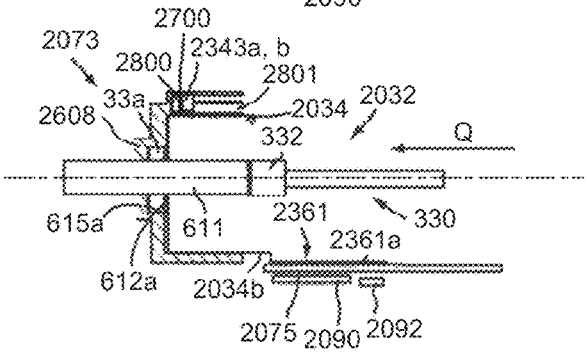
Figure 101A:
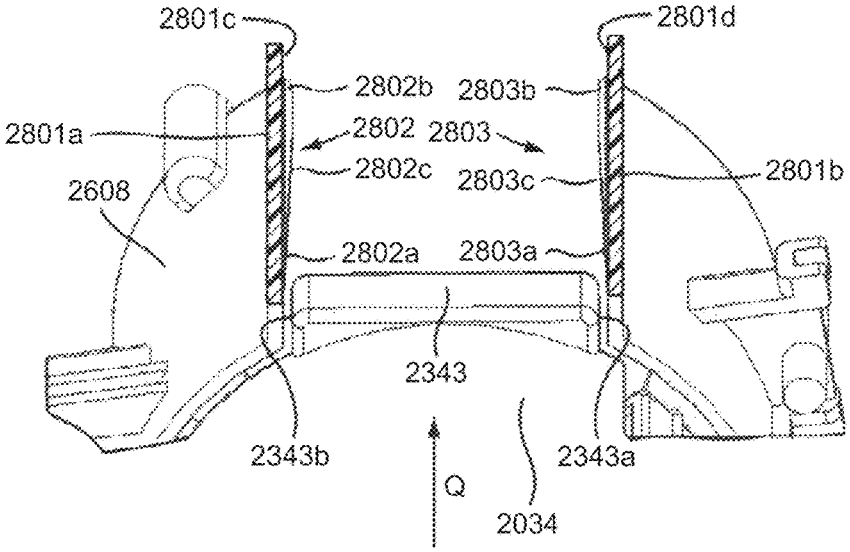
Figure 101B:
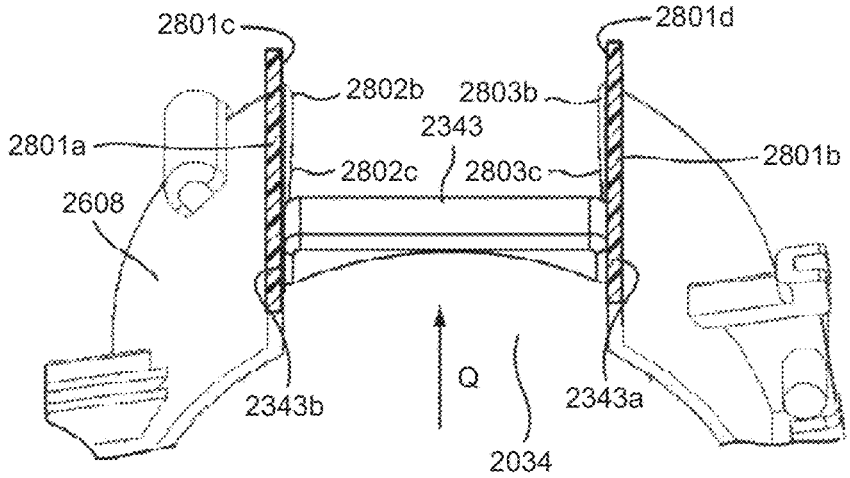
Figure 101C:
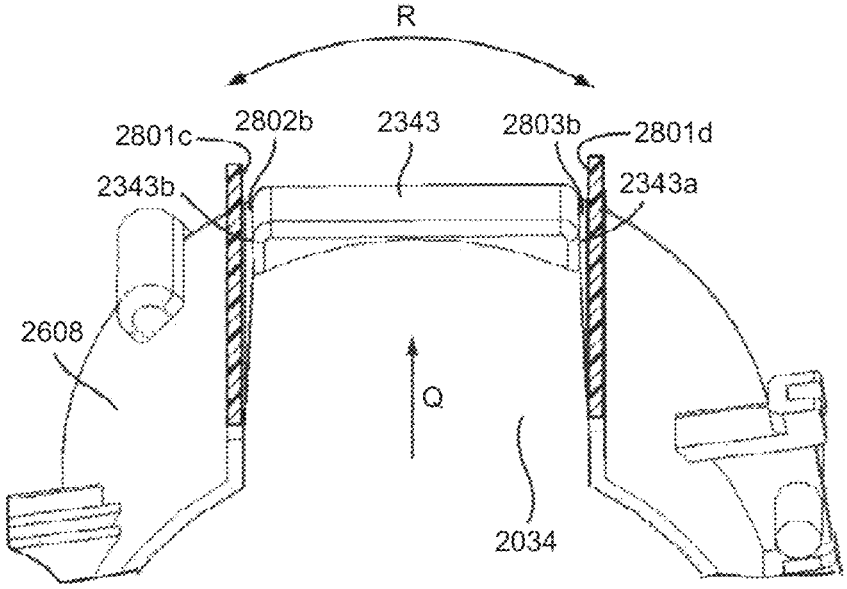
Figure 102A:
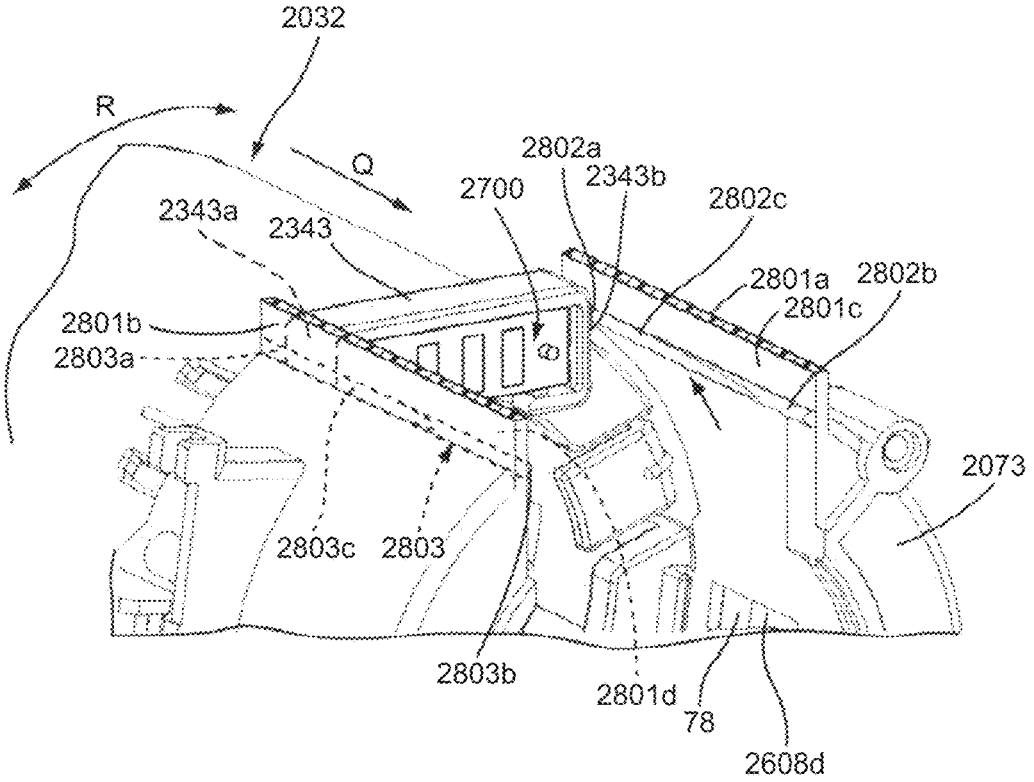
Figure 102B:
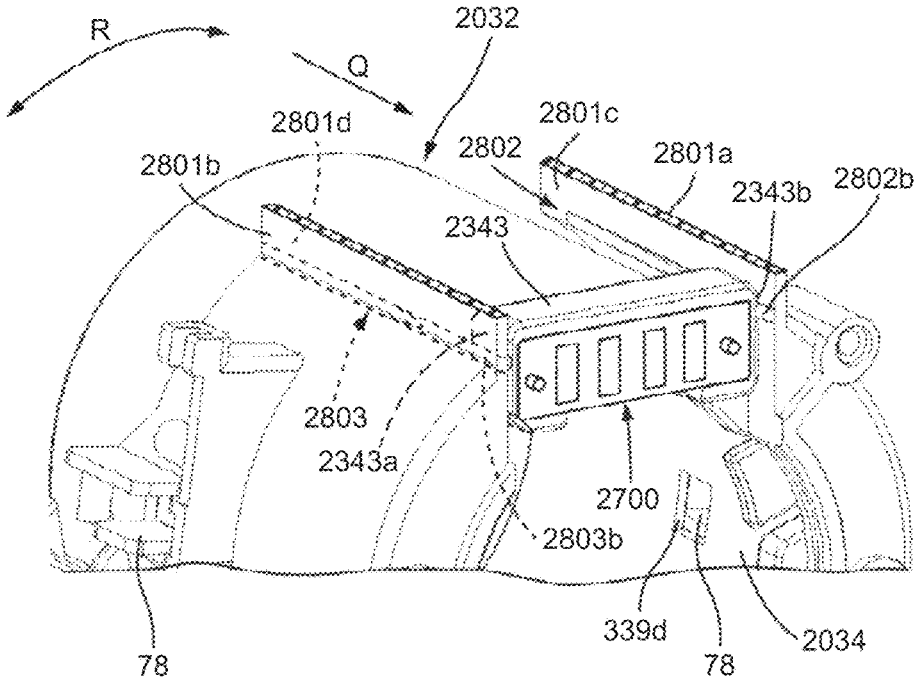
Figure 103A:
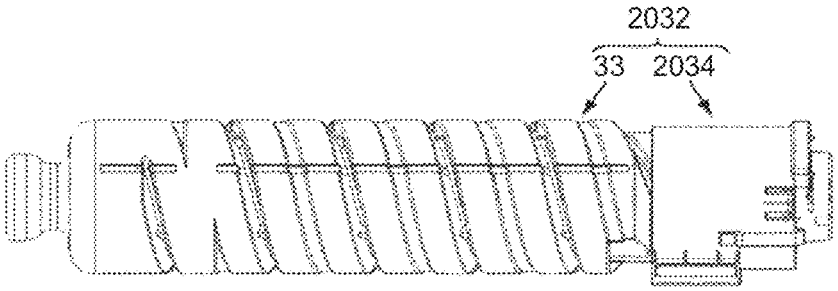
Figure 103B:
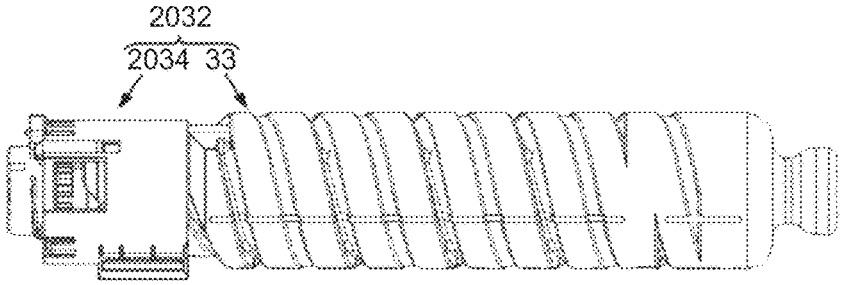
Figure 103C:
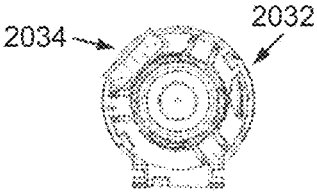
Figure 103D:
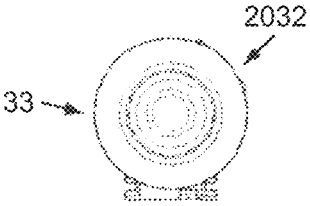
Figure 103E:
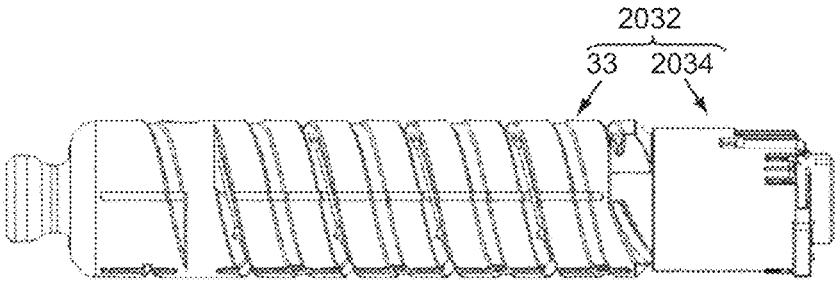
Figure 103F:
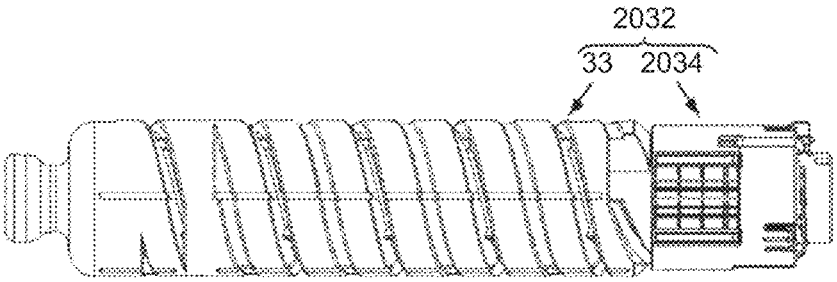
Figure 104:
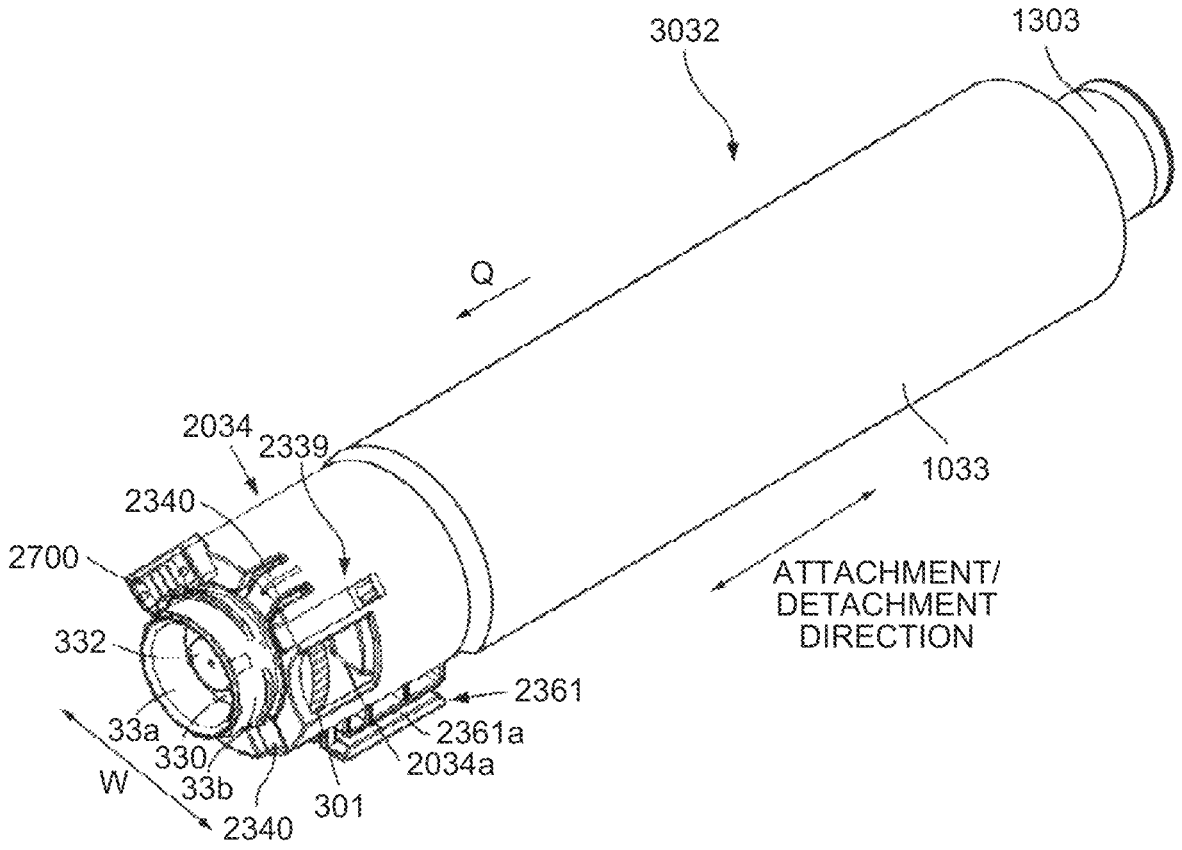
Figure 105A:
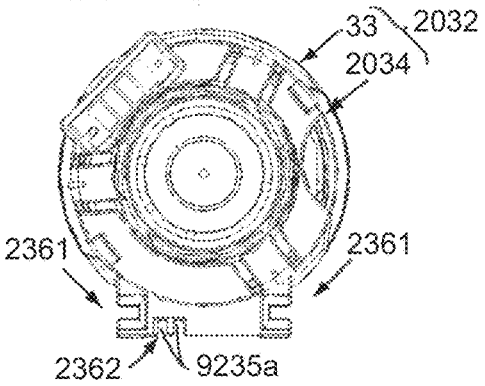
Figure 105B:
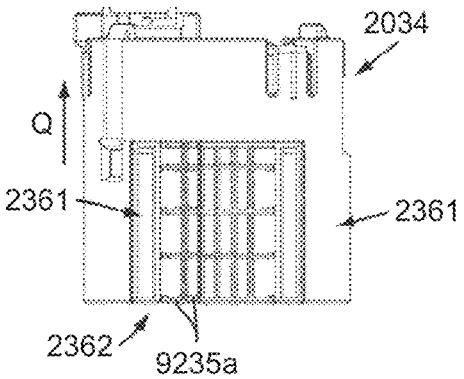
Figure 105C:
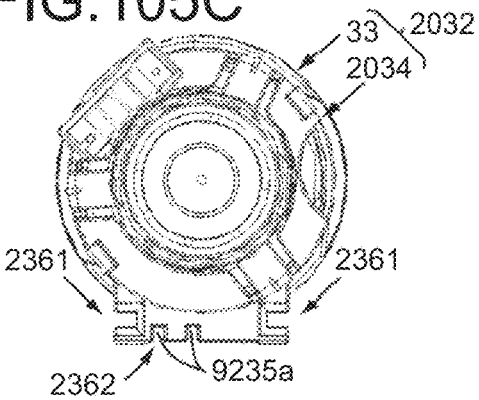
Figure 105D:
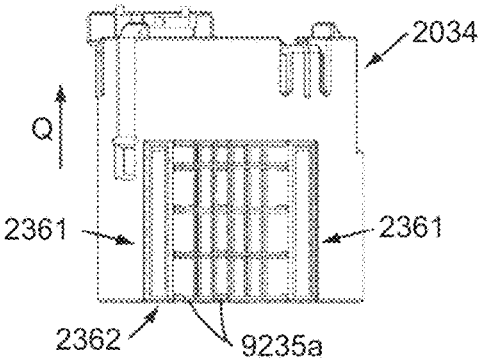
Figure 105E:
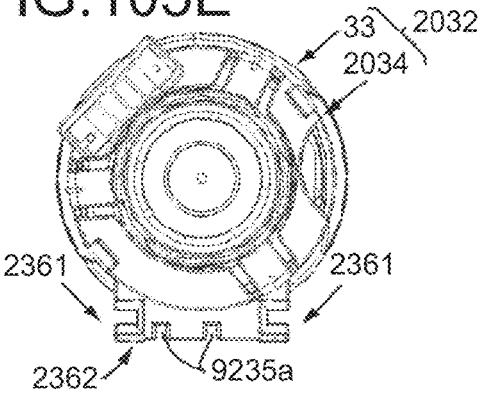
Figure 105F:
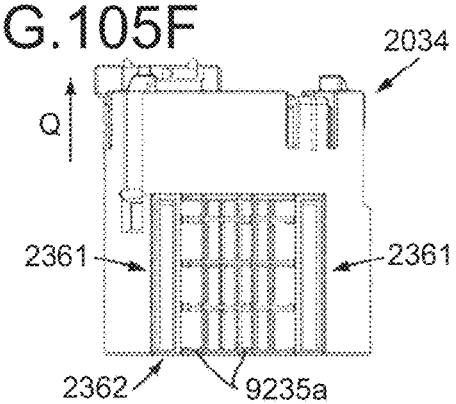
Figure 105G:
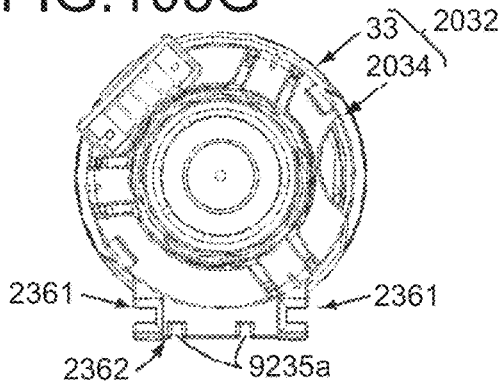
Figure 105H:
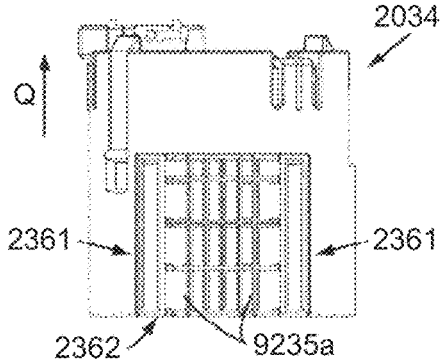
Figure 106A:
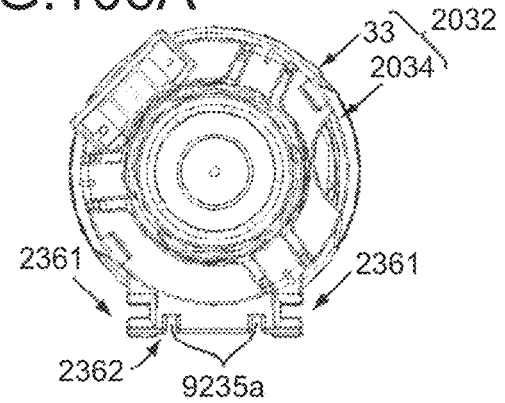
Figure 106B:
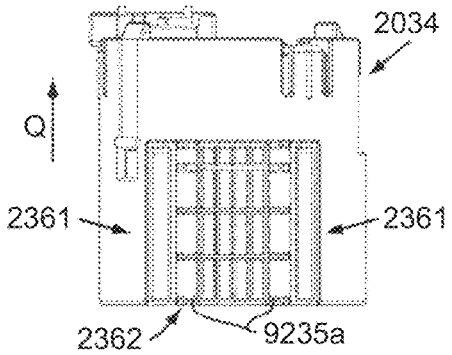
Figure 106C:
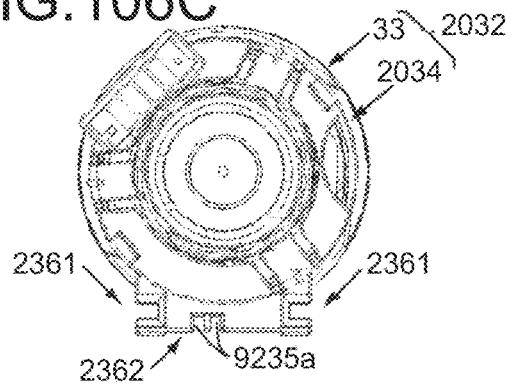
Figure 106D:
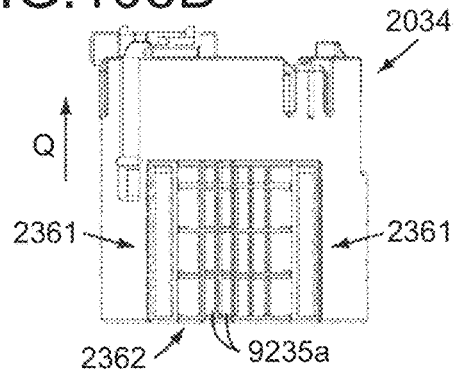
Figure 106E:
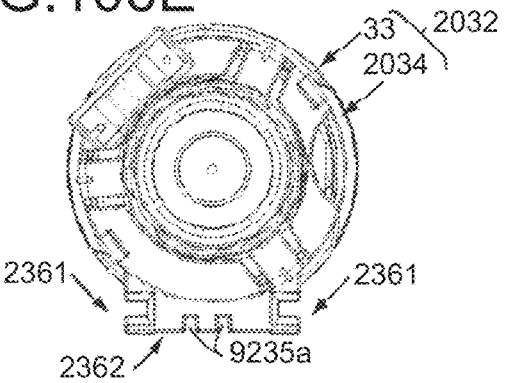
Figure 106F:
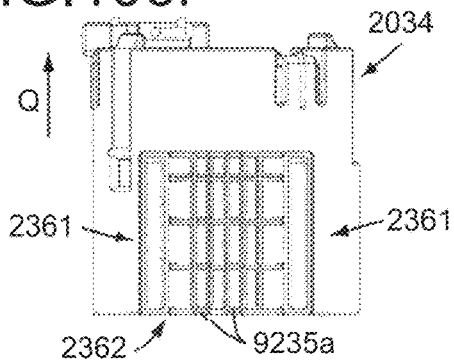
Figure 106G:
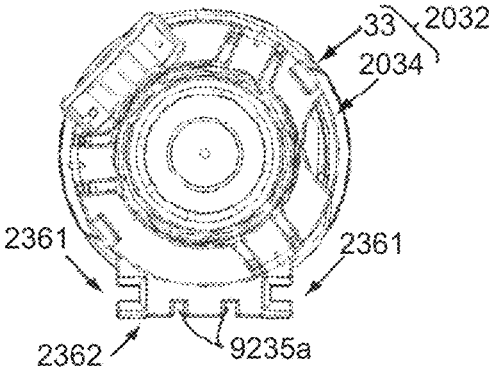
Figure 106H:
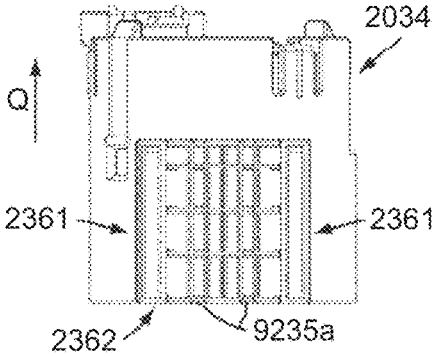
Figure 107A:
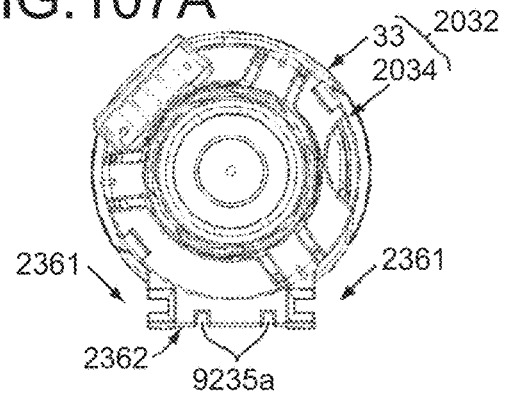
Figure 107B:
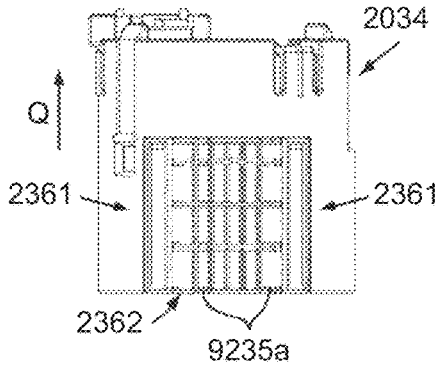
Figure 107C:
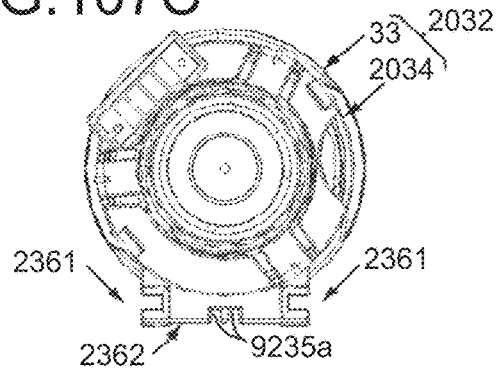
Figure 107D:
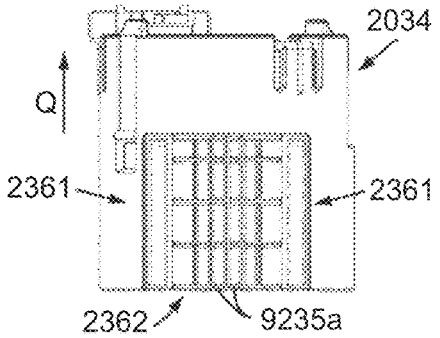
Figure 107E:
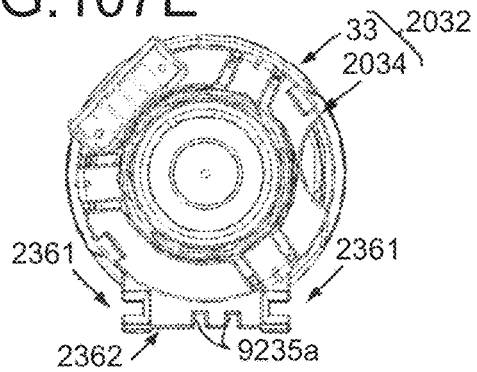
Figure 107F:
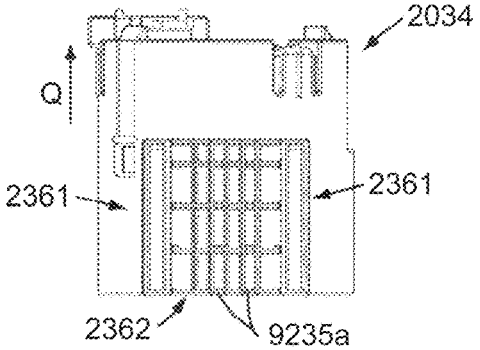
Figure 107G:
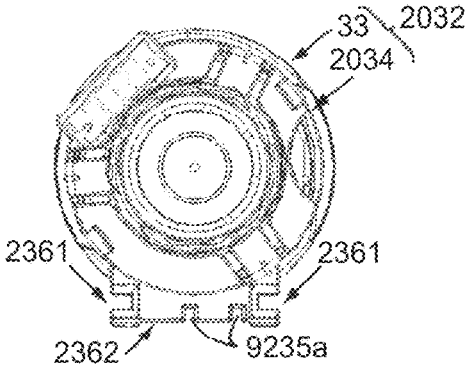
Figure 107H:
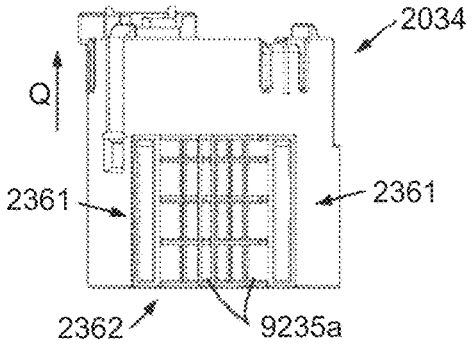
Figure 108A:
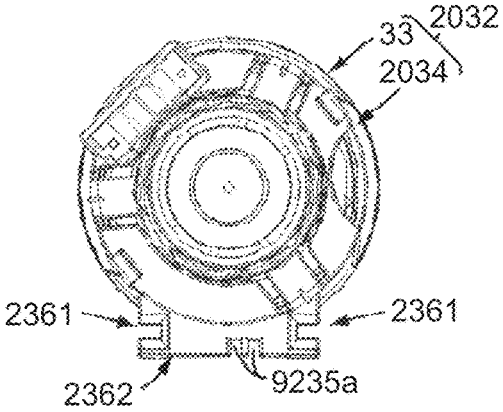
Figure 108B:
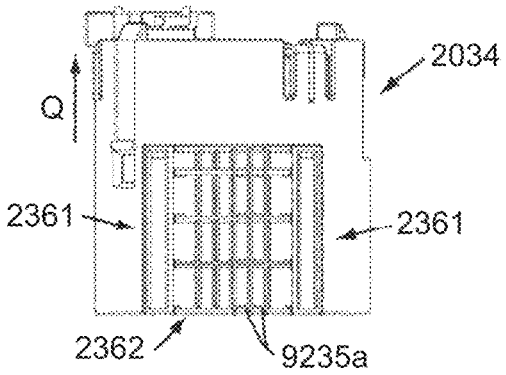
Figure 108C:
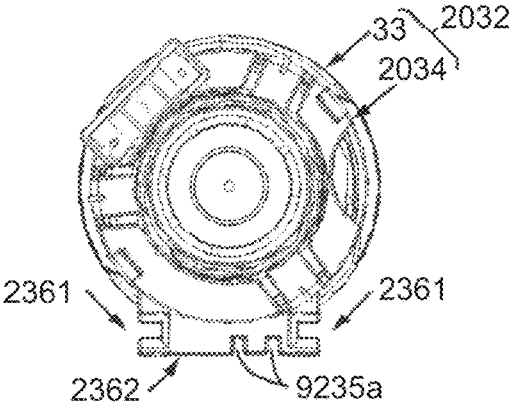
Figure 108D:
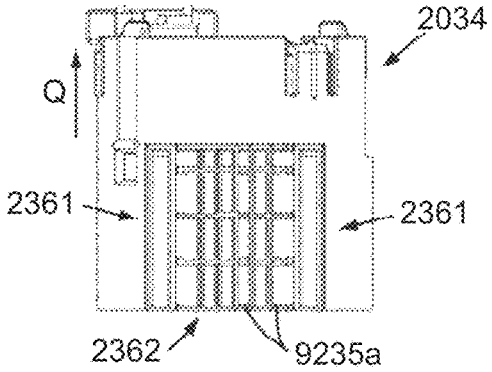
Figure 108E:
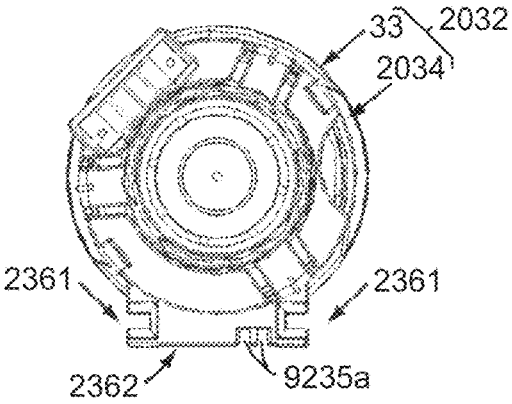
Figure 108F:
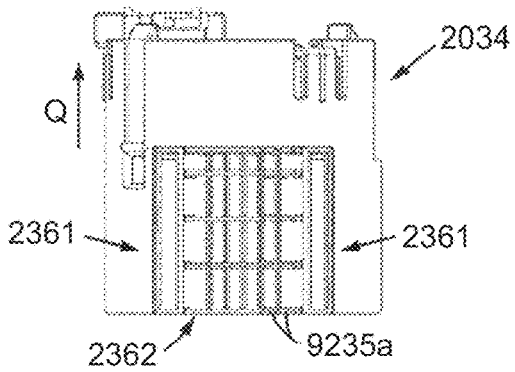
Figure 109:
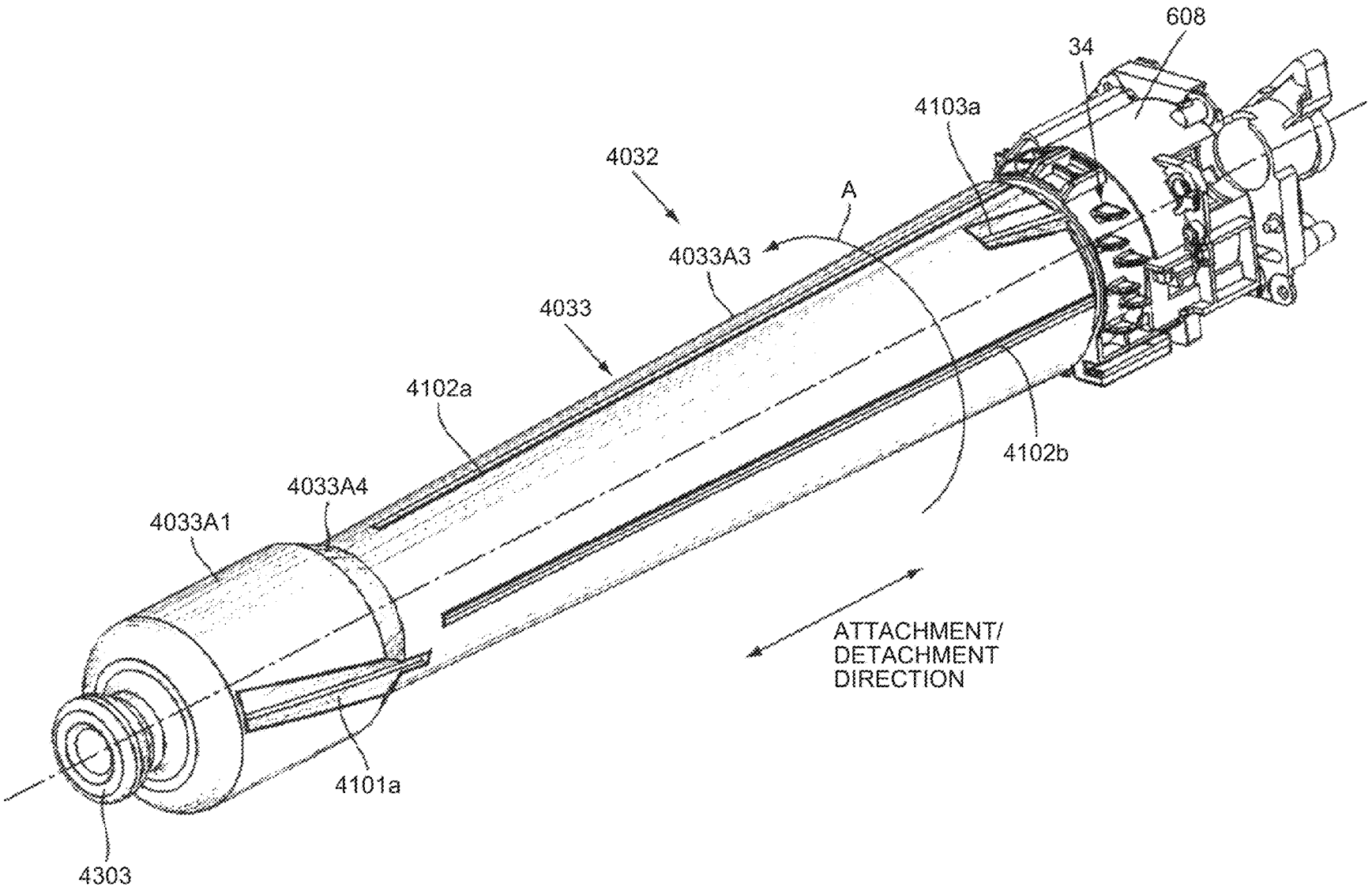
Figure 110:
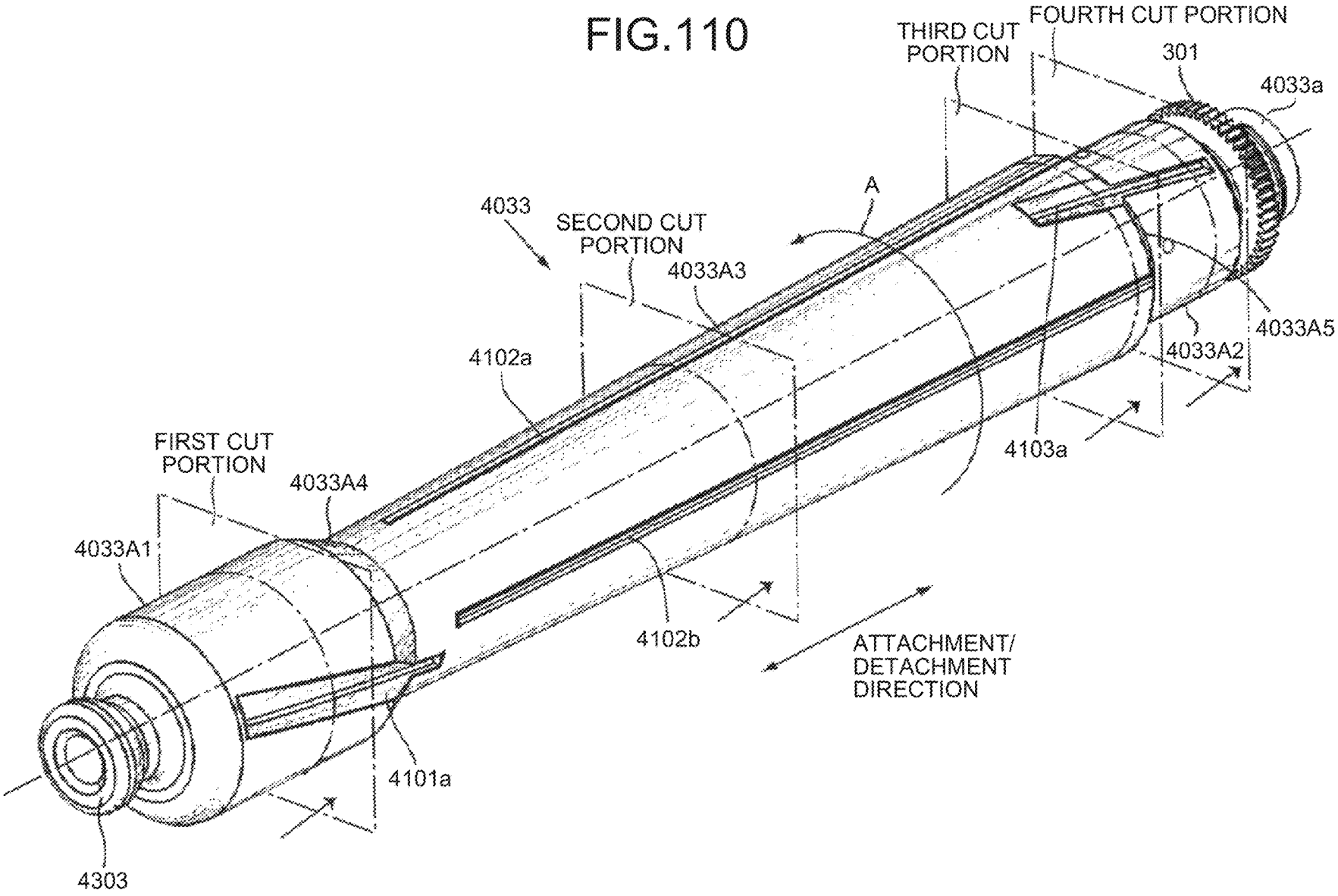
Figure 111:
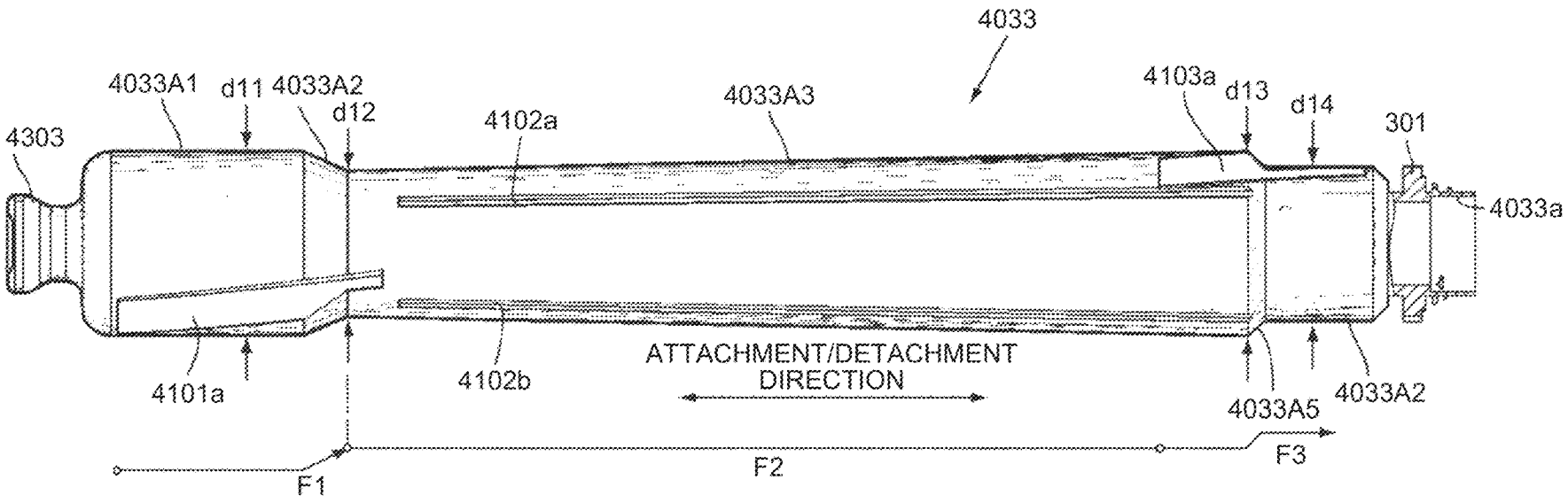
Figure 112A:
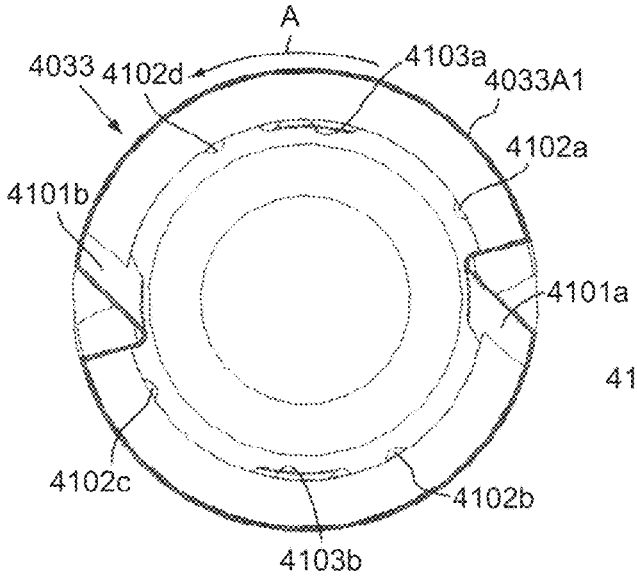
Figure 112B:
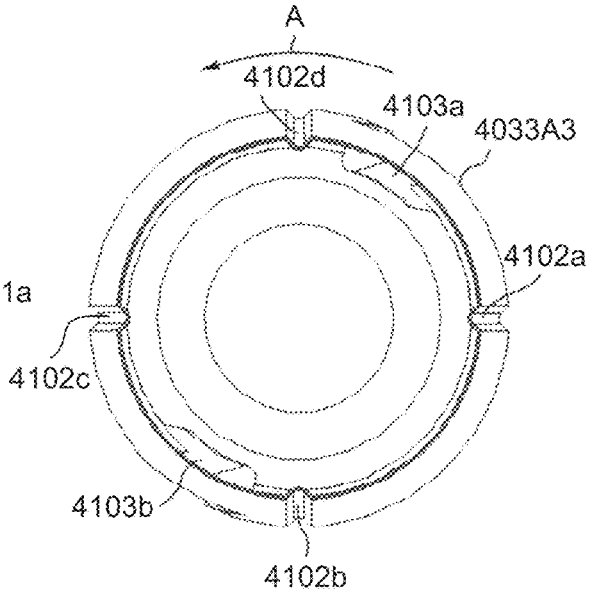
Figure 112C:
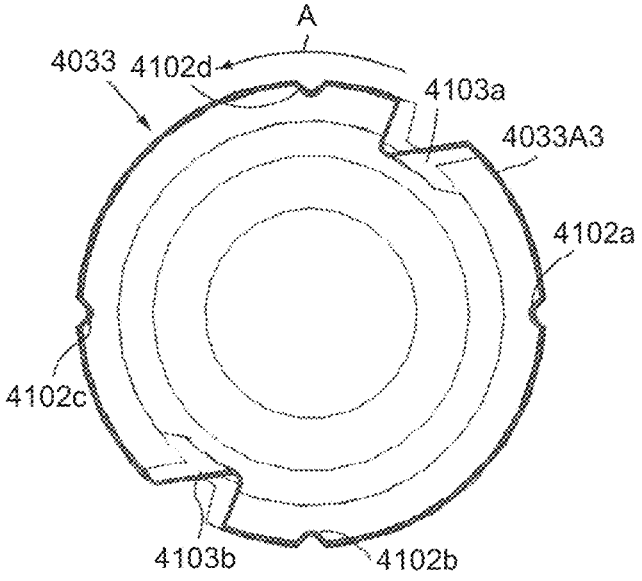
Figure 112D:
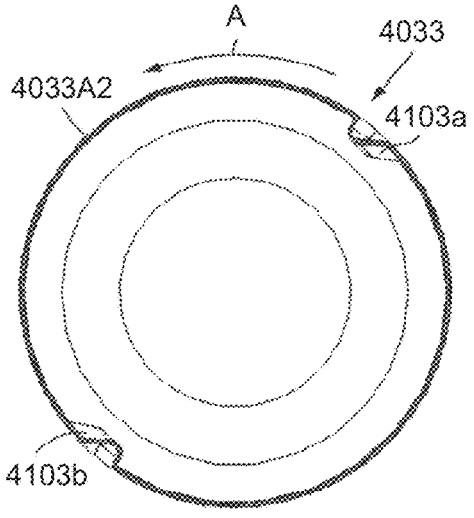
Figure 113A:
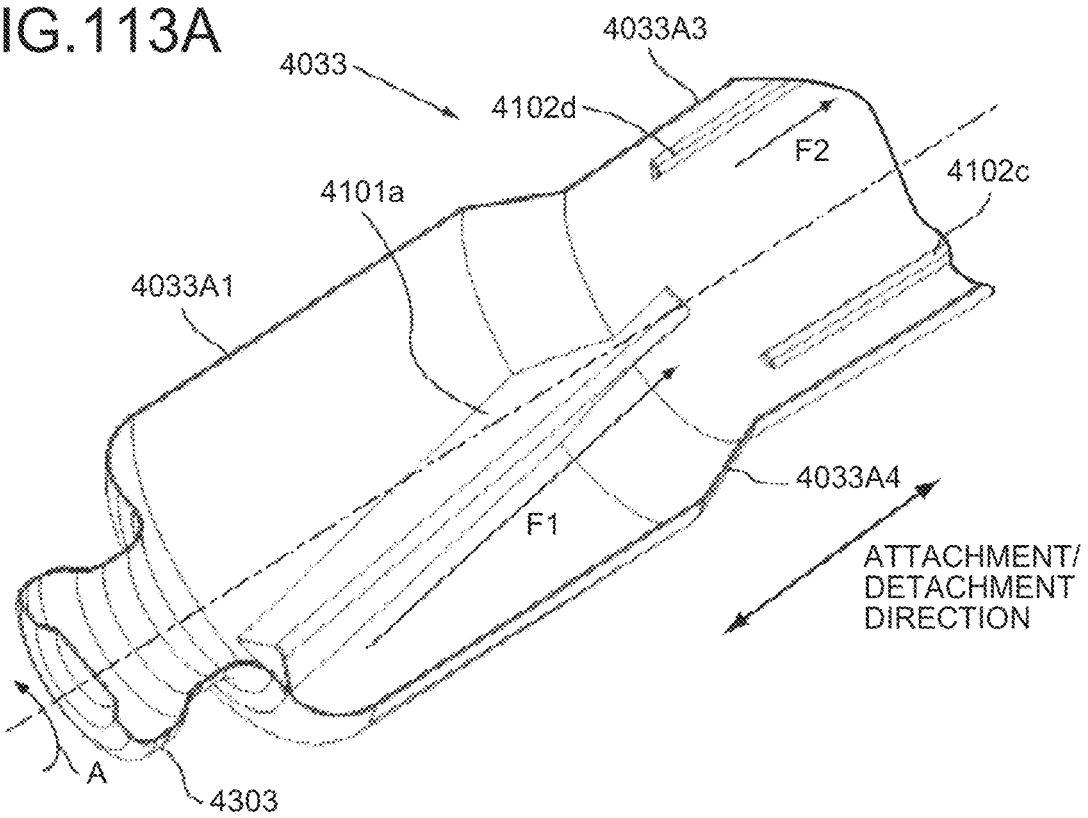
Figure 113B:
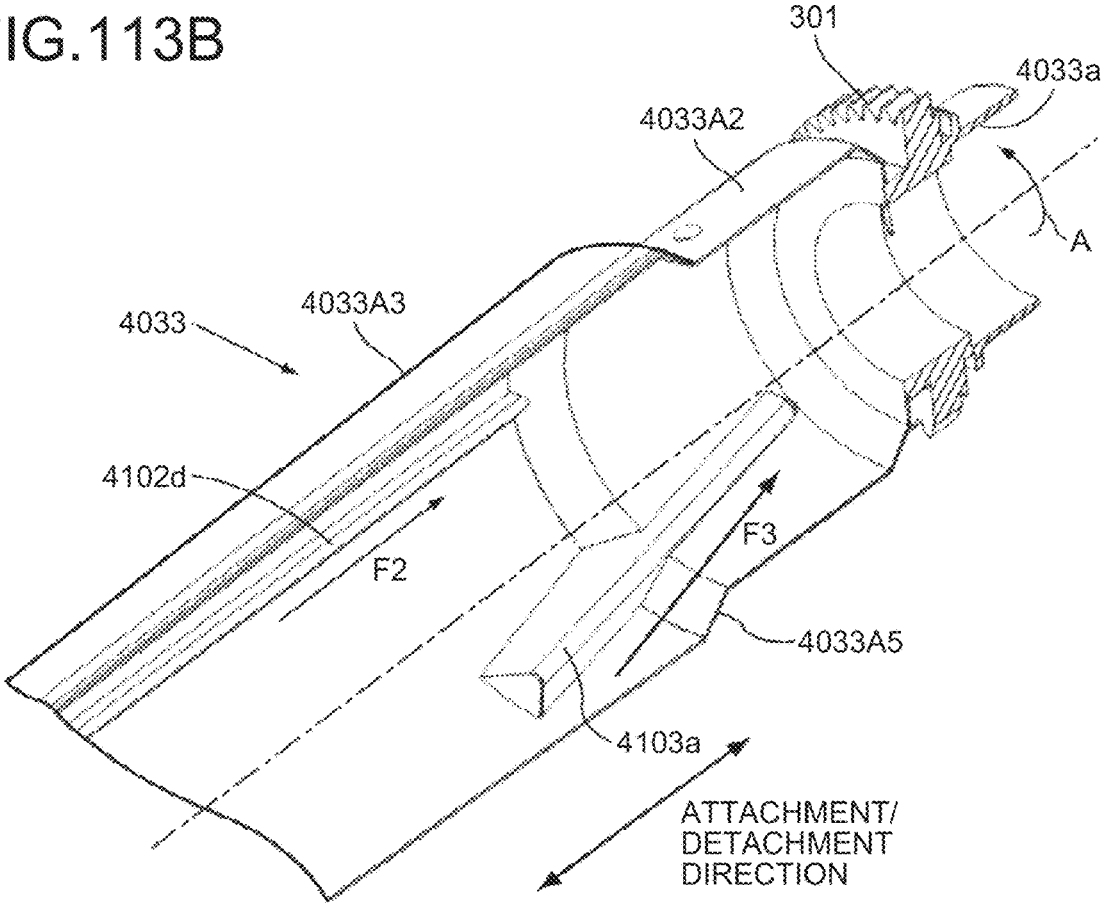
Figure 114:
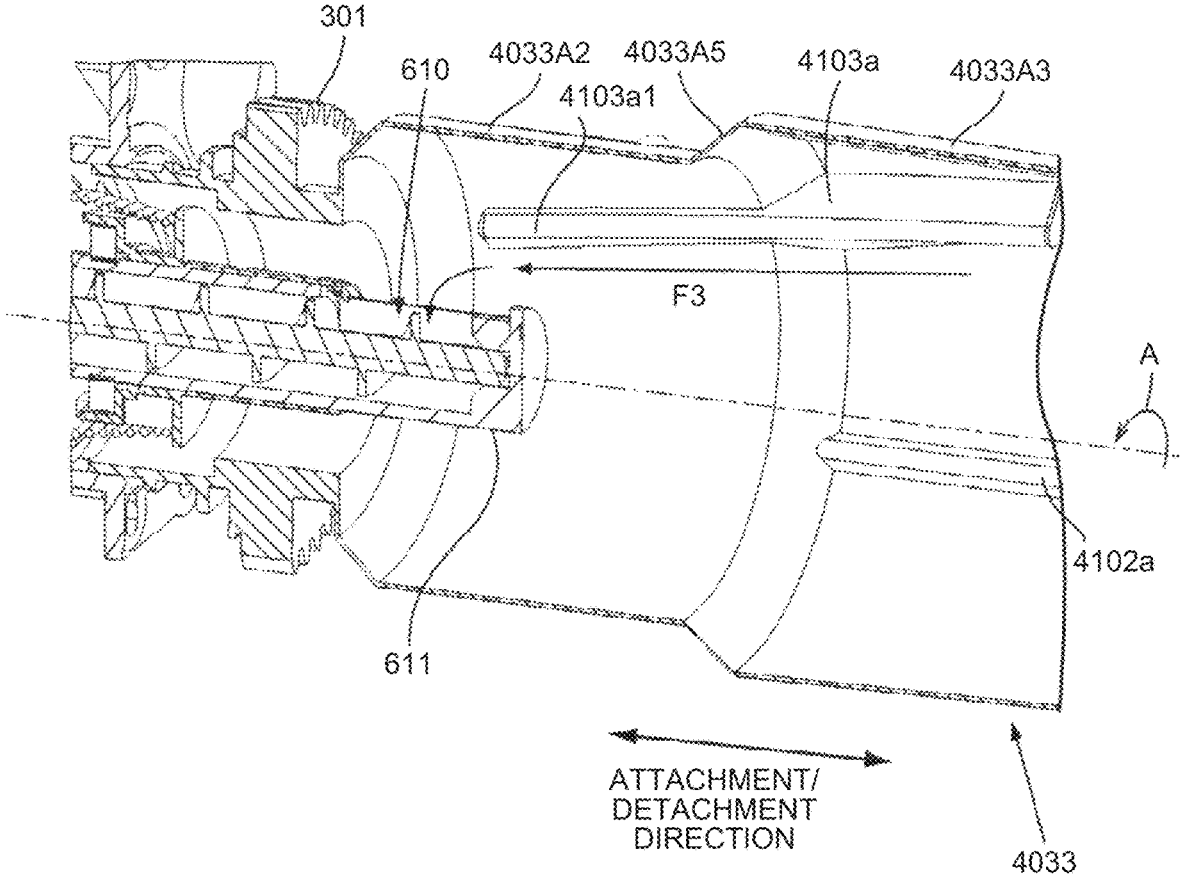
Figure 115:
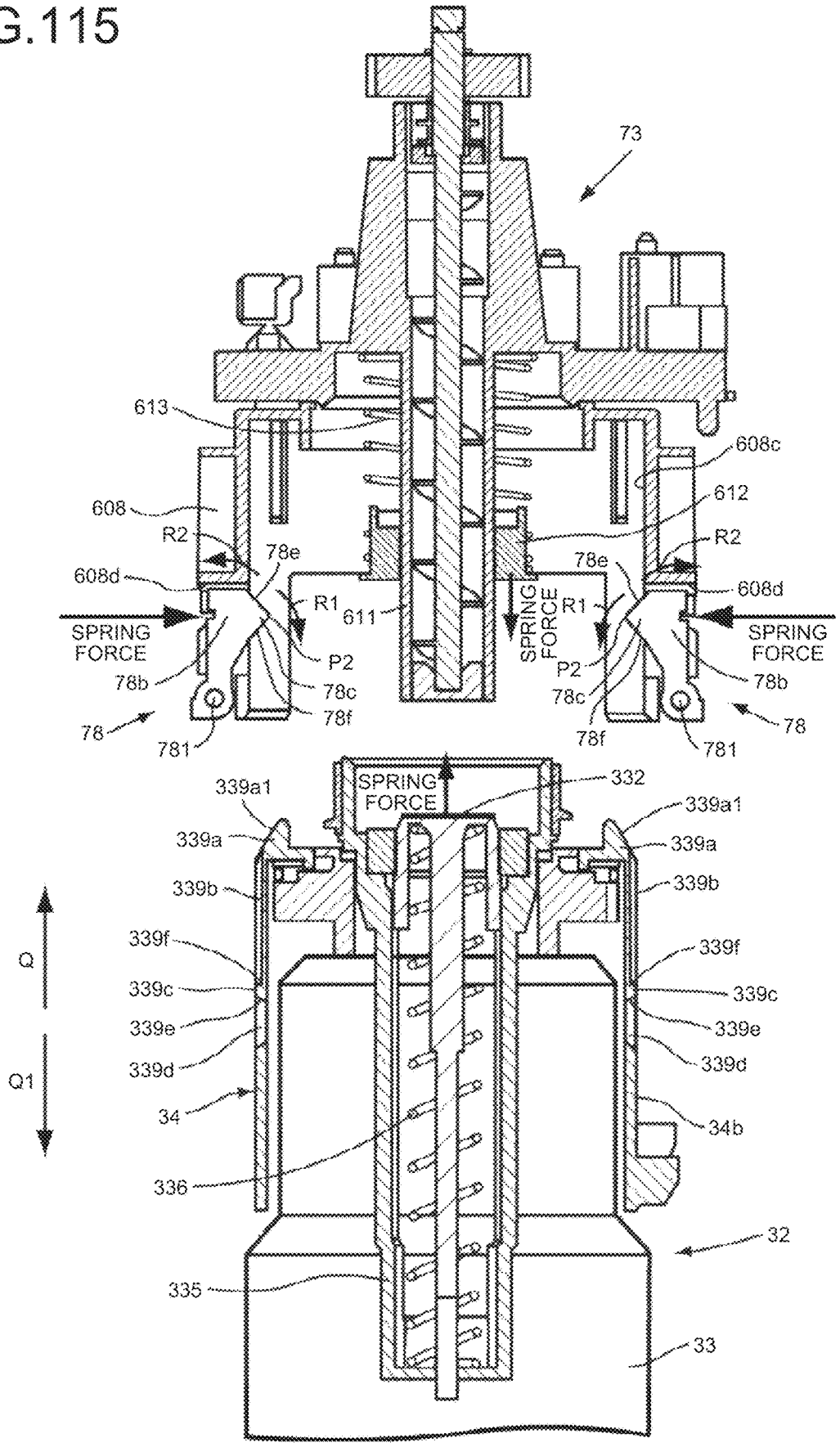
Figure 116:
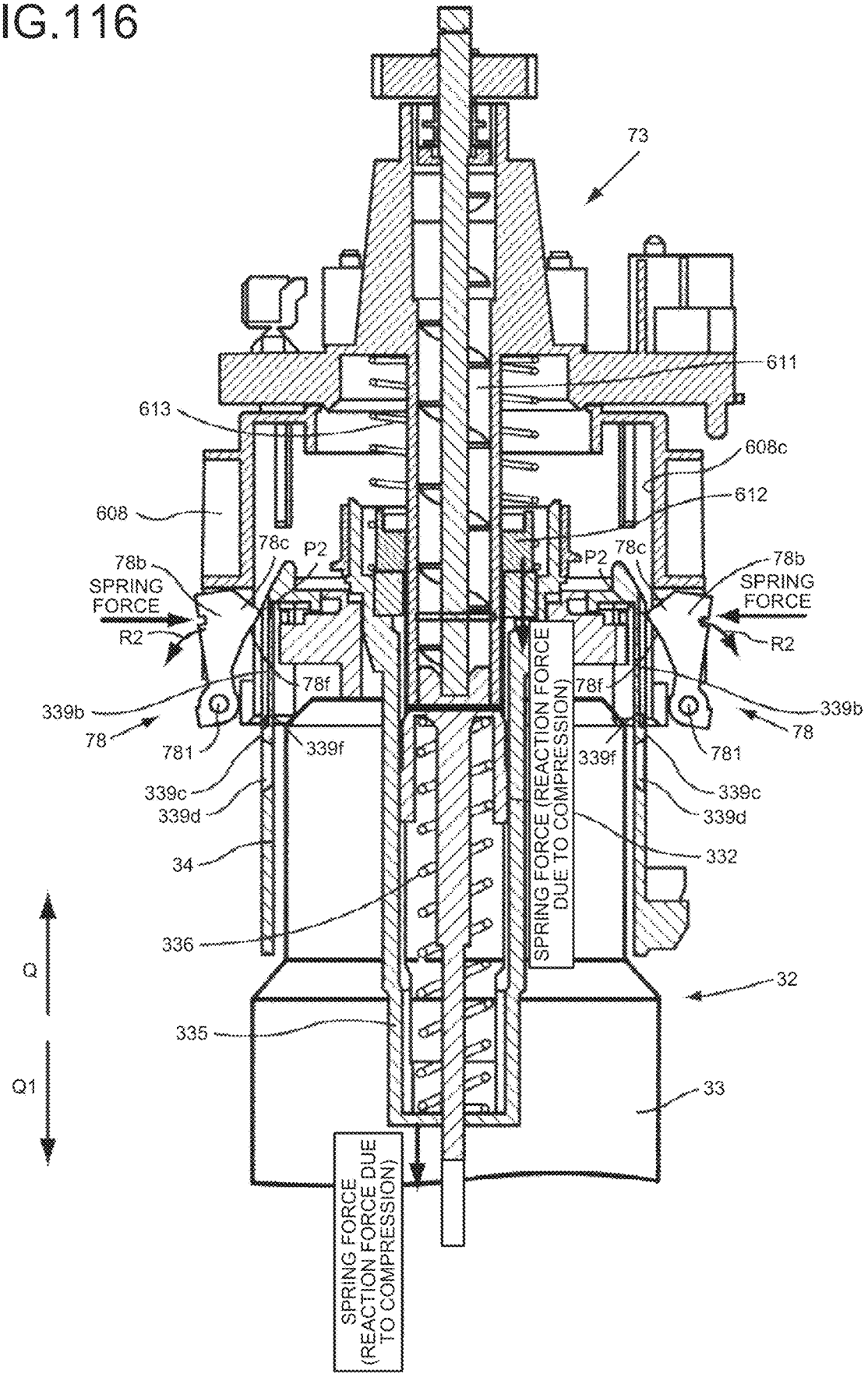
Figure 117:
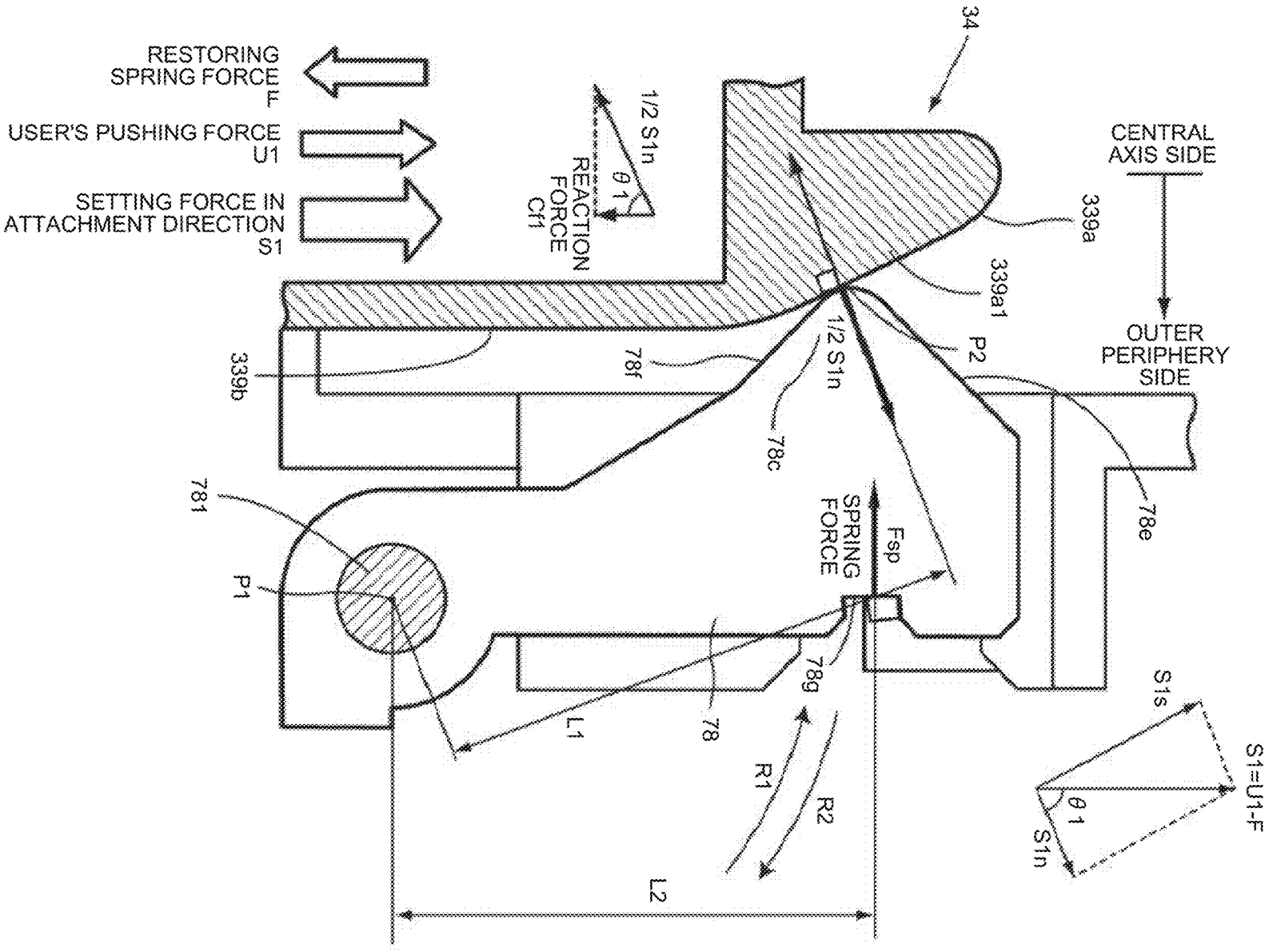
Figure 118:
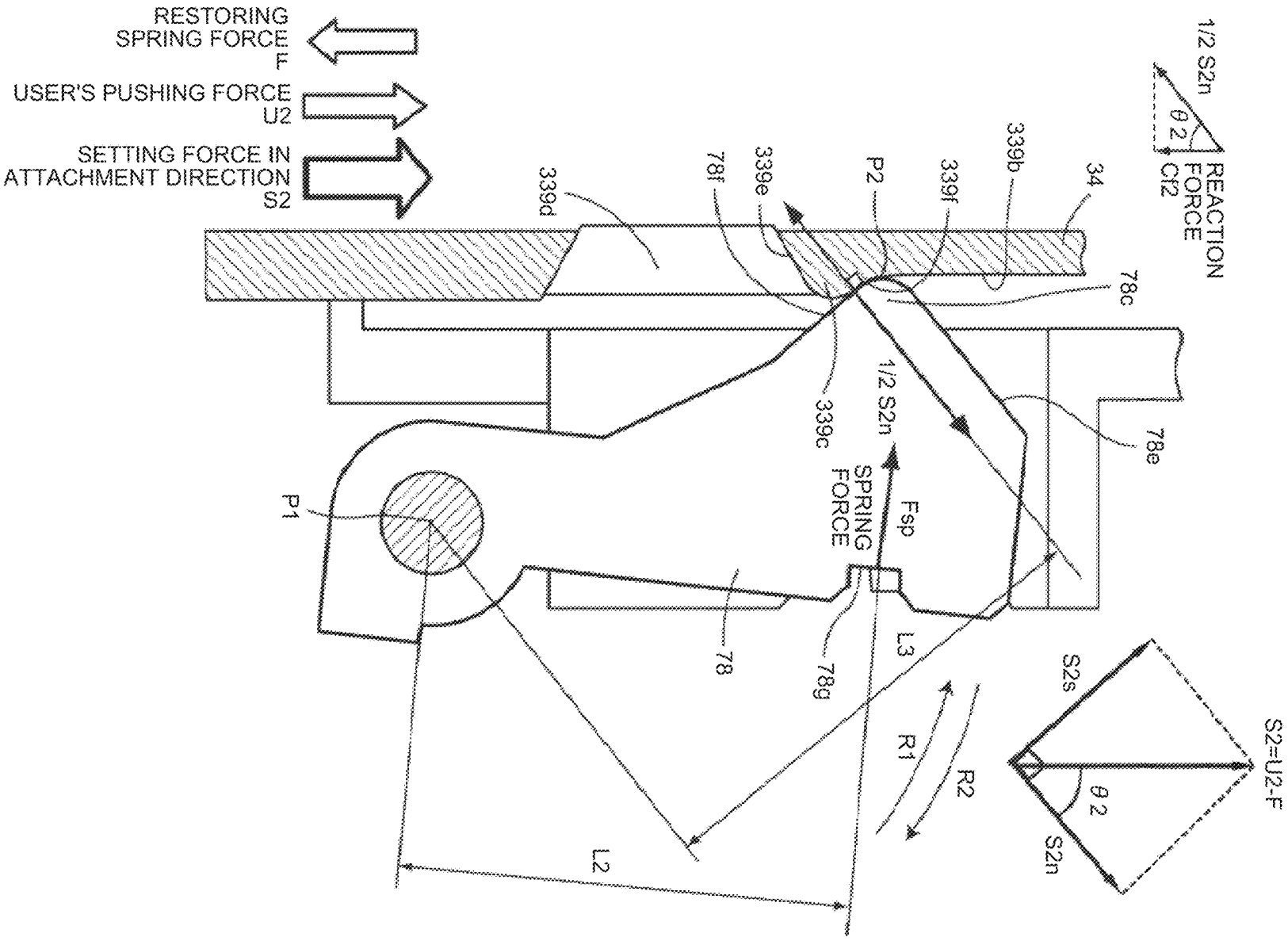
Figure 119:
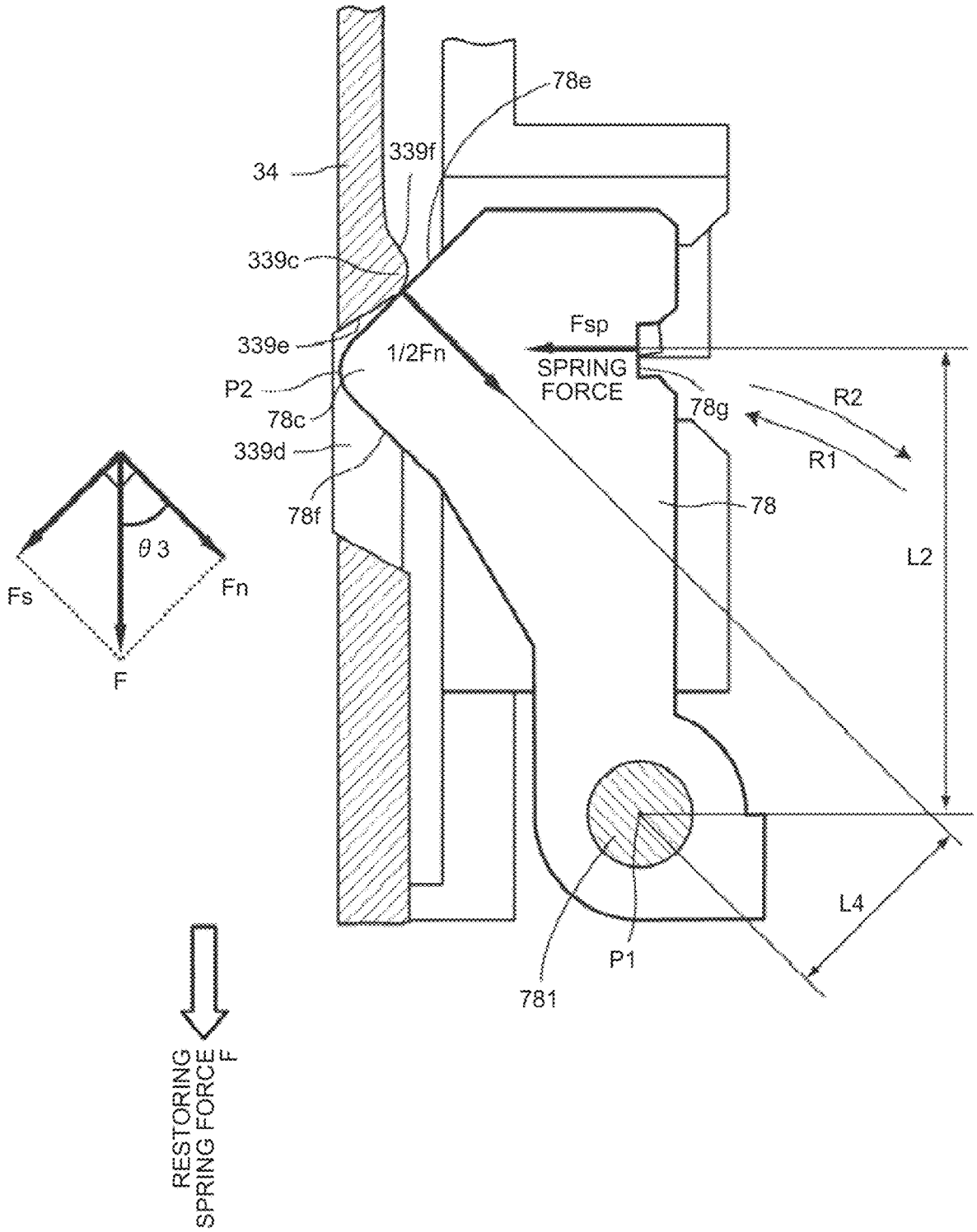
Figure 120:
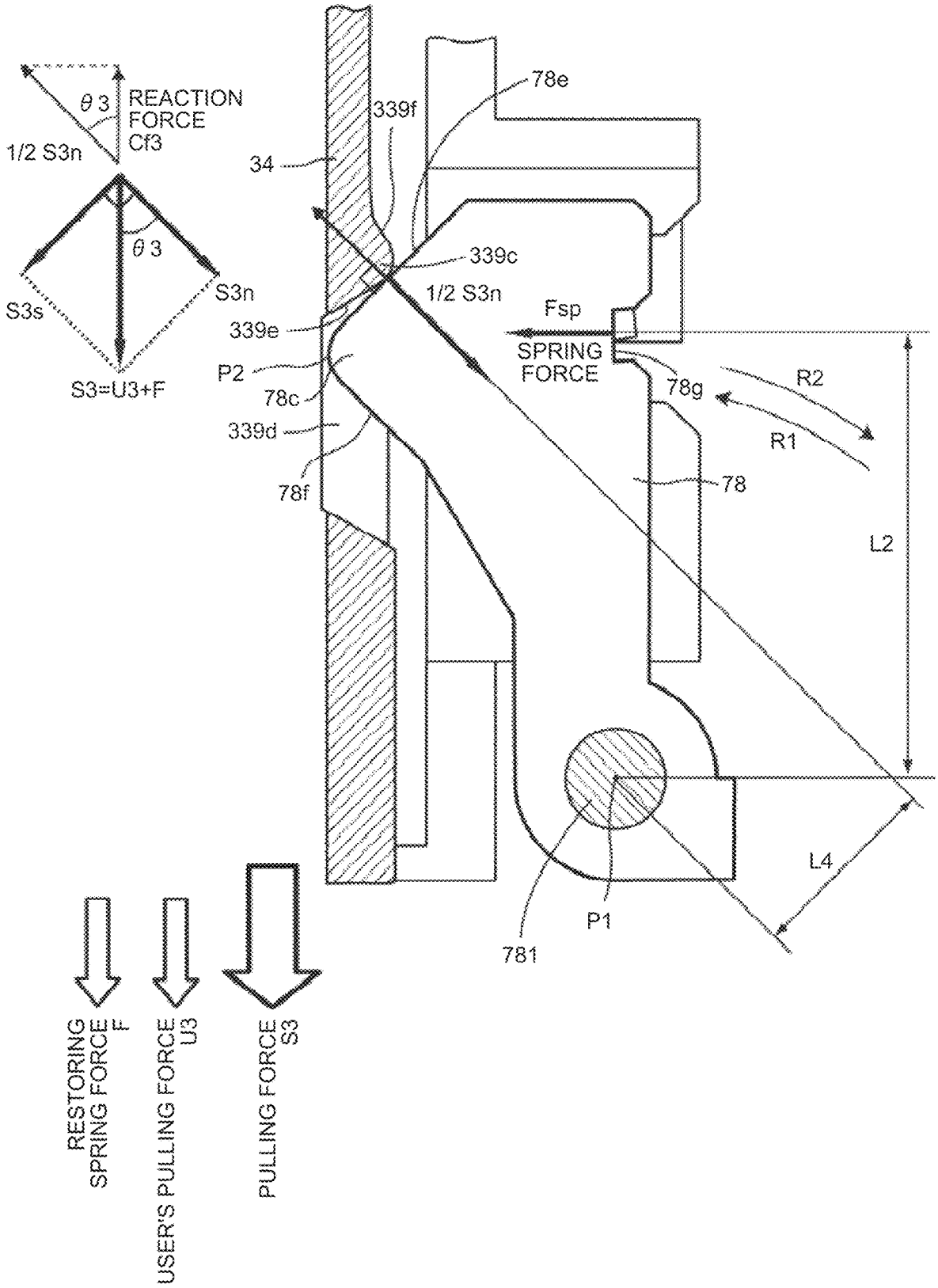
Figure 121:
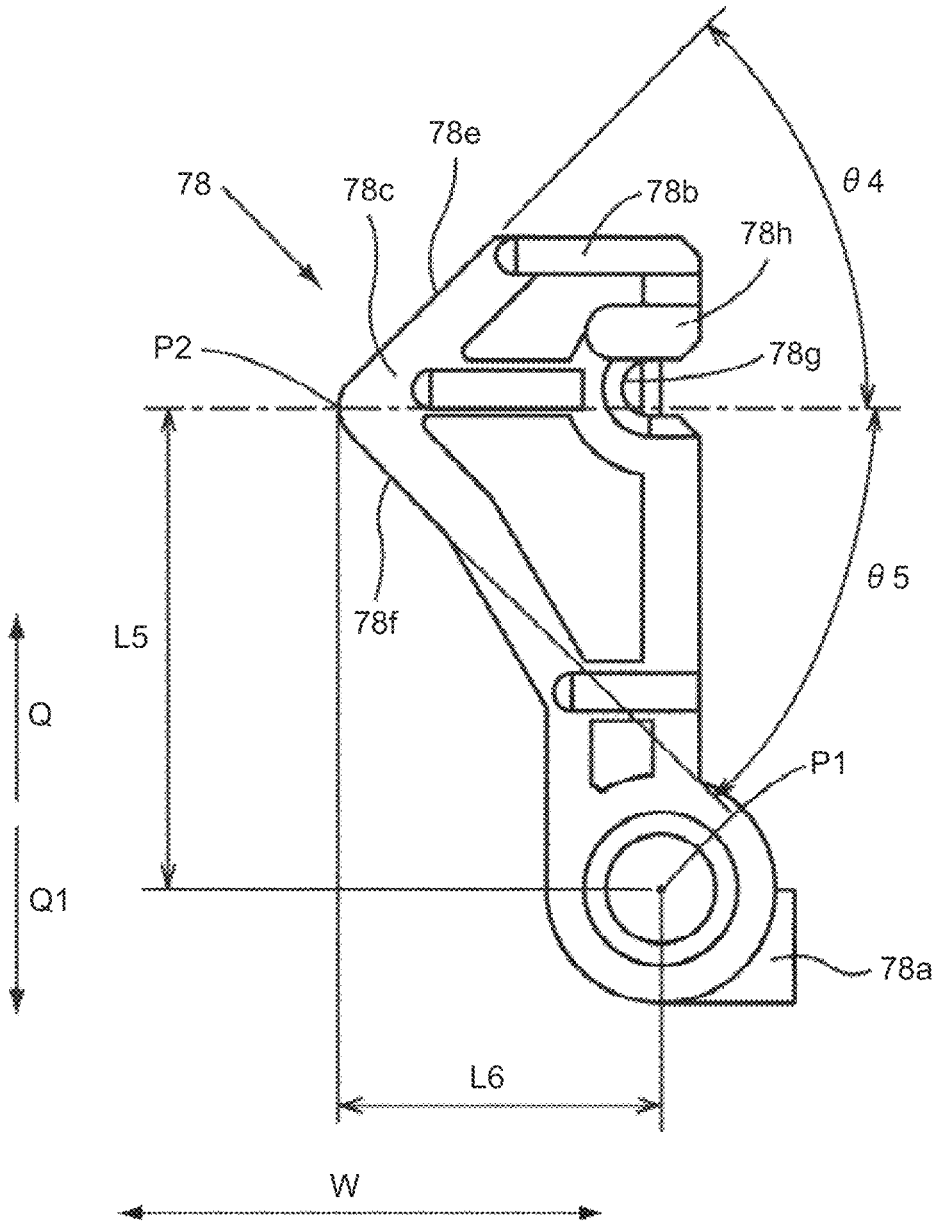

FIG. 91B is a bottom view of the container front end cover illustrated in FIG. 91A;

FIG. 92 is an explanatory perspective view of a container holding section employed in the eighth embodiment;

FIG. 93 is an enlarged perspective view for explaining a container cover receiving section and a driving system of the container holding section illustrated in FIG. 92;

FIG. 94 is an explanatory front view of the container holding section illustrated in FIG. 92;

FIG. 95 is a perspective view illustrating a state in which the powder container according to the eighth embodiment is attached to the container holding section;

FIG. 96 is a partially-enlarged perspective view for explaining configurations of positioners arranged on the setting cover;

FIG. 97 is a front view illustrating configurations of guiding parts and an identifying part arranged on the container holding section according to the eighth embodiment;

FIG. 98 is a partially-enlarged view illustrating engaged states of the guiding parts of the container holding section and the vertical restrictors of the powder container, and an engaged state of the identifying part of the container holding section and an incompatible portion of the powder container;

FIG. 99A is a schematic diagram illustrating the powder container on the container holding section when the powder container starts to move;

FIG. 99B is a schematic diagram illustrating a first restricted state obtained by vertical restrictors;

FIG. 99C is a schematic diagram illustrating a state in which the conveying nozzle and the container shutter come in contact with each other;

FIG. 99D is a schematic diagram illustrating a second restricted state obtained by the vertical restrictors and circumferential restrictors;

FIG. 100A is a schematic diagram illustrating the powder container on the container holding section when the nozzle shutter flange and the container seal come in contact with each other;

FIG. 100B is a schematic diagram illustrating a moving stale in which restriction of movement is maintained by the vertical restrictors and the circumferential restrictors;

FIG. 100C is a schematic diagram illustrating a third restricted state obtained by the vertical restrictors and the circumferential restrictors;

FIG. 100D is a schematic diagram illustrating a fourth restricted state obtained by the vertical restrictors and the circumferential restrictors;

FIG. 100E is a schematic diagram illustrating a fifth restricted state in which the powder container is held in the final setting position;

FIG. 101A is a partially-enlarged cross-sectional perspective view of the circumferential restrictors and the holder in the second restricted state viewed from the powder container side;

FIG. 101B is a partially-enlarged cross-sectional perspective view illustrating a state when the restriction by the circumferential restrictors is intensified in the second restricted state;

FIG. 101C is a partially-enlarged cross-sectional perspective view of the circumferential restrictors and the holder in the third restricted state;

FIG. 102A is a partially-enlarged cross-sectional perspective view of the circumferential restrictors and the holder in the second restricted state viewed from the container holding section side;

FIG. 102B is a partially-enlarged cross-sectional perspective view of the circumferential restrictors and the holder in the third restricted state;

FIG. 103A is a right side view illustrating the configuration of the powder container according to the eighth embodiment;

FIG. 103B is a left side view of the powder container according to the eighth embodiment;

FIG. 103C is a front view of the powder container according to the eighth embodiment;

FIG. 103D is a back view of the powder container according to the eighth embodiment;

FIG. 103E is a plan view of the powder container according to the eighth embodiment;

FIG. 103F is a bottom view of the powder container according to the eighth embodiment;

FIG. 104 is a perspective view of another example of the powder container according to the eighth embodiment, in which a spiral groove is not provided in a container body;

FIGS. 105A and 105B are front and bottom views of a first example of an identified portion provided on the powder container according to the eighth embodiment;

FIGS. 105C and 105D are front and bottom view of a second example of the identified portion provided on the powder container according to the eighth embodiment;

FIGS. 105E and 105F are front and bottom views of a third example of the identified portion provided on the powder container according to the eighth embodiment;

FIGS. 105G and 105H are front and bottom views of a fourth example of the identified portion provided on the powder container according to the eighth embodiment;

FIGS. 106A and 106B are front and bottom views of a fifth example of the identified portion provided on the powder container according to the eighth embodiment;

FIGS. 106C and 106D are front and bottom views of a sixth example of the identified portion provided on the powder container according to the eighth embodiment;

FIGS. 106E and 106F are front and bottom views of a seventh example of the identified portion provided on the powder container according to the eighth embodiment;

FIGS. 106G and 106H are front and bottom views of an eighth example of the identified portion provided on the powder container according to the eighth embodiment;

FIGS. 107A and 107B are front and bottom views of a ninth example of the identified is portion provided on the powder container according to the eighth embodiment;

FIGS. 107C and 107D are front and bottom views of a tenth example of the identified portion provided on the powder container according to the eighth embodiment;

FIGS. 107E and 107F are front and bottom views of an eleventh example of the identified portion provided on the powder container according to the eighth embodiment;

FIGS. 107G and 107H are front and bottom views of a twelfth example of the identified portion provided on the powder container according to the eighth embodiment;

FIGS. 108A and 108B are front and bottom views of a thirteenth example of the identified portion provided on the powder container according to the eighth embodiment;

FIGS. 108C and 108D are front and bottom views of a fourteenth example of the identified portion provided on the powder container according to the eighth embodiment;

FIGS. 108E and 108F are front and bottom views of a fifteenth example of the identified rib provided on the powder container according to the eighth embodiment;

FIG. 109 is an explanatory perspective view illustrating an overall configuration of a powder container according to a ninth embodiment;

FIG. 110 is a perspective view for explaining cross-sectional portions in the longitudinal direction of a container body according to the ninth embodiment;

FIG. 111 is a side view for explaining a configuration of the container body and flow of toner according to the ninth embodiment;

FIG. 112A is a cross-sectional view of a first cut portion illustrated in FIG. 110;

FIG. 112B is a cross-sectional view of a second cut portion illustrated in FIG. 110;

FIG. 112C is a cross-sectional view of a third cut portion illustrated in FIG. 110;

FIG. 112D is a cross-sectional view of a fourth cut portion illustrated in FIG. 110;

FIG. 113A is an enlarged cross-sectional view illustrating configurations of guiding portions on one end of the container body;

FIG. 113B is an enlarged cross-sectional view illustrating configurations of guiding portions on the other end of the container body;

FIG. 114 is an enlarged cross-sectional view illustrating a state in which the conveying nozzle is inserted in the container body;

FIG. 115 is an explanatory cross-sectional view of the powder container before being attached and the replenishing device engaging members;

FIG. 116 is an explanatory cross-sectional view of the replenishing device engaging members when the powder container is entered into the container cover receiving section;

FIG. 117 is an explanatory enlarged view illustrating a relationship of forces applied to the replenishing device engaging member, and a state in which a guiding protrusion of a container engaged portion and the replenishing device engaging member come in contact with each other due to pushing in the attachment direction;

FIG. 118 is an explanatory enlarged view illustrating a relationship of forces applied to the replenishing device engaging member, and a state just before an attached state is obtained by the pushing in the attachment direction;

FIG. 119 is an explanatory enlarged view illustrating a relationship of forces applied to the replenishing device engaging member, and the attached state;

FIG. 120 is an explanatory enlarged view illustrating a relationship of forces applied to the replenishing device engaging member, and a state in which the powder container in the attached state is pulled out in a detachment direction Q1; and FIG. 121 is a plan view illustrating an example of dimensions of the replenishing device engaging member.

DETAILED DESCRIPTION OF THE PREFERRED EMBODIMENTS

Various embodiments of the present invention will be explained below with reference to the accompanying drawings. In the embodiments, the same components or components with the same functions are denoted by the same reference numerals and symbols, and the same explanation will not be repeated. The descriptions below are mere examples and do not limit the scope of the appended claims. Furthermore, a person skilled in the art may easily conceive other embodiments by making modifications or changes within the scope of the appended claims; however, such modifications and changes obviously fall within the scope of the appended claims. In the drawings, Y, M, C, and K are symbols appended to components corresponding to yellow, magenta, cyan, and black, respectively, and will be omitted appropriately.

First Embodiment

Figure 2:
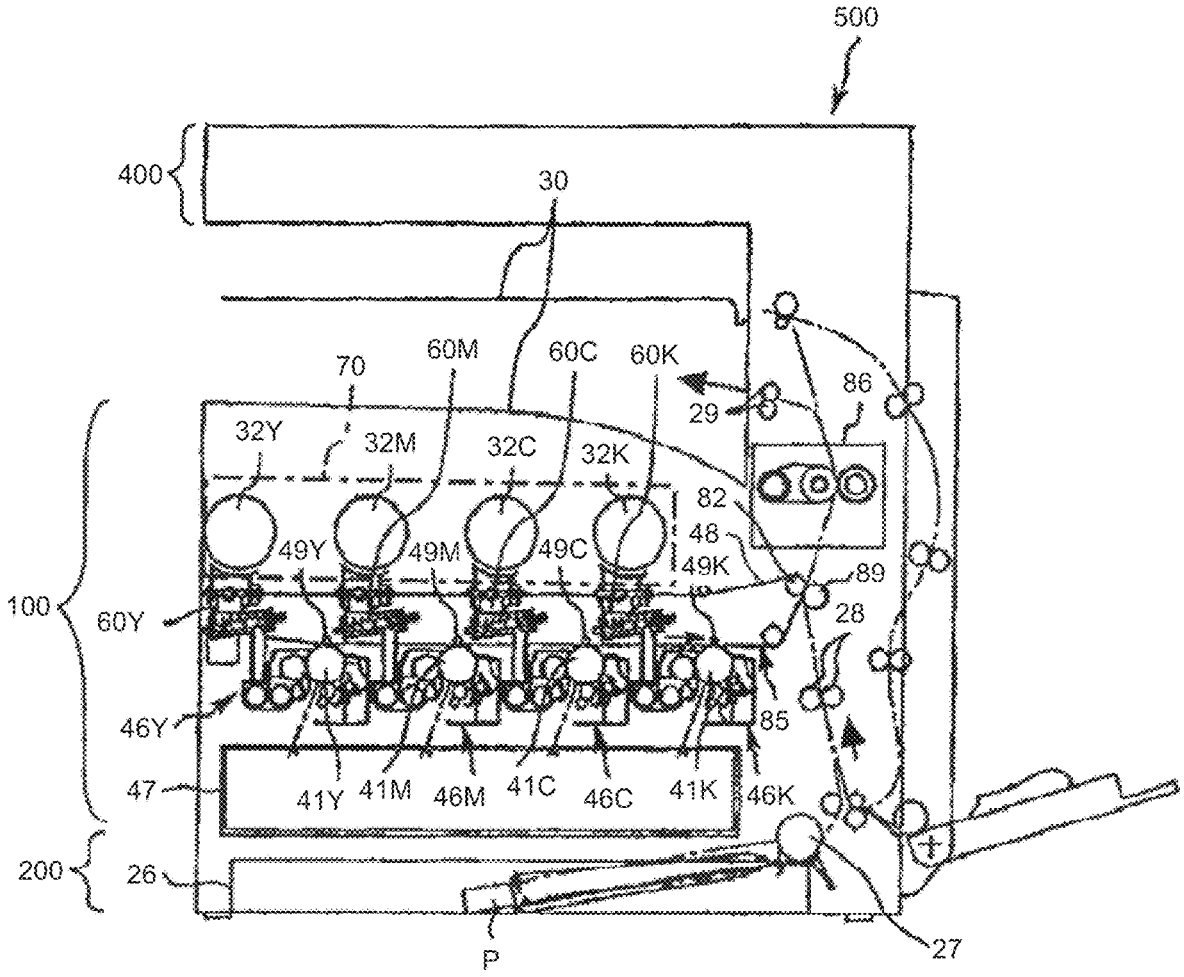
FIG. 2 is a diagram illustrating an overall configuration of an image forming apparatus according to the embodiments of the present invention.

FIG. 2 is an overall configuration diagram of an electrophotographic tandem-type color copier (hereinafter, referred to as a "copier 500") serving as an image forming apparatus according to an embodiment. The copier 500 may be a monochrome copier. The copier 500 mainly includes a copier main-body (hereinafter, referred to as a "printer 100"), a feed table (hereinafter, referred to as a "sheet feeder 200"), and a scanner section (hereinafter, referred to as a "scanner 400") mounted on the printer 100. In the following, the "main-body" indicates the copier main-body (main body of the image forming apparatus).

Four toner containers 32 (Y, M, C, K) serving as powder containers corresponding to different colors (yellow, magenta, cyan, black) are detachably (replaceably) attached to a toner container holder 70 serving as a container holding section provided in the upper part of the printer 100. An intermediate transfer device 85 is arranged below the toner container holder 70.

The intermediate transfer device 85 includes an intermediate transfer belt 48 serving as an intermediate transfer medium, four primary-transfer bias rollers 49 (Y, M, C, K), a secondary-transfer backup roller 82, multiple tension rollers, an intermediate-transfer cleaning device, and the like. The intermediate transfer belt 48 is stretched and supported by multiple roller members and endlessly moves in the arrow direction in FIG. 2 along with rotation of the secondary-transfer backup roller 82 that serves as one of the roller members.

In the printer 100, four image forming sections 46 (Y, M, C, K) corresponding to the respective colors are arranged in tandem so as to face the intermediate transfer belt 48. Four toner replenishing devices 60 (Y, M, C, K) serving as powder supply (replenishing) devices corresponding to the four toner containers 32 (Y, M, C, K) of the four colors are arranged below the toner containers 32, respectively. The toner replenishing devices 60 (Y, M, C, K) respectively supply (replenish) toner that is powder developer contained in the toner containers 32 (Y, M, C, K) to developing devices of the image forming sections 46 (Y, M, C, K) for the respective colors. In the embodiment, the four image forming sections 46 (Y, M, C, K) form an image forming unit.

As illustrated in FIG. 2, the printer 100 includes an exposing device 47 serving as a latent-image forming means below the four image forming sections 46. The exposing device 47 exposes and scans the surfaces of photoconductors 41 (Y, M, C, K) serving as image bearers (to be described later) with light based on image information of an original image read by the scanner 400, so that electrostatic latent images are formed on the surfaces of the photoconductors. The image information may be input from an external apparatus, such as a personal computer, connected to the copier 500, instead of being read by the scanner 400.

In the embodiment, a laser beam scanning system using a laser diode is employed as the exposing device 47. However, other configurations, such as a configuration including an LED array, may be employed as the exposing means.

Figure 3:
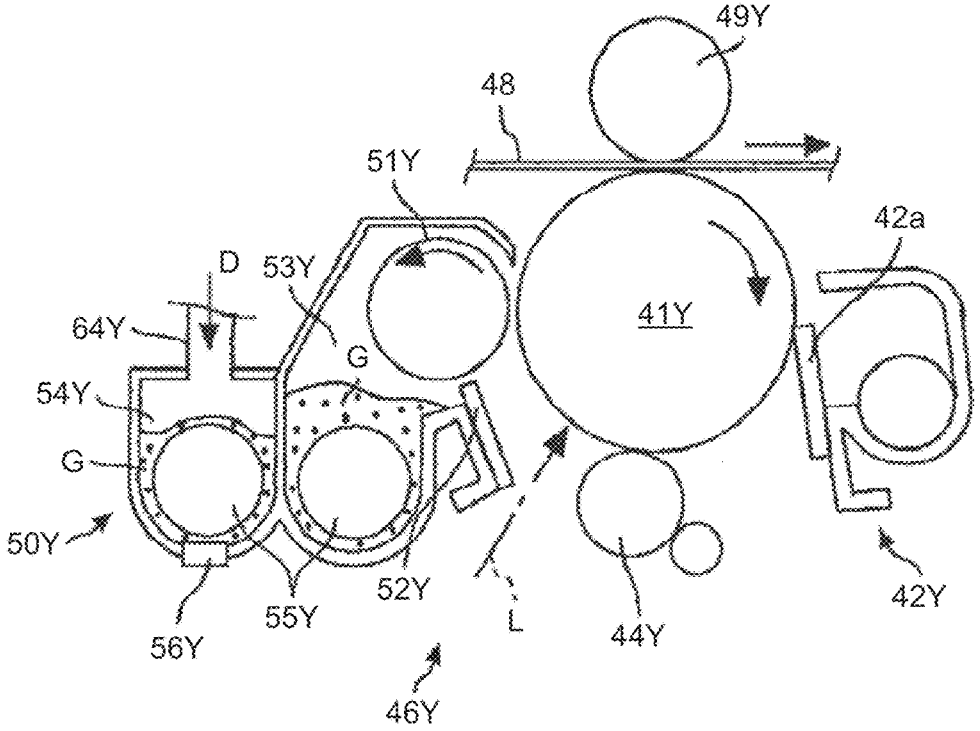
FIG. 3 is a schematic diagram illustrating a configuration of an image forming section of the image forming apparatus illustrated in FIG. 2.

FIG. 3 is a schematic diagram illustrating an overall configuration of the image forming section 46Y for yellow.

The image forming section 46Y includes the drum-shaped photoconductor 41Y. The image forming section 46Y includes a charging roller 44Y serving as a charging device, a developing device 50Y serving as a developing means, a photoconductor cleaning device 42Y serving as a cleaning device, and a neutralizing device, all of which are arranged around the photoconductor 41Y. Image forming processes (a charging process, an exposing process, a developing process, a transfer process, and a cleaning process) are performed on the photoconductor 41Y, so that a yellow toner image is formed on the photoconductor 41Y.

The other three image forming sections 46 (M, C, K) have almost the same configurations as the image forming section 46Y for yellow except that colors of toner to be used are different, and toner images corresponding to the respective toner colors are formed on the photoconductors 41 (M, C, K). Hereinafter, explanation of only the image forming section 46Y for yellow will be given, and explanation of the other three image forming sections 46 (M, C, K) will be omitted appropriately.

The photoconductor 41Y is rotated clockwise in FIG. 3 by a drive motor. The surface of the photoconductor 41Y is uniformly charged at a position facing the charging roller 44Y (charging process). Subsequently, the surface of the photoconductor 41Y reaches a position of irradiation with laser light L emitted by the exposing device 47, where an electrostatic latent image for yellow is formed through exposure scanning (exposing process). The surface of the photoconductor 41Y then reaches a position facing the developing device 50Y, where the electrostatic latent image is developed with yellow toner to form a yellow toner image (developing device).

The four primary-transfer bias rollers 49 (Y, M, C, K) of the intermediate transfer device 85 and the photoconductors 41 (Y, M, C, K) sandwich the intermediate transfer belt 48, so that primary transfer nips are formed. A transfer bias with polarity opposite to the polarity of toner is applied to the primary-transfer bias rollers 49 (Y, M, C, K).

The surface of the photoconductor 41Y, on which the toner image is formed through the developing process, reaches the primary transfer nip facing the primary-transfer bias roller 49Y across the intermediate transfer belt 48, and the toner image on the photoconductor 41Y is transferred to the intermediate transfer belt 48 at the primary transfer nip (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the photoconductor cleaning device 42Y. At this position, the non-transferred toner remaining on the photoconductor 41Y is mechanically collected by a cleaning blade 42*a* included in the photoconductor cleaning device 42Y (cleaning process). The surface of the photoconductor 41Y finally reaches a position facing the neutralizing device, where the residual potential on the photoconductor 41Y is removed. In this way, a series of image forming processes performed on the photoconductor 41Y is completed.

The above image forming processes are also performed on the other image forming sections 46 (M, C, K) in the same manner as the image forming section 46Y for yellow. Specifically, the exposing device 47 arranged below the image forming sections 46 (M, C, K) emits laser light L based on image information toward the photoconductors 41 (M, C, K) of the image forming sections 46 (M, C, K). More specifically, the exposing device 47 emits the laser light L from a light source and irradiates each of the photoconductors 41 (M, C, K) with the laser light L via multiple optical elements while performing scanning with the laser light L by a rotating polygon mirror. Subsequently, toner images of the respective colors formed on the photoconductors 41 (M, C, K) through the developing process are transferred to the intermediate transfer belt 48.

At this time, the intermediate transfer belt 48 moves in the arrow direction in FIG. 2 and sequentially passes through the primary transfer nips of the primary-transfer bias rollers 49 (Y, M, C, K). Therefore, the toner images of the respective colors on the photoconductors 41 (Y, M, C, K) are superimposed on the intermediate transfer belt 48 as primary transfer, so that a color toner image is formed on the intermediate transfer belt 48.

The intermediate transfer belt 48, on which the color toner image is formed by superimposing the toner images of the respective colors, reaches a position facing a secondary transfer roller 89. At this position, the secondary-transfer backup roller 82 and the secondary transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to, for example, the action of a transfer bias applied to the secondary-transfer backup roller 82. At this time, non-transferred toner which has not been transferred to the recording medium P remains on the intermediate transfer belt 48. The intermediate transfer belt 48 that has passed through the secondary transfer nip reaches the position of the intermediate-transfer cleaning device, where the non-transferred toner remaining on the surface is collected. In this way, a series of transfer processes performed on the intermediate transfer belt 48 is completed.

Movement of the recording medium P will be explained below.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being stopped. The registration roller pair 28 is rotated to convey the recording medium P toward the secondary transfer nip in accordance with the timing at which the color toner image on the intermediate transfer belt 48 reaches the secondary transfer nip. Accordingly, a desired color image is formed on the recording medium P.

The recording medium P on which the color toner image is transferred at the secondary transfer nip is conveyed to the position of a fixing device 86. In the fixing device 86, the color toner image transferred on the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of image forming processes in the copier 500 is completed.

A configuration and operation of the developing device 50 in the image forming section 46 will be explained in detail below. In the following, the image forming section 46Y for yellow will be explained by way of example. However, the image forming section 46 (M, C, K) for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating sections, i.e., first and second developer accommodating sections 53Y and 54Y. The developing roller 51Y includes a magnet roller fixed inside thereof and a sleeve that rotates around the magnet roller. Two-component developer G containing carrier and toner is stored in the first developer accommodating section 53Y and the second developer accommodating section 54Y. The second developer accommodating section 54Y communicates with a toner dropping passage 64Y via an opening provided in the upper side thereof. The toner density sensor 56Y detects toner density in the developer G stored in the second developer accommodating section 54Y.

The developer G in the developing device 50 circulates between the first developer accommodating section 53Y and the second developer accommodating section 54Y while being stirred by the two developer conveying screws 55Y. The developer G in the first developer accommodating section 53Y is supplied to and borne on the surface of the sleeve of the developing roller 51Y due to a magnetic field generated by the magnet roller in the developing roller 51Y while the developer G is being conveyed by one of the developer conveying screws 55Y. The sleeve of the developing roller 51Y rotates counterclockwise as indicated by an arrow in FIG. 3, and the developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field generated on the developing roller 51Y.

The developer G borne on the developing roller 51Y is conveyed in the arrow direction in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section, and then conveyed to a development area facing the photoconductor 41Y. In the development area, the toner in the developer G adheres to the latent image formed on the photoconductor 41Y by a developing electric field generated between the developing roller 51Y and the photoconductor 41Y. The developer G remaining on the surface of the developing roller 51Y that has passed through the development area reaches the upper side of the first developer accommodating section 53Y along with the rotation of the sleeve. At this position, the developer G is separated from the developing roller 51Y.

The developer G in the developing device 50Y is adjusted so that the toner density falls within a predetermined range. Specifically, toner contained in the toner container 32Y is replenished to the second developer accommodating section 54Y by the toner replenishing device 60Y (to be described later) in accordance with the amount of toner consumed from the developer G in the developing device 50Y through the development. The toner replenished to the second developer accommodating section 54Y circulates between the first developer accommodating section 53Y and the second developer accommodating section 54Y while being mixed and stirred with the developer G by the two developer conveying screws 55Y.

Next, the toner replenishing device 60 (Y, M, C, K) will be explained.

Figure 4:
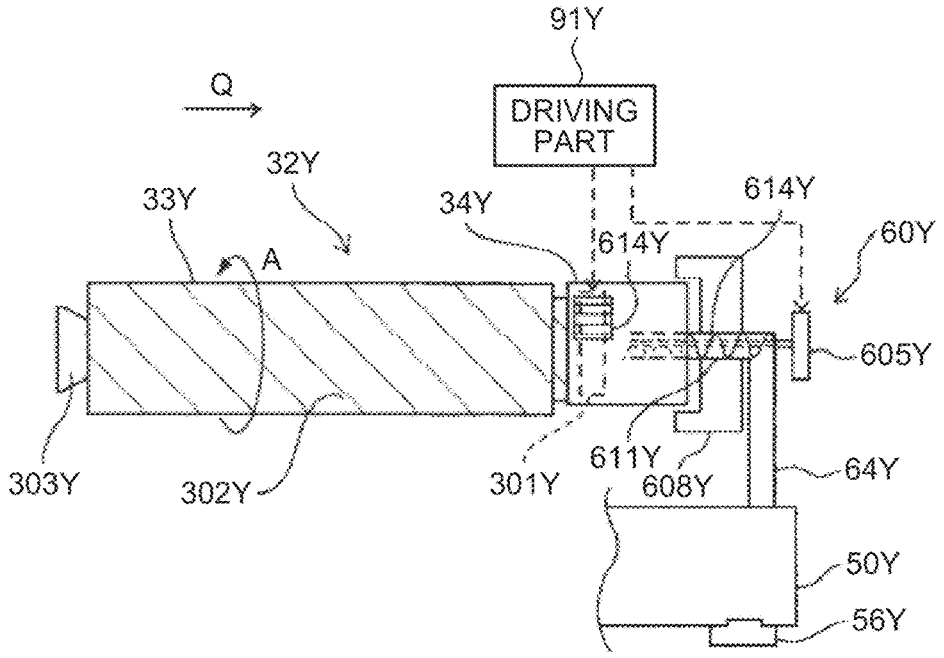
FIG. 4 is a schematic diagram illustrating a state in which the powder container is attached to the powder replenishing device of the image forming apparatus illustrated in FIG. 2.
Figure 5:
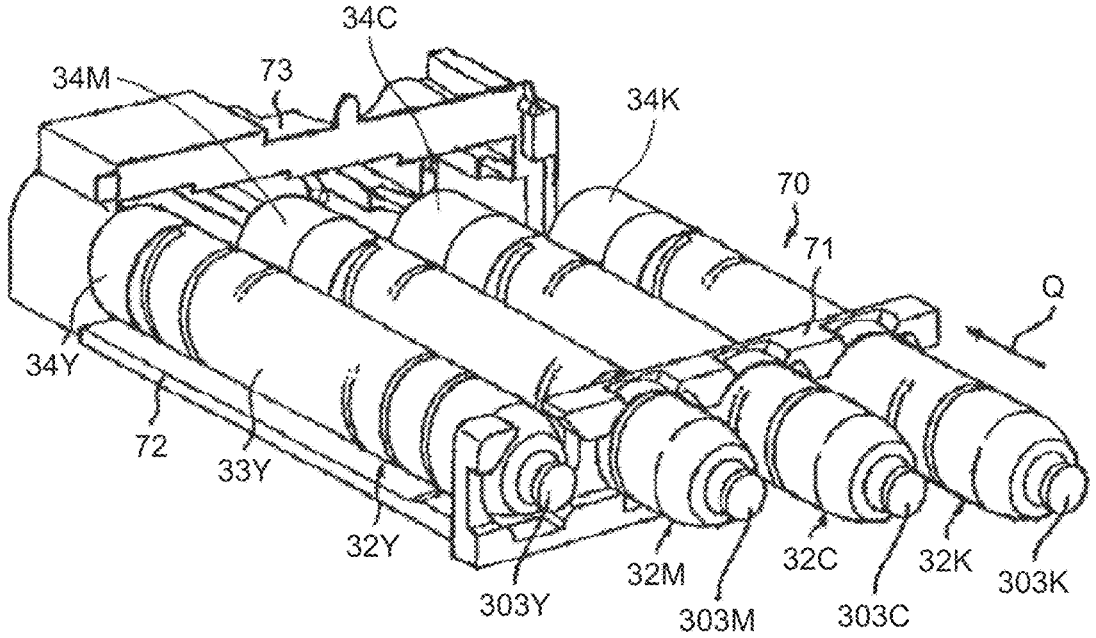
FIG. 5 is a schematic perspective view illustrating a state in which the powder container is attached to a container holding section.

FIG. 4 is a schematic diagram illustrating a state in which the toner container 32Y is attached to the toner replenishing device 60Y. FIG. 5 is a schematic perspective view illustrating a state in which the four toner containers 32 (Y, M, C, K) are attached to the toner container holder 70.

Toner contained in the toner containers 32 (Y, M, C, K) attached to the toner container holder 70 of the printer 100 is appropriately replenished to the developing devices 50 (Y, M, C, K) in accordance with the consumption of toner in the developing devices 50 (Y, M, C, K) fix the respective colors as illustrated in FIG. 4. At this time, the toner in the toner containers 32 (Y, M, C, K) is replenished by the toner replenishing devices 60 (Y, M, C, K) provided for the respective colors.

Figure 27:
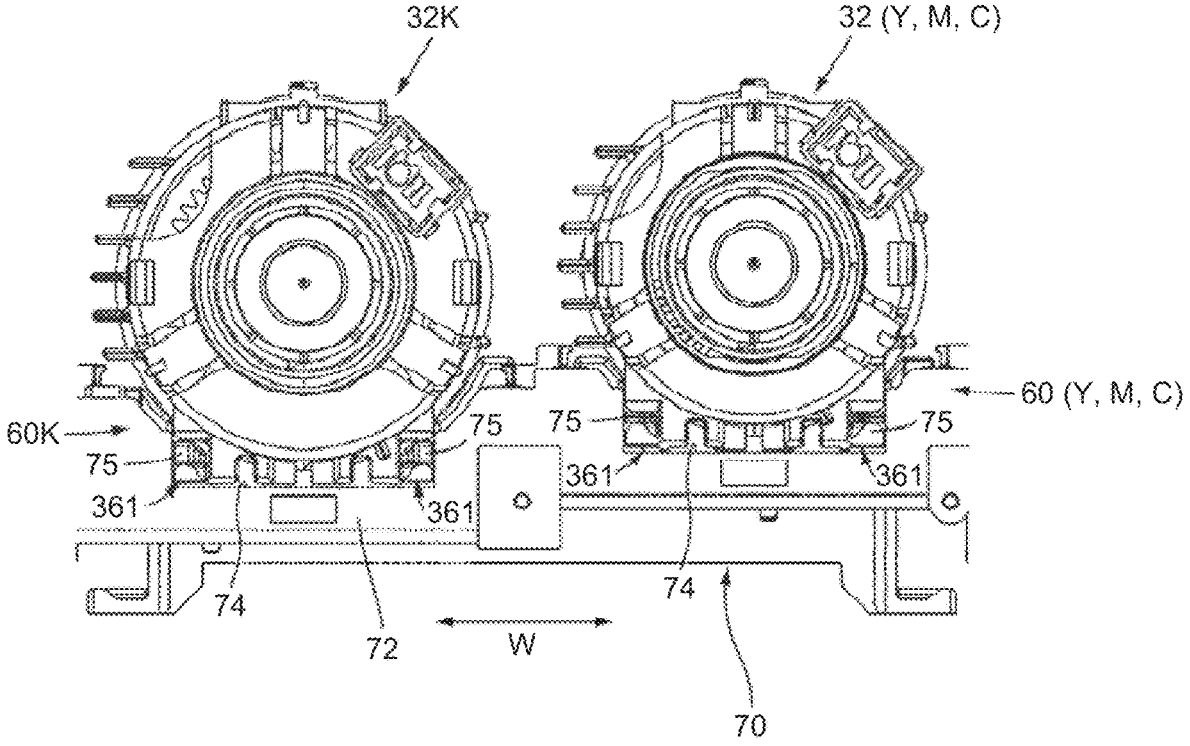
FIG. 27 is an explanatory front view of the container holding sections for black and the colors other than black viewed from the attachment direction.

As illustrated in FIG. 27, among the four toner containers 32 (Y, M, C, K), the size of the toner container 32K containing black toner is different from the sizes of the toner containers 32 (Y, M, C) containing yellow toner, magenta toner, and cyan toner. Specifically, the diameter of the toner container 32K is greater than those of the other toner containers. Therefore, it becomes possible to reduce the frequency of replacement of the toner container 32K containing black toner that is frequently used.

As for the toner replenishing devices 60 (Y, M, C, K), the shape of the toner replenishing device 60K to which the toner container 32K containing black toner is attached is different from the shapes of the toner replenishing devices 60 (Y, M, C) to which the toner containers 32 (Y, M, C) containing yellow toner, magenta toner, and cyan toner are attached, in accordance with the shapes of the toner containers 32.

Incidentally, the toner replenishing devices 60 and the toner containers 32 have almost the same configurations except that the colors of toner to be used in the image forming processes and the diameters of the toner containers 32 are different. Therefore, only the toner replenishing device 60Y and the toner container 32Y for yellow will be explained below, and explanation of the toner replenishing devices 60 (M, C, K) and the toner containers 32 (M, C, K) for the other three colors will be omitted appropriately. In the following, components configured in different manners for different colors may be denoted by symbols Y, M, C, and K indicating the respective colors, and components configured in the same manner for all of the colors and components common to all of the colors may be denoted by a symbol (Y, M, C, K) or may be denoted without symbols.

The toner replenishing device 60 (Y, M, C, K) includes, as illustrated in FIG. 4, the toner container holder 70, a conveying nozzle 611 (Y, M, C, K) serving as a conveying pipe, a conveying screw 614 (Y, M, C, K) serving as an apparatus main-body conveyor, the toner dropping passage 64 (Y, M, C, K), and a container rotating part 91 (Y, M, C, K) serving as a driving part.

When a user performs attachment operation to push the toner container 32Y in the attachment direction indicated by an arrow Q in FIG. 4 and FIG. 5 and the toner container 32Y is moved inside the toner container holder 70 of the printer 100, the conveying nozzle 611Y of the toner replenishing device 60Y is inserted from a front side of the toner container 32Y in the attachment direction along with the attachment operation. Therefore, the toner container 32Y and the conveying nozzle 611Y communicate with each other. A configuration for the communication along with the attachment operation will be described in detail later.

As an example of the toner container, the toner container 32Y is a toner bottle in the form of an approximate cylinder. The toner container 32Y mainly includes a container front end cover 34Y serving as a container cover or a held portion that is non-rotatably held by the toner container holder 70, and includes a container body 33Y serving as a powder storage integrated with a container gear 301Y serving as a gear of the container. The container body 33Y and the container gear 301Y may be integrally provided as a single part or as a couple of separate parts. The container body 33Y is rotatably held by the container front end cover 34Y. In other words, the container cover is a member that can rotate relative to the container gear.

As illustrated in FIG. 5, the toner container holder 70 mainly includes a container cover receiving section 73, a container receiving section 72, and an insertion hole part 71. The container cover receiving section 73 is a section for holding the container front end cover 34Y and the container body 33 of the toner container 32Y. The container receiving section 72 is a section for supporting the container body 33Y of the toner container 32Y. An insertion hole 71*a* serving as an insertion opening used in the attachment operation of the toner container 32Y is defined by the insertion hole part 71. When a main-body cover arranged on the front side of the copier 500 (the front side in the direction normal to the sheet of FIG. 2) is opened, the insertion hole part 71 of the toner container holder 70 is exposed. Then, attachment/detachment operation of each of the toner containers 32 (Y, M, C, K) (attachment/detachment operation with the longitudinal direction of the toner containers 32 taken as an attachment/detachment direction) is performed from the front side of the copier 500 while each of the toner containers 32 (Y, M, C, K) is oriented with its longitudinal direction being parallel to the horizontal direction. Incidentally, a setting cover 608Y in FIG. 4 is a part of the container cover receiving section 73 of the toner container holder 70.

The container receiving section 72 is provided such that its longitudinal length becomes approximately the same as the longitudinal length of the container body 33Y. The container cover receiving section 73 is arranged on a container front side of the container receiving section 72 in the longitudinal direction (attachment direction), and the insertion hole part 71 is arranged on a container rear side of the container receiving section 72 in the longitudinal direction (attachment direction). The four toner containers 32 are able to move on the container receiving section 72 in a sliding manner. Therefore, along with the attachment operation of the toner container 32Y, the container front end cover 34Y first passes through the insertion hole part 71, slides on the container receiving section 72 for a while, and is finally attached to the container cover receiving section 73.

Figure 8:
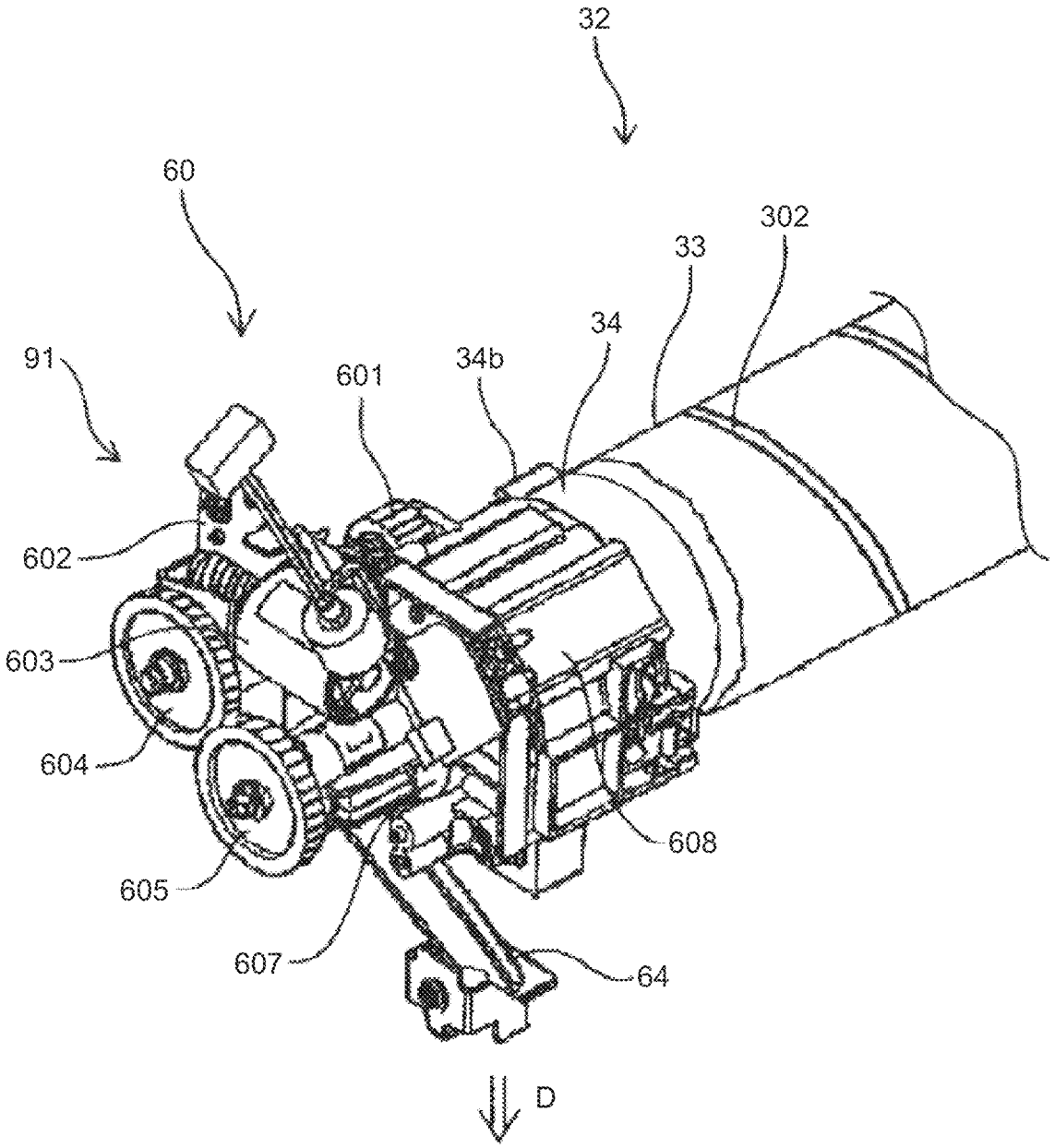
FIG. 8 is an explanatory perspective view of the powder replenishing device to which the powder container is attached and the powder container.
Figure 9:
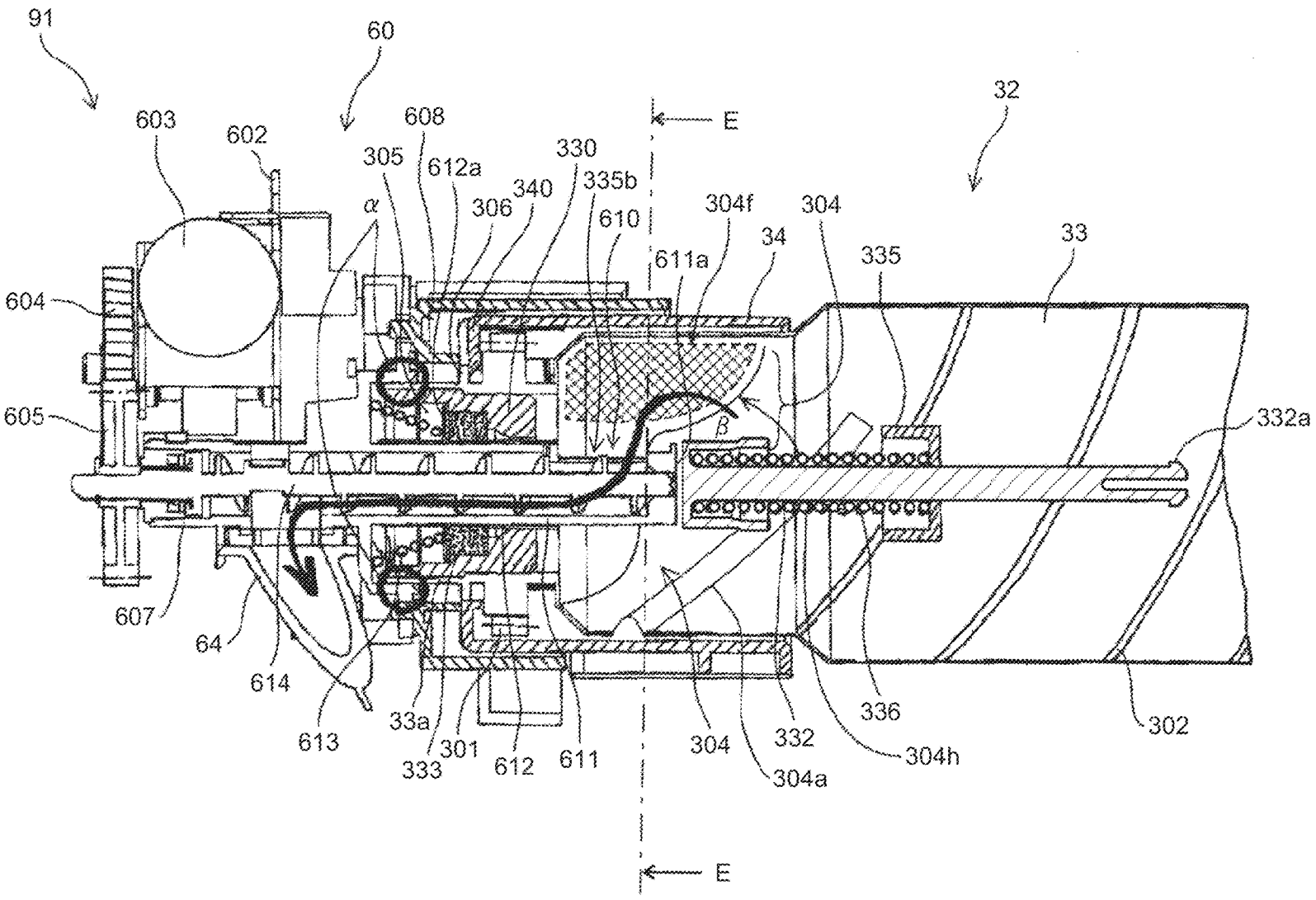
FIG. 9 is an explanatory cross-sectional view of the powder replenishing device to which the powder container is attached and the powder container.

While the container front end cover 34Y is attached to the container cover receiving section 73, the container rotating part (driving part) 91Y including a driving motor, a driving gear, or the like as illustrated in FIG. 4 and FIG. 8 inputs rotation drive to the container gear 301Y (FIG. 10) that is a gear provided in the container body 33Y, via a container driving gear 601Y serving as an apparatus main-body gear. Therefore, the container body 33Y is rotated in the arrow A direction in FIG. 4. With the rotation of the container body 33Y, a spiral groove 302Y serving as a rotary conveyor provided with a spiral shape on the inner surface of the container body 33Y conveys toner stored in the container body 33Y from one end on the left side in FIG. 4 to the other end on the right side in FIG. 4 along the longitudinal direction of the container body. Specifically, in the embodiment, the spiral groove 302Y serves as a rotary conveyor. Consequently, the toner is supplied from the container front end cover 34Y side to the inside of the conveying nozzle 611Y via a nozzle hole 610 serving as a powder receiving hole provided on the conveying nozzle 611Y. As illustrated in FIG. 9, the powder container 32 has a container opening 33*a* (opening portion) on one end in the longitudinal direction thereof. And the nozzle hole 610 communicates with an opening of shutter supporting portion 335*b* serving as a shutter side opening, at an inner position relative to the position where the container gear 301Y is arranged in the longitudinal direction of the container body 33 in a state in which the toner container 32 is attached to the main body of the image forming apparatus. Specifically, a position at which the container gear 301Y meshes with the container driving gear 601Y is closer to the container opening 33*a* than the position where the nozzle hole 610 and the opening of shutter supporting portion 335*b* communicate with each other in the longitudinal direction of the toner container 32. And the container gear 301Y is positioned on one end side (an opening side) relative to the nozzle hole 610. More specifically, the container gear 301 meshes with the container driving gear 601 at the position where a distance between the opening 33*a* and the container gear 301 is shorter than a distance between the opening of shutter supporting portion 335*b* and the nozzle hole 610. That is, in a state in which toner container 32 is attached to the image forming apparatus, the container gear 301Y is positioned between the container opening 33*a* (a front end of container opening 33*c*) and the nozzle hole 610 in the longitudinal direction of the toner container 32.

The conveying screw 614Y is arranged in the conveying nozzle 611Y. When the container rotating part (driving part) 91Y inputs the rotation drive to a conveyor screw gear 605Y, the conveying screw 614Y rotates to convey the toner supplied in the conveying nozzle 611Y. A downstream end of the conveying nozzle 611Y in the conveying direction is connected to the toner dropping passage 64Y. The toner conveyed by the conveying screw 614Y falls along the toner dropping passage 64Y by gravity and is replenished to the developing device 50Y (the second developer accommodating section 54Y).

The toner containers 32 (Y, M, C, K) are replaced with new ones at the end of their lifetimes (when the containers become empty because almost all of the contained toner is consumed). A gripper 303 is arranged on one end of the toner container 32 opposite the container front end cover 34 in the longitudinal direction. When the toner container 32 is to be replaced, an operator can grip the gripper 303 to pull out and detach the attached toner container 32.

Figure 7:
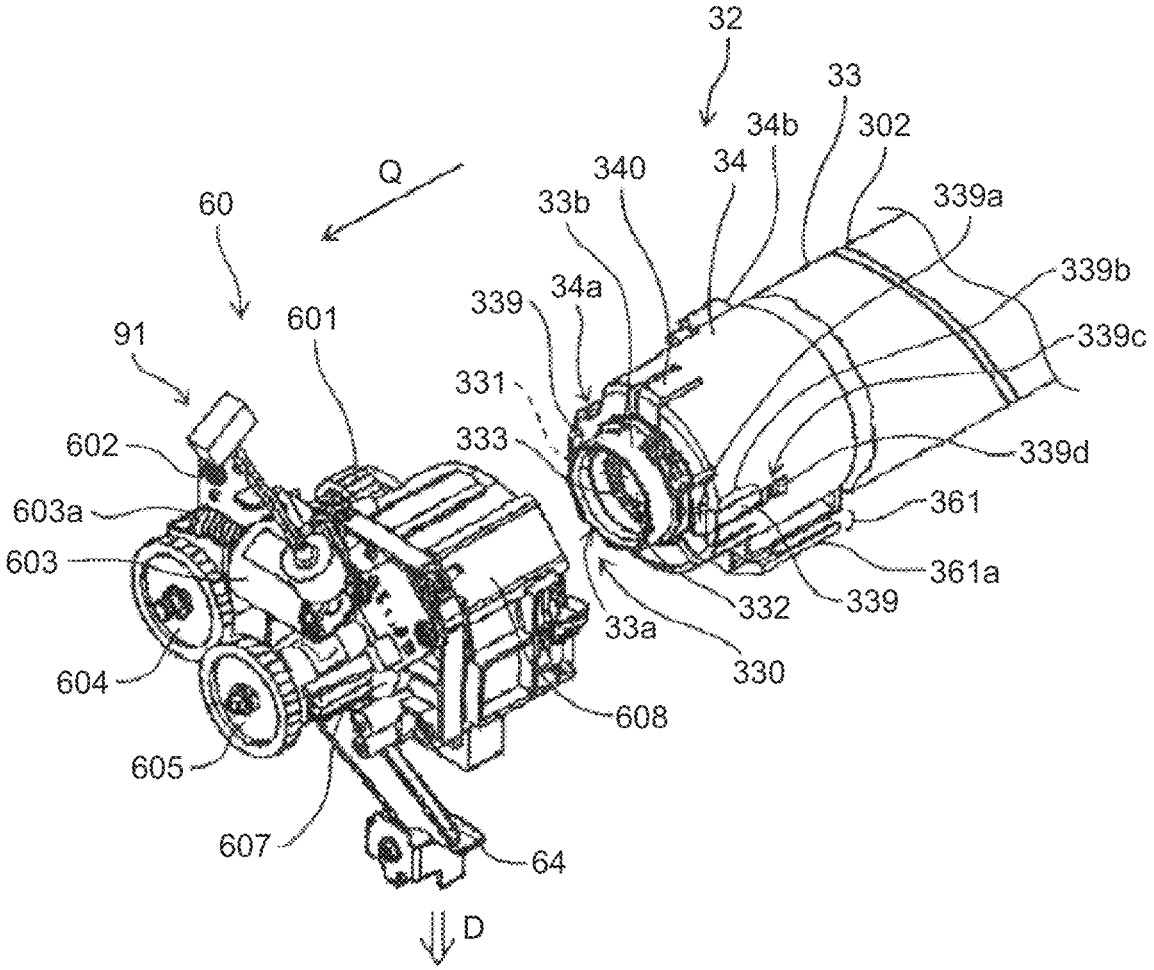
FIG. 7 is an explanatory perspective view of the powder replenishing device before the powder container is attached and the powder container.

The configuration of the container rotating part 91Y will be further explained below. The container rotating part 91Y includes the container driving gear 601Y and the conveyor screw gear 605Y. As illustrated in FIG. 7 and FIG. 8, when a driving motor 603 serving as an apparatus main-body gear fixed to a mounting frame 602 is driven and an output gear 603*a* is rotated, the container driving gear 601Y rotates. The conveyor screw gear 605Y rotates by receiving the rotation of the output gear 603*a* via a coupled gear 604.

The toner replenishing device 60Y controls the amount of toner supplied to the developing device 50Y in accordance with the rotation frequency of the conveying screw 614Y. Therefore, toner that passes through the conveying nozzle 611Y is directly conveyed to the developing device 50Y via the toner dropping passage 64Y without the need to control the amount of toner supplied to the developing device 50Y. Even in the toner replenishing device 60Y configured to insert the conveying nozzle 611Y into the toner container 32Y as described in the embodiment, it may be possible to provide a temporary toner storage, such as a toner hopper.

The toner containers 32 (Y, M, C, K) and the toner replenishing devices 60 (Y, M, C, K) according to the embodiment will be explained in detail below. As described above, the toner containers 32 (Y, M, C, K) and the toner replenishing devices 60 (Y, M, C, K) have almost the same configurations except that the colors of toner to be used are different. Therefore, in the following explanation, symbols Y, M, C, and K representing the colors of toner will be omitted.

Figure 1:
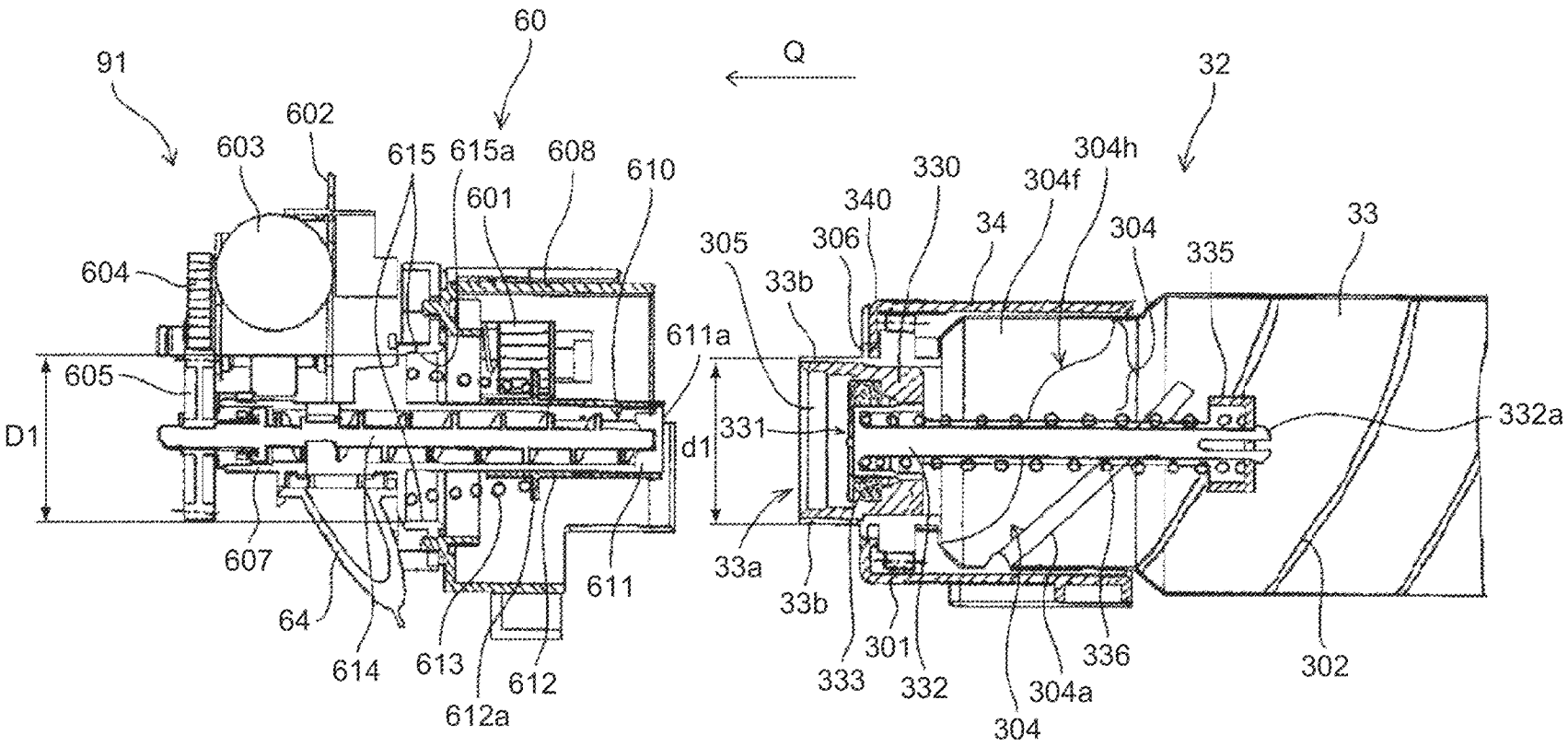
FIG. 1 is an explanatory cross-sectional view of a powder replenishing device before a powder container according to embodiments of the present invention is attached and the powder container.
Figure 6:
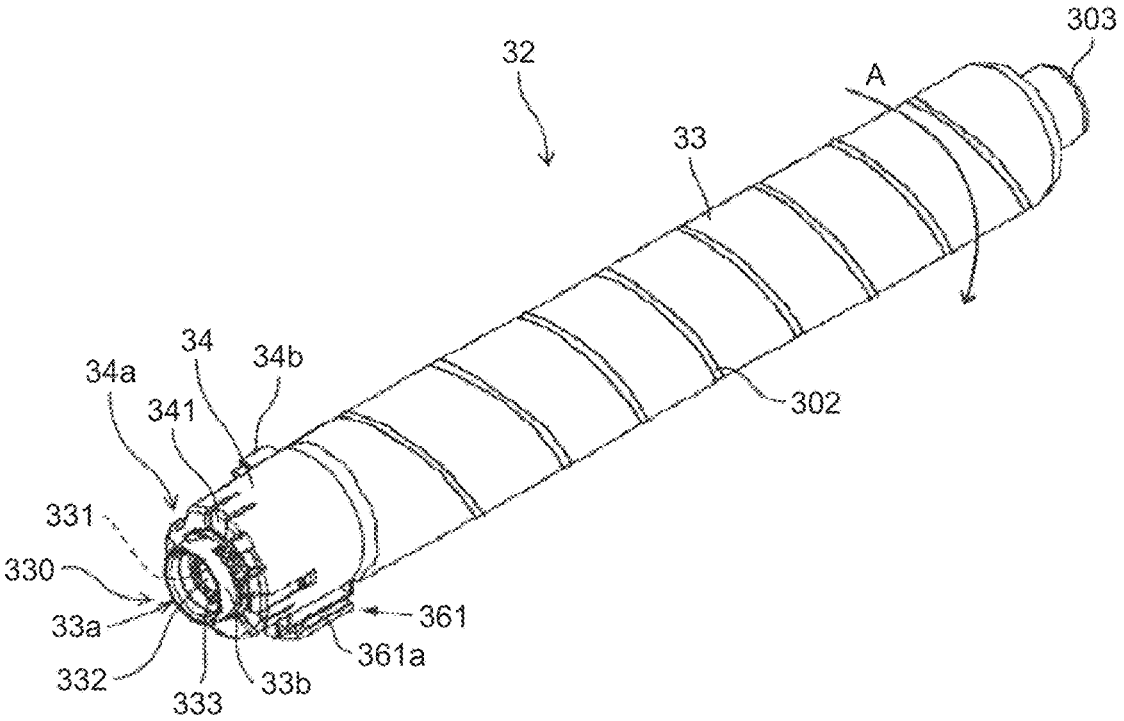
FIG. 6 is an explanatory perspective view illustrating a configuration of the powder container according to the present embodiments of the present invention.
Figure 20:
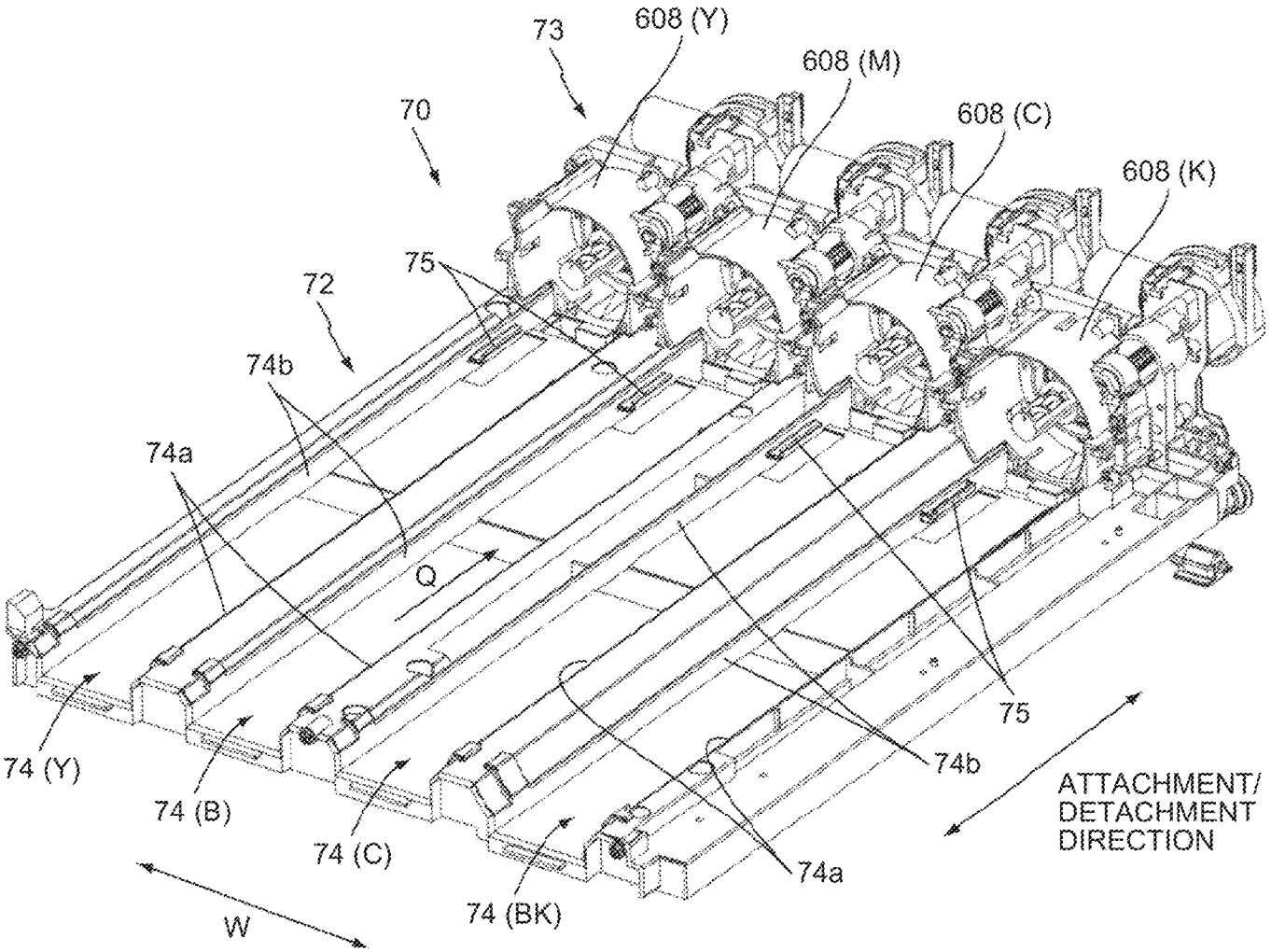
FIG. 20 is an explanatory perspective view of the container holding section according to first to third embodiments.
Figure 21A:
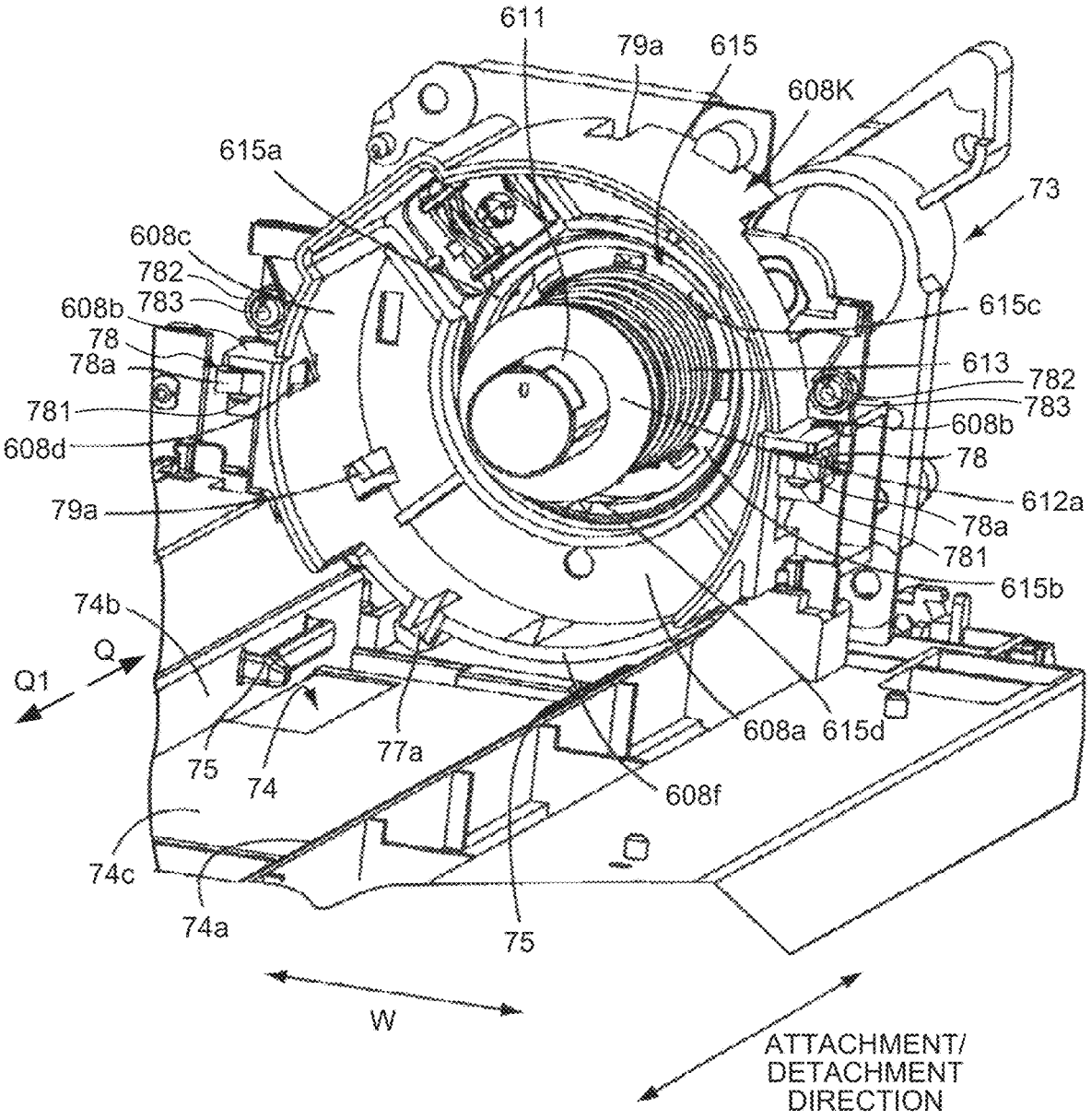
FIG. 21A is a partially-enlarged perspective view for explaining a container holding section for black according to the first to fifth embodiments.
Figure 21B:
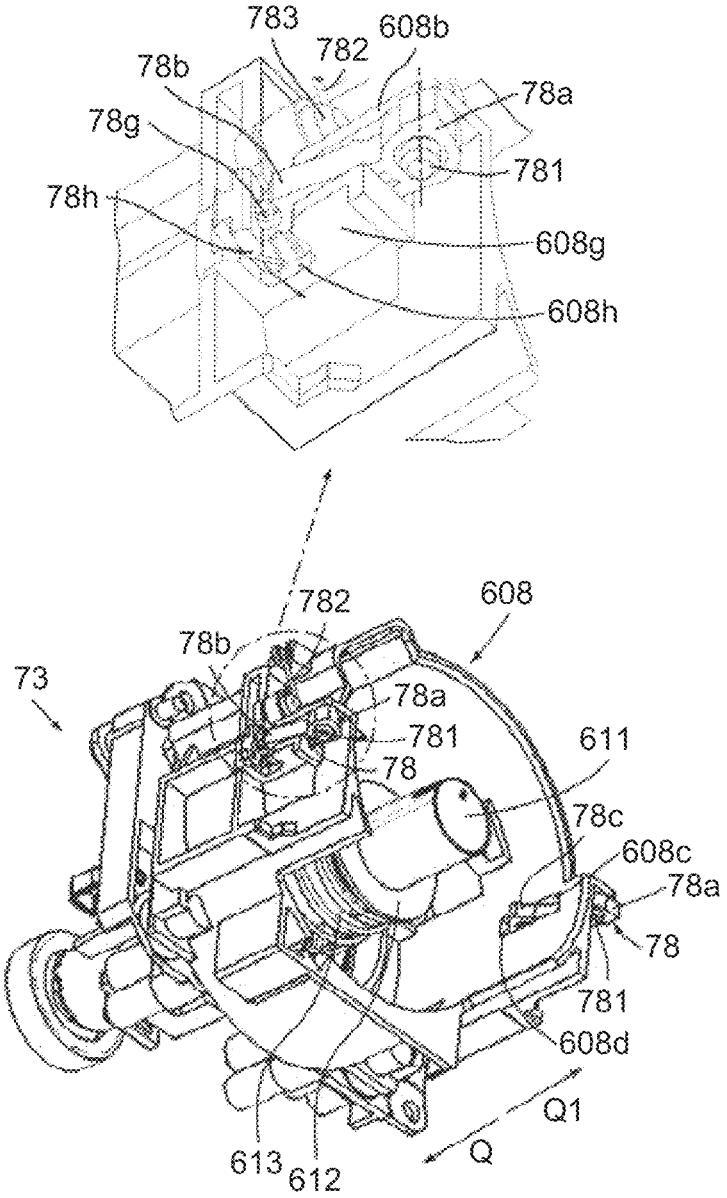
FIG. 21B is an explanatory perspective view of a container cover receiving section viewed obliquely from below and a configuration near replenishing device engaging members.

FIG. 1 is an explanatory cross-sectional view of the toner replenishing device 60 before the toner container 32 is attached and a front end of the toner container 32. FIG. 9 is an explanatory cross-sectional view of the toner replenishing device 60 to which the toner container 32 is attached and the front end of the toner container 32. FIG. 6 is an explanatory perspective view of the toner container 32. FIG. 7 is an explanatory perspective view of the toner replenishing device 60 before the toner container 32 is attached and the front end of the toner container 32. FIG. 8 is an explanatory perspective view of the toner replenishing device 60 to which the toner container 32 is attached and the front end of the toner container 32. FIG. 20 is an explanatory perspective view illustrating the configuration of the toner container holder 70 of the toner replenishing device 60. FIGS. 21A and 21B are explanatory perspective views illustrating the configuration of the container cover receiving section 73.

The toner replenishing device 60 includes the conveying nozzle 611 inside which the conveying screw 614 is arranged, and also includes a nozzle shutter 612 serving as a nozzle opening/closing member. The nozzle shutter 612 is slidably mounted on the outer surface of the conveying nozzle 611 so as to close the nozzle hole 610 at the time of detachment, which is before the toner container 32 is attached (in the states in FIG. 1 and FIG. 7), and to open the nozzle hole 610 at the time of attachment, which is when the toner container 32 is attached (in the states in FIG. 8 and FIG. 9). The nozzle shutter 612 includes a nozzle shutter flange 612*a* serving as a flange, on the downstream side in the attachment direction relative to an end surface of a nozzle receiver 330 serving as a conveyor receiver (to be described later) that comes in contact with the conveying nozzle 611.

Meanwhile, a receiving opening 331, which serves as a nozzle insertion opening into which the conveying nozzle 611 is inserted at the time of attachment, is provided in the center of the front end of the toner container 32, and a container shutter 332, which serves as an opening/closing member that closes the receiving opening 331 at the time of detachment, is provided.

Figure 22:
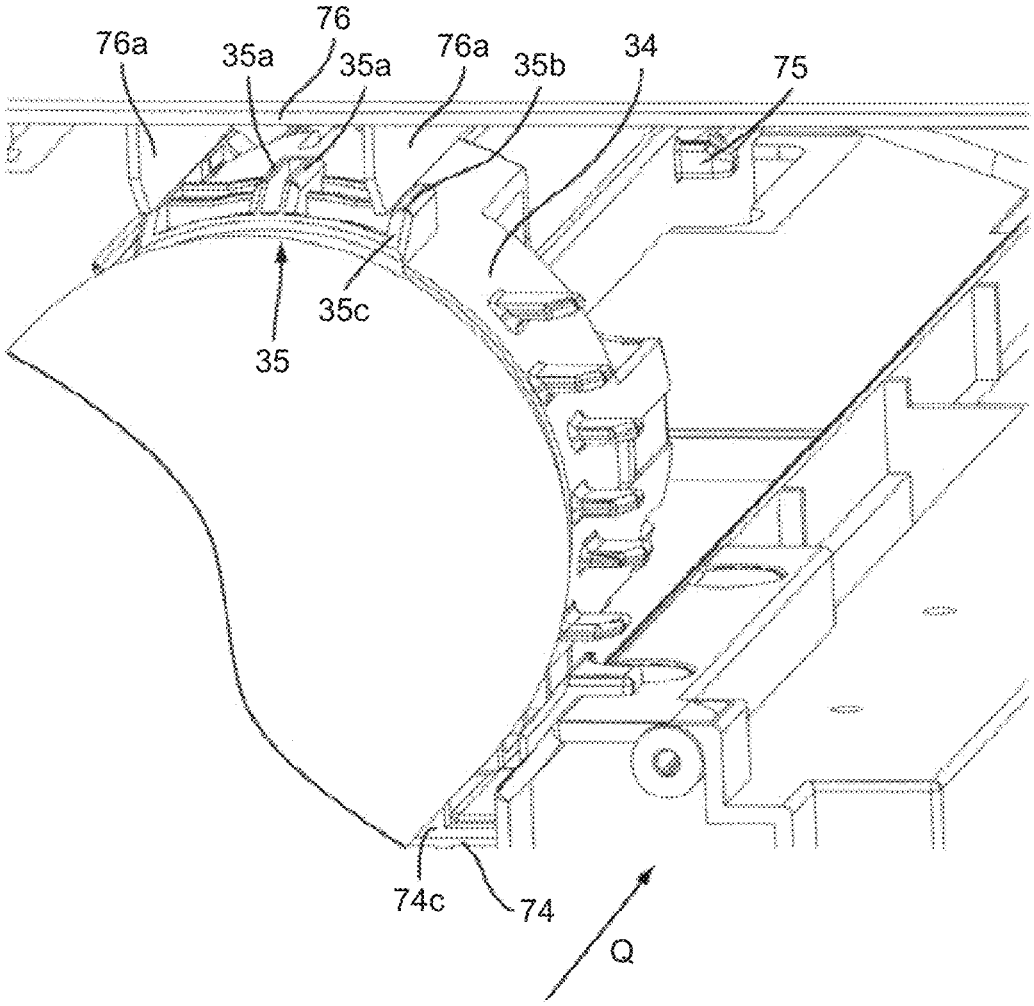
FIG. 22 is an explanatory perspective view illustrating configurations of an upper part of the container holding section and an upper portion of the powder container according to the first to the fifth embodiments.

The toner container holder 70 includes the container receiving section 72 that enables the toner container 32 to slide and move when the toner container 32 is attached to the toner replenishing device 60. As illustrated in FIG. 5 and FIG. 20, the container receiving section 72 is divided into four sections in a width direction W perpendicular to the longitudinal direction of the toner container 32 (attachment/detachment direction), and gutters 74 are provided that serve as container mounting sections extending from the insertion hole part 71 to the container cover receiving section 73 along the longitudinal direction of the container body 33. The toner containers 32 (Y, M, C, K) for the respective colors are able to move on the gutters 74 in a sliding manner in the longitudinal direction. As illustrated in FIG. 22, on a ceiling surface 76 that is an opposite surface of a mounting surface 74*c* of the gutter 74, two projections 76*a* and 76*a* are provided so as to project from the ceiling surface 76 toward the gutter 74 and so as to extend along the longitudinal direction of the gutter 74, and come in contact with an upward guide 35 provided in the upper portion of the toner container 32 when the toner container 32 (Y, M, C, K) slides and moves on the gutter 74.

On side surfaces 74*a* and 74*b* of the gutter 74, which are opposite surfaces arranged in the width direction W, guide rails 75 and 75 are arranged so as to face each other. The guide rails 75 protrude in the width direction W from the respective side surfaces 74*a* and 74*b*, extend in the longitudinal direction, and are arranged in front of the container cover receiving section 73. The guide rails 75 and 75 have functions to guide the container opening 33*a* serving as the opening to a container setting section 615 serving as a container receiving section by being fitted to sliding guides 361, which serve as guiding portions, vertical restrictors, vertical regulators, vertical positioners, or vertical guides, when the toner container 32 is attached to the main body of the image forming apparatus.

Figure 28:
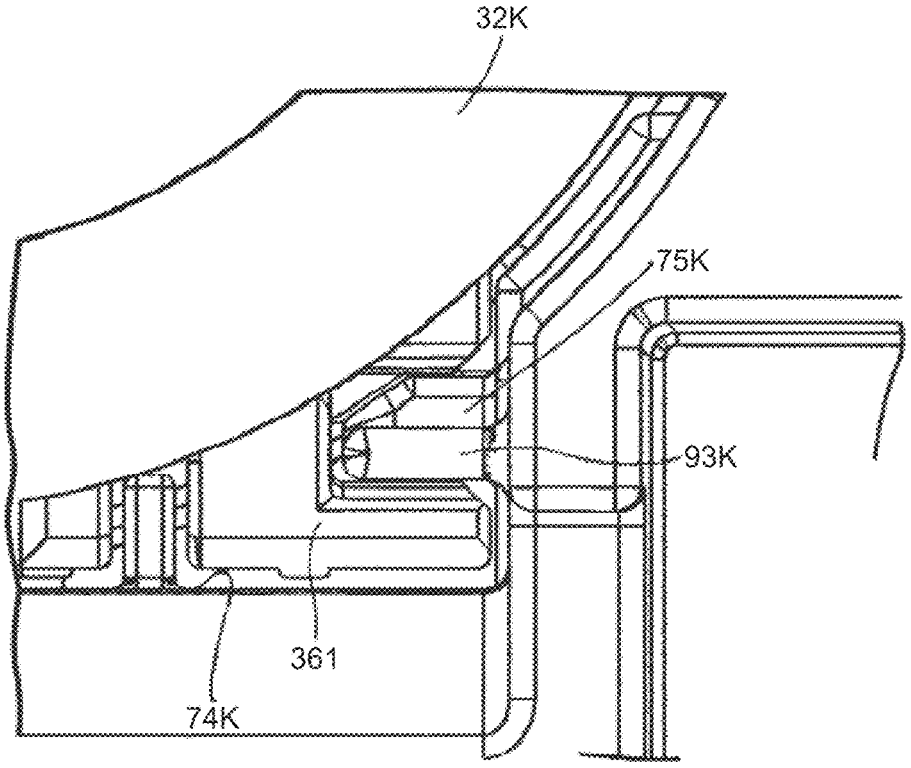
FIG. 28 is a partially-enlarged view illustrating a fitted state of a guiding part arranged on the container holding section and a guiding portion of a held portion of the powder container.
Figure 56:
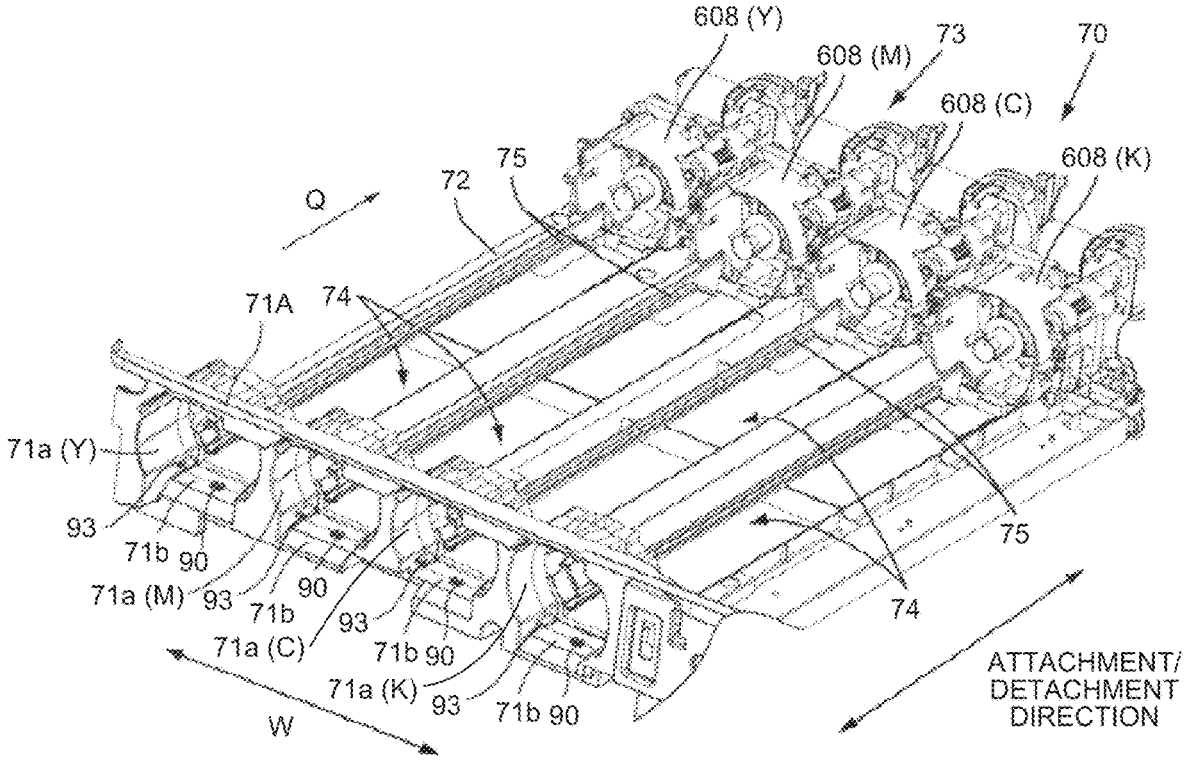
FIG. 56 is an explanatory perspective view illustrating a configuration of the container holding section including a guiding part having a different configuration.

Incidentally, as illustrated in FIG. 56, each of the guide rails 75 may be extended to the vicinity of the insertion hole part 71 in the longitudinal direction. Each of the guide rails 75 is provided so as to be parallel to the rotation axis of the container body 33 when the toner container 32 is attached to the toner replenishing device 60. As illustrated in FIG. 27 and FIG. 28, the guide rails 75 are provided such that the lengths of the guide rails 75K in the height direction on the gutter 74K to which the toner container 32K is attached differ from the lengths of the guide rails 75 (Y, M, C) in the height direction on the respective gutters 74 (Y, M, C) to which the toner containers 32 (Y, M, C) are attached. In particular, the lengths of the guide rails 75K in the height direction are longer than the lengths of the guide rails 75 (Y, M, C) in the height direction. Meanwhile, the diameters of the toner containers 32 (Y, M, C) are smaller than the diameter of the toner container 32K; therefore, even when any of the toner containers 32 (Y, M, C) is inserted in the gutter 74K, a load due to the insertion operation is small and the toner container may be attached to a wrong position. However, because the lengths of the guide rails 75K in the height direction are longer than the lengths of the guide rails 75 (Y, M, C) in the height direction, if any of the toner containers 32 (Y, M, C) is mounted on the gutter 74K, the sliding guides 361 (to be described later) of the toner container 32 (Y, M, C) come in contact with the guide rails 75K during the attachment operation, and therefore, the movement in the attachment direction is restricted. Therefore, it becomes possible to prevent the toner containers 32 (Y, M, C) from being erroneously attached. Incidentally, only one of the guide rails 75 arranged on one of the side surfaces 74*a* is illustrated in FIG. 20 and FIG. 56.

Figure 23:
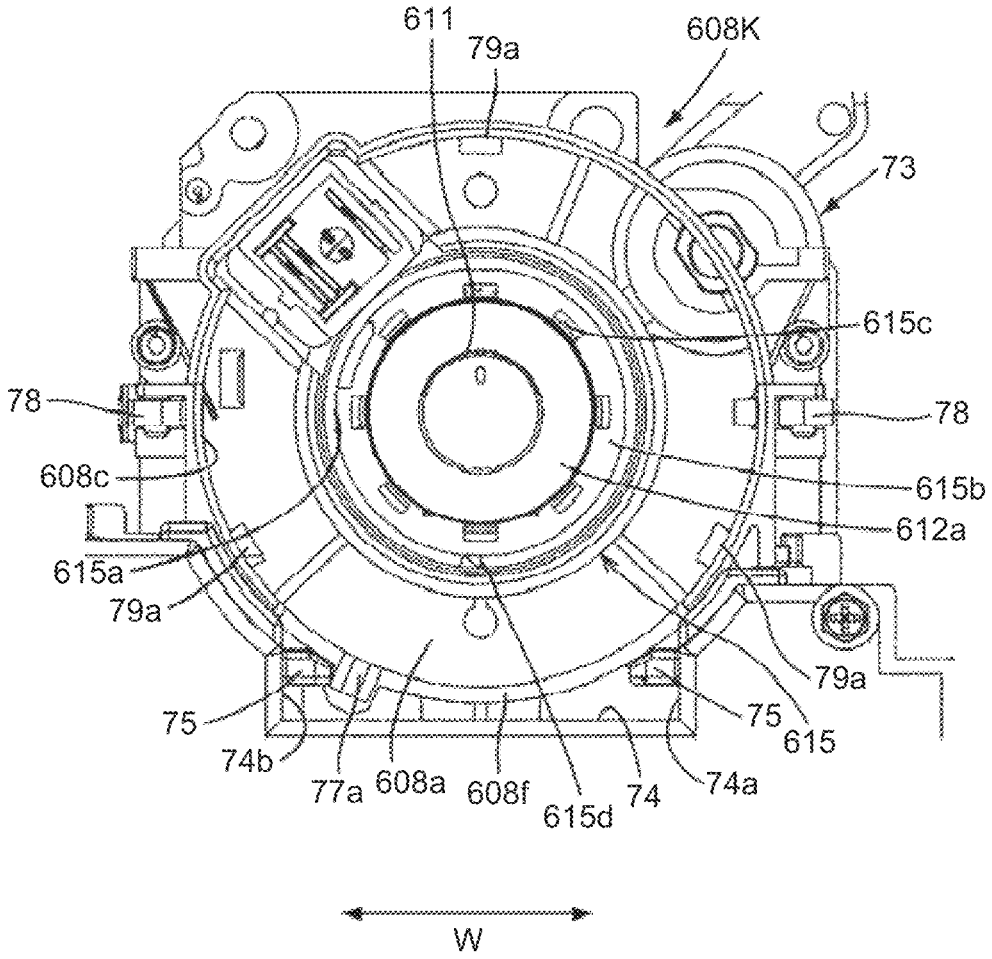
FIG. 23 is an explanatory front view of a container holding section for black viewed from the attachment direction.
Figure 24:
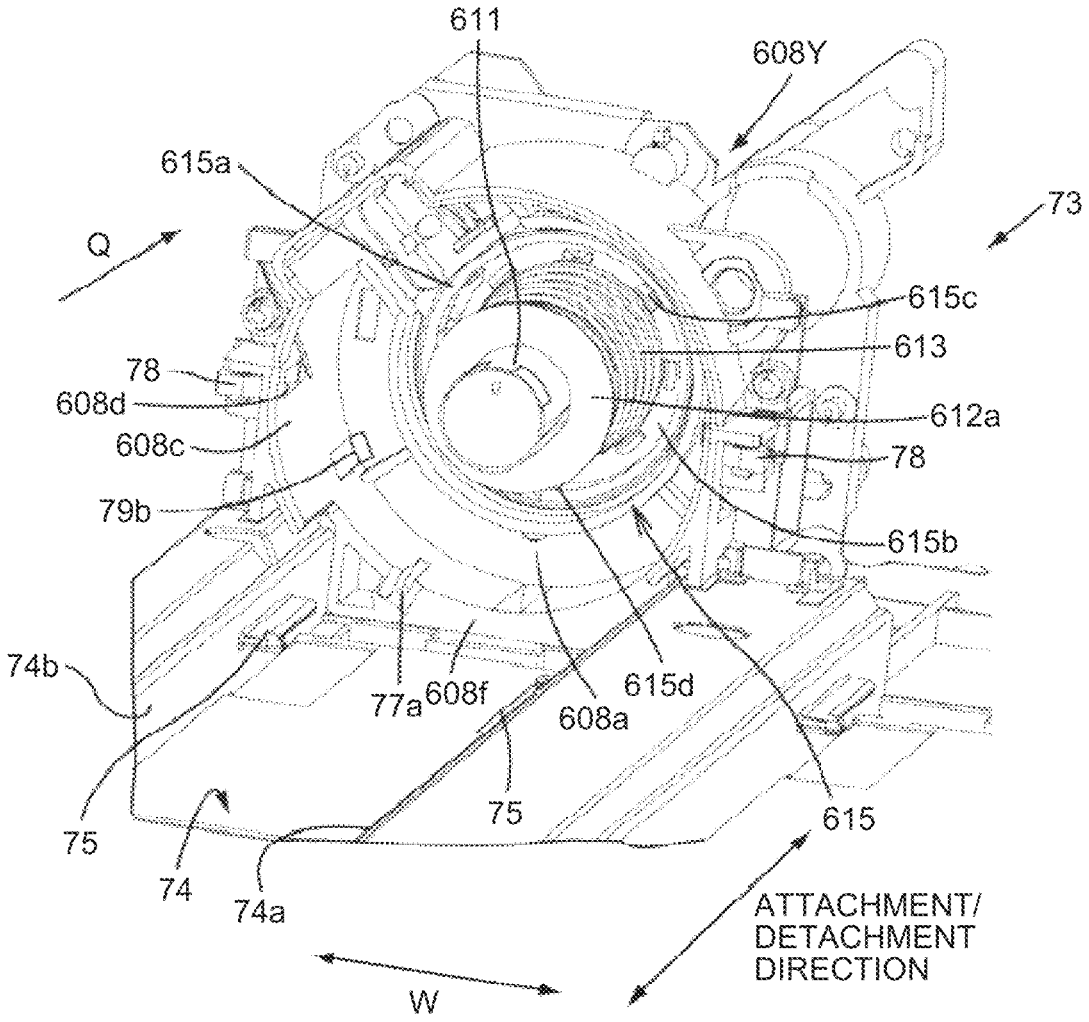
FIG. 24 is a partially-enlarged perspective view for explaining a container holding section for colors other than black according to the first to the fifth embodiments.
Figure 25:
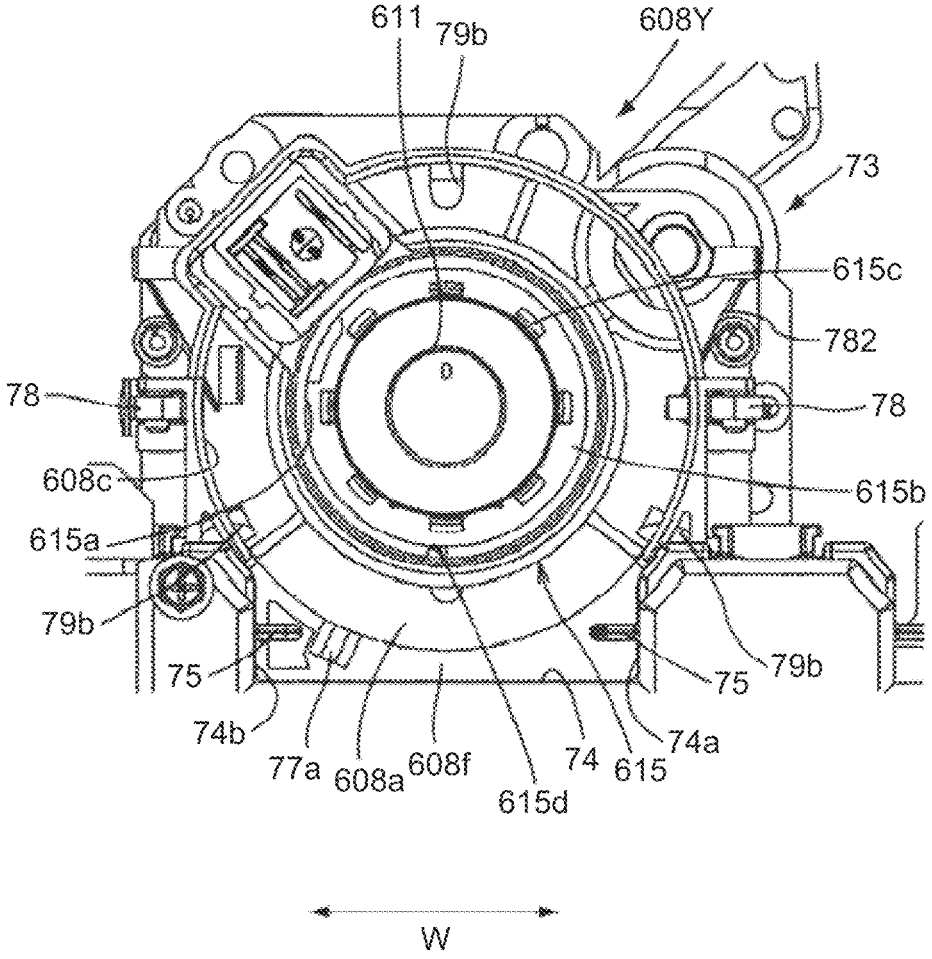
FIG. 25 is an explanatory front view of the container holding section for the colors other than black viewed from the attachment direction.

As illustrated in FIG. 20, setting covers 608 (Y, M, C, K) for the respective colors are arranged on the container cover receiving section 73. The setting covers 608 are provided such that the radial size of the setting cover 608K for black as illustrated in FIG. 21A, FIG. 21B, and FIG. 23 differs from the radial sizes of the setting covers 608 (Y, M, C) for yellow, magenta, and cyan as illustrated in FIG. 24 and FIG. 25, More specifically, the radial size of the setting cover 608K is greater than the radial sizes of the setting covers 608 (Y, M, C). The conveying nozzle 611 is arranged in the center of the setting cover 608. As illustrated in FIGS. 21A and 21B, the conveying nozzle 611 is arranged so as to protrude from an end surface of container setting section 615*b* that is on the inner side in the attachment direction and that serves as a second hack surface of the container setting section 615 located on the downstream side in the attachment direction of the toner container 32, toward the upstream side in the attachment direction inside the container cover receiving section 73. The container setting section 615 serving as the container receiving section is arranged in the protruding direction of the conveying nozzle 611, that is, toward the upstream side in the attachment direction of the toner container 32, so as to surround the conveying nozzle 611. Specifically, the container setting section 615 is arranged at the base of the conveying nozzle 611 and serves as a positioner to determine the position of the container opening 33*a* relative to the toner container holder 70, where the container opening 33*a* functions as a rotational shaft when the conveyor inside the toner container 32 rotates to convey the toner contained in the toner container 32. Namely, when the container opening 33*a* is inserted in and mated to the container setting section 615, the radial position of the container opening 33*a* is determined.

As illustrated in FIG. 21A, FIG. 21B, and FIG. 24, on a part of an inner surface of setting cover 608*c* (first cover inner periphery), in other words, on a part of an inner surface of the container cover receiving section, a groove 77*a*, which has a depth extending in the attachment direction of the toner container 32 from an edge of setting cover 608*f* located on the upstream side in the attachment direction of the toner container 32, is provided as a cut in the radial direction of the setting cover 608. At the base of the conveying nozzle 611 located on the downstream side in the attachment direction relative to the groove 77*a* of the setting cover when viewed from the attachment direction, the container setting section 615 is provided to which the container opening 33*a* (to be described later) is mated when the toner container 32 is attached to the toner replenishing device 60.

Figure 26:
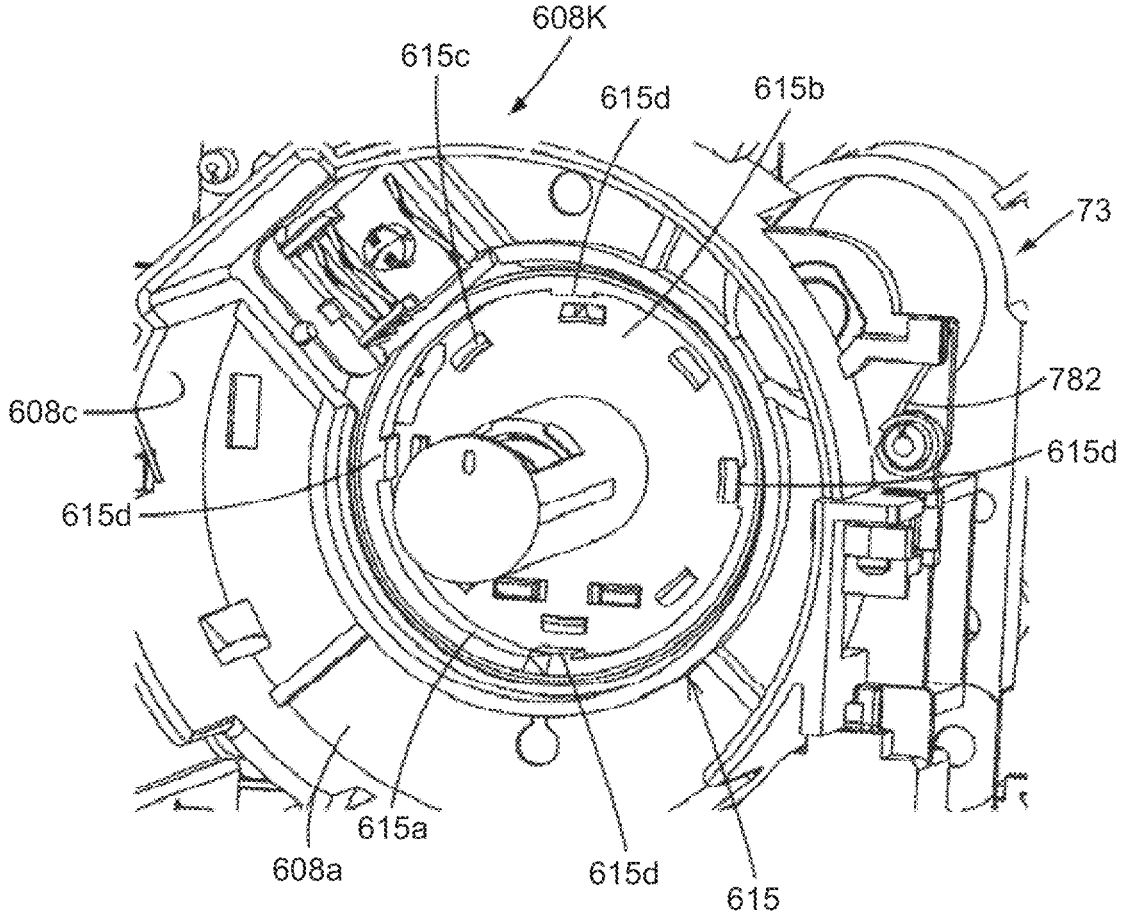
FIG. 26 is a partially-enlarged perspective view for explaining an internal configuration of the container holding section.

The container setting section 615 is located at the base of the conveying nozzle 611, includes an inner surface of container setting section 615*a* in which the container opening 33*a* is inserted, and includes the end surface of container setting section 615*b* on the downstream side in the attachment direction of the toner container 32 relative to the inner surface of container setting section 615*a*. On the end surface of container setting section 615*b*, as illustrated in FIG. 26, spring fixing parts 615*c* protruding from the end surface of container setting section 615*b* to the upstream side in the attachment direction of the toner container 32 are provided at eight evenly-spaced positions along the outer periphery of a nozzle shutter spring 613 serving as a biasing member. In FIG. 23 and FIG. 25, the nozzle shutter spring 613 is omitted to illustrate the shape of the spring fixing parts 615*c*. By placing the spring fixing parts 615*c* so as to cover the outer periphery of the nozzle shutter spring 613, it becomes possible to restrict the radial movement of the nozzle shutter spring 613. Therefore, it becomes possible to prevent the toner container 32 from being set while the nozzle shutter spring 613 is deviated in the radial direction and prevent the nozzle shutter spring 613 from being caught between the end surface of container setting section 615*b* and a front end of the container opening 33*c*, enabling to prevent a failure to attach the toner container 32 to the toner replenishing device 60.

When the toner container 32 is attached to the toner replenishing device 60, an outer surface of container opening 33*b*, which is a part of the container opening 33*a*, is slidably mated to the container setting section 615. On the inner surface of container setting section 615*a*, as illustrated in FIG. 26, contact surfaces 615*d*, which are parts of the inner surface of container setting section 615*a* and which protrude inward in the radial direction from the inner surface of container setting section 615*a*, are provided at four evenly-spaced positions. The contact surfaces 615*d* and the outer surface of container opening 33*b* slide against each other with rotation of the toner container 32. In the present embodiment, the contact surfaces 615*d* have the widths of about 4 millimeters (mm) in the circumferential direction and are provided at four evenly-spaced positions. However, for example, the contact surfaces 615*d* may have the widths of about 6 mm in the circumferential direction at three evenly-spaced positions. If the areas of the contact surfaces 615*d* that come in contact with the outer surface of container opening 33*b* are too large, the sliding resistance against the outer surface of container opening 33*b* increases and a rotational load may be generated. In contrast, if the areas are too small, the contact surfaces 615*d* are rubbed and worn over time due to the sliding against the outer surface of container opening 33*b* and it becomes difficult to perform positioning with accuracy. Therefore, it is preferable to determine the widths and the number of the contact surfaces 615*d* to ensure the contact areas so that the defects as described above can be prevented.

By the mating the inner surface of container setting section 615*a* to the outer surface of container opening 33*b* of the toner container 32. the position of the toner container 32 relative to the toner replenishing device 60 in the radial direction perpendicular to the longitudinal direction of the toner container 32 (the attachment/detachment direction) is determined. In other words, the container opening 33*a* serves as a radial restrictor or radial positioner of the toner container 32 with respect to the toner replenishment device 60. Furthermore, when the toner container 32 rotates, the outer surface of container opening 33*b* functions as a rotational shaft and the inner surface of container setting section 615*a* functions as a bearing. In other words, the container opening 33*a* including the outer surface of container opening 33*b* serves as a rotational shaft of the toner container 32.

Figure 29A:
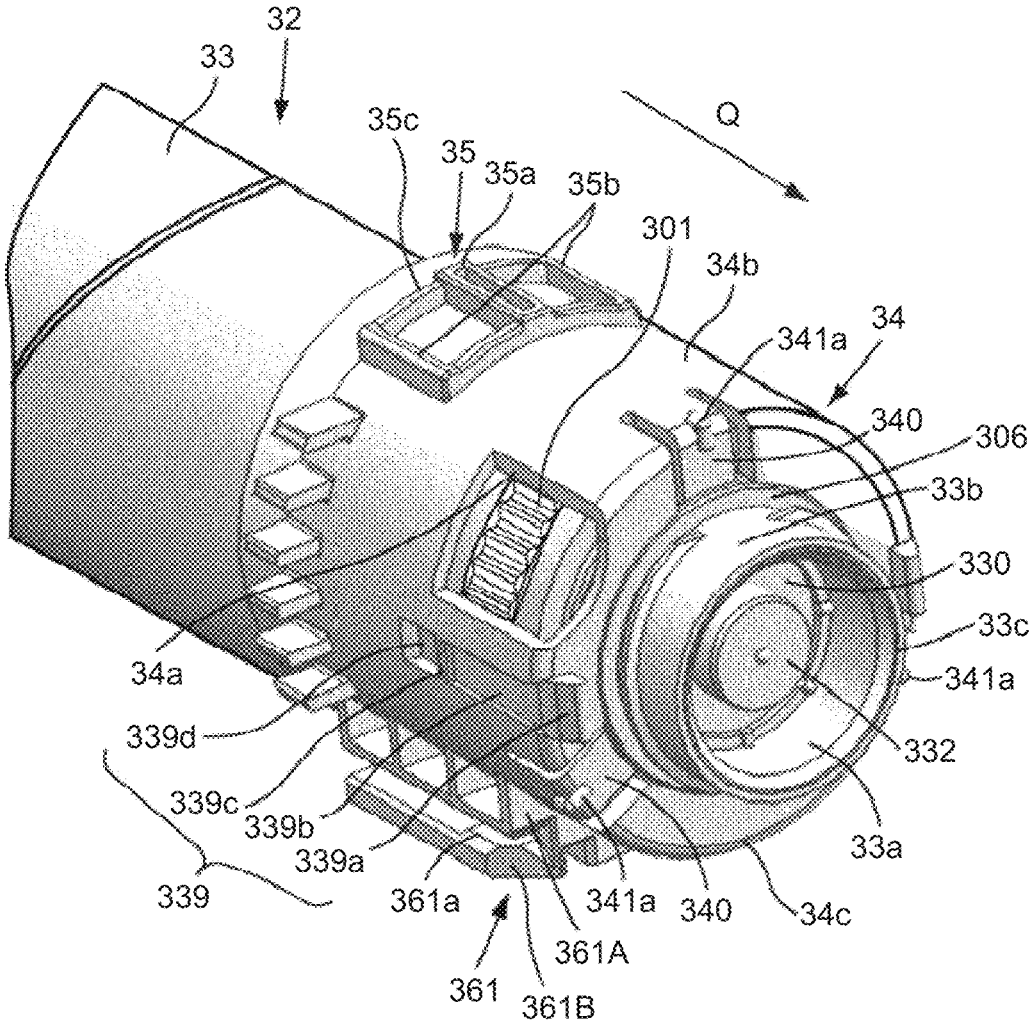
FIG. 29A is an explanatory perspective view of the powder container according to the first embodiment.
Figure 29B:
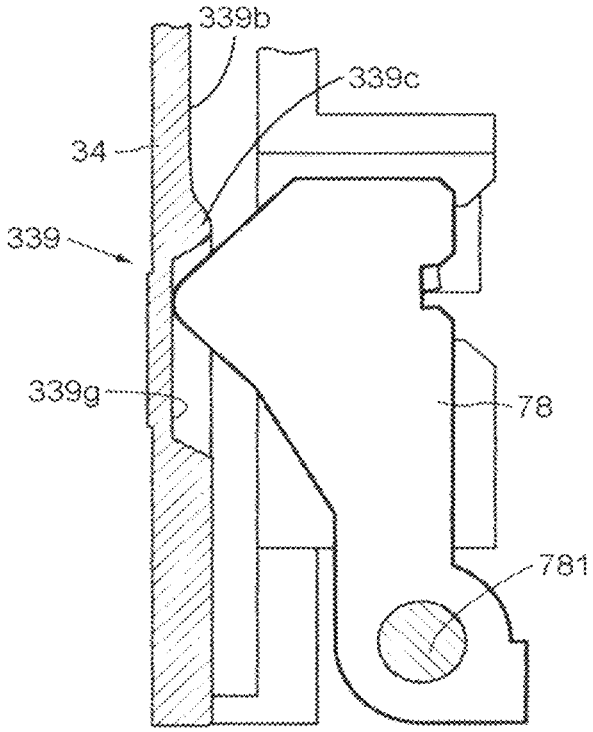
FIG. 29B is a partially-enlarged cross-sectional view of a container engaged portion according to another embodiment.
Figure 29C:
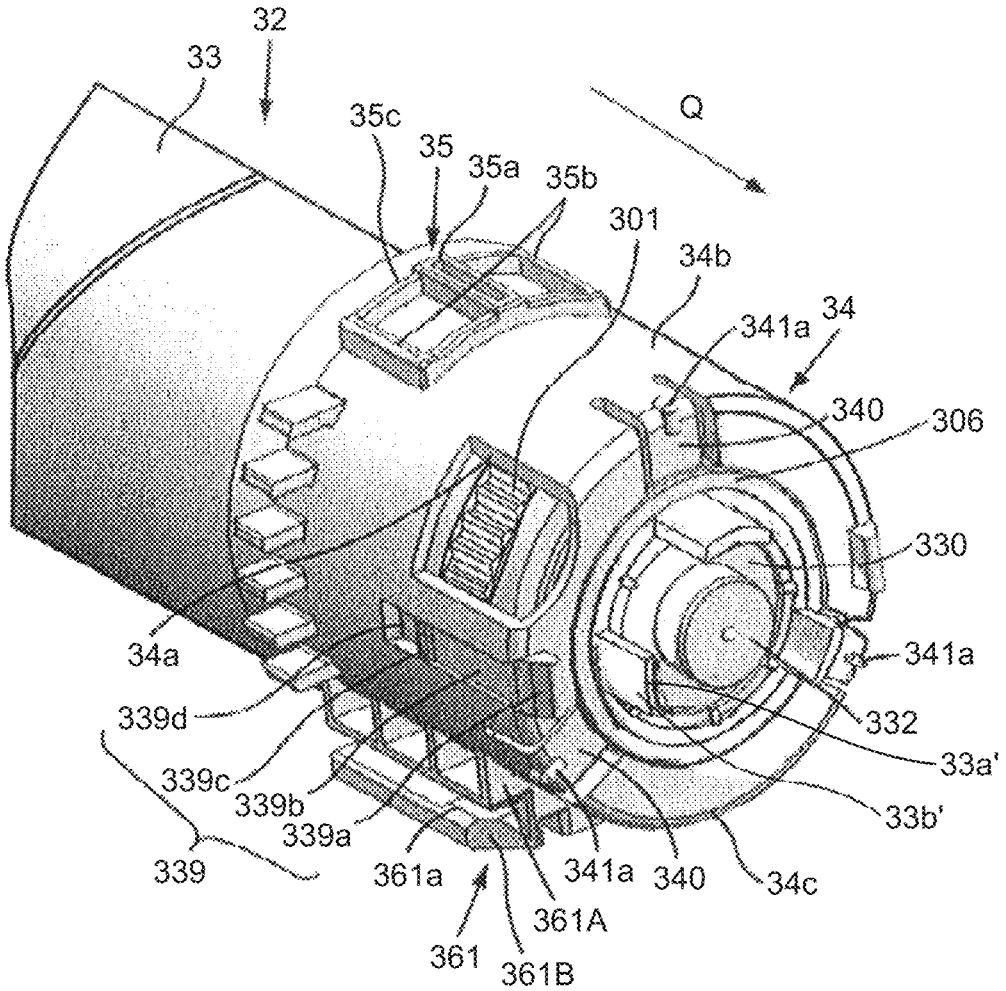
FIG. 29C is a an explanatory perspective view of another example of the powder container according to the first embodiment.

Incidentally, as a method to determine the position of the toner container 32 relative to the container setting section 615, the following method may be employed instead of the method to cause the outer surface of container opening 33*b* to be mated to the inner surface of container setting section 615*a*. For example, as illustrated in FIG. 29C, it may be possible to provide a plurality of protrusions 33*a*' for positioning on the front end of the toner container 32 in the longitudinal direction, and cause outer surfaces 33*b*' of the protrusions 33*a*' for positioning to be mated to the inner surface of container setting section 615*a* to perform positioning. To determine the top, bottom, left, and right positions of the toner container 32, it is preferable to provide at least three protrusions 33*a*' for positioning, in FIG. 29C, the three protrusions 33*a*' for positioning are provided on the container front end so as to extend parallel to the longitudinal direction. Furthermore, the three protrusions 33*a*' for positioning are provided at positions separated by 120 degrees about the center of the nozzle receiver 330 of the toner container 32 (the center of the receiving opening 331 in which the conveying nozzle 611 is inserted). Namely, the shape of the container opening 33*a* is not limited to the continuous cylindrical shape, but may be divided or may be a rod shape as long as the container opening 33*a* functions as a positioner or a rotational shaft of the toner container 32.

In FIG. 9, $\alpha$ indicates the position at which the outer surface of container opening 33*b* comes in sliding contact with the contact surfaces 615*d* as parts of the inner surface of container setting section 615*a* and at which the radial position of the toner container 32 relative to the toner replenishing device 60 is determined at this time.

Incidentally, in the descriptions below, it is repeatedly explained that the container opening 33*a* of the toner container 32 and the container setting section 615 mate with each other in a slidable manner. The mating state is, in a precise sense, a state in which the outer surface of container opening 33*b* of the toner container 32 is in contact with the contact surfaces 615*d* which is a part of the inner surface of container setting section 615*a*. Hereinafter, for simplicity of explanation, the mating will be referred to as mating the outer surface of container opening 33*b* with the inner surface of container setting section 615*a* by omitting the contact surfaces 615*d*.

The container setting section 615 includes, as illustrated in FIG. 1, the inner surface of container setting section 615*a* to be mated to the outer surface of container opening 33*b* of the toner container 32 when the toner container 32 is set. The inner diameter of the inner surface of container setting section 615*a* is denoted by D1. Furthermore, the diameter of the outer surface of container opening 33*b* of the toner container 32 is denoted by d1. To enable the outer surface of container opening 33*b* of the toner container 32 and the inner surface of container setting section 615*a* to be rotatably mated to each other, the diameter d1 of the outer surface of container opening 33*b* of the toner container 32 and the inner diameter D1 of the inner surface of container setting section 615*a* are set such that "d1<D1". Moreover, a mating tolerance between d1 and D1 is set to about "D1−d1=0.01 to 0.1 mm". By ensuring the relationship of "d1<D1", it becomes possible to rotate the toner container 32 while the toner container 32 is held by the setting cover 608, in particular, while the container body 33 is held by the container setting section 615.

As illustrated in FIG. 21A, FIG. 21B, FIG. 24, and FIG. 32, holes 608*d* are provided so as to face each other in the width direction W of the setting cover 608. On the setting cover 608, engaging members 78 and 78, serving as replenishing device engaging members (to be described later), are arranged so as to be able to move back and forth from the outer surface of the setting cover 608 to the inner surface of setting cover 608*c* side via the holes 608*d* and 608*d*. The engaging members 78 and 78 are biased from the outer side to the inner side of the setting cover 608 by biasing means, such as torsion coil springs 782.

Detailed explanations will be given below with reference to FIG. 21B. Each of the engaging members 78 is rotatably supported by the setting cover 608 such that one end 78*a* thereof is inserted in a shaft 781 serving as a fulcrum protruding from a mounting part 608*b* provided on the setting cover 608. On another end 78*b* opposite the one end 78*a* of each of the engaging members 78, a spring press part 78*g* and a rotation stopper 78*h* are provided. Each of the torsion coil springs 782, which serve as a pressing unit and are wound around respective pins 783 provided near the mounting parts 608*b* of the setting cover 608, is fitted to each of the spring press parts 78*g* at one end thereof. A tip part 78*c* of each of the engaging members 78 is pressed and biased so as to protrude inwardly to the inner surface of the setting cover 608 via each of the holes 608*d*.

By the pressing and biasing, each of the rotation stoppers 78*h* is pressed against a setting cover notch 608*h* provided on a supporting part of setting cover 608*g* of the engaging member located below the mounting part 608*b* of the setting cover 608, so that forward and backward movement of each of the engaging members 78 is restricted.

Figure 32:
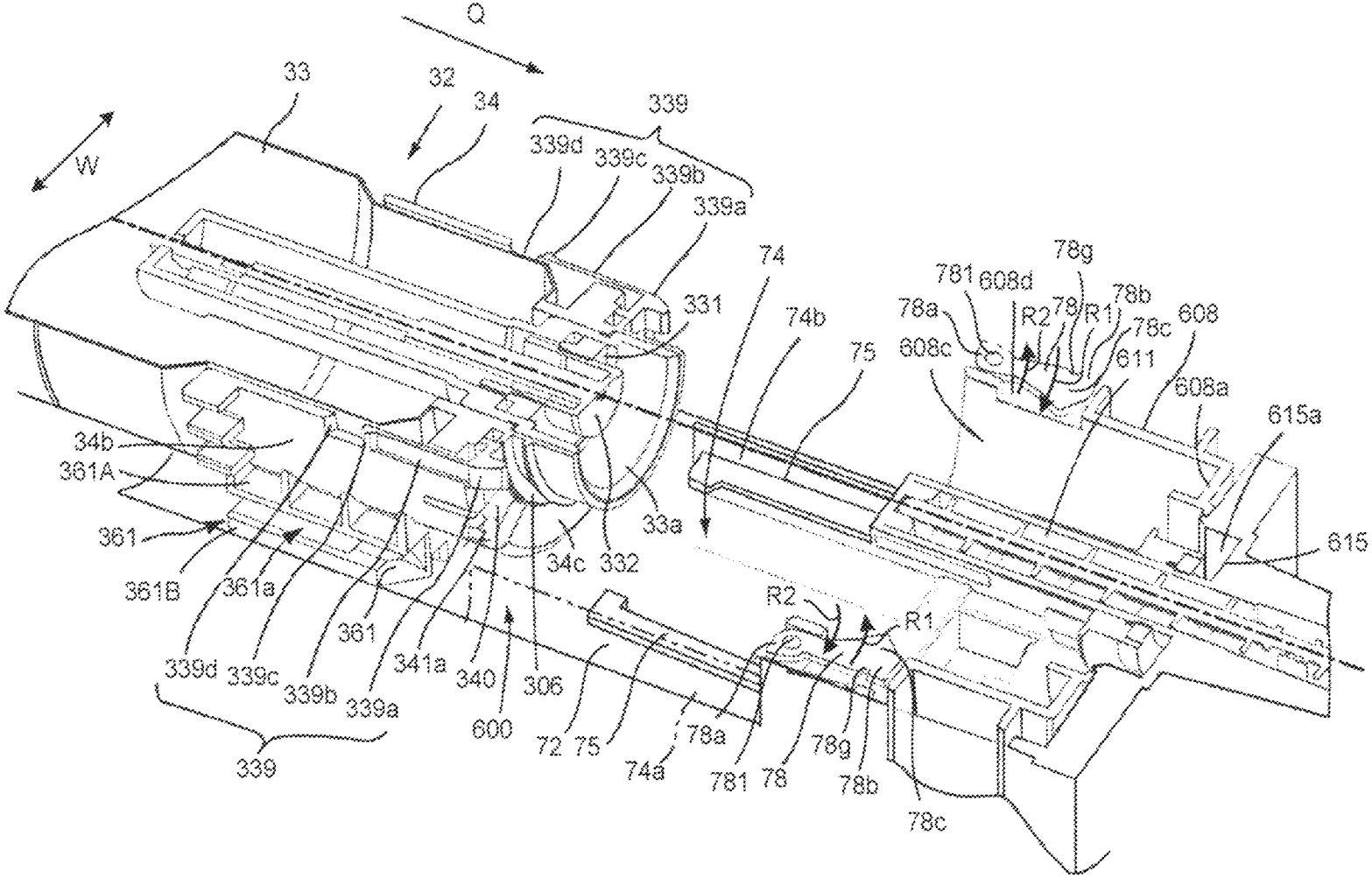
FIG. 32 is a cross-sectional perspective view illustrating a configuration of a positioner serving as the guiding portion.

Incidentally, a direction indicated by R1 in FIG. 32 is a direction in which each of the engaging members 78 protrudes inwardly from the inner surface of the setting cover 608 by being biased by the torsion coil spring 782, and is referred to as an engaging direction (container holding direction). When the engaging members 78 move in the engaging direction R1, the tip parts 78*c* of the engaging members 78 are respectively engaged with engaged openings 339*d* serving as guiding portions, axial restrictors (longitudinal restrictors), axial regulators, axial positioners, or axial guides of container engaged portions 339 of the toner container 32 to be described later, to thereby hold the toner container 32 in the attached state. Furthermore, a direction indicated by R2 in FIG. 32 is a direction in which each of the engaging members 78 is retracted from the inner surface side of the setting cover 608 against the biasing by the torsion coil springs 782, and is referred to as a releasing direction. When the engaging members 78 move in a releasing direction R2, the engagement between the tip parts 78*c* of the engaging members 78 and the engaged openings 339*d* of the container engaged portions 339 is released, so that the toner container 32 can be pulled out in the detachment direction.

Incidentally, each of the tip parts 78*c* includes a mountain-shaped top portion P2 (see FIG. 115 and FIG. 121) that is provided on the opposite side to the spring press part 78*g*. The engaging members 78 are mounted on the setting cover 608 in a bilaterally symmetrical manner.

The setting covers 608 will be explained in detail below.

Regarding the setting covers 608, the shape of the setting cover 608K to which the toner container 32K is attached differs from the shapes of the setting covers 608 (Y, M, C) to which the toner containers 32 (Y, M, C) are attached. As illustrated in FIG. 23, the setting cover 608K includes through holes 79*a* at three evenly-spaced positions on a corner portion (bent portion) between a recess surface 608*a* serving as a first back surface on the inner side in the attachment direction and the inner surface of setting cover 608*c*. In contrast, as illustrated in FIG. 25, each of the setting covers 608 (Y, M, C) includes L-shaped recesses 79*b* on the corner portion between the recess surface 608*a* and the inner surface of setting cover 608*c*, but no hole is provided on the corner portion. Incidentally, it may be possible to provide recesses on the setting cover 608K or to provide through holes on the setting covers (Y, M, C). However, in the present embodiment, the recesses are provided on the setting covers 608 (Y, M, C) to ensure the strength of the setting covers 608 (Y, M, C).

The toner container 32 will be explained below.

Figure 10:
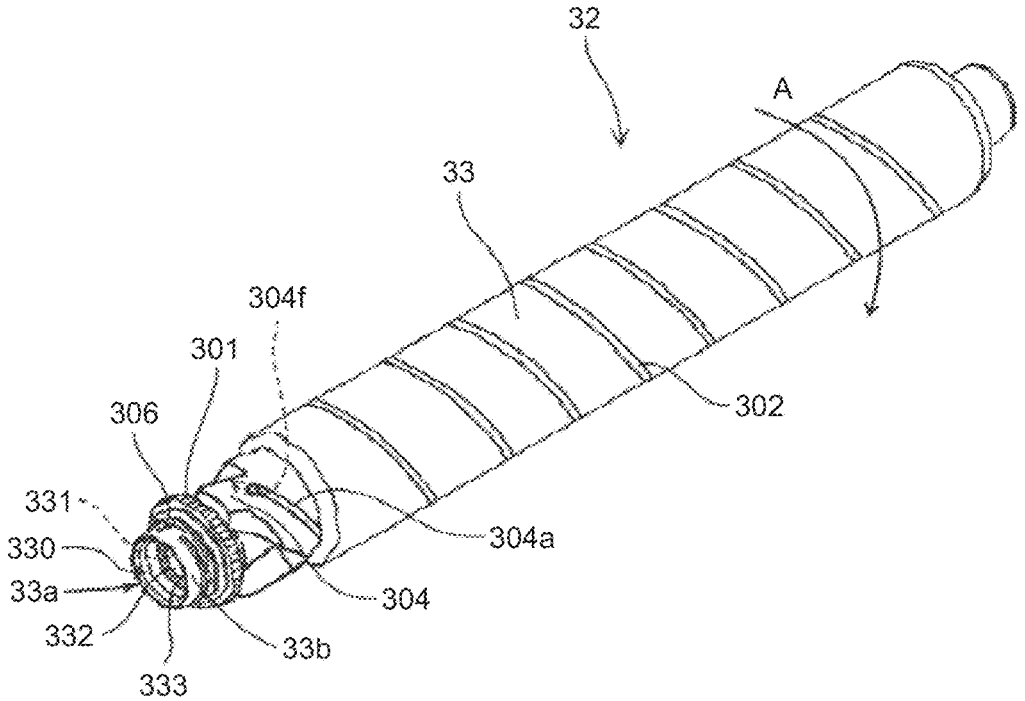
FIG. 10 is an explanatory perspective view of the powder container when a container front end cover is detached.

As described above, the toner container 32 mainly includes the container body 33 containing toner and includes the container front end cover 34. FIG. 10 is an explanatory perspective view of the toner container 32 when the container front end cover 34 is detached from the state illustrated in FIG. 6.

Figure 11:
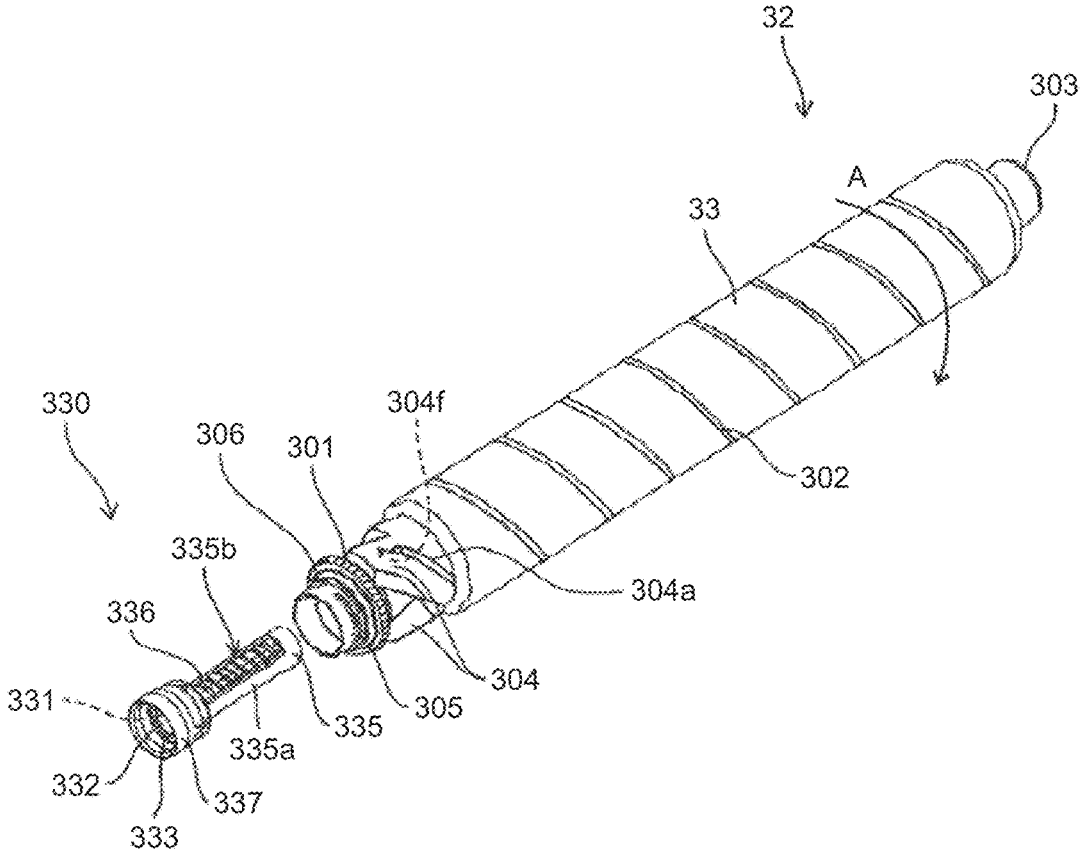
FIG. 11 is an explanatory perspective view of the powder container when a nozzle receiver is detached from a container body.
Figure 12:
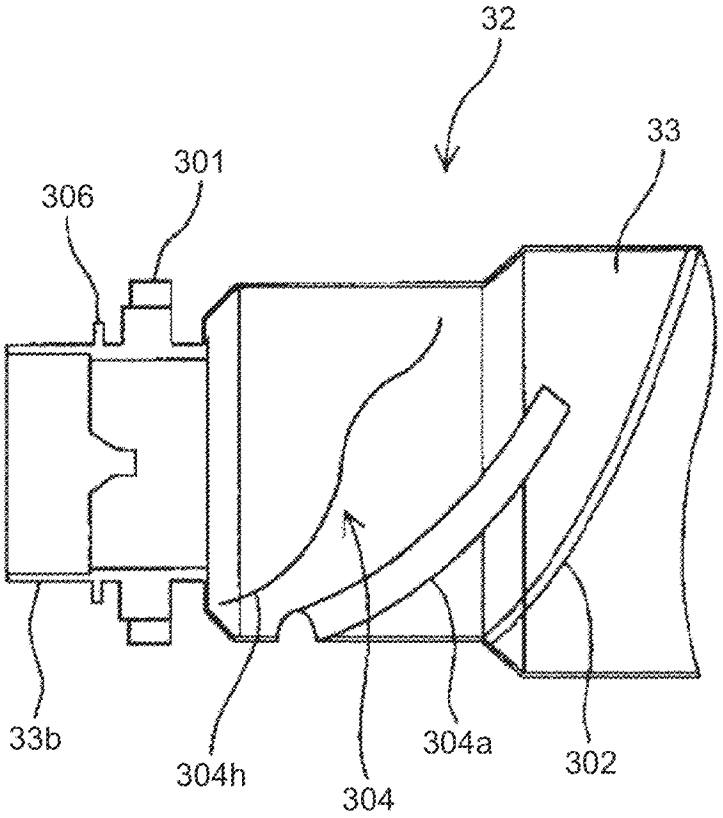
FIG. 12 is an explanatory cross-sectional view of the powder container when the nozzle receiver is detached from the container body.
Figure 12:
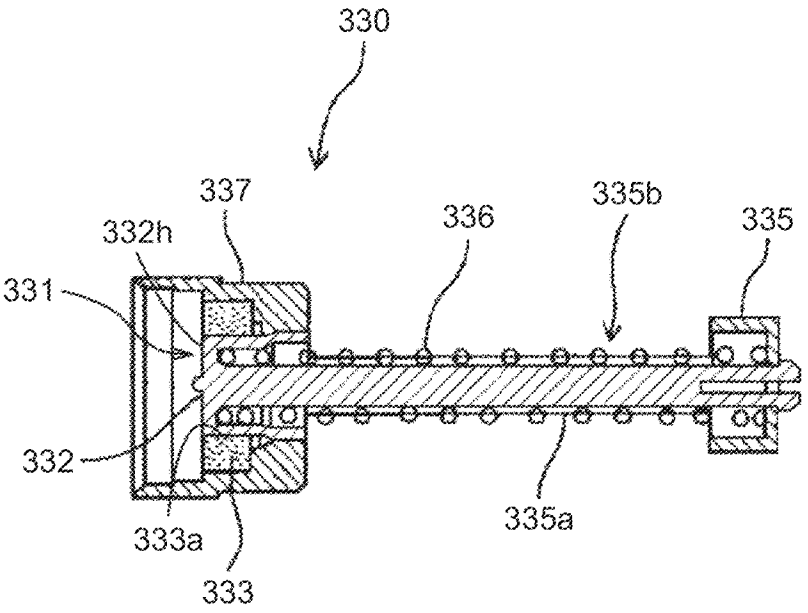
Figure 13:
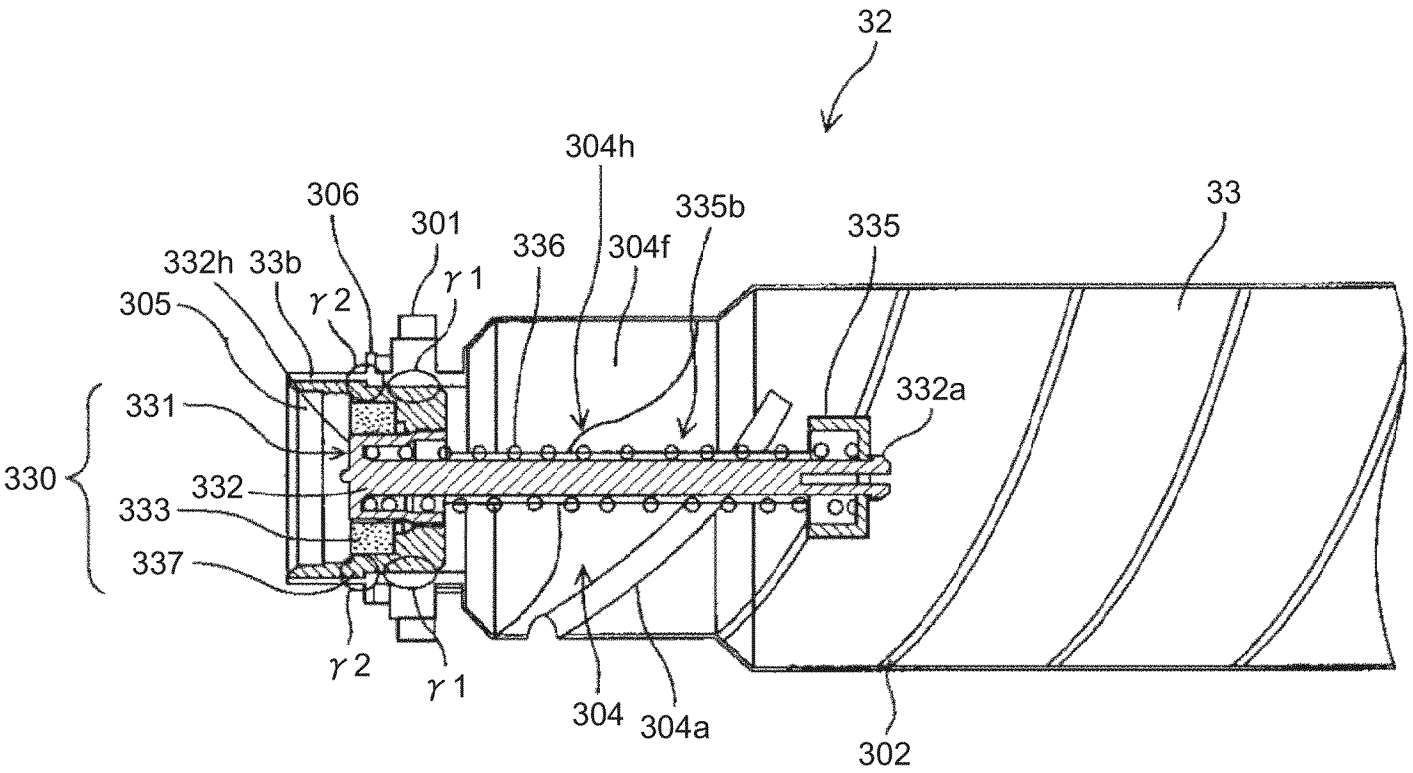
FIG. 13 is an explanatory cross-sectional view of the powder container when the nozzle receiver is attached to the container body from the state illustrated in FIG. 12.
Figure 30A:
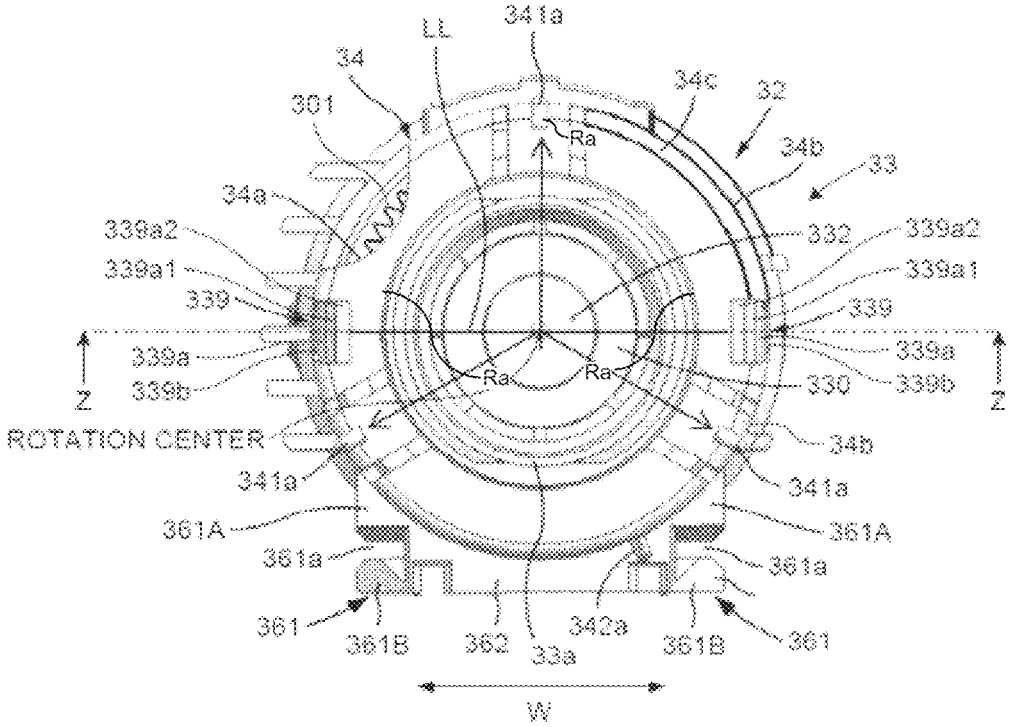
FIG. 30A is an explanatory front view of the powder container according to the first embodiment.

FIG. 11 is an explanatory perspective view of the toner container 32 when the nozzle receiver 330 serving as the nozzle receiver is detached from the container body 33 from the state illustrated in FIG. 10. FIG. 12 is an explanatory cross-sectional view of the toner container 32 when the nozzle receiver 330 is detached from the container body 33. FIG. 13 is an explanatory cross-sectional view of the toner container 32 when the nozzle receiver 330 is attached to the container body 33 from the state illustrated in FIG. 12 (the container front end cover 34 is detached from the toner container 32 similarly to FIG. 10). FIG. 29A is an explanatory perspective view of the front end of the toner container 32. FIG. 30A is front views of the front end of the toner container 32.

As illustrated in FIG. 10 and FIG. 11, the container body 33 is in the form of an approximate cylinder and rotates about a central axis of the cylinder as a rotation axis. Hereinafter, one side of the toner container 32 where the receiving opening 331 is provided (the side where the container front end cover 34 is arranged) in the longitudinal direction of the toner container 32 may be referred to as "a container front end". Furthermore, the other side of the toner container 32 where the gripper 303 is arranged (the side opposite the container front end) may be referred to as "a container rear end". The longitudinal direction of the toner container 32 is the rotation axis direction, and corresponds to the horizontal direction when the toner container 32 is attached to the toner replenishing device 60. The container rear side of the container body 33 relative to the container gear 301 has a greater outer diameter than that of the container front side, and the spiral groove 302 is provided on the inner surface of the container body. When the container body 33 rotates in the arrow A direction in the figures, a conveying force for moving toner from one end (the container rear end) to the other end (the container front end) in the rotation axis direction is applied to the toner in the container body 33 due to the action of the spiral groove 302.

Scooping portions 304, which scoop up the toner conveyed to the container front end by the spiral groove 302 along with the rotation of the container body 33 in the arrow A direction in the figures, are provided on the inner wall of the front end of the container body 33. As illustrated in FIG. 13, each of the scooping portions 304 includes a convex 304*h* and a scooping wall surface 304*f*. The convex 304*h* of the scooping portion rises inside the container body 33 so as to form a ridge toward the rotation center of the container body 33 in a spiral shape. The scooping wall surface 304*f* is a downstream part of the wall surface of a portion continuing from the convex 304*h* (ridge) of the scooping portion to the inner wall of the container body 33 in the rotation direction of container. When the scooping wall surface 304*f* is located in the lower side, the scooping wall surface 304*f* scoops up toner, which has been entered into an inner space facing the scooping portion 304 by the conveying force of the spiral groove 302, along with the rotation of the container body 33. Therefore, the toner can be scooped up so as to be located above the inserted conveying nozzle 611.

Furthermore, as illustrated in FIG. 1 and FIG. 10 for example, a spiral rib 304*a* in a spiral shape is provided on the inner surface of each of the scooping portions 304 in order to convey the internally-located toner, similarly to the spiral groove 302.

The container gear 301 is provided on the container front side relative to the scooping portions 304 on the container body 33. A gear exposing opening 34*a* serving as a gear exposing portion is arranged on the container front end cover 34 so that a part of the container gear 301 (the back side of FIG. 6) can be exposed when the container front end cover 34 is attached to the container body 33. In other words, the container front end cover 34 serves as a cover portion which covers a part of the container gear 301. When the toner container 32 is attached to the toner replenishing device 60, the container gear 301 exposed from the gear exposing opening 34*a* meshes with a container driving gear 601 of the toner replenishing device 60.

The container gear 301 is arranged on the container opening 33*a* side (near the container opening 33*a*) relative to the nozzle hole 610 in the longitudinal direction of the container body 33 such that the container gear 301 can mesh with the container driving gear 601. The container gear 301 meshes with the container driving gear 601 to thereby rotate the conveyor.

The container opening 33*a* in the form of a cylinder is provided on the container front side relative to the container gear 301 of the container body 33 so as to be coaxial with the container gear 301. A nozzle receiver attachment portion 337 of the nozzle receiver 330 is press fitted to the container opening 33*a* so as to be coaxial with the container opening 33*a*, so that the nozzle receiver 330 can be attached to the container body 33. A method to attach the nozzle receiver 330 is not limited to press fitting. Other methods including attachment with adhesive agent or attachment with screws may be applied. Furthermore, it may be possible to form a recess on the container body 33 and insert a protrusion provided on the nozzle receiver attachment portion 337 into the recess to enable hook fitting.

The toner container 32 is configured such that toner is replenished from the container opening 33*a* serving as the opening provided on one end of the container body 33, and thereafter, the nozzle receiver 330 is attached to the container opening 33*a* of the container body 33.

Cover hook stoppers 306 serving as cover hook restrictors are provided beside the container gear 301 on the end of the container opening 33*a* of the container body 33. The cover hook stoppers 306 are provided at three evenly-spaced positions in the circumferential direction on the front end of the container front end cover 34 in the attachment direction, that is, arranged at intervals of 120 degrees. The container front end cover 34 is attached to the toner container 32 (the container body 33) in the state illustrated in FIG. 10 from the container front end (from the bottom left side in FIG. 10). Therefore, the container body 33 penetrates through the container front end cover 34 in the longitudinal direction, and the cover hook stoppers 306 are engaged with respective cover hooks 340 arranged at three positions in the circumferential direction on the container front end cover 34. The cover hook stoppers 306 are provided so as to surround the outer surface of the container opening 33*a*, and when the cover hook stoppers 306 are engaged with the cover hooks 340, the container body 33 and the container front end cover 34 are attached so as to rotate relative to each other.

The container front end cover 34 of the toner container 32 includes a guiding portion that guides the opening 33*a* to the container setting section 615 by restricting the toner container 32 being attached from moving in directions other than the attachment direction when the toner container 32 is attached to the main body of the image forming apparatus. Meanwhile, according to the functions described in the present embodiment, the container front end cover 34 may be a portion mainly used to provide the guiding portion, and may be referred to as a container guide holder. As illustrated in FIG. 6, FIG. 7, FIG. 29A, and FIGS. 30A and 30B, a pair of guiding portions for restricting movement of the container front end cover 34 in the vertical direction are provided on both side surfaces of the lower portion of the container front end cover 34 of the toner container 32. Hereinafter, the pair of the guiding portions serving as vertical restrictors are referred to as sliding guides 361 and 361. In other words, the container cover serves as a supporter of the vertical restrictors. Each of the sliding guides 361 and 361 includes an upper surface 361A serving as an upper guide and a lower surface 361B serving as a lower guide, each extending along the longitudinal direction of the container body 33. Sliding grooves 361*a* and 361*a* are provided between the upper surfaces 361A and the lower surfaces 361B, respectively. Each of the sliding grooves 361*a* is provided parallel to the rotation axis of the container body 33 such that each of the guide rails 75 and 75 provided on the gutter 74 of the container receiving section 72 as illustrated in FIG. 20, FIG. 21A, and FIG. 21B can be sandwiched in the vertical direction. Specifically, the upper surfaces 361A and the lower surfaces 361E sandwich the respective guide rails 75 in the vertical direction, so that the sliding guides 361 and 361 function as positioners of the container front end cover 34 in a vertical direction Z and the width direction W perpendicular to the attachment/detachment direction when the toner container 32 is attached to the main body of the image forming apparatus, to thereby restrict the movement of the toner container 32 in the vertical direction Z and the width direction W.

Figure 30B:
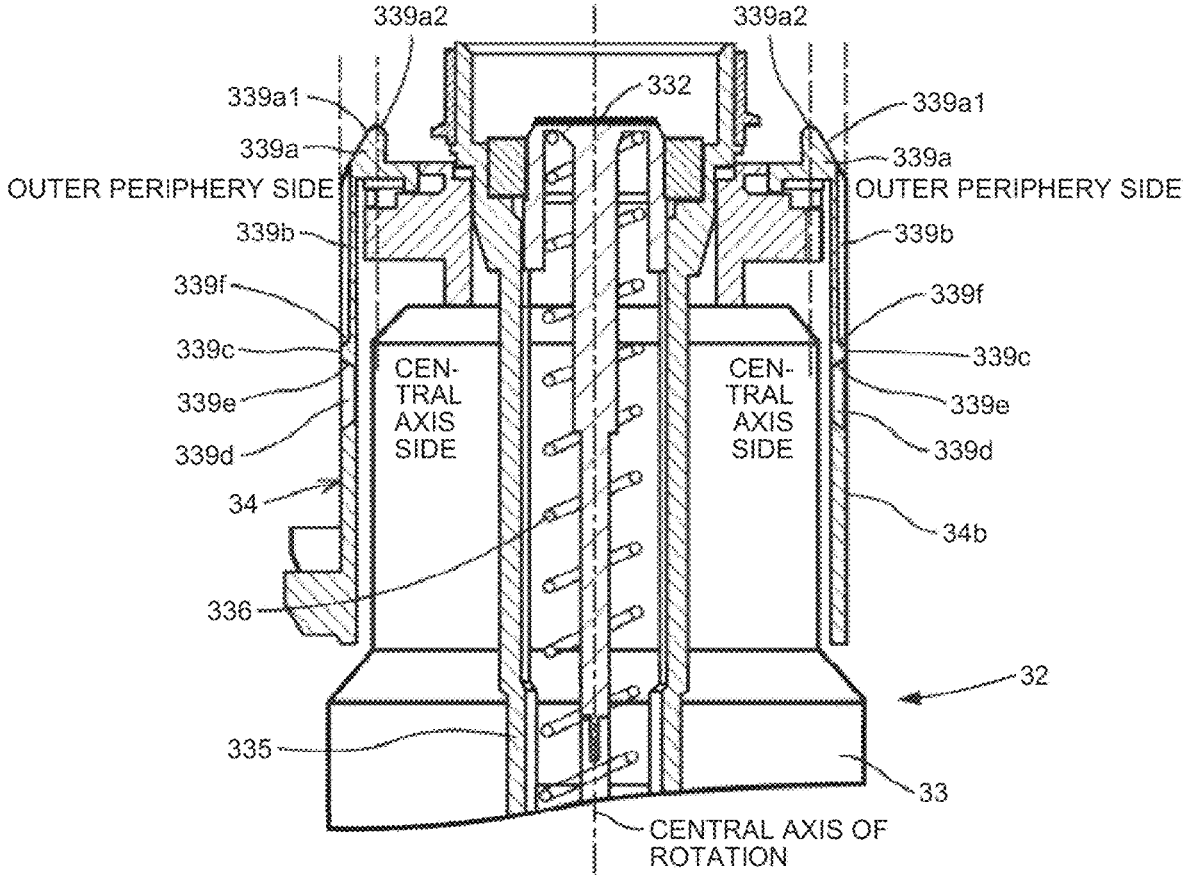
FIG. 30B is a cross-sectional view taken along Z-Z in FIG. 30A.
Figure 31:
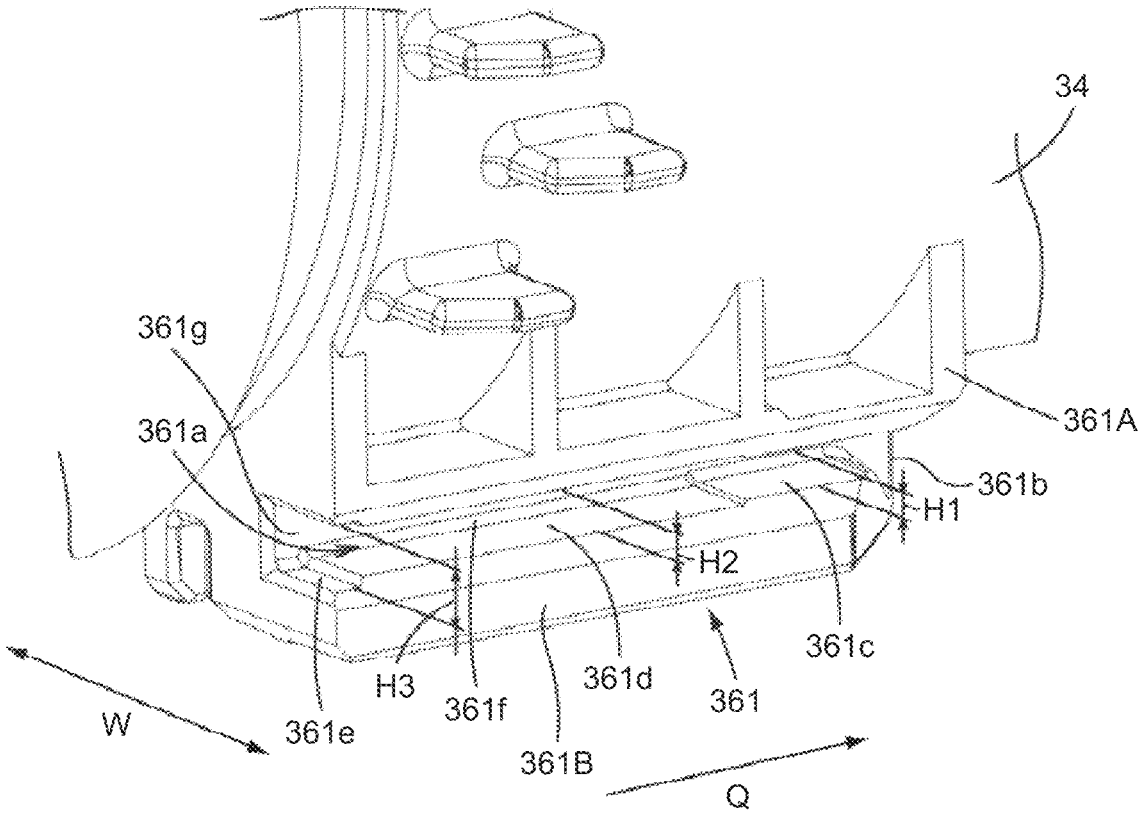
FIG. 31 is a partially-enlarged view illustrating a configuration of the guiding portion of the held portion of the powder container.

As illustrated in FIG. 31, each of the sliding grooves 361*a* is provided such that a gap in the height direction between a lower side of the upper surface 361A and an upper side of the lower surface 361B facing each other is gradually changed in the attachment direction. The gap between the upper side and the lower side is gradually increased such that a gap H1<a gap H2<a gap H3, where H1 is a gap of a front 361*c* serving as a first guide of the sliding groove on the downstream side in the attachment direction of the toner container 32, H2 is a gap of a center 361*d* serving as a second guide of the sliding groove, and H3 is a gap of a rear 361*e* of the sliding groove. Namely, the gap is a distance between the upper surface 361A and the lower surface 361B and is set such that the gap on the downstream side in the attachment direction of the toner container 32 becomes narrower than the gap on the upstream side in the attachment direction. Furthermore, a groove inclined portion 361*f* is provided so as to be inclined toward a recess surface 361*g* of the sliding groove 361*a* and extend along the front 361*c* and the center 361*d* of the sliding groove, so that the sliding guides 361 is prevented from being bent or broken by the gutter 74. Moreover, as illustrated in FIGS. 30A and 30B, a reinforcing portion 362 is provided between the sliding guides 361 in an integrally connected manner, so that it is possible to prevent the sliding guide 361 from being broken when the toner container 32 falls down.

The container engaged portions 339 are provided on an outer surface of container front end cover 34*b* to determine the position of the toner container 32 relative to the toner replenishing device 60 in the axial direction. When the toner container 32 is attached to the toner replenishing device 60, the replenishing device engaging members 78 arranged on the setting cover 608 are engaged with the respective container engaged portions 339.

FIG. 30A is a front view of the toner container 32 viewed from the container front end. FIG. 30B is a cross-sectional view taken along Z-Z in FIG. 30A.

As illustrated in FIG. 7, FIG. 30A and FIG. 32, each of the container engaged portions 339 includes a guiding protrusion 339*a*, a guiding groove 339*b*, a bump 339*c* serving as a force converting portion, and the quadrangular engaged opening 339*d*. Two sets of the container engaged portions 339 are arranged on left and right sides of the container cover 34, respectively, where one set of the container engaged portion 339 includes the guiding protrusion 339*a*, the guiding groove 339*b*, the bump 339*c*, and the engaged opening 339*d* as described above. Each of the guiding protrusions 339*a* is arranged on the container front end of the container cover 34 so as to be located on a vertical plane perpendicular to the longitudinal direction of the toner container 32 and on a horizontal plane passing through the rotation axis of the container body 33. Each of the guiding protrusions 339*a* serving as guiding members includes a guiding inclined surface 339*a*1 that is an inclined surface adjoined to each of the guiding grooves 339*b* so as to come in contact with the replenishing device engaging members 78. And each of the guiding protrusions 339*a* guides the engaging members 78 to the guiding grooves 339*b* when the toner container 32 is attached. As illustrated in FIGS. 30A and 30B, each of the guiding inclined surfaces 339*a*1 is provided such that a tip 339*a*2 of the container front side is located on the inner side relative to the outer surface of container cover 34*b* and is extended to each of the guiding grooves 339*b* arranged on the outer surface of container cover 34*b*. Each of the guiding grooves 339*b* is a groove provided on the outer surface of container cover 34*b* and is a sliding surface on which the top portion P2 of the tip part 78*c* of each of the engaging members 78 slides.

The width of each of the guiding grooves 339*b* in the direction perpendicular to the longitudinal direction of the grooves is set to be slightly wider than the width of each of the engaging members 78 in the same direction such that the engaging members 78 do not come off from the guiding grooves 339*b* when the guiding grooves 339*b* guides the engaging members 78. Each of the guiding grooves 339*b* extends in the longitudinal direction and the container rear end side of the guiding groove is adjoined to the bump 339*c* with the same height as the outer surface of container cover 34*b*. In other words, the outer surface of the container cover 34 with a width of about 1 mm is located between each of the guiding grooves 339*b* and each of the engaged openings 339*d*.

The tip parts 78*c* of the engaging members 78 pass over the bumps 339*c* and are entered into and engaged with (dropped in) the engaged openings 339*d*, so that the toner container 32 is set in (engaged with) the toner replenishing device 60. This state is the attached state of the toner container 32.

Incidentally, each of the engaged openings 339*d* is not limited to the through hole, but may have a closed-end shape with a depth in which each of the engaging members 78 can move to the initial position in the rotation direction (to be described later with reference to FIG. 115). In other words, it may be possible to employ a concave such that one side of the engaged opening of the container cover 34 closer to the circumferential surface of the container body is closed, as long as the movement of the engaging members 78 to the initial position (to be described later with reference to FIG. 115) is not interrupted.

In FIG. 30A, the container shutter 332 is located in the center of a segment LL connecting the two container engaged portions 339 on a virtual plane perpendicular to the rotation axis. If the container shutter 332 is not located on the segment LL connecting the two container engaged portions 339, the following situations may occur. Specifically, due to biasing forces of a container shutter spring 336 serving as a biasing member and the nozzle shutter spring 613, a moment of force acts to rotate the toner container 32 about the segment LL serving as the rotation axis, where the moment arm is a distance from the segment LL to the container shutter 332. Due to the action of the moment of force, the toner container 32 may be inclined with respect to the toner replenishing device 60. In this case, an attachment load on the toner container 32 increases, so that a load is applied to the nozzle receiver 330 that holds and guides the container shutter 332. in particular, if the toner container 32 is new and adequately filled with toner, and when the toner container 32 is pushed from the rear side so as to insert the conveying nozzle 611 protruding in the horizontal direction, a moment of force acts to rotate the toner container 32 with the weight of toner added. Therefore, a load is applied to the nozzle receiver 330 in which the conveying nozzle 611 is inserted, and the nozzle receiver 330 may be deformed or broken in the worst case. In contrast, in the toner container 32 according to the present embodiment, the container shutter 332 is located on the segment LL connecting the two container engaged portions 339. Therefore, it becomes possible to prevent the toner container 32 from being inclined with respect to the toner replenishing device 60 due to the biasing forces of the container shutter spring 336 and the nozzle shutter spring 613 that act at the position of the container shutter 332.

The container rotating part 91 serving as a driving part inputs rotation drive to the container gear 301 of the toner container 32 via the container driving gear 601. When the drive is input to the container gear 301, the outer surface of container opening 33*b* of the container body 33 functions as a rotational shaft and the inner surface of container setting section 615*a* functions as a bearing, so that the container body 33 in which the container gear 301 is provided or integrated is rotated. Incidentally, in the present embodiment, the rotation center of the container gear 301 is located so as to be concentric with the axis of the container opening 33*a*.

Furthermore, when the drive is input to the container gear 301 due to the mesh between the container driving gear 601 and the container gear 301, a force is applied in a direction of the pressure angle of the container gear 301 (an angle between a radial line and a tooth profile at a single point (pitch point) on the tooth surface (based on Japanese Industrial Standards (JIS))), so that the container gear 301 rotates. The force applied in the direction of the pressure angle of the container gear 301 is resolved into a component in a direction toward the rotation center of the container gear 301, so that a force in the direction toward the central axis (rotation axis) of the container body 33 and perpendicular to the central axis is added to the toner container 32 including the container body 33.

If the force is applied in the direction perpendicular to the central axis of the toner container 32 as described above, the posture of the toner container 32 in the longitudinal direction becomes unstable and the toner container 32 may be inclined with respect to the central axis. As a result, the meshing state between the container driving gear 601 and the container gear 301 may become unstable, noise may be generated due to the unstable meshing state, or a toner conveying failure may occur.

As described above, because the outer surface of container opening 33*b* that is the front end of the toner container 32 serves as the rotational shaft and is supported by the inner surface of container setting section 615*a*, an unstable meshing state, noise due to the unstable meshing state, or the toner conveying failure is likely to occur when the container gear 301 is located on the container rear side relative to the container engaged portions 339. This is because it is expected that a rotational moment as described below is generated. First, an explanation is given of a rotational moment generated on the container opening 33*a* of the toner container 32 when the toner container 32 is set in the replenishing device and a driving force is transmitted to the container gear 301. On the container opening 33*a* of the toner container 32, a rotational moment M1 is generated due to the force (driving force) applied in the direction perpendicular to the rotation axis of the container gear 301, so that the engagement between the container opening 33*a* and the container setting section 615 becomes unstable. In contrast, the engaged openings 339*d* of the container engaged portions 339 of the toner container 32 are held by the replenishing device engaging members 78. By the holding by the engaging members, a rotational moment M2 is generated on the container opening 33*a* in a direction in which the rotational moment due to the driving force of the container gear 301 as described above is canceled out.

If the container gear 301 is located on the container rear side relative to the container engaged portions 339. the length of the arm of the rotational moment M1 (a distance from the container opening 33*a* to the container gear 301 in the rotation axis direction) becomes longer than the length of the arm of the rotational moment M2 (a distance from the container opening 33*a* to the engaged opening in the rotation axis direction). That is, M1>M2, so that the holding of the toner container 32 and the container front end cover 34 by the toner container holder 70 may become unstable.

Figure 49:
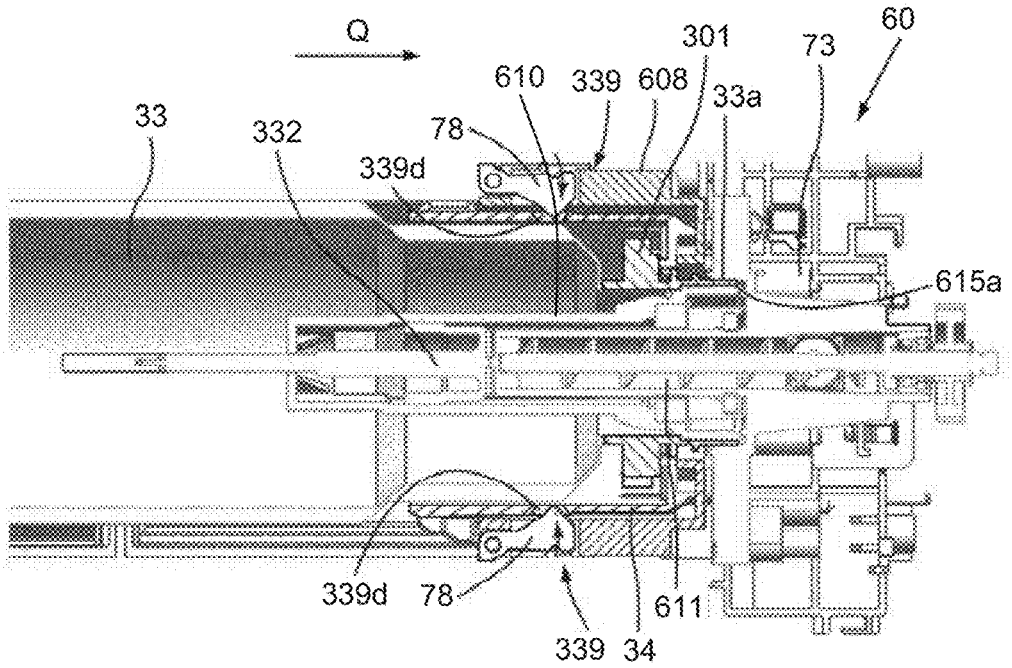
FIG. 49 is an enlarged view of a portion on a reference line X3 in FIG. 48 viewed from above.
Figure 57:
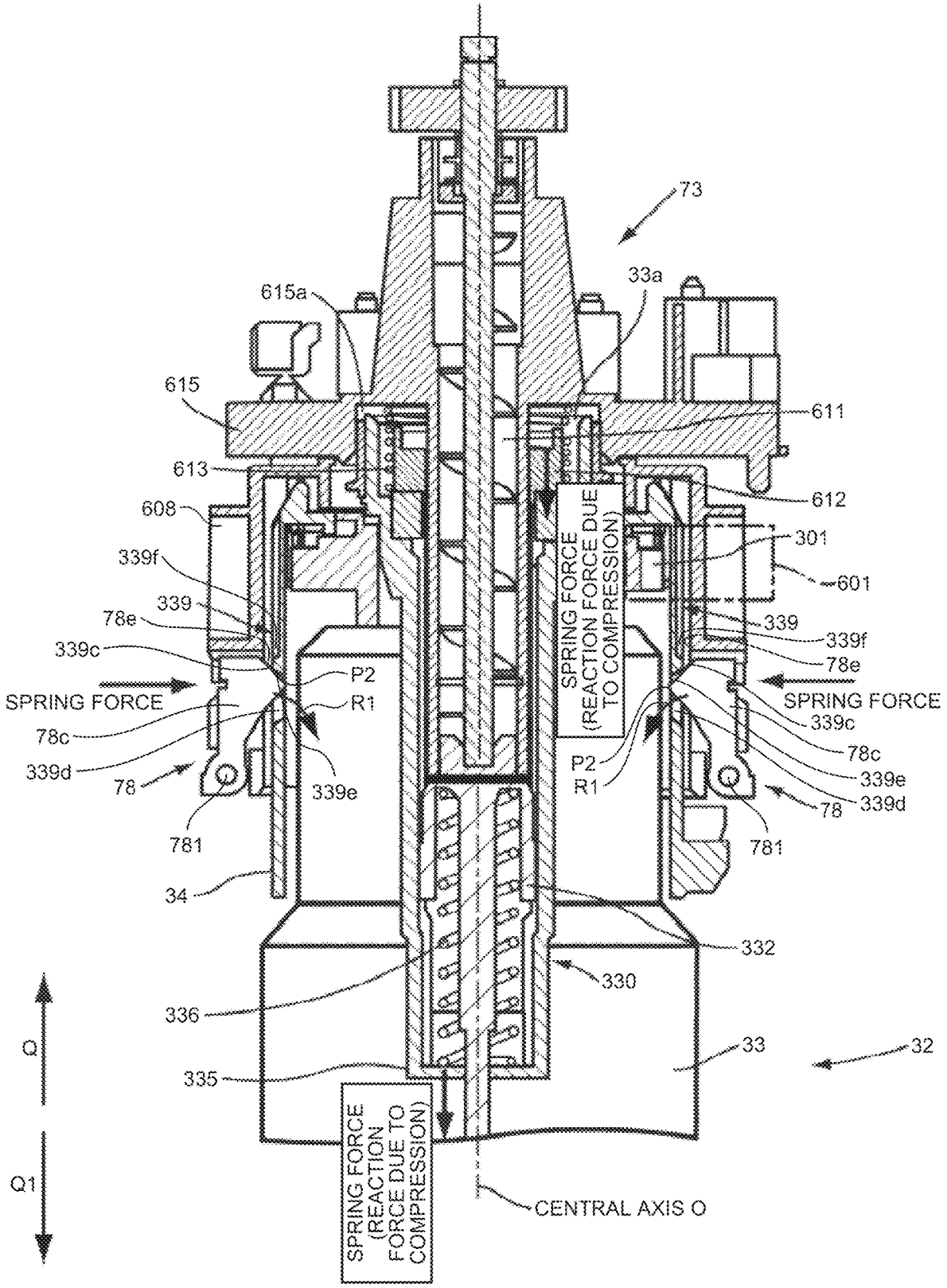
FIG. 57 is an explanatory cross-sectional view of the powder container attached to the container holding section.

In contrast, according to the present embodiment, as illustrated in FIG. 49 and FIG. 57, the container gear 301 is arranged between the container engaged portions 339 and the container opening 33*a* in the central axis direction (longitudinal direction) of the toner container 32. Therefore, the length of the arm of the rotational moment M2 becomes longer than the length of the arm of the rotational moment M1, so that M2>M1. Therefore, the influence of the rotational moment M1 due to the force (driving force) applied in the direction perpendicular to the central axis of the toner container 32 can be reduced, the toner container holder 70 can stably hold the toner container 32 and the container front end cover 34, and the posture of the toner container 32 in the longitudinal direction can be maintained stably.

Detailed explanations will be given below. When the toner container 32 is held by the toner container holder 70 (the set state), the toner container 32 is set such that the outer surface of container opening 33*b* that is the front end of the toner container 32 serves as the rotational shaft and is supported by the inner surface of container setting section 615*a* while the engaged openings 339*d* of the container engaged portions 339 are engaged with the replenishing device engaging members 78. Furthermore, the container gear 301 is arranged between the container engaged portions 339 and the container opening 33*a*.

Therefore, the length of the arm of the rotational moment M1 due to the force applied to the toner container 32 in the direction perpendicular to the central axis caused by the mesh between the container driving gear 601 and the container gear 301 is the same as the length from the position at which the outer surface of container opening 33*b* is supported by the inner surface of container setting section 615*a* to the position at which the container gear 301 is arranged in the central axis direction (longitudinal direction). Furthermore, the length of the arm of the rotational moment M2 due to the force (referred to as a holding force) applied to the toner container 32 in the direction perpendicular to the central axis caused by the engagement between the engaged openings 339*d* of the container engaged portions 339 and the replenishing device engaging members 78 is the same as the length from the position at which the outer surface of container opening 33*b* is supported by the inner surface of container setting section 615*a* to the position at which the engaged openings 339*d* of the container engaged portions 339 are arranged in the central axis direction (longitudinal direction).

Incidentally, the rotational moment is obtained by multiplying the length of the arm of the rotational moment by the magnitude of the force. Therefore, when the container gear 301 is arranged on the container rear side relative to the container engaged portions 339, a greater holding force is needed than in the configuration in which the container gear 301 is arranged between the container engaged portions 339 and the container opening 33*a*.

Therefore, assuming that the holding force as described above is constant, it becomes possible to effectively apply the holding force of the toner container holder 70 to hold the toner container 32 and the container front end cover 34 in the configuration in which the container gear 301 is arranged between the container engaged portions 339 and the container opening 33*a*, as compared to the configuration in which the container gear 301 is arranged on the container rear side relative to the container engaged portions 339. As a result, even when the driving force is transmitted to the container gear 301, it becomes possible to stably maintain the posture of the toner container 32 in the longitudinal direction.

Figure 58A:
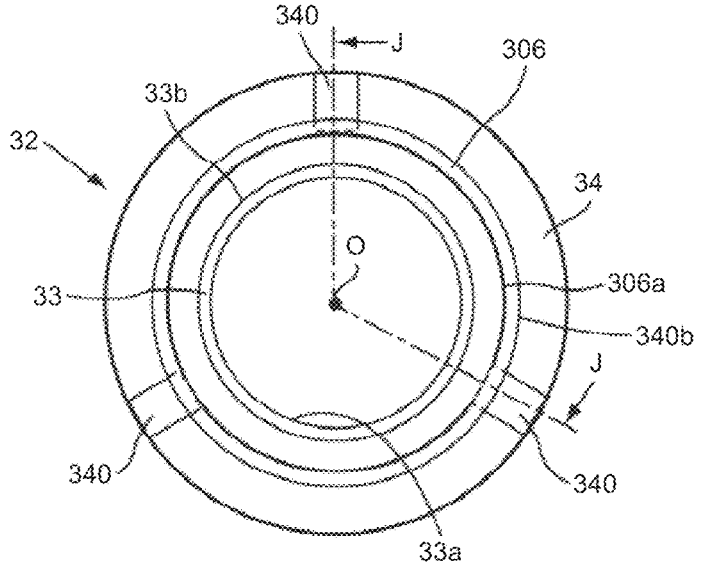
FIG. 58A is a diagram illustrating a contact state of cover hooks of the container front end cover and cover hook stoppers of the container body.
Figure 58B:
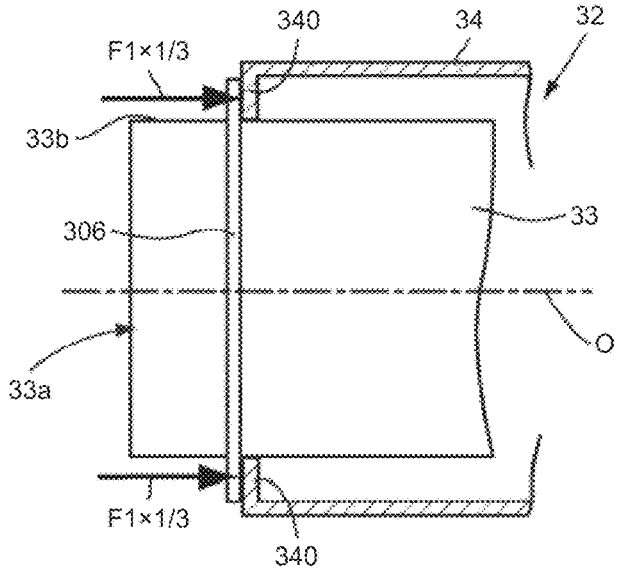
FIG. 58B is a partial cross-sectional view taken along a line JJ in FIG. 58A.
Figure 58C:
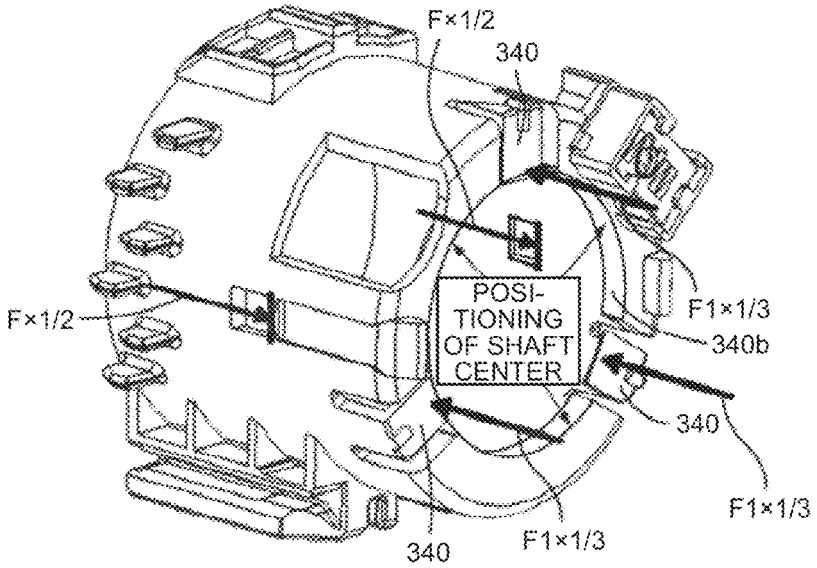
FIG. 58C is a diagram for explaining the cover hooks.

When the toner container 32 is held by the toner container holder 70, as illustrated in FIG. 58B and FIG. 58C, a reaction force F (restoring force) to compress the container shutter spring 336 and a reaction force F1 caused by compression of the nozzle shutter spring 613 are applied to the toner container 32. As illustrated in FIG. 58A, FIG. 58B, and FIG. 58C, each of the cover hooks 340 arranged at three evenly-spaced positions in the circumferential direction of the container front end cover 34 receives a component of the reaction force F1 (i.e., ⅓ of F1) from the toner container 32 via a surface of the cover hook stopper 306 of the toner container 32 on the container rear side. Resultant forces of the reaction forces F and F1 are applied to the container front end cover 34 evenly and with equal radial distances to the central axis O (rotation axis) of the toner container 32, so that only a component in the central axis (rotation axis) direction mainly acts. Namely, a component that causes the container front end cover 34 to be inclined with respect to the central axis O (rotation axis) can hardly act.

Furthermore, as illustrated in FIG. 57, the container engaged portions 339 are arranged at horizontally symmetrical positions with respect to the central axis O (rotation axis), so that components in the direction perpendicular to the central axis O are canceled out, Therefore, only a component in the central axis direction acts, but a component that inclines the container front end cover 34 with respect to the central axis O does not act.

In the container front end cover 34, an inner surface 340*b* of a front end of the container front end cover 34 comes in contact with an outer edge 306*a* of the cover hook stopper 306 serving as a cover hook restrictor, on the container front side relative to front ends of the cover hooks 340. Therefore, the radial position of the toner container 32 relative to the container front end cover 34 is determined.

Specifically, the toner container 32 serving as the powder container of the present embodiment is attachable to an image forming apparatus. The image forming apparatus is configured such that the toner container 32 containing toner for image formation is attached thereto and includes the conveying nozzle 611 serving as a conveyor for conveying toner, the nozzle shutter 612 serving as a nozzle opening/closing member that opens and closes the nozzle hole 610 serving as the powder receiving hole arranged on the conveying nozzle, the nozzle shutter spring 613 serving as a biasing member that biases the nozzle shutter 612 to close the nozzle hole 610, the replenishing device engaging members 78 that apply biasing forces to the sides of the toner container 32 to hold the toner container 32 with respect to the main body of the image forming apparatus, the container driving gear 601 serving as an apparatus main-body gear to transmit a driving force to the conveyor in the toner container 32, and the container setting section 615 serving as the container receiving section that is arranged around the conveying nozzle 611 so as to be coaxial with the conveying nozzle 611 and that receives the toner container 32. The toner container 32 includes the container body 33 for storing toner for image formation, the opening 33*a* arranged on one end of the toner container 32, the conveyor that rotates to convey powder inside the container body to the container opening 33*a* side, the container gear 301 serving as a gear to mesh with the container driving gear 601 to drive the conveyor, the container engaged portions 339 engaged with the replenishing device engaging members 78, and the container front end cover 34 serving as a container cover arranged on the outer surface of the toner container 32 so as to be coaxial with the toner container 32. The center of the opening 33*a* and the rotation center of the container gear 301 are located on the same axis. The container driving gear 601 is arranged between the container engaged portions 339 and the container opening 33*a* in the longitudinal direction of the toner container 32. The opening 33*a* is able to mate with the container setting section 615.

With the configuration as described above, the toner container 32 can be held in a stable posture in the radial direction and the axial direction with respect to the toner replenishing device 60. If the container gear 301 is arranged between the opening 33*a* and the container engaged portions 339 in the longitudinal direction of the toner container 32, a stable state is maintained because of a balance between the forces in the central axis direction. Therefore, the influence of the force generated at the engaged portion between the container driving gear 601 and the container gear 301 is reduced, so that it becomes possible to prevent the toner container 32 from being inclined in the longitudinal direction (in the central axis direction). Consequently, it becomes possible to prevent the meshing state between the container driving gear 601Y and the container gear 301 from becoming unstable, prevent noise due to the unstable meshing state, and prevent a toner conveying failure.

Meanwhile, according to the functions of the present embodiment, the container front end cover 34 may be a portion mainly used to provide the container engaged portions 339, and may be referred to as a container engaged portion holder.

As illustrated in FIG. 29 and FIGS. 30A and 30B, the cover hooks 340 are arranged at three evenly-spaced positions in the circumferential direction on a front end surface of the container front end cover 34. At bent portions of the cover hooks 340, protrusions 341*a* are provided, which serve as guiding portions, radial restrictors, radial regulators, radial positioning portions, radial positioners, or radial guides and which protrude outward from the outer surface of container front end cover 34*b*. The protrusions 341*a* are bent along the bent portions of the container front end cover 34 and arranged at three evenly-spaced positions in the circumferential direction of the container front end cover 34, that is, at intervals of 120 degrees. The protrusions 341*a* protrude 0.9 mm from the outer surface of container front end cover 34*b* and extend 4 mm from the bent portions in each of the radial direction and the longitudinal direction. As illustrated in FIG. 32, the protrusions 341*a* serving as the guiding portions have functions to guide the movement of the toner container 32 and determine the position of the toner container 32 in the radial direction by coming into contact with the inner surface of setting cover 608*c* when the container front end cover 34 is entered into the container cover receiving section 73. Each of the protrusions 341*a* is provided with a rounded shape so as to come in point contact with the inner surface of setting cover 608*c* to reduce the sliding resistance. The protrusions 341*a* are arranged so as to face the respective through holes 79*a* or recesses 79*b* (see FIG. 23 and FIG. 24) provided at three positions on the setting cover 608. The protrusions 341*a* are also arranged so as to come in contact with the inner surface of setting cover 608*c* before the container opening 33*a* of the container body 33 comes in contact with the nozzle shutter flange 612*a*. Therefore, the protrusions 341*a* function as radial positioners of the toner container 32 with respect to the toner replenishing device 60 by coming into contact with the inner surface of setting cover 608*c*. Namely, the protrusions 341*a* function as guiding portions, radial restrictors, radial regulators, radial positioners, radial guides or radial positioners.

As illustrated in FIGS. 30A and 30B, a plate-shaped circumferential restricting portion serving as a circumferential restrictor as the guiding portion is arranged on the outer surface of container front end cover 34*b*. Hereinafter, the circumferential restricting portion is described as a rotation restrictive rib 342*a* that serves as a rotation restrictive portion, a rotation restrictive protrusion, a guiding portion, a circumferential restrictor, a circumferential regulator, a circumferential positioner, or circumferential guide. The rotation restrictive rib 342*a* and one of the sliding guides 361 are provided to be integrated with the container front end cover 34. The rotation restrictive rib 342*a* is arranged between the two protrusions 341*a* located in the lower portion, and protrudes in a radially outward direction from the outer surface of the container front end cover 34. The rotation restrictive rib 342*a* is arranged so as to be entered into the groove 77*a* provided on the setting cover 608 (see FIG. 21A) when the toner container 32 is attached to the toner replenishing device 60. The rotation restrictive rib 342*a* protrudes from a downstream end surface of one of the sliding guides 361 in the attachment direction, and is integrated with the one of the sliding guides 361. The rotation restrictive rib 342*a* is arranged so as to protrude from the one of the sliding guides 361 and be located at approximately the same height as the sliding groove 361*a*. Therefore, even if the sliding guides 361 are entered in a slightly deviated manner with respect to the guide rails 75 when the toner container 32 is attached to the toner replenishing device 60, a deviation in the position of the rotation restrictive rib 342*a* with respect to the groove 77*a* of the setting cover can be reduced and the rotation restrictive rib 342*a* can easily be entered into the groove 77*a* of the setting cover. Therefore, it becomes possible to reliably determine the position in the circumferential direction.

Figure 33:
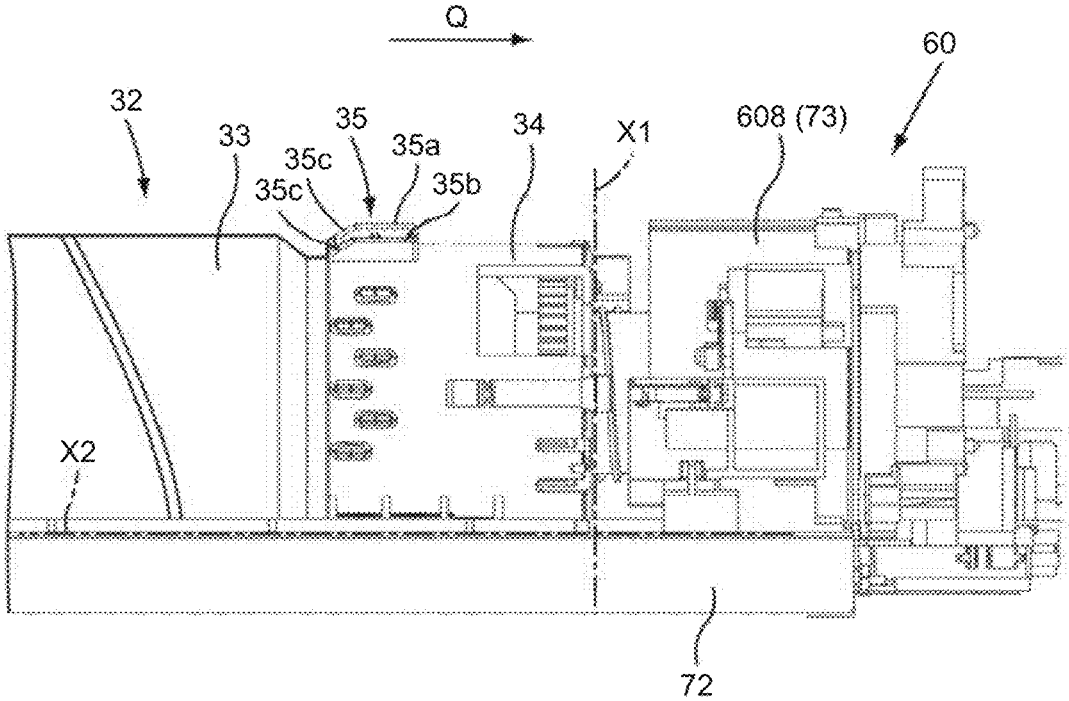
FIG. 33 is an enlarged view of the powder container attached to the container holding section.
Figure 34:
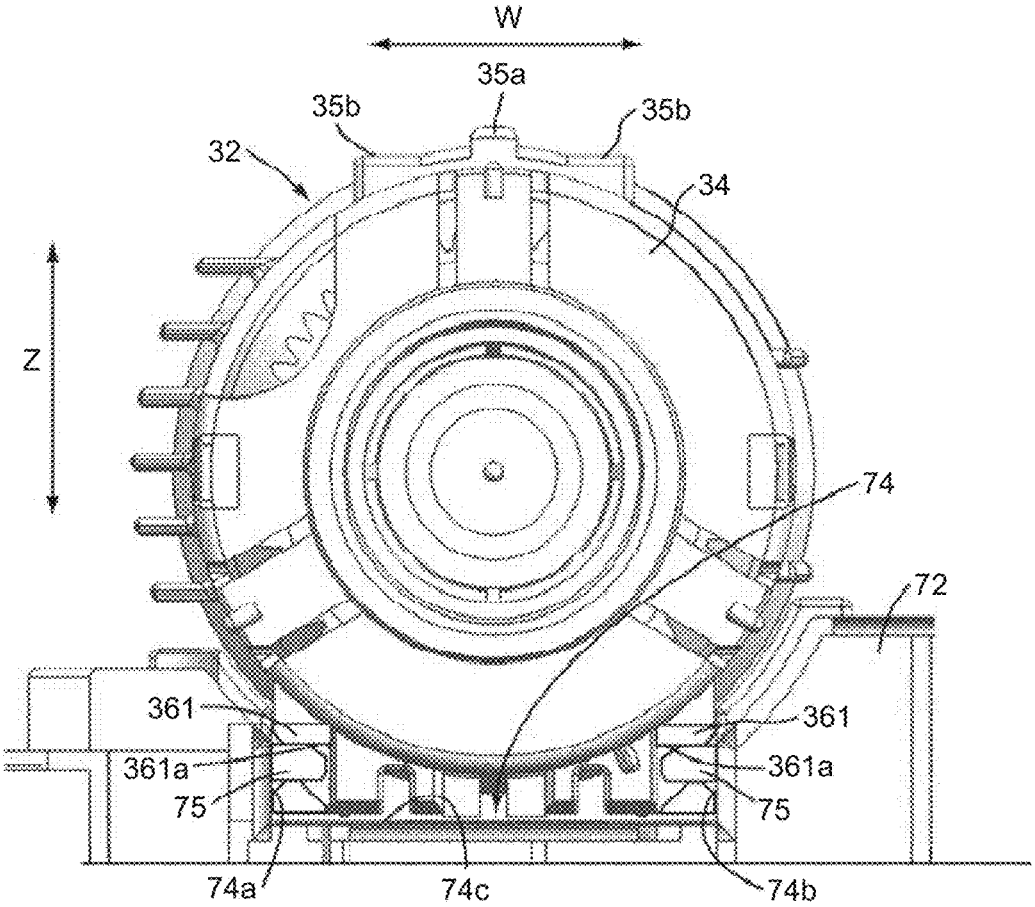
FIG. 34 is an enlarged view of a portion on a reference line X1 in FIG. 33 viewed from the attachment direction.

As illustrated in FIG. 22, FIG. 33, and FIG. 34, the upward guide 35 is arranged on the container front end cover 34 so as to protrude upward from the outer surface of container cover 34*b* in the attached state. On the upward guide 35, a top portion of upward guide 35*a*, side portions of upward guide 35*b*, and inclined surfaces of upward guide 35*c* are provided. The top portion of upward guide 35*a* and the side portions of upward guide 35*b* extend in the longitudinal direction of the toner container 32. The side portions of upward guide 35*b* are provided on both sides of the top portion of upward guide 35*a* so as to be deviated downward from the top portion 35*a* of the upward guide in the circumferential direction of the container front end cover 34. The inclined surfaces of upward guide 35*c* are inclined downward from the top portion of upward guide 35*a* and the side portions of upward guide 35*b* of the toner container 32 to the container rear side.

The container body 33 is molded by a biaxial stretch blow molding method. The biaxial stretch blow molding method generally includes a two-stage process including a preform molding process and a stretch blow molding process, in the preform molding process, a test-tube shaped preform is molded with resin by injection molding. By the injection molding, the container opening 33*a*, the cover hook stoppers 306, and the container gear 301 are provided at the opening of the test-tube shape preform. In the stretch blow molding process, the preform that is cooled after the preform molding process and detached from a mold is heated and softened, and then subjected to blow molding and stretching.

In the container body 33, the container rear side relative to the container gear 301 is molded by the stretch blow molding process. Specifically, a portion in which the spiral groove 302 is provided and the gripper 303 are molded by the stretch blow molding process.

In the container body 33, each of the portions such as the container gear 301, the container opening 33*a*, and the cover hook stoppers 306 provided on the container front side relative to the container gear 301 remains in the same form as in the preform generated by the injection molding; therefore, they can be molded with high accuracy. In contrast, the portion in which the spiral groove 302 is provided and the gripper 303 are molded by stretching through the stretch blow molding process after the injection molding; therefore, the molding accuracy is lower than that of the preform molded portions.

The nozzle receiver 330 fixed to the container body 33 will be explained below.

Figure 14:
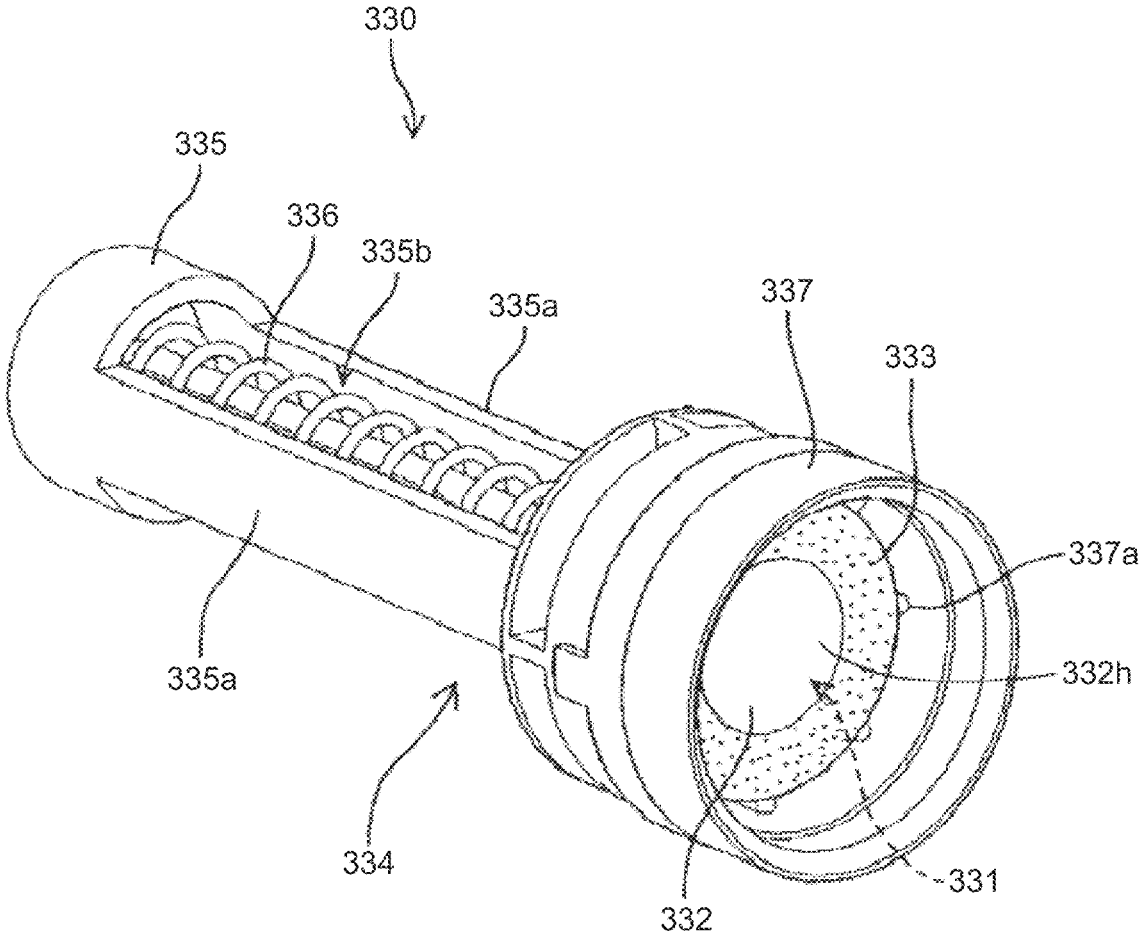
FIG. 14 is an explanatory perspective view of the nozzle receiver viewed from a container front side.
Figure 15:
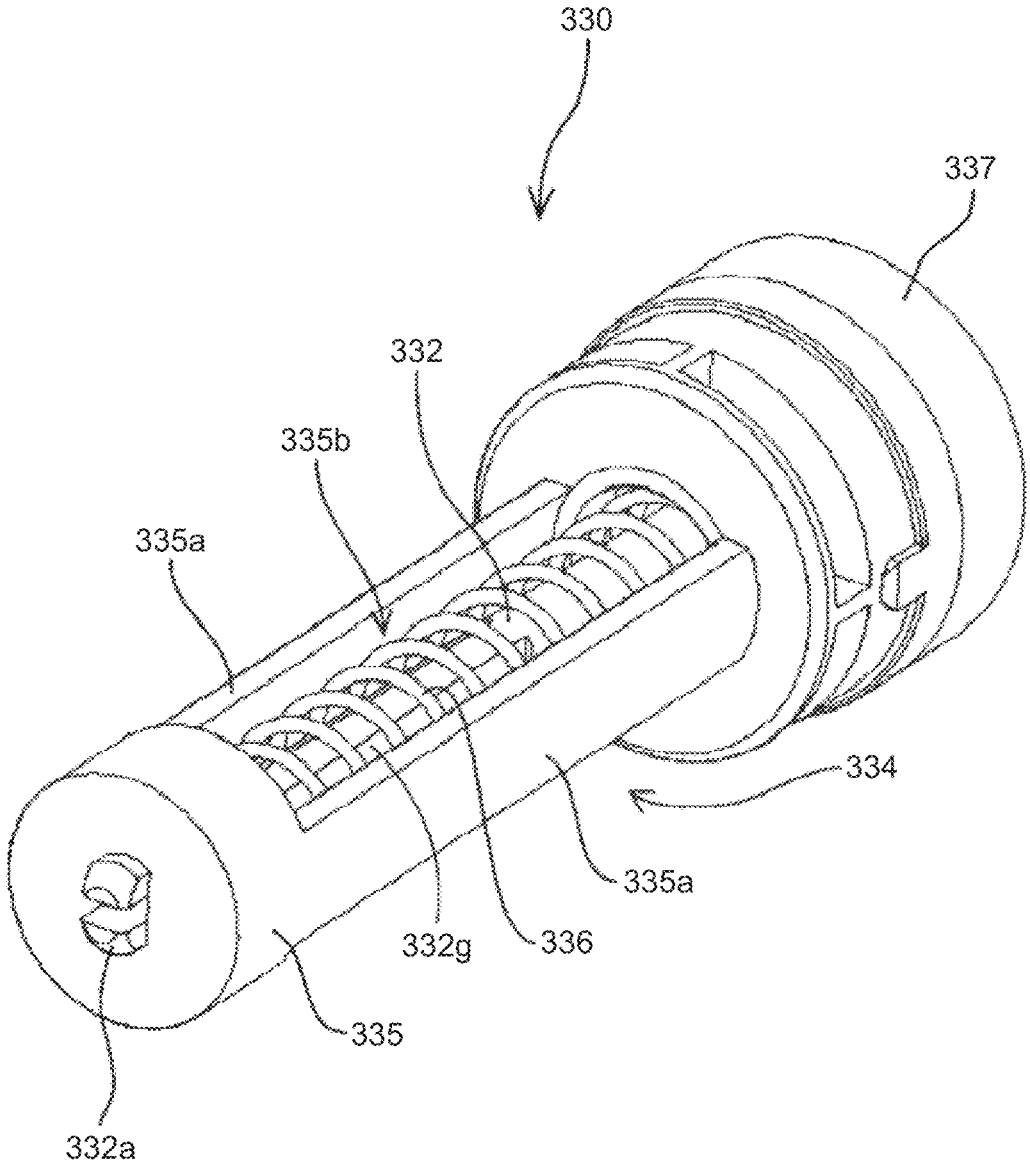
FIG. 15 is an explanatory perspective view of the nozzle receiver viewed from a container rear side.
Figure 16:
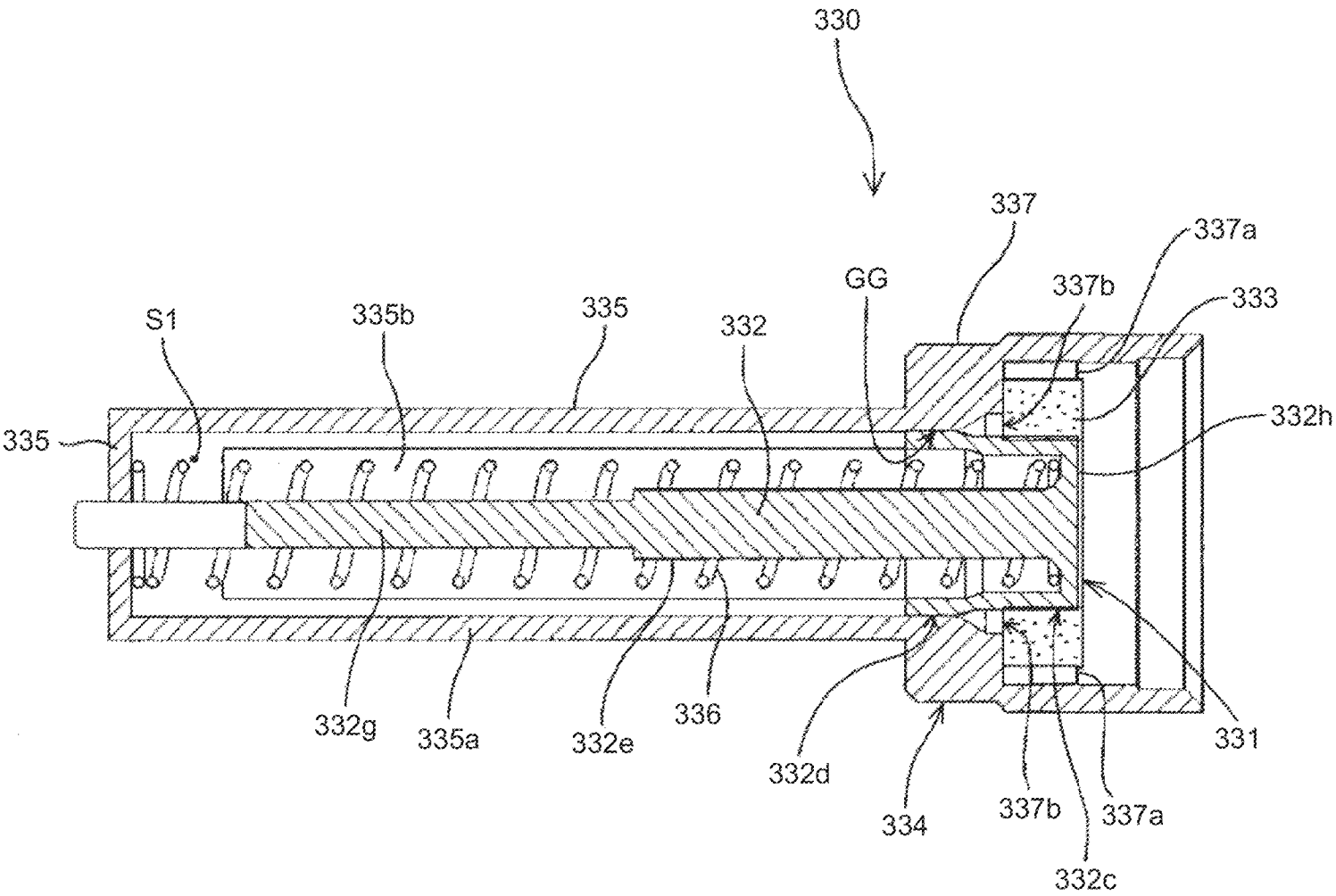
FIG. 16 is a top cross-sectional view of the nozzle receiver in the state illustrated in FIG. 13.
Figure 17:
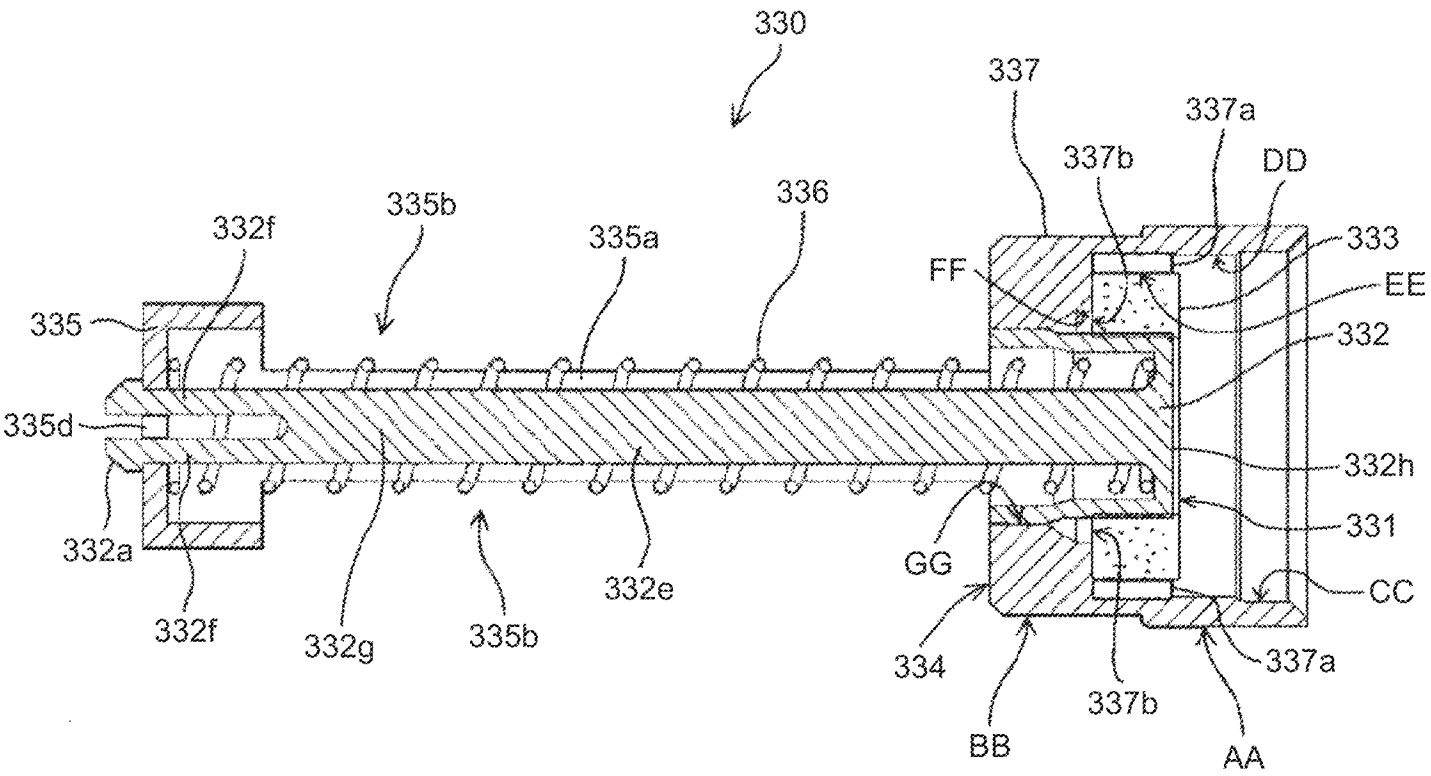
FIG. 17 is a transverse cross-sectional view of the nozzle receiver in the state illustrated in FIG. 13.
Figure 18:
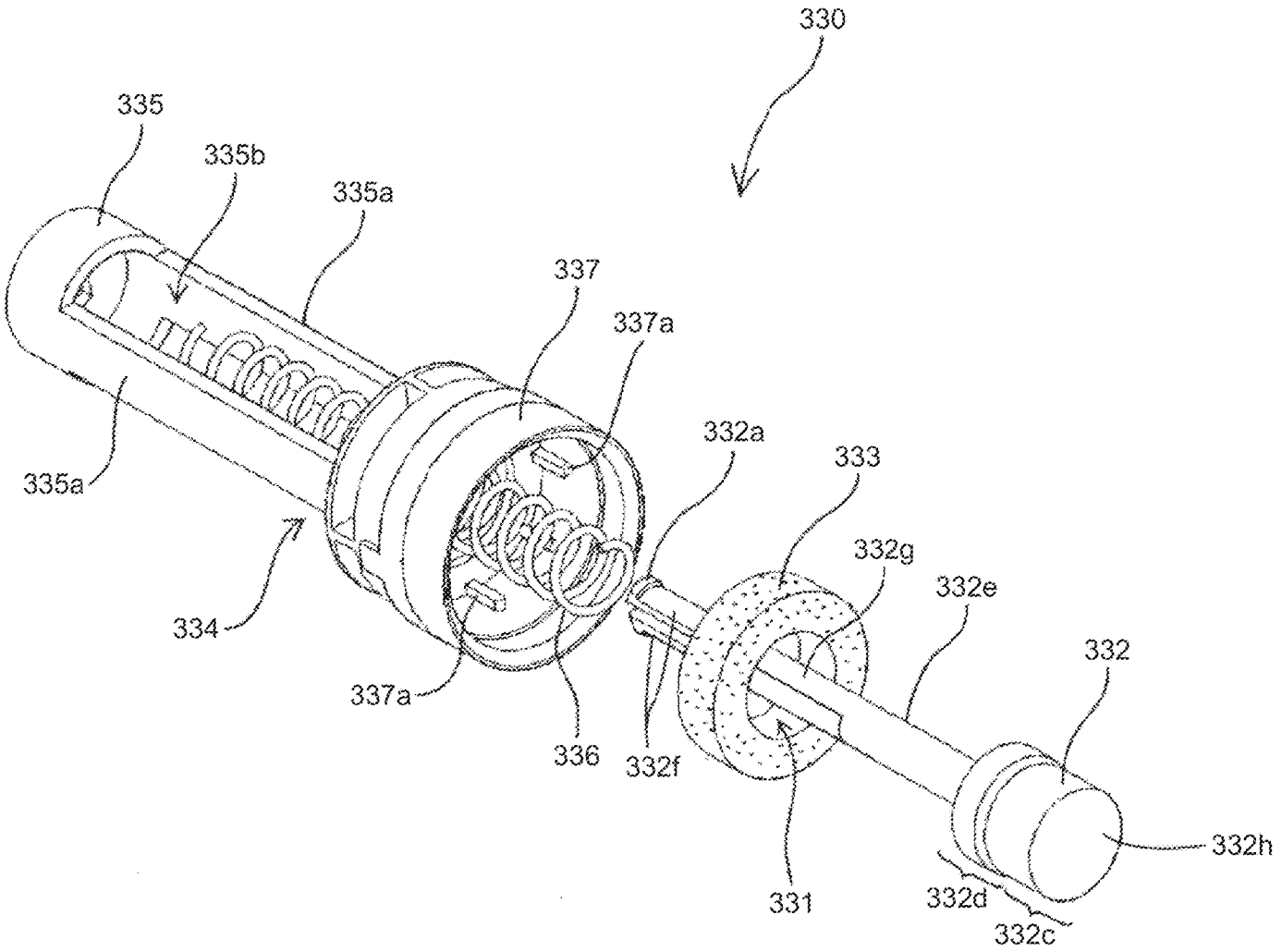
FIG. 18 is an exploded perspective view of the nozzle receiver.

FIG. 14 is an explanatory perspective view of the nozzle receiver 330 viewed from the container front side. FIG. 15 is an explanatory perspective view of the nozzle receiver 330 viewed from the container rear side. FIG. 16 is a top cross-sectional view of the nozzle receiver 330 viewed from above in the state illustrated in FIG. 13. FIG. 17 is a transverse cross-sectional view of the nozzle receiver 330 viewed from side (from the back side of FIG. 13) in the state illustrated in FIG. 13. FIG. 18 is an exploded perspective view of the nozzle receiver 330.

The nozzle receiver 330 includes a container shutter supporter 334 serving as a supporter, the container shutter 332, a container seal 333 serving as a seal, the container shutter spring 336 serving as a biasing member, and the nozzle receiver attachment portion 337. The container shutter supporter 334 includes a shutter rear end supporting portion 335 as a shutter rear portion, shutter side supporting portions 335*a* as shutter side portions, the openings of shutter supporting portion 335*b* as shutter side openings of the shutter supporting portion, and the nozzle receiver attachment portion 337. The container shutter spring 336 includes a coil spring.

The shutter side supporting portions 335*a* and the openings of shutter supporting portion 335*b* on the container shutter supporter 334 are arranged adjacent to each other in the rotation direction of the toner container such that the two shutter side supporting portions 335*a* facing each other form a part of a cylindrical shape and the cylindrical shape is largely cut out at the openings (two portions) of shutter supporting portion 335*b*. With this shape, it is possible to cause the container shutter 332 to move in the longitudinal direction in a cylindrical space S1 (FIG. 16) defined by the cylindrical shape.

The nozzle receiver 330 provided to the container body 33 rotates with the container body 33 when the container body 33 rotates. At this time, the shutter side supporting portions 335*a* of the nozzle receiver 330 rotate around the conveying nozzle 611 of the toner replenishing device 60. Therefore, the shutter side supporting portions 335*a* being rotated alternately pass a space just above the nozzle hole 610 provided in the upper side of the conveying nozzle 611. Consequently, even if toner is instantaneously accumulated above the nozzle hole 610, because the shutter side supporting portions 335*a* cross the accumulated toner and alleviate the accumulation, it becomes possible to prevent a cohesion of the accumulated toner when the device is not used and prevent a toner conveying failure when the device is resumed. In contrast, when the shutter side supporting portions 335*a* are located on the sides of the conveying nozzle 611 and the nozzle hole 610 and the opening of shutter supporting portion 335*b* face each other, toner in the container body 33 is supplied to the conveying nozzle 611 as indicated by an arrow J3 in FIG. 9.

In the conventional toner container in which the container gear is located on the side opposite the opening relative to the powder receiving hole in the longitudinal direction of the toner container, the diameter of a portion where the container gear is provided needs to be smaller than those of the other portions of the container body in order to attach and detach the toner container and to couple and drive the container gear and the container driving gear of the main body. Therefore, a so-called shoulder portion is provided to pass over the small-diameter portion and toner is moved from the inside of the container body to the opening.

In contrast, according to the present embodiment, the container gear 301 is coupled and driven with the container driving gear 601 at a position on the opening 33*a* side arranged on one end of the container body 33 relative to the nozzle hole 610 in the longitudinal direction of the toner container 32. Therefore, the conveying nozzle 611 can receive toner on the inner side of the container body 33 relative to the position (small-diameter position) at which the container gear 301 is provided. Consequently, it becomes possible to transfer toner more smoothly as compared to the conventional configuration.

The container shutter 332 includes a front cylindrical portion 332*c* serving as a closure, a slide area 332*d*, a guiding rod 332*e*, and shutter hooks 332*a*. The front cylindrical portion 332*c* is a container front end portion to be tightly fitted to a cylindrical opening (the receiving opening 331) of the container seal 333. The slide area 332*d* is a cylindrical portion, which is provided on the container rear side relative to the front cylindrical portion 332*c*. The slide area 332*d* has an outer diameter slightly greater than that of the front cylindrical portion 332*c*, and slides on the inner surfaces of the pair of the shutter side supporting portions 335*a*.

The guiding rod 332*e* is a cylinder that stands from the inner side of the cylinder of the front cylindrical portion 332*c* toward the container rear end, and serves a rod portion that prevents the container shutter spring 336 from being buckled when the guiding rod 332*e* is inserted to the inside of the coil of the container shutter spring 336.

A guiding rod sliding portion 332*g* includes a pair of flat surfaces that are provided on both sides across the central axis of the cylindrical guiding rod 332*e* from the middle of the guiding rod 332*e*. Furthermore, the container rear end of the guiding rod sliding portion 332*g* is bifurcated into a pair of cantilevers 332*f*.

The shutter hooks 332*a* are a pair of hooks that are provided on ends of the cantilevers 332*f* opposite the base from which the guiding rod 332*e* stands, and that prevent the container shutter 332 from coming off from the container shutter supporter 334.

As illustrated in FIG. 16, a front end of the container shutter spring 336 abuts against the inner wall of the front cylindrical portion 332*c*, and a rear end of the container shutter spring 336 abuts against the wall of the shutter rear end supporting portion 335. At this time, the container shutter spring 336 is in a compressed state, so that the container shutter 332 receives a biasing force in a direction away from the shutter rear end supporting portion 335 (to the right or toward the container front end in FIG. 16). However, the shutter hooks 332*a* provided on the container rear end of the container shutter 332 are hooked on an outer wall of the shutter rear end supporting portion 335. Therefore, the container shutter 332 is prevented from moving further in the direction away from the shutter rear end supporting portion 335 in the state illustrated in FIG. 16 and FIG. 17.

Due to the hooked state between the shutter hooks 332*a* and the shutter rear end supporting portion 335 and the biasing force of the container shutter spring 336, the positioning is performed. Specifically, the longitudinal positions of the front cylindrical portion 332*c* and the container seal 333, both of which implement a toner leakage preventing function of the container shutter 332, are determined relative to the container shutter supporter 334. Therefore, it becomes possible to determine the positions of the front cylindrical portion 332*c* and the container seal 333 so that they can be fitted to each other, enabling to prevent toner leakage.

The nozzle receiver attachment portion 337 is in the form of a cylinder whose outer diameter and inner diameter are reduced in a stepped manner toward the container rear end. The diameters are gradually reduced from the container front end to the container rear end. As illustrated in FIG. 17, two outer diameter portions (outer surfaces AA and BB located in this order from the container front end) are present on the outer surface, and five inner diameter portions (inner surfaces CC, DD, EE, FF, and GG located in this order from the container front end) are present on the inner surface. The outer surfaces AA and BB on the outer surface are connected by a tapered surface at their boundary. Similarly, the fourth inner diameter portion FF and the fifth inner diameter portion GG on the inner surface are connected by a tapered surface at their boundary. The inner diameter portion FF on the inner surface and the connected tapered surface correspond to a seal jam preventing space 337*b* to be described later, and the ridge lines of these surfaces correspond to sides of a pentagonal cross-section to be described later.

As illustrated in FIG. 16 to FIG. 18, the pair of the shutter side supporting portions 335*a*, which face each other and which have flake shapes obtained by cutting a cylinder in the axial direction, protrude from the nozzle receiver attachment portion 337 toward the container rear end. The ends of the two shutter side supporting portions 335*a* on the container rear side are connected to the shutter rear end supporting portion 335 that has a cup shape with a circular opening in the center of the bottom. The two shutter side supporting portions 335*a* face to each other, and thus, the cylindrical space S1 is defined by inner cylindrical surfaces of the shutter side supporting portions 335*a* and virtual cylindrical surfaces extending from the shutter side supporting portions 335*a*. The nozzle receiver attachment portion 337 includes the inner diameter portion GG, which is the fifth portion from the front end, as a cylindrical inner surface having the same inner diameter as the diameter of the cylindrical space S1. The slide area 332*d* of the container shutter 332 slides on the cylindrical space S1 and the cylindrical inner surface GG. The third inner surface EE of the nozzle receiver attachment portion 337 is a virtual circumferential surface that passes through longitudinal tips of nozzle shutter positioning ribs 337*a* that serve as abutting portions or convex portions and that are equally spaced at 45°. The container seal 333 with a quadrangular cylindrical (cylindrical tube shaped) cross section (the cross section in the cross-sectional view in FIG. 18) is arranged so as to correspond to the inner surface EE. The container seal 333 is attached to a vertical surface connecting the third inner surface EE and the fourth inner surface FF with adhesive agent or double-stick tape. The exposed surface of the container seal 333 opposite the attachment surface (the right side in FIG. 16 and FIG. 17) serves as an inner bottom of the cylindrical opening of the cylindrical nozzle receiver attachment portion 337 (the container opening).

Furthermore, as illustrated in FIG. 16 and FIG. 17, the seal jam preventing space 337*b* (a catch preventing space) is defined so as to correspond to the inner surface FF of the nozzle receiver attachment portion 337 and the connected tapered surface. The seal jam preventing space 337*b* is an annular sealed space enclosed by three different parts. Specifically, the seal jam preventing space 337*b* is an annular space enclosed by the inner surface (the fourth inner surface FF and the connected tapered surface) of the nozzle receiver attachment portion 337, the vertical surface on the attachment side of the container seal 333, and the outer surface from the front cylindrical portion 332*c* to the slide area 332*d* of the container shutter 332. A cross section of the annular space (the cross section illustrated in FIG. 16 and FIG. 17) is in the form of a pentagon. The angle between the inner surface of the nozzle receiver attachment portion 337 and the end surface of the container seal 333 and the angle between the outer surface of the container shutter 332 and the end surface of the container seal 333 are 90°.

Functions of the seal jam preventing space 337*b* will be described below. When the container shutter 332 moves toward the container rear end from the state in which the receiving opening 331 is closed by the container shutter 332, the inner surface of the container seal 333 slides against the front cylindrical portion 332*c* of the container shutter 332. Therefore, the inner surface of the container seal 333 is pulled by the container shutter 332 and elastically deformed so as to move toward the container rear end.

At this time, if the seal jam preventing space 337*b* is not provided but the vertical surface (the attachment surface of the container seal 333) continuing from the third inner surface is connected to the fifth inner surface GG so as to be perpendicular to each other, the following situation may occur. Specifically, the elastically-deformed portion of the container seal 333 may be caught between the inner surface of the nozzle receiver attachment portion 337 sliding against the container shutter 332 and the outer surface of the container shutter 332, resulting in causing a jam. If the container seal 333 is jammed in the portion where the nozzle receiver attachment portion 337 and the container shutter 332 slide against each other, that is, between the front cylindrical portion 332*c* and the inner surface GG, the container shutter 332 is firmly attached to the nozzle receiver attachment portion 337, so that the receiving opening 331 may not be opened and closed.

In contrast, the nozzle receiver 330 according to the present embodiment is provided with the seal jam preventing space 337*b* in the inner area thereof. The inner diameter of the seal jam preventing space 337*b* (the inner diameter of each of the inner surface EE and the connected tapered surface) is smaller than the outer diameter of the container seal 333. Therefore, the entire container seal 333 can hardly be entered into the seal jam preventing space 337*b*. Furthermore, an area of the container seal 333 to be elastically deformed by being pulled by the container shutter 332 is limited, and the container seal 333 can be restored by its own elasticity before the container seal 333 is brought to and jammed at the inner surface GG. With this action, it becomes possible to prevent a situation in which the receiving opening 331 cannot be opened and closed because of the attached state between the container shutter 332 and the nozzle receiver attachment portion 337.

As illustrated in FIG. 16 to FIG. 18, the multiple nozzle shutter positioning ribs 337*a* are provided so as to radially extend on the inner surface of the nozzle receiver attachment portion 337 that comes in contact with the outer periphery of the container seal 333. As illustrated in FIG. 16 and FIG. 17, when the container seal 333 is attached to the nozzle receiver attachment portion 337, the vertical surface of the container seal 333 on the container front side slightly protrudes relative to the front ends of the nozzle shutter positioning ribs 337*a* in the longitudinal direction.

As illustrated in FIG. 9, when the toner container 32 is attached to the toner replenishing device 60, the nozzle shutter flange 612*a* of the nozzle shutter 612 of the toner replenishing device 60 presses and deforms the protruding portion of the container seal 333 by being biased by the nozzle shutter spring 613. The nozzle shutter flange 612*a* further moves inward and abuts against the container front ends of the nozzle shutter positioning ribs 337*a*, thereby covering and sealing the front end surface of the container seal 333 from the outside of the container. Therefore, it becomes possible to ensure the sealing performance in the periphery of the conveying nozzle 611 at the receiving opening 331 in the attached state, enabling to prevent toner leakage.

The back side of a biased surface 612*f* of the nozzle shutter flange 612*a* biased by the nozzle shutter spring 613 abuts against the nozzle shutter positioning ribs 337*a*, so that the position of the nozzle shutter 612 relative to the toner container 32 in the longitudinal direction is determined. Therefore, a positional relationship of the front end surface of the container seal 333, the front end surface of a front end opening 305 (an inner space of the cylindrical nozzle receiver attachment portion 337 arranged in the container opening 33*a* as will be described later), and the nozzle shutter 612 in the longitudinal direction is determined.

Figure 19A:
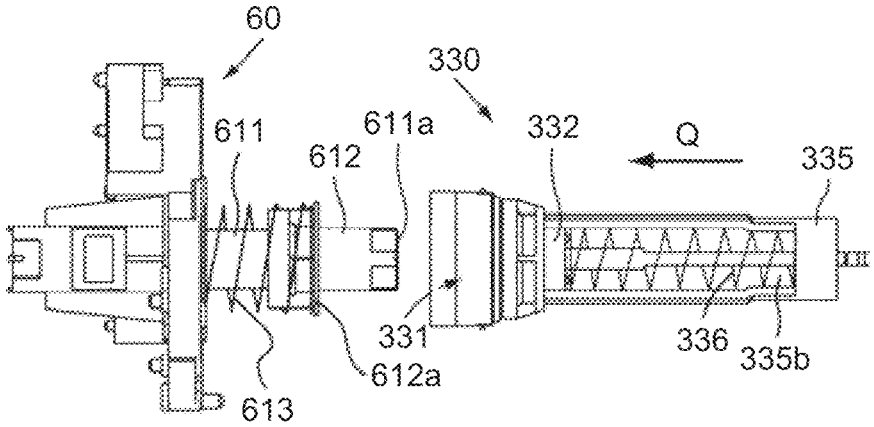
FIGS. 19A to 19D are top plan views for explaining states of an opening/closing member and a conveying nozzle in attachment operation.
Figure 19B:
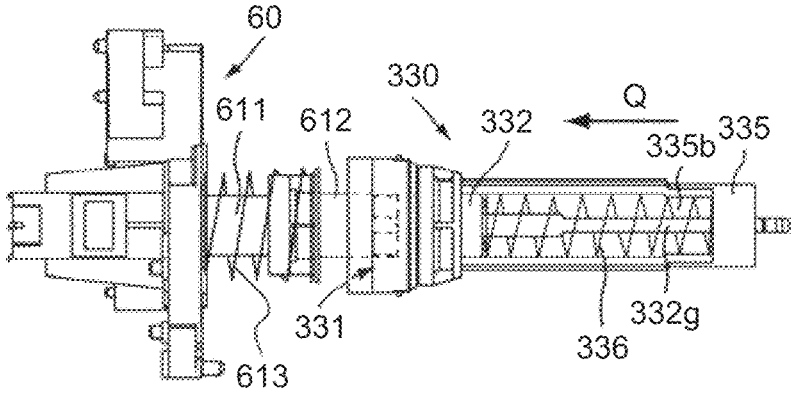
Figure 19C:
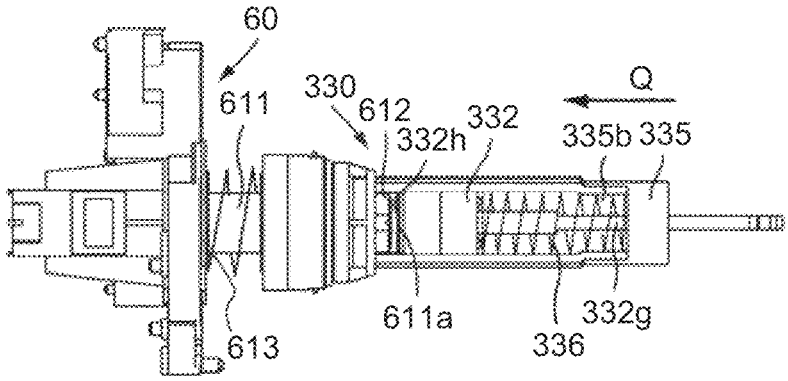
Figure 19D:
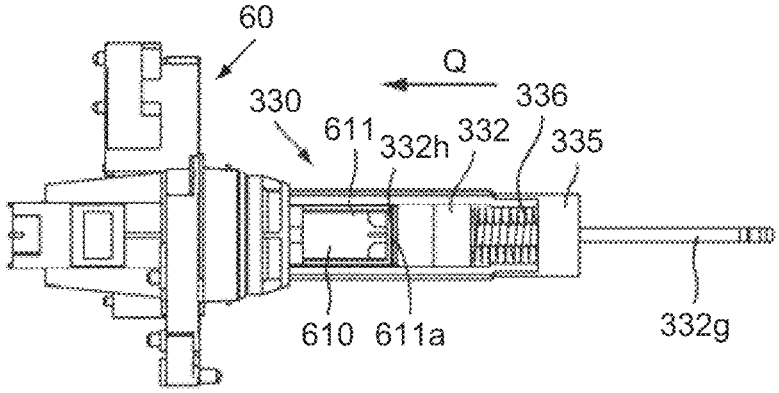

The operation of the container shutter 332 and the conveying nozzle 611 will be explained below with reference to FIG. 1. FIG. 9, and FIGS. 19A to 19D. Before the toner container 32 is attached to the toner replenishing device 60, as illustrated in FIG. 1, the container shutter 332 is biased by the container shutter spring 336 toward a closing position so as to close the receiving opening 331. The appearance of the container shutter 332 and the conveying nozzle 611 at this time is illustrated in FIG. 19A. When the toner container 32 is attached to the toner replenishing device 60, as illustrated in FIG. 19B, the conveying nozzle 611 is inserted in the receiving opening 331. When the toner container 32 is further pushed into the toner replenishing device 60, an end surface 332*h* of the front cylindrical portion 332*c*, which serves as an end surface of the container shutter 332 (hereinafter, referred to as "the end surface 332*h* of the container shutter"), and a front end 611*a* that is an end surface of the conveying nozzle 611 in the insertion direction (hereinafter, referred to as "the front end 611*a* of the conveying nozzle") come in contact with each other. When the toner container 32 is further pushed from the state as described above, the container shutter 332 is pushed as illustrated in FIG. 19C. Accordingly, the conveying nozzle 611 is inserted in the shutter rear end supporting portion 335 from the receiving opening 331 as illustrated in FIG. 19D. Therefore, as illustrated in FIG. 9. the conveying nozzle 611 is inserted in the container body 33 and located at a setting position. At this time, as illustrated in FIG. 19D, the nozzle hole 610 is located at a position overlapping the opening of shutter supporting portion 335*b*.

Subsequently, when the container body 33 is rotated, toner scooped up above the conveying nozzle 611 by the scooping portions 304 falls in and is introduced into the conveying nozzle 611 via the nozzle hole 610. The toner introduced into the conveying nozzle 611 is conveyed inside the conveying nozzle 611 toward the toner dropping passage 64 along with the rotation of the conveying screw 614. Subsequently, the toner falls in and is supplied to the developing device 50 through the toner dropping passage 64.

In the relationship between the toner container 32 and the toner replenishing device 60 according to the present embodiment, the conveying nozzle 611 is inserted to a position by penetrating through the inside of the container gear 301 in the longitudinal direction of the container body 33. Namely, the container gear 301 meshes with the container driving gear 601 at a position closer to the opening 33*a* than the nozzle hole 610 in the longitudinal direction of the container body 33 in a state in which the toner container 32 is attached to the main body of the image forming apparatus. Therefore, if the rotation drive is input to the container gear 301 via the container driving gear 601 in a direction A indicated in FIG. 4, a force generated at the position where the container driving gear 601 and the container gear 301 mesh with each other is applied to the container body 33, the conveying nozzle 611, or the nozzle receiver 330 that extend inside the container body 33. Therefore, the conveying nozzle 611 or the nozzle receiver 330 may be damaged or a gap may be generated between the conveying nozzle 611 and the nozzle receiver 330, resulting in toner leakage.

Furthermore, by causing the toner container 32 to slide in the attachment direction Q (pushing direction) on the toner container holder 70, the conveying nozzle 611 of the toner replenishing device 60 pushes open the container shutter 332 inside the receiving opening 331 of the toner container 32 and is entered into the container body 33. Therefore, if the relative position is deviated during the movement, toner leakage may occur, or the conveying nozzle 611, the container shutter 332, or the nozzle receiver 330 may be damaged. Therefore, it is desirable to perform the movement while the centers of the conveying nozzle 611, the container shutter 332, and the receiving opening 331 are located on the same axis as best as possible.

Furthermore, the rotation center of the container gear 301 is on the same line as the axis of the container opening 33*a* (the container body 33). Therefore, to mesh the container gear 301 with the container driving gear 601 at a correct position without causing gear mesh fault, it is important to determine the radial position of the toner container 32 relative to the toner replenishing device 60 by mating the container opening 33*a* to the container setting section 615.

For example, while it may be possible to restrict the positional relationship between the toner container 32 and the toner replenishing device 60 by uniformly using a long guide extending in the axial direction of the toner container 32, if the number of directions to be restricted is small, it becomes difficult to achieve adequate regulation. Alternatively, it may be possible to provide multiple restrictors so as to determine the positional relationship between the toner container 32 and the toner replenishing device 60 from the beginning of the attachment. However, in this case, positioning (movement restriction) is performed by the multiple restrictors from an early stage of the movement in the attachment direction Q (pushing direction), so that a push resistance increases and the operability may be degraded.

Therefore, in the present embodiment, the container opening 33*a* is to mate with the container setting section 615 arranged around the conveying nozzle 611, and the position of the toner container 32 relative to the toner replenishing device 60 is determined by causing the container opening 33*a* and the container setting section 615 to mate with each other. Therefore, it becomes possible to stabilize the relative position of the toner container 32 and the toner replenishing device 60 and to reduce the influence of the force generated at the meshing portion between the container driving gear 601 and the container gear 301.

Furthermore, as illustrated in FIG. 32, a positioning portion 600 serving as a guiding portion to enable restriction and release with respect to the toner replenishing device 60 in the attachment direction Q of the toner container 32 is arranged on the toner container 32. Therefore, it becomes possible to move the toner container 32 toward the toner replenishing device 60 in the attachment direction Q while the centers of the conveying nozzle 611 and the nozzle receiver 330 are located on the same axis as best as possible. Consequently, it becomes possible to prevent totter leakage and prevent the conveying nozzle 611 and the nozzle receiver 330 from being damaged. Incidentally, the positioning portion 600 includes multiple positioners (restrictors or regulators) arranged in the attachment direction Q. While FIG. 32 is a perspective view for explaining the positional relationship between the multiple positioners and the toner replenishing device 60. the configurations of the multiple positioners are mainly illustrated and other configurations are omitted or simplified to avoid complication.

The positioning portion 600 performs positioning (restricts movement in a predetermined direction) by using the container front end cover 34 that defines an external shape of the toner container 32 when the toner container 32 is being moved in the attachment direction Q on the toner container holder 70. The positioning portion 600 performs positioning by using the container opening 33*a* of the container body 33 that defines an internal shape of the toner container 32 when the toner container 32 is located in the setting position in the toner replenishing device 60. Incidentally, the positioning portion 600 serving as the guiding portion restricts movement in any of directions other than the attachment direction Q of the toner container 32 when the toner container 32 is being moved in the attachment direction Q on the toner container holder 70, to thereby guide the toner container 32 to the toner replenishing device 60. Specifically, when the toner container 32 is attached to the main body of the image forming apparatus, the guiding portion restricts the movement of the toner container 32 in a direction other than the attachment direction while the toner container 32 is being moved, and guides the opening 33*a* to the container setting section 615.

In the positioning portion 600, the pair of the sliding guides 361 and 361, the engaged openings 339*d*, the multiple (three) protrusions 341*a*, the rotation restrictive rib 342*a*, and the container opening 33*a* serve as positioners. Of these components, the sliding guides 361 and 361 and the engaged openings 339*d*, the multiple (three) protrusions 341*a* are integrally provided and arranged on the container front end cover 34 that is made of resin. The container opening 33*a* is integrated with the container body 33.

Figure 38A:
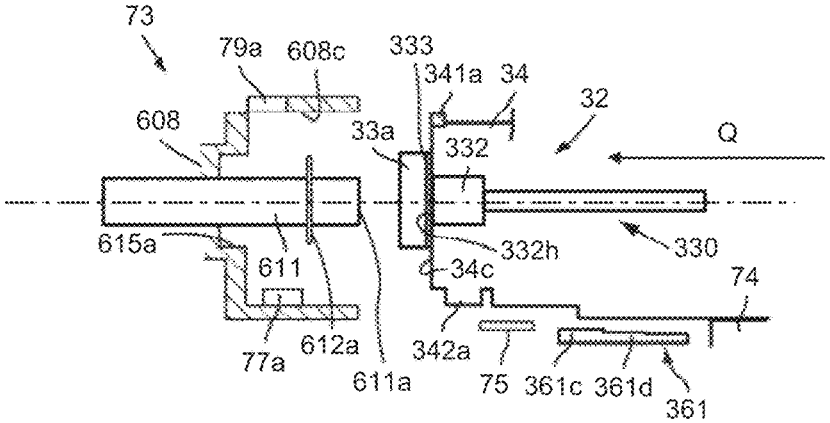
FIG. 38A is a schematic diagram illustrating the powder container on the container holding section when the powder container starts to move.

The order of restriction and release of all of the positioners with respect to the toner replenishing device 60 will be described below. First, as illustrated in FIG. 38A, when a user places the toner container 32 on the gutter 74 of the container receiving section 72 of the toner container holder 70 and pushes the toner container 32 in the attachment direction Q (performs attachment operation), the toner container 32 slides on the gutter 74. At this time, as illustrated in FIG. 22, the toner container 32 slides while the side portions of upward guide 35*b* of the toner container 32 conic in contact with the projections 76*a* provided on the ceiling surface 76 facing the gutter 74. Therefore, the toner container 32 can be pushed in the attachment direction Q while the movement in the vertical direction Z is restricted. Furthermore, the movement in the vertical direction is restricted not by the top portion of upward guide 35*a* but by the side portions of upward guide 35*b* provided on the both sides of the top portion of upward guide 35*a*. Therefore, even when the toner container 32 is deviated in the horizontal direction during the attaching operation, the toner container 32 can reliably be brought into contact with the ceiling surface 76 side.

Figure 35:
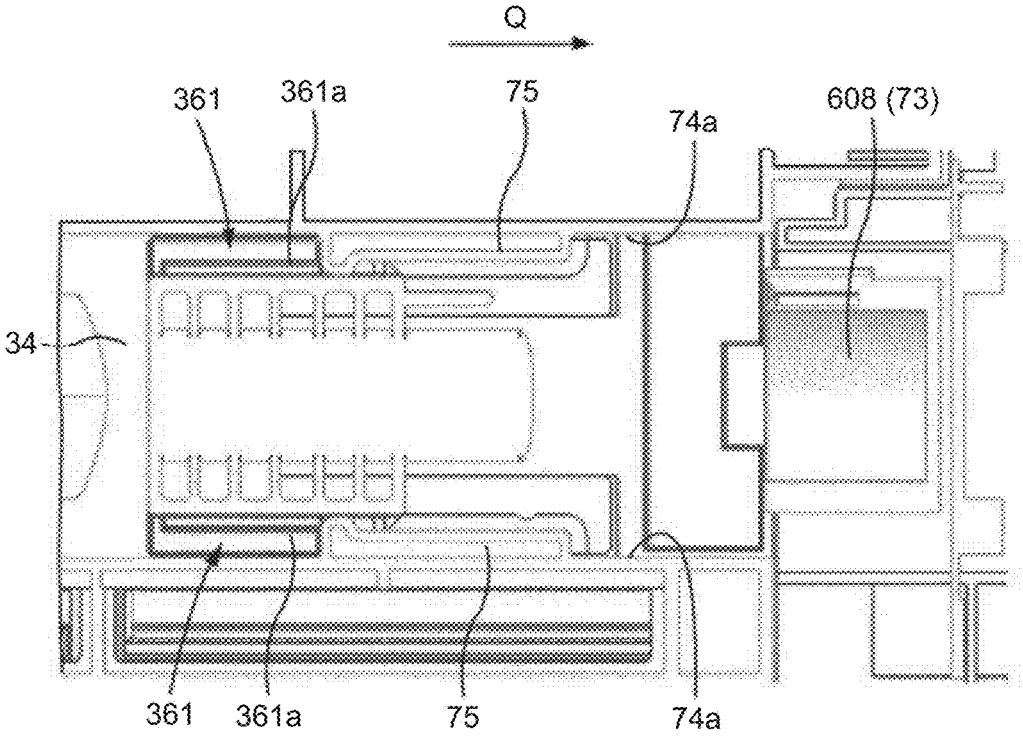
FIG. 35 is an enlarged view of a portion on a reference line X2 in FIG. 33 viewed from above.
Figure 36:
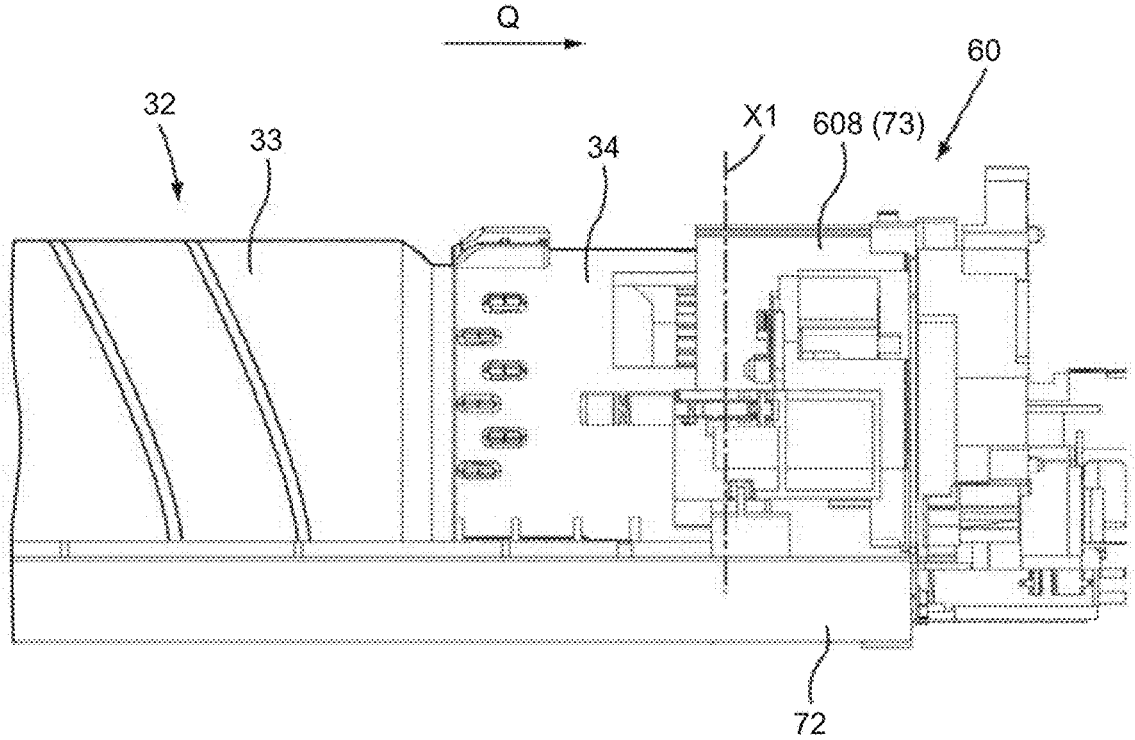
FIG. 36 is an enlarged view of the powder container attached to the container holding section.
Figure 37:
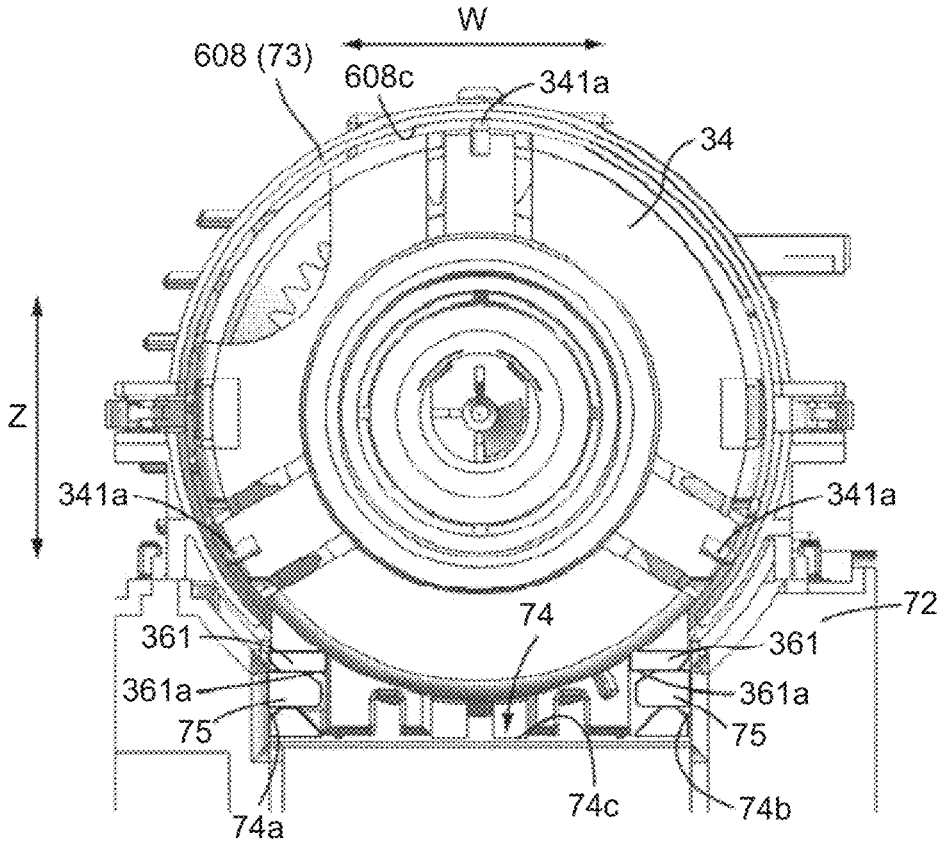
FIG. 37 is an enlarged view of a portion on a reference line X1 in FIG. 36 viewed from the attachment direction.
Figure 38B:
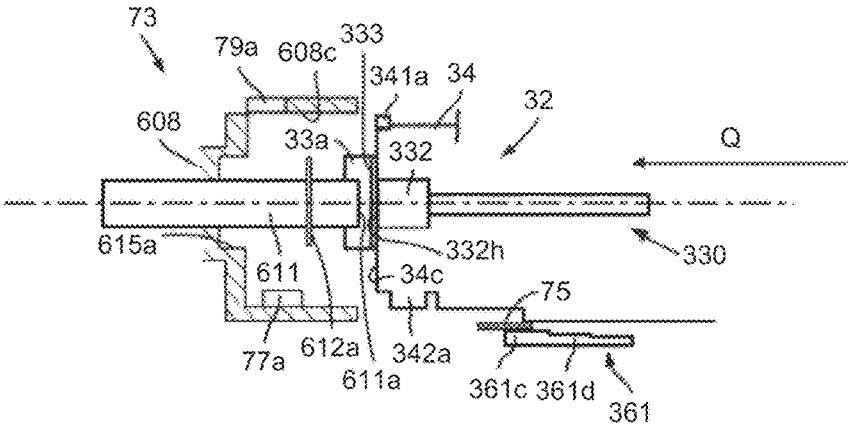
FIG. 38B is a schematic diagram illustrating a first restricted state obtained by vertical restrictors.

On the toner replenishing device 60 side, as illustrated in FIG. 38B, the front of the sliding groove 361*c* serving as the first guides are entered into the most upstream side of the respective guide rail 75 in the attachment direction Q. Due to the entrance of the front of the sliding groove 361*c* into the guide rail 75, the sliding guide 361 get on the guide rail 75 and the toner container 32 that has been in contact with the top surface of the gutter 74 is lifted upward. The guide rails 75 and 75 are provided on the side surfaces 74*a* and 74*b* of the gutter 74 so as to be spaced apart from the mounting surface 74*c* of the gutter 74. Therefore, by causing the front of the sliding groove 361*c* to enter into the guide rail 75, it becomes possible to roughly determine the positions in the width direction W perpendicular to the attachment direction Q and in the vertical direction Z. This state will be described as a first restricted state. FIG. 33, FIG. 34, FIG. 35, and FIG. 38B are diagrams illustrating the first restricted state. FIG. 33 is a side view illustrating the first restricted state. FIG. 34 is a diagram of a portion on a reference line X1 in FIG. 33 viewed from the attachment direction. FIG. 35 is a diagram of a portion on a reference line X2 in FIG. 33 viewed from above. Incidentally, the reference line X1 illustrated in FIG. 33 indicates the position of the end surface of the container front end cover 34 and the same applies to the other figures described below.

Figure 38C:
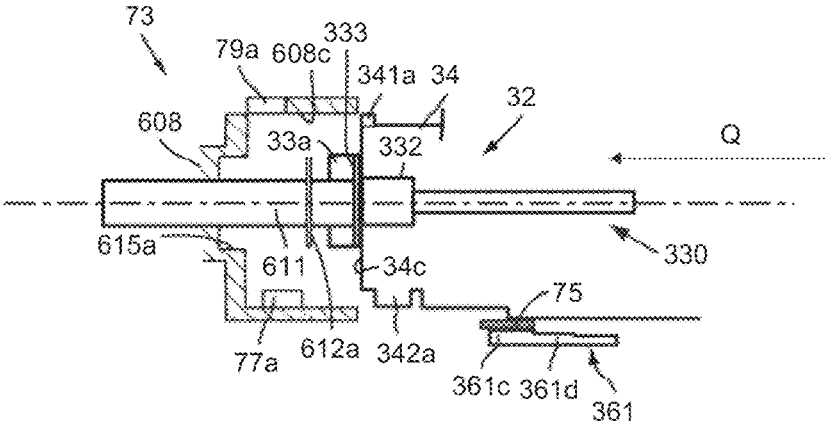
FIG. 38C is a schematic diagram illustrating a state in which the conveying nozzle and a container shutter come in contact with each other.

When the toner container 32 in the first restricted state is further pushed in the attachment direction Q. as illustrated in FIG. 38C, the end surface of the container shutter 332*h* and the front end of the conveying nozzle 611*a* come in contact with each other. In the first restricted state, the sliding guides 361 and the guide rails 75 regulate the width direction W and the vertical direction Z, so that the container shutter 332 can face the conveying nozzle 611 as desired and the positional relationship between the receiving opening 331 and the conveying nozzle 611 can be ensured. By ensuring the positional relationship between the receiving opening 331 and the conveying nozzle 611, it becomes possible to prevent the container seal 333 from being detached or damaged due to insertion of the container shutter 332 into the conveying nozzle 611 in a deviated manner.

Figure 38D:
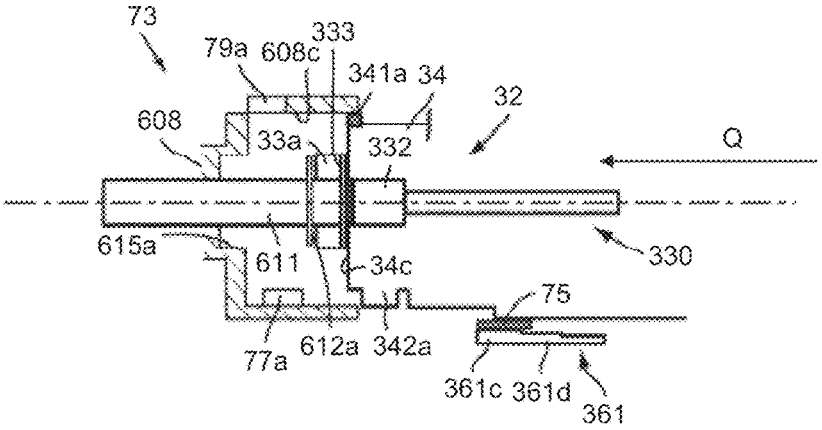
FIG. 38D is a schematic diagram illustrating a second restricted state obtained by radial restrictors.

When the toner container 32 in this state is further pushed in the attachment direction Q, a second restricted state as illustrated in FIG. 28, FIG. 29, and FIG. 38D is obtained. In the second restricted state, the front end of the container front end cover 34 is entered into the container cover receiving section 73. Due to the entrance of the front end of the container front end cover 34 into the container cover receiving section 73, the three protrusions 341*a* provided at evenly-spaced circumferential positions on the outer surface of a front end of container front end cover 34*c* in the attachment direction come in contact with, from the inner side, the inner surface of setting cover 608*c* being a part of the container cover receiving section 73. It is preferable to form at least three protrusions as the protrusions 341*a*, but the number of the protrusions is not limited to three.

Due to the contact between the protrusions 341*a* and the inner surface of setting cover 608*c*, the movement of the toner container 32 is guided and the radial movement of the toner container 32 is restricted. Therefore, in the second restricted state, the radial movement of the container front end cover 34 relative to the container cover receiving section 73 is restricted by the contact between the three protrusions 341*a* and the inner surface of setting cover 608*c*. Namely, the radial position of the container front end cover 34 relative to the container cover receiving section 73 is restricted. Meanwhile, the regulation of the position in a predetermined direction means restriction of the movement of the toner container 32 in the predetermined direction.

Figure 44A:
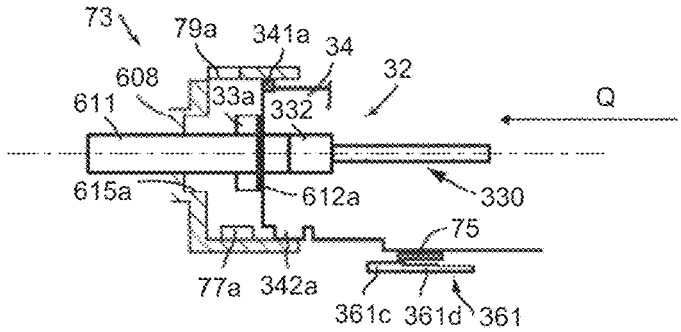
FIG. 44A is a schematic diagram illustrating the powder container on the container holding section when a nozzle shutter flange and a container seal come in contact with each other.

When the toner container 32 in the second restricted state is further pushed in the attachment direction Q, the container seal 333 and the nozzle shutter flange 612*a* come in contact with each other as illustrated in FIG. 44A. In the second restricted state, the radial direction is restricted by the protrusions 341*a* and the inner surface of setting cover 608*c*, in addition to the regulation in the width direction W and the vertical direction Z by the guide rails 75 and the sliding guides 361; therefore, the centers of the container shutter 332 and the conveying nozzle 611 coincide with each other. Accordingly, it becomes possible to prevent the attachment operation from being performed when the toner container 32 is inclined in the width direction W or the vertical direction Z with respect to a contact surface between the end surface of the container shutter 332*h* and the front end of the conveying nozzle 611*a* or with respect to the sliding guides 361. Therefore, it becomes possible to prevent the conveying nozzle 611 and the container shutter 332 from being broken or prevent the container seal 333 from being detached. Furthermore, a force applied to the sliding guides 361 due to the attachment operation is distributed to the protrusions 341*a*, so that the force can be reduced. Therefore, it becomes possible to prevent a defect such as breakage or damage of the sliding guides 361.

Figure 39:
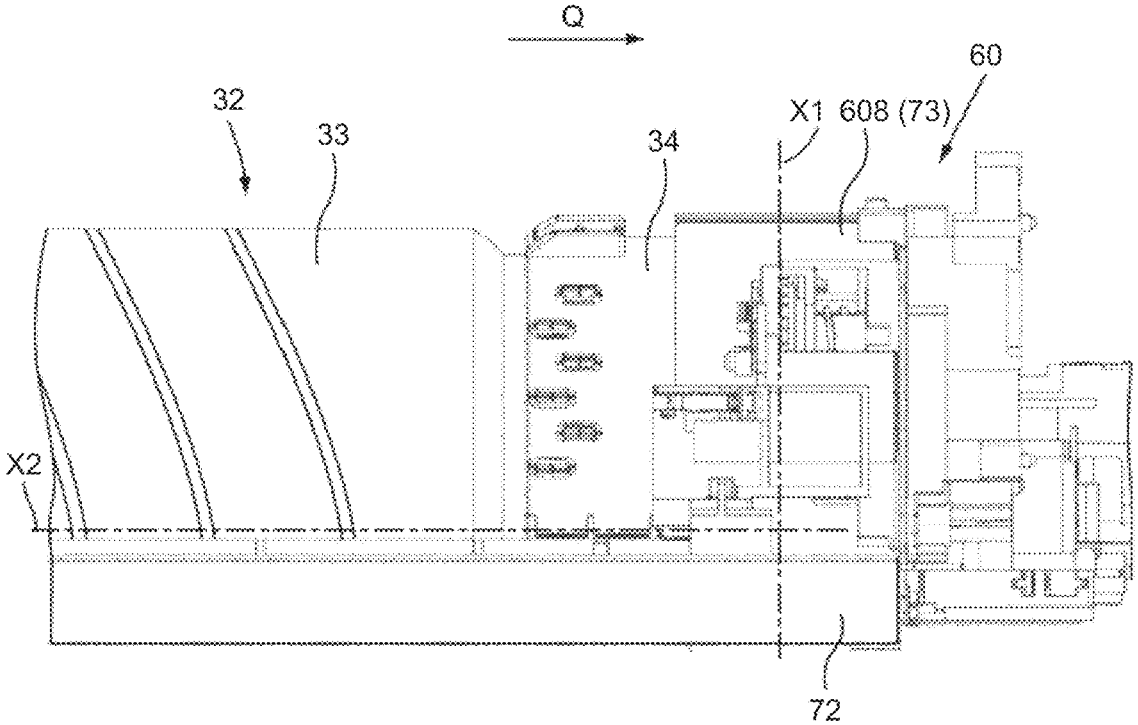
FIG. 39 is an enlarged view of the powder container attached to the container holding section.
Figure 40:
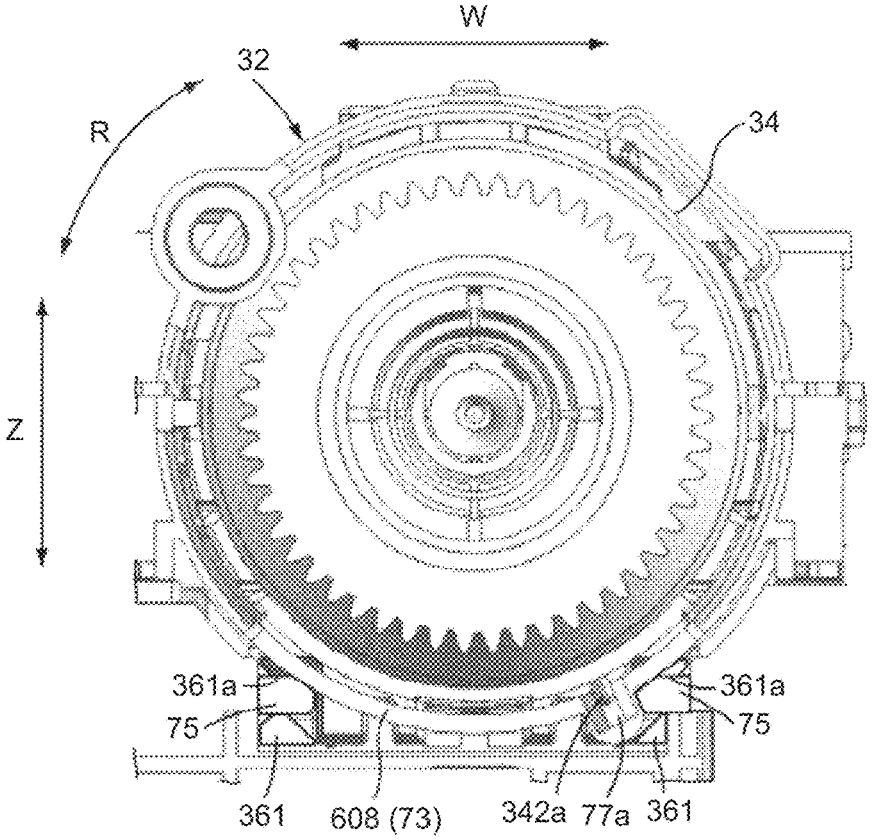
FIG. 40 is an enlarged view of a portion on a reference line X1 in FIG. 39 viewed from the attachment direction.
Figure 41:
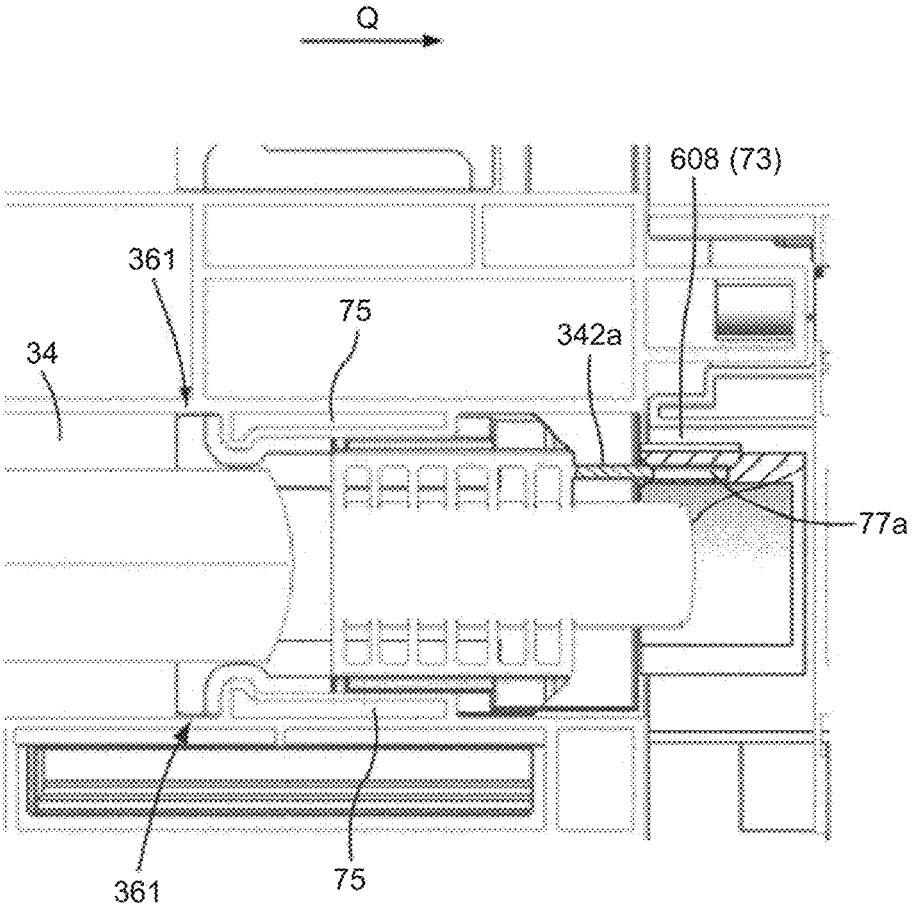
FIG. 41 is an enlarged view of a portion on a reference line X2 in FIG. 39 viewed from above.
Figure 44B:
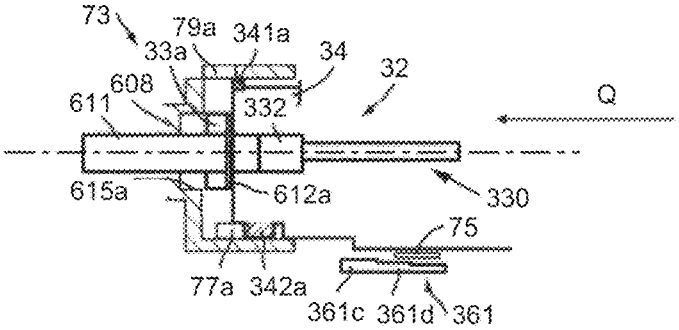
FIG. 44B is a schematic diagram illustrating a third restricted state obtained by a circumferential restricting groove.

When the toner container 32 is further pushed in the attachment direction Q in the state in which the container seal 333 and the nozzle shutter flange 612*a* come in contact with each other as illustrated in FIG. 44A, the fronts of the sliding grooves 361*c* come off from the guide rails 75, and the restriction in the vertical direction Z is implemented by the centers of the sliding grooves 361*d*, serving as second guides, of the sliding grooves as illustrated in FIG. 44B. When the toner container 32 in this state is further pushed in the attachment direction Q, a third restricted state as illustrated in FIG. 39 to FIG. 41 is obtained. In the third restricted state, the rotation restrictive rib 342*a* provided on the outer surface of the front end of the container front end cover 34 are entered into the groove 77*a* of the setting cover 608 as illustrated in FIG. 44B. Therefore, the container front end cover 34 and the setting cover 608 (the container cover receiving section 73) are integrated and the circumferential movement is additionally restricted by the container front end cover 34. At this time, because the vertical direction Z is restricted by the centers 361*d* having wider gaps than those of the fronts of the sliding grooves 361*c*, sliding resistance during the insertion can be reduced, which is preferable in terms of the operability.

Figure 42:
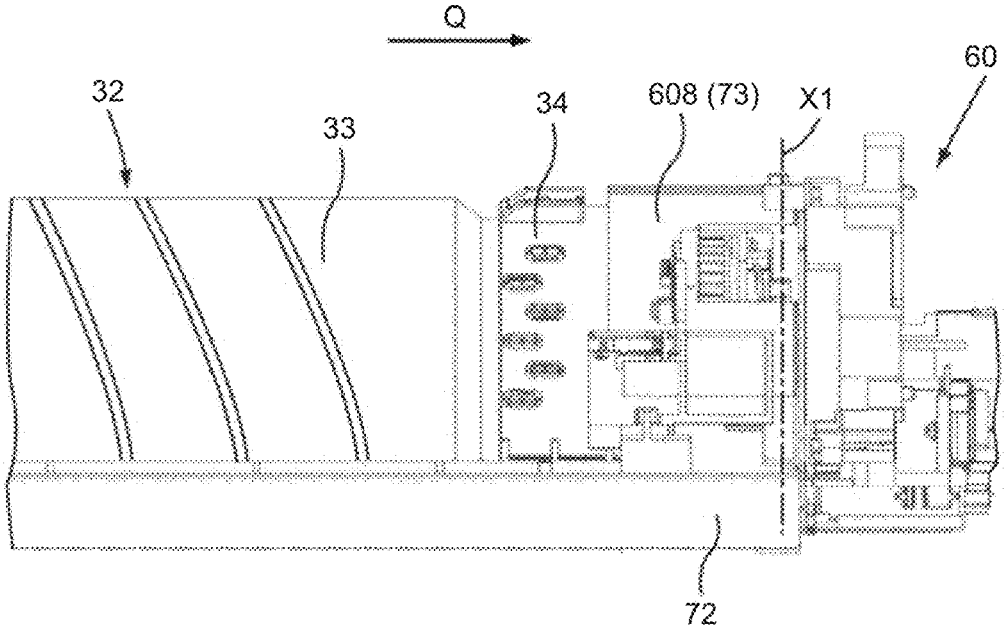
FIG. 42 is an enlarged view of the powder container attached to the container holding section.
Figure 43:
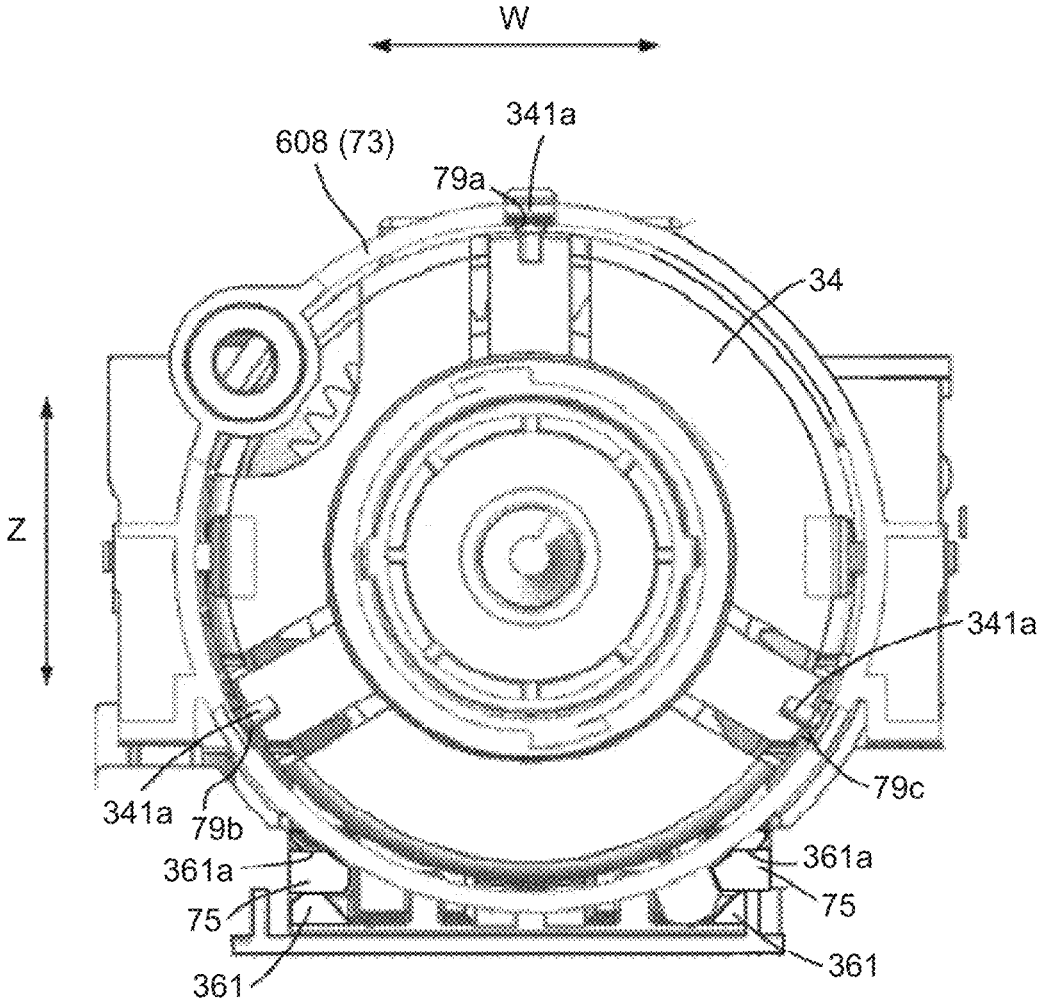
FIG. 43 is an enlarged view of a portion on a reference line X1 in FIG. 42 viewed from the attachment direction.
Figure 44C:
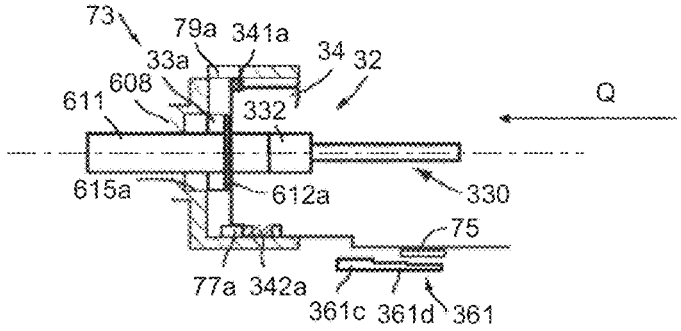
FIG. 44C is a schematic diagram illustrating a fourth restricted state obtained by the radial restrictors.

When the toner container 32 in the third restricted state is further pushed in the attachment direction Q, a fourth restricted state as illustrated in FIG. 42, FIG. 43, FIG. 44C is obtained. In the fourth restricted state, the three protrusions 341*a* on the container front end cover 34 are located opposite the through holes 79*a* provided on the setting cover 608K or the recesses 79*b* of the setting cover 608 (Y,M,C). Therefore, the protrusions 341*a* are entered into the through holes 79*a* of the setting cover 608K or be located inside the recess 79*b* of the setting cover 60 (Y,M,C), and the radial restriction of the container front end cover 34 by the protrusions 341*a* and the inner surface of setting cover 608*c* is released.

Figure 44D:
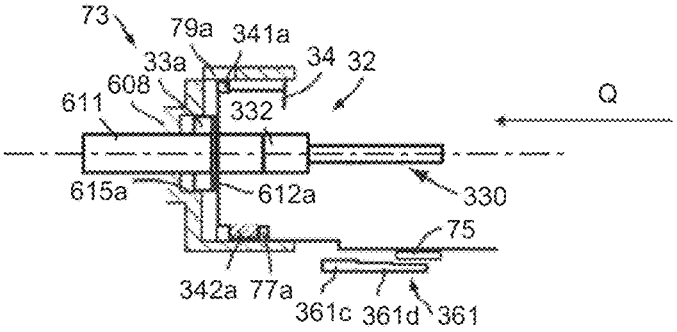
FIG. 44D is a schematic diagram illustrating a fifth restricted state in which the container opening is entered into a container setting section.
Figure 45:
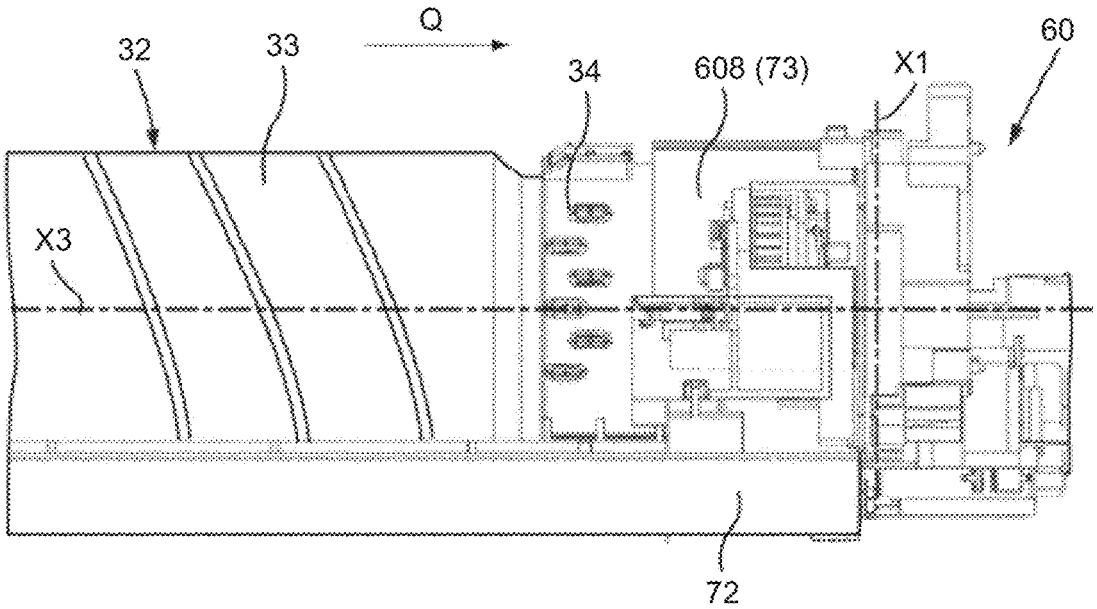
FIG. 45 is an enlarged view of the powder container attached to the container holding section.
Figure 46:
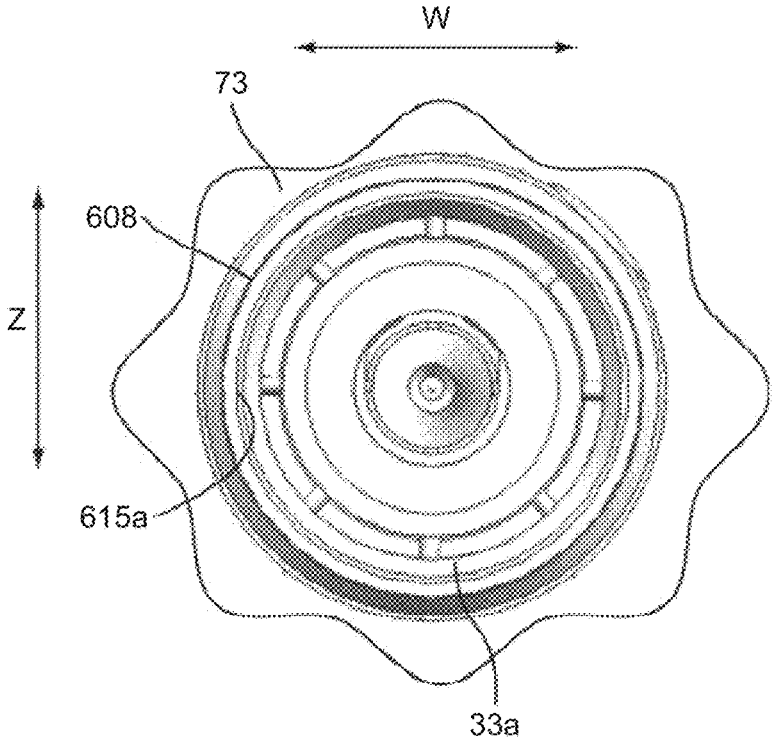
FIG. 46 is an enlarged view of a portion on a reference line X1 in FIG. 45 viewed from the attachment direction.
Figure 47:
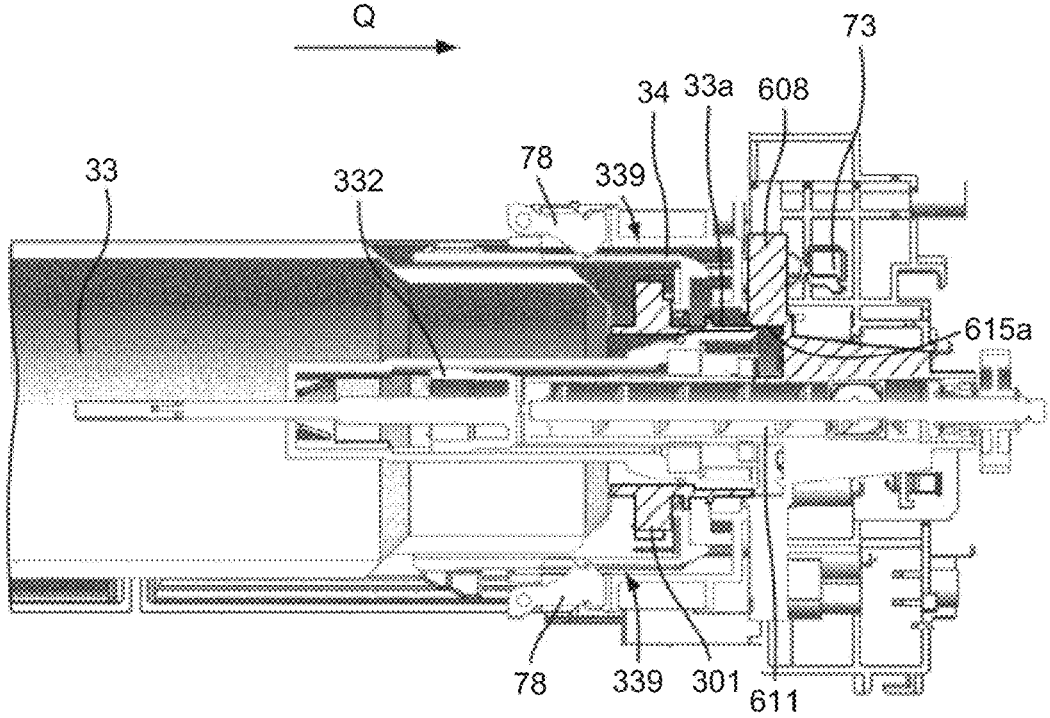
FIG. 47 is an enlarged view of a portion on a reference line X3 in FIG. 45 viewed from above.

When the toner container 32 in the fourth restricted state is further pushed in the attachment direction Q, a fifth restricted state as illustrated in FIG. 45, FIG. 46, and FIG. 47 is obtained. In the fifth restricted state, as illustrated in FIG. 44D, the front end of the container opening 33*a* is entered into the inner surface of container setting section 615*a* (the setting cover 608) serving as a positioner of the container setting section. Therefore, the container body 33 is rotatable supported inside the inner surface of container setting section 615*a*. At this time, the circumferential position of the container front end cover 34 is restricted by the rotation restrictive rib 342*a* and the groove 77*a* of the setting cover, so that the container opening 33*a* and the container setting section 615 can be mate with each other such that the respective centers coincide with each other. Therefore, it becomes possible to prevent toner leakage from the container shutter 332 due to insertion of the container opening 33*a* into the container setting section 615 in a deviated manner. Furthermore, when the container opening 33*a* is entered into the inner surface of container setting section 615*a*, the radial restriction by the protrusions 341*a* is already released, so that the circumferential restriction by the rotation restrictive rib 342*a* is not interfered.

Figure 44E:
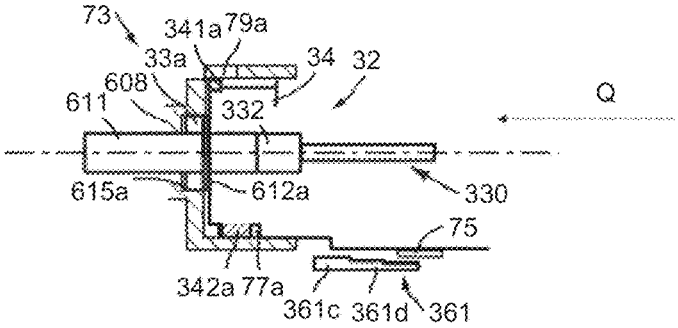
FIG. 44E is a schematic diagram illustrating a sixth restricted state in which the powder container is held in a final setting position.
Figure 48:
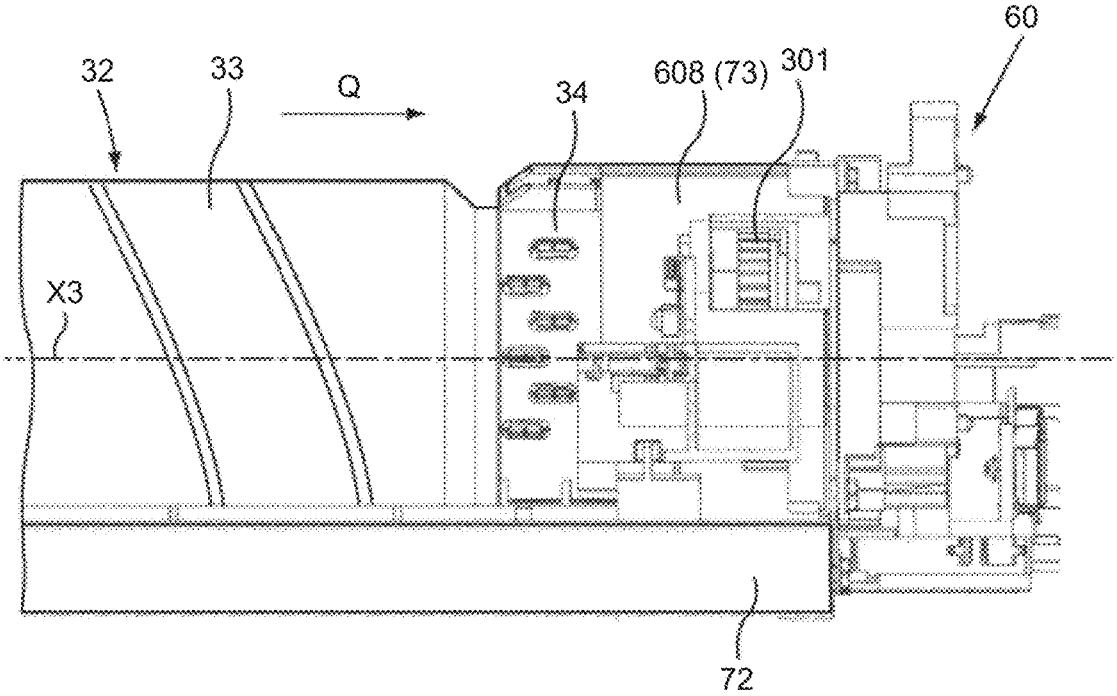
FIG. 48 is an enlarged view of the powder container attached to the container holding section.

When the toner container 32 in the fifth restricted state is further pushed in the attachment direction Q, a sixth restricted state as illustrated in FIG. 44E, FIG. 48, and FIG. 49 is obtained. In the sixth restricted state, the container opening 33*a* is entered further into the inner surface of container setting section 615*a*, and the replenishing device engaging members 78 and 78 are entered into and engaged with the respective engaged openings 339*d* of the container engaged portions 339 and 339 as illustrated in FIG. 49. Therefore, the toner container 32 is prevented from moving in the longitudinal direction (the rotation axis direction) and is maintained in the setting position.

Incidentally, a backlash may be provided in the positions in which the replenishing device engaging members 78 and 78 are entered into the respective engaged openings 339*d* of the container engaged portions 339 and 339 in the longitudinal direction. With this, it becomes possible to cause the replenishing device engaging members 78 and 78 to be reliably entered into the respective engaged openings 339*d* of the container engaged portions 339 and 339 and to prevent a defective setting of the toner container 32 in the toner replenishing device 60 even when the accuracies of components or mount positions of components vary, which is a preferable configuration.

Figure 44F:
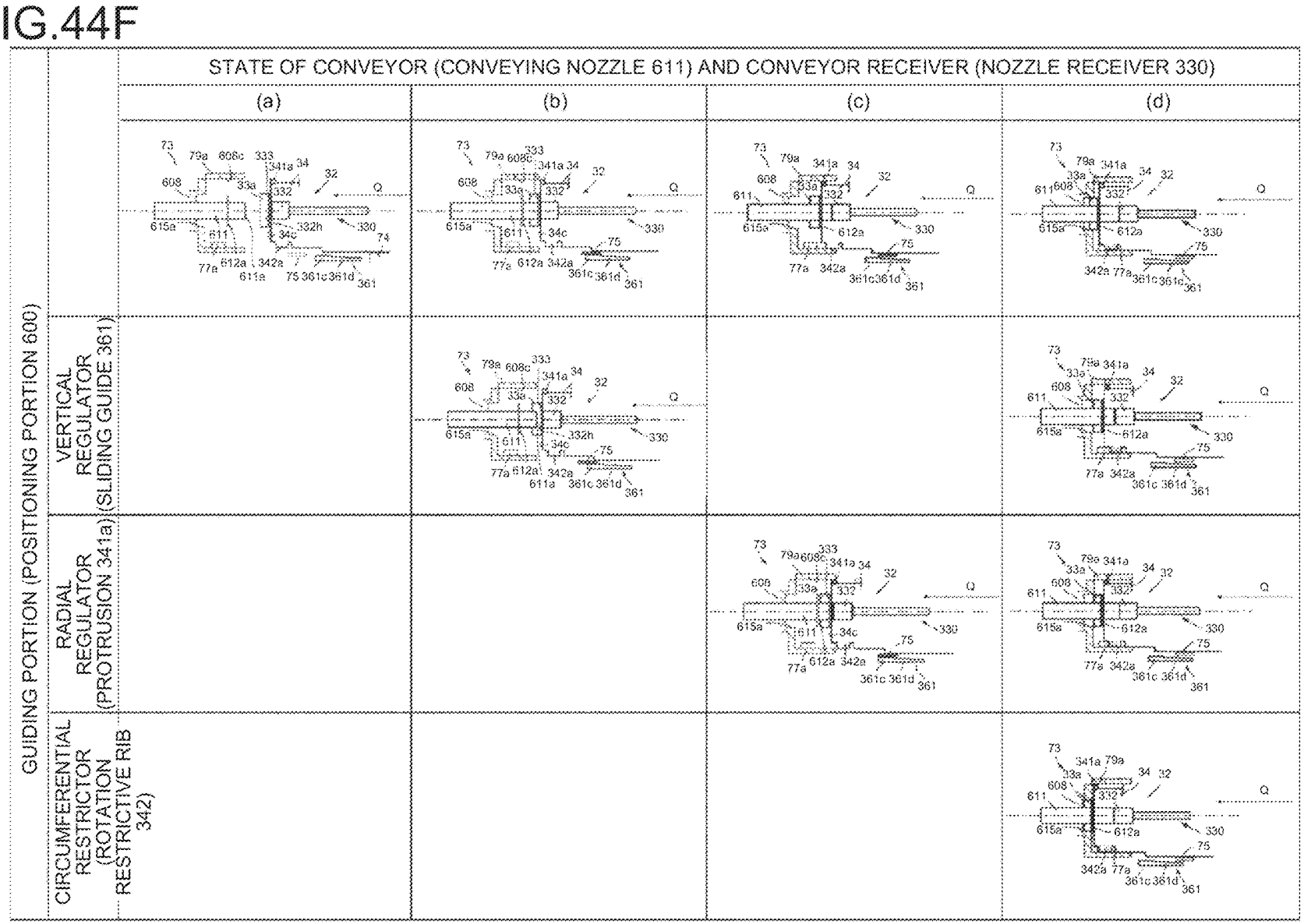
FIG. 44F illustrates a relationship of the states of the conveying nozzle and the nozzle receiver in the attachment operation (horizontal row) and the restricted states of the powder container (vertical column)

FIG. 44F illustrates a relationship of the state of the conveying nozzle 611 and the nozzle receiver 330 in the attachment operation (horizontal row) and the restricted state of the toner container 32 (vertical column). The horizontal row in FIG. 44F illustrates a contact state of the conveying nozzle 611 and the nozzle receiver 330. Specifically, (a) illustrates a state in the beginning of the movement and before the conveying nozzle 611 and the nozzle receiver 330 come in contact with each other, (b) illustrates a state in which the end surface of the container shutter 332*h* and the front end of the conveying nozzle 611*a* come in contact with each other, (c) illustrates a state in which the container seal 333 and the nozzle shutter flange 612*a* come in contact with each other, and (d) illustrates a state in which the container opening 33*a* mates with the container setting section 615. The vertical column in FIG. 44F illustrates which one of the guiding portions is used from among the sliding guides 361 for restricting movement in the vertical direction, the protrusions 341*a* for restricting movement in the radial direction, and the rotation restrictive rib 342*a* for restricting movement in the circumferential direction in order to restrict the movement of the toner container 32 in the states (a) to (d) illustrated in the horizontal row. For example, to obtain the state (b), in which the end surface of the container shutter 332*h* and the front end of the conveying nozzle 611*a* come in contact with each other, the sliding guides 361 restrict the movement in the vertical direction.

As described above, the positional relationship between the toner container 32 and the toner replenishing device 60 can be determined by restricting and releasing the toner container 32 and the toner replenishing device 60 in the stepped manner along with the movement of the toner container 32 in the attachment direction Q relative to the toner replenishing device 60. Therefore, it becomes possible to stabilize the positions of the centers of the conveying nozzle 611. the container shutter 332, and the receiving opening 331. Therefore, it becomes possible to improve the operability in the attachment operation, prevent breakage of the conveying nozzle 611, the container shutter 332, or the receiving opening 331, and prevent toner leakage.

Second Embodiment

Figure 50:
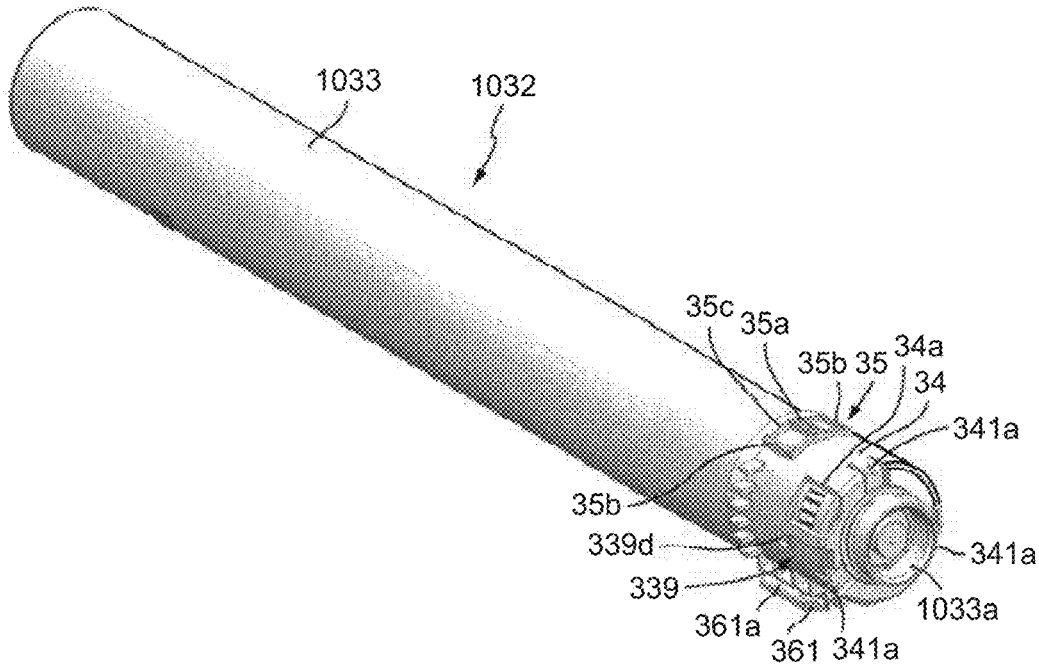
FIG. 50 is an explanatory perspective view of a powder container according to the second embodiment.

FIG. 50 is an explanatory perspective view of a toner container 1032 according to a second embodiment. The toner container 1032 is a toner bottle in the form of an approximate cylinder. The toner container 1032 mainly includes the container front end cover 34 that is non-rotatably held by the toner container holder 70, and includes a container body 1033 serving as a powder storage in which a container gear 1301 serving as a gear of the container is integrally provided. Similarly to the first embodiment, the toner container 1032 is detachably attached to the toner replenishing device 60 and is able to slide in the longitudinal direction on the toner container holder 70 of the toner replenishing device 60 (see FIG. 5 and FIG. 20).

The toner container 1032 differs from the toner container 32 explained in the first embodiment in that the container body 1033 is configured in a different manner, but the other configurations are the same as those of the toner container 32. Therefore, the configuration of the container body 1033 will be mainly explained below.

Figure 51A:
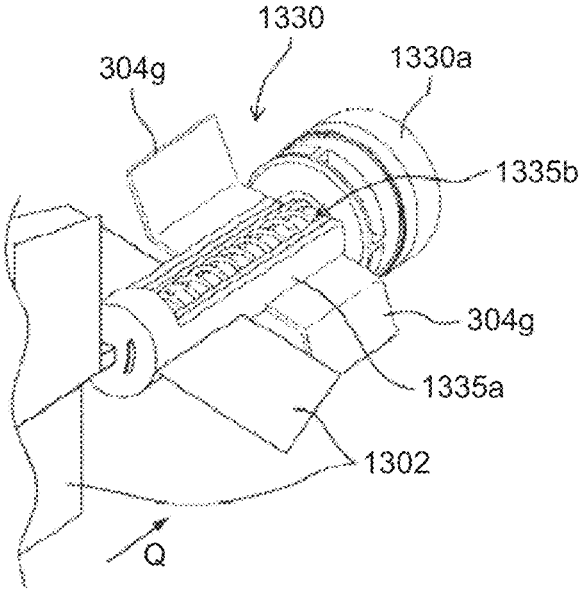
FIG. 51A is an explanatory perspective view of a nozzle receiver including scooping ribs as scooping portions.
Figure 51B:
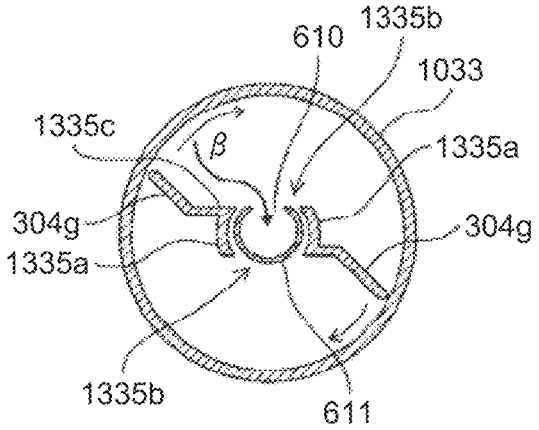
FIG. 51B is an explanatory cross-sectional view of the nozzle receiver illustrated in FIG. 51A when the nozzle receiver is attached to the container body.
Figure 51C:
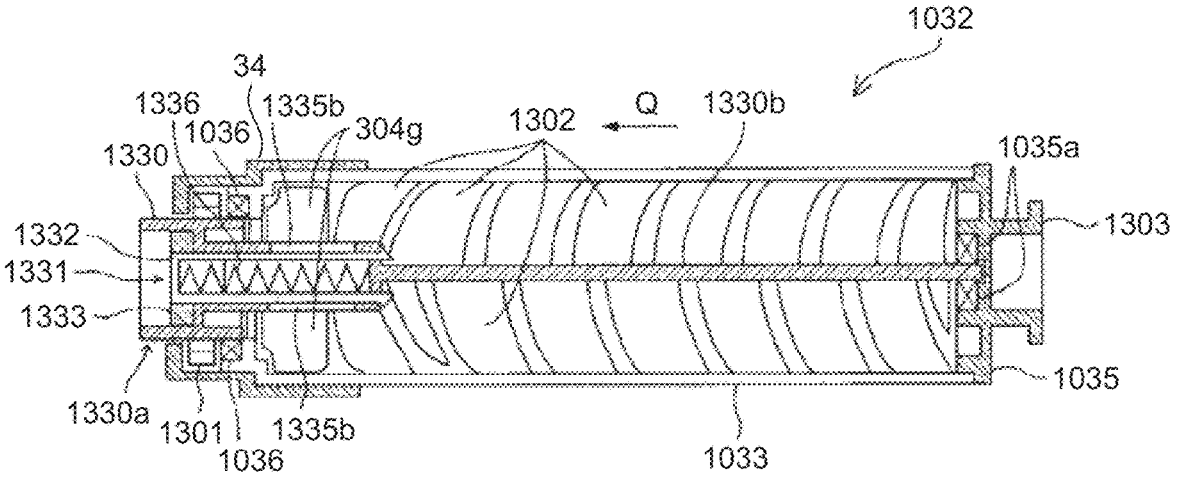
FIG. 51C is an explanatory lateral cross-sectional view of the entire powder container to which the nozzle receiver illustrated in FIG. 51A is attached.
Figure 51D:
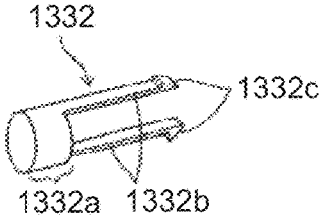
FIG. 51D is a perspective view of a container shutter of the powder container illustrated in FIG. 51C.

The container body 1033 is a cylindrical member made of resin. The container body 1033 stores therein toner serving as powder developer and includes a conveyor inside thereof. A scooping function is provided in a part of the conveyor. The configuration will be explained below with reference to FIGS. 51A to 51D, FIG. 51A is a perspective view of the nozzle receiver 330 integrated with scooping ribs 304*g* corresponding to the scooping wall surfaces 304*f* (hereinafter, the nozzle receiver is referred to as a "nozzle receiver 1330"). FIG. 51B is a cross-sectional view for explaining a relationship between the nozzle receiver 1330 illustrated in FIG. 51A and the conveying nozzle 611 when the nozzle receiver 1330 is arranged inside the container body 1033. FIG. 51C is an explanatory lateral cross-sectional view of the entire toner container 1032 on which the nozzle receiver 1330 illustrated in FIG. 51A is mounted. FIG. 51D is a perspective view of a container shutter 1332 as a part of the toner container 1032.

The nozzle receiver 1330 illustrated in FIGS. 51A to 51D includes the scooping ribs 304*g* as described above, and is integrated with a conveying blade holder 1330*b* to which conveying blades 1302 made of a flexible material, such as a resin film, are provided.

Furthermore, the nozzle receiver 1330 illustrated in FIGS. 51A to 51D includes a container seal 1333 serving as a seal, a receiving opening 1331 serving as a nozzle insertion opening, the container shutter 1332, and a container shutter spring 1336 serving as a biasing member. The container seal 1333 is a seal including a front surface that faces and comes in contact with the nozzle shutter flange 612*a* of the nozzle shutter 612 held by the conveying nozzle 611 when the toner container 1032 is attached to the main body of the copier 500. The receiving opening 1331 is an opening in which the conveying nozzle 611 is inserted. The container shutter 1332 is a shutter that opens and closes the receiving opening 1331. The container shutter spring 1336 is a biasing member that biases the container shutter 1332 to a closing position so as to close the receiving opening 1331.

Figure 52:
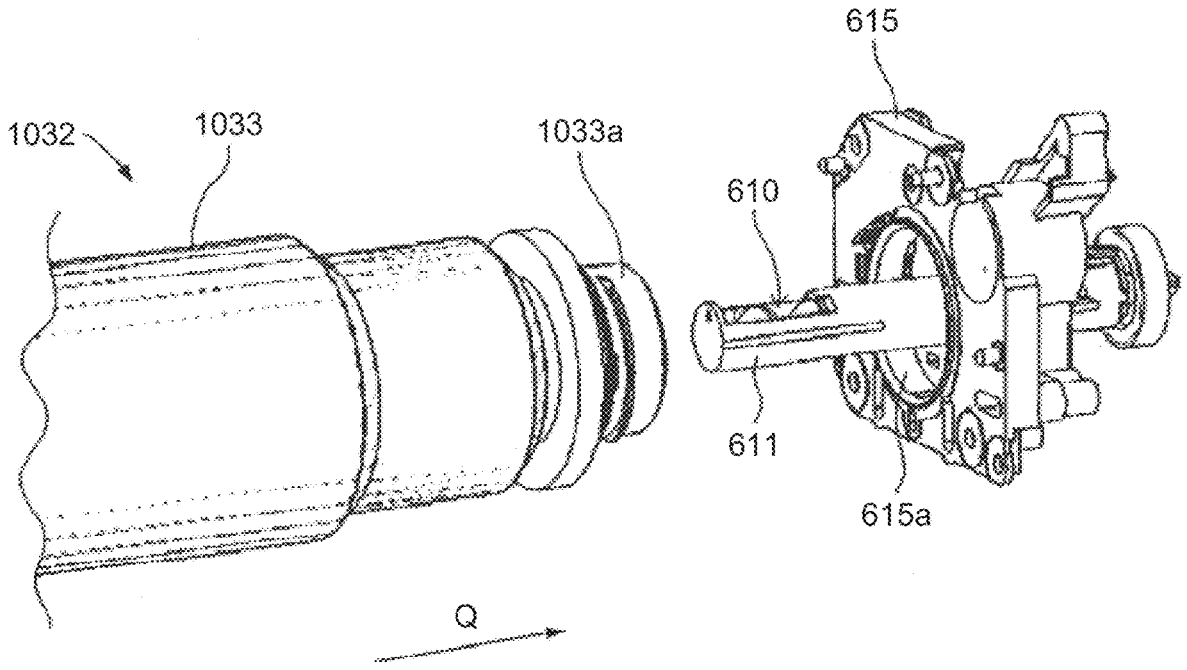
FIG. 52 is an explanatory perspective view a front end of the powder container and the container setting section according to the second embodiment.

Moreover, in the configuration illustrated in FIGS. 51A to 51D, the nozzle receiver 1330 includes an outer surface 1330*a* that slidably mates with the inner surface of container setting section 615*a* of the main body of the copier 500 illustrated in FIG. 52. Furthermore, as illustrated in FIG. 51D, the container shutter 1332 includes a contact portion 1332*a* that comes in contact with the conveying nozzle 611, and includes shutter supporting portions 1332*b*. The shutter supporting portions 1332*b* extend from the contact portion 1332*a* in the longitudinal direction of the container body 1033, and include hook portions 1332*c* that prevent the container shutter 1332 from coming off from the nozzle receiver 1330 due to biasing by the container shutter spring 1336. The container gear 1301 provided as a separate body is provided to the nozzle receiver 1330 of the toner container 1032 such that the container gear can transmit drive.

As described above, it is possible to integrate the components, such as a scooping inner wall surface, a bridging portion, and openings of shutter supporting portion 1335*b* serving as shutter side openings, for introducing toner to the nozzle hole 610.

The toner container 1032 including the scooping ribs 304*g* will be described in detail below.

As illustrated in FIG. 51C, the toner container 1032 includes the container front end cover 34, the container body 1033, a rear cover 1035 serving as a rear cap, the nozzle receiver 1330, and the like. The container front end cover 34 is arranged on the front end of the toner container 1032 in the attachment direction Q with respect to the main body of the copier 500. The container body 1033 has an approximately cylindrical shape. The rear cover 1035 is arranged on the rear end of the toner container 1032 in the attachment direction Q. The nozzle receiver 1330 is rotatably held by the approximately cylindrical container body 1033 as described above.

The gear exposing opening 34*a* (see FIG. 29A) is arranged on the container front end cover 34 in order to expose the container gear 1301 attached to the nozzle receiver 1330. The approximately cylindrical container body 1033 holds the nozzle receiver 1330 so that the nozzle receiver 1330 can rotate. The container front end cover 34 and the rear cover 1035 are attached to the container body 1033 (by a well-known method, such as thermal welding or adhesive agent). The rear cover 1035 includes a rear side bearing 1035*a* that supports one end of the conveying blade holder 1330*b*, and includes a gripper 1303 that a user can grip when he/she attaches and detaches the toner container 1032 to and from the main body of the copier 500.

A method to assemble the container front end cover 34, the rear cover 1035, and the nozzle receiver 1330 on the container body 1033 will be explained below.

The nozzle receiver 1330 is first inserted in the container body 1033 from the container rear side, and positioning is performed such that the nozzle receiver 1330 is rotatably supported by a front side hearing 1036 arranged on the front end of the container body 1033. Subsequently, positioning is performed such that one end of the conveying blade holder 1330*b* of the nozzle receiver 1330 is rotatably supported by the rear side bearing 1035*a* arranged on the rear cover 1035, and the rear cover 1035 is assembled to the container body 1033. Thereafter, the container gear 1301 is assembled to the nozzle receiver 1330 from the container front side. After the container gear 1301 is assembled, the container front end cover 34 is assembled to the container body 1033 so as to cover the container gear 1301 from the container front side.

Incidentally, the assembling of the container body 1033 and the container front end cover 34, the assembling of the container body 1033 and the rear cover 1035, and the assembling of the nozzle receiver 1330 and the container gear 1301 are performed by appropriately using a well-known method (for example, thermal welding, adhesive agent, or the like).

A configuration for conveying toner from the toner container 1032 to the nozzle hole 610 will be explained below.

The scooping ribs 304*g* protrude so as to come closer to the inner surface of the container body 1033 such that rib surfaces are connected from downstream side parts 1335*c*, which are on the downstream side in the rotation direction, of shutter side supporting portions 1335*a* serving as shutter side portions. The rib surfaces are bent once in their middle portions so as to resemble curved surfaces; however, the configuration is not limited to this example depending on the compatibility with toner. For example, simple flat ribs without bend may be used. With this configuration, it becomes not necessary to form a bulged portion in the container body 1033. Furthermore, the scooping ribs 304*g* stand from the openings of shutter supporting portion 1335*b* in an integrated manner. Therefore, it becomes possible to obtain the same bridging function and advantageous effects as those obtained in the configuration in which the shutter side supporting portions 335*a* and the convexes 304*h* are tightly fitted to each other. Specifically, when the nozzle receiver 1330 rotates while the toner container 1032 is being attached to the main body of the image forming apparatus, the conveying blades are rotated, so that the toner contained in the toner container 1032 is conveyed from the rear side to the front side Where the nozzle receiver 1330 is arranged. Subsequently, the scooping ribs 304*g* receive the toner conveyed by the conveying blades 1302, scoop up the toner from bottom to top along with the rotation, and introduce the toner into the nozzle hole 610 by using the rib surfaces as slides.

Furthermore, similarly to the first embodiment, when a user places the toner container 1032 according to the second embodiment on the gutter 74 of the container receiving section 72 of the toner container holder 70 and pushes the toner container 1032 in the attachment direction Q, the toner container 1032 moves on the gutter 74. Along with the movement of the toner container 1032, the state of the container front end cover 34 is changed from the first restricted state to the fifth restricted state, so that the position of the toner container is restricted in a stepped manner according to each of the states. When the toner container is further pushed in the attachment direction Q to change the state from the fifth restricted state to the sixth restricted state, a container opening 1033*a* is entered further into the inner surface of container setting section 615*a* and located in the setting position. And the replenishing device engaging members 78 and 78 are entered into and engaged with the respective engaged openings of the container engaged portions 339*d*. Incidentally, in the present embodiment too, the shape of the container opening 1033*a* is not limited to the cylindrical shape, as long as the container opening 1033*a* is entered into the container setting section 615 so that the radial position is determined, as illustrated in FIG. 29C. That is, the shape of the container opening 1033*a* is not limited to the continuous cylindrical shape, but may be divided or may be a rod shape. Therefore, the toner container 1032 is prevented from moving in the longitudinal direction.

As described above, by restricting the positional relationship between the toner container 1032 and the toner replenishing device 60 in a stepped manner to perform positioning along with the movement of the toner container 1032 in the attachment direction Q with respect to the toner replenishing device 60, it becomes possible to stabilize the positions of the centers of the conveying nozzle 611, the container shutter 332, and the receiving opening 331. Therefore, it becomes possible to improve the operability in the attachment operation and prevent toner leakage.

Meanwhile, as the scooping portion for improving toner conveying performance to the nozzle hole serving as a powder receiving hole, it is also possible to adopt configurations as disclosed in International Publication No. WO2013/183782, International Publication No, WO2013/077474, and U.S. application Ser. No. 13/991,250, which are hereby incorporated herein by reference. The conveying blade serving as the scooping portion may be provided to the nozzle receiver serving as the conveyor receiver, or alternatively, may be provided so as to extend from the inner wall of the container body toward the inner surface of the container body.

Third Embodiment

Figure 53A:
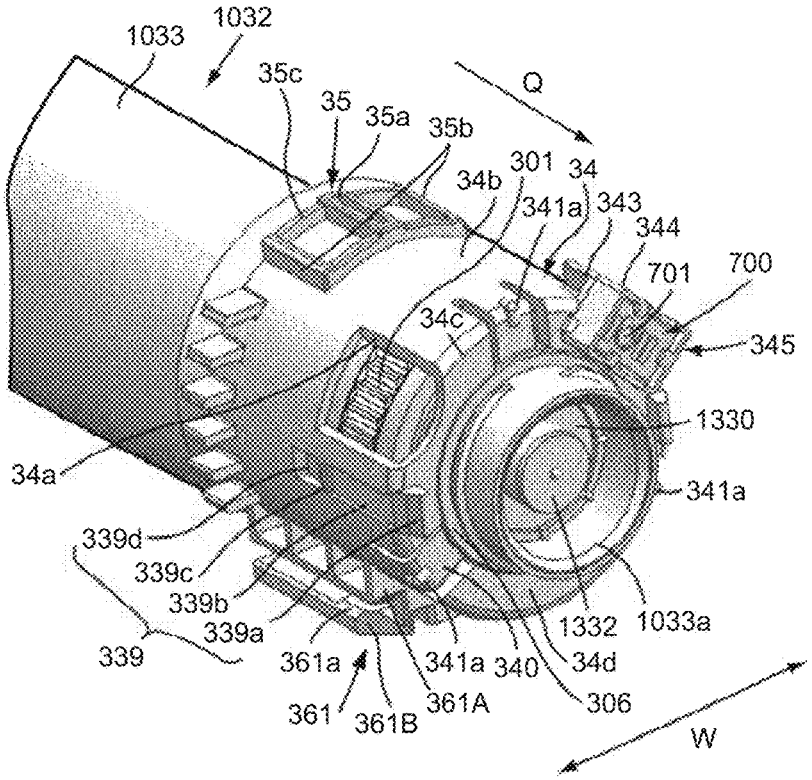
FIG. 53A is an explanatory perspective view of a front end of the powder container according to the third embodiment.
Figure 53B:
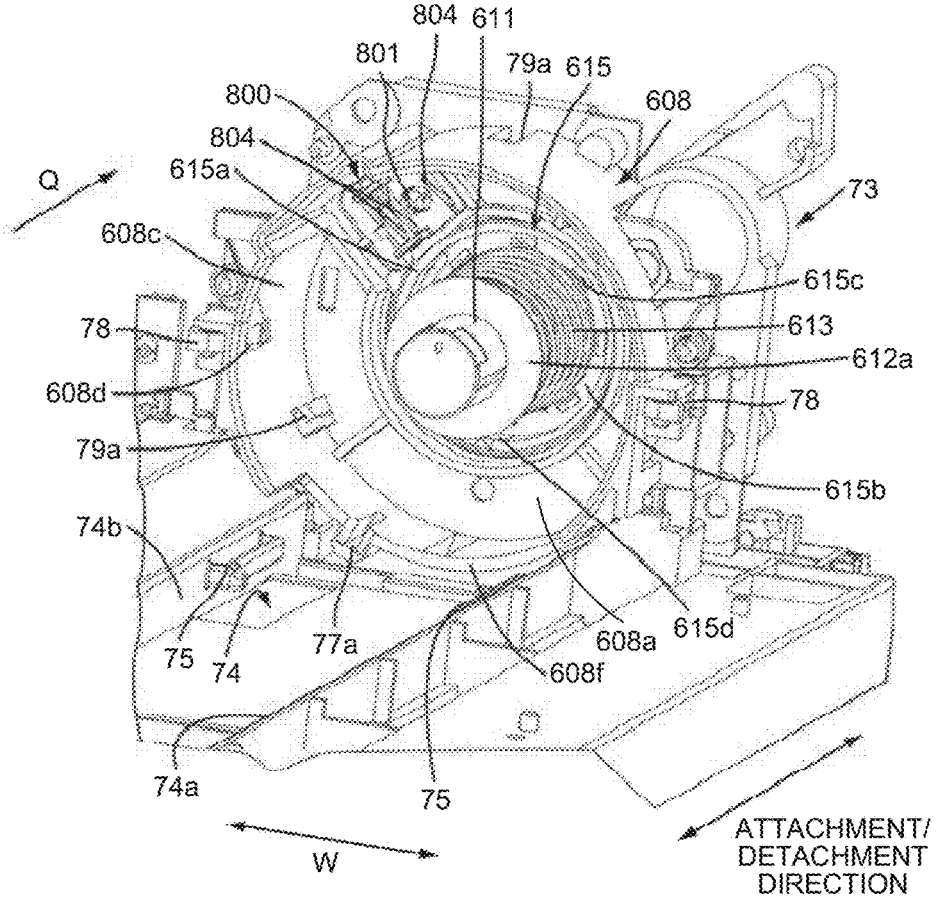
FIG. 53B is an explanatory perspective view of the container setting section.

FIGS. 53A and 53B illustrate a third embodiment, in which an integrated circuit (IC) tag 700, which serves as an IC chip or an information storage medium, and a holding mechanism 345 of the IC tag are arranged on the container front end cover 34 serving as a container cover of the toner container 1032, and a connector 800 serving as a reading means for reading information by coming into contact with the IC tag 700 is arranged on the toner replenishing device 60.

The IC tag 700 employs a contact-type communication system. Therefore, the connector 800 is arranged at a position on the main body of the toner replenishing device 60 so as to face the front end surface of the container front end cover 34.

Figure 54:
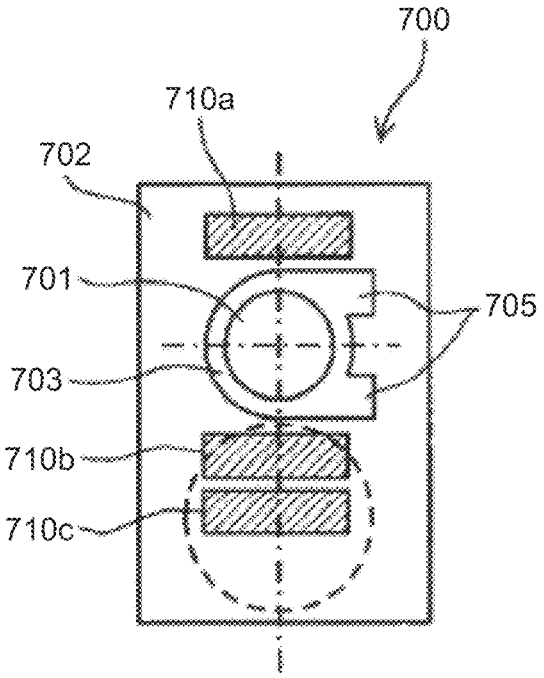
FIG. 54 is a front view of an information storage device.

As illustrated in FIG. 54, the IC tag 700 is provided with an IC tag opening 701 in which a terminal is set, at a position vertically above the gravity center of a substrate 702 in the tag vertical direction. The IC tag opening 701 serves as a positioning opening to determine a position of the IC tag 700 with respect to the image forming apparatus. An earth terminal 703 for grounding (earth), which is a metal terminal, is mounted on the inner surface of the ID tag opening 701 and on the periphery of the ID tag opening 701. The earth terminal 703 is provided on the front surface of the substrate 702 such that two earth terminal projections 705 extend in the tag horizontal direction relative to the annular portion. One rectangular metallic pad 710 (a first metallic pad 710*a*) is arranged above the IC tag opening 701 in the tag vertical direction. Furthermore, two metallic pads 710 (a second metallic pad 710*b* and a third metallic pad 710*c*) are arranged below the IC tag opening 701 in the tag vertical direction. A hemispherical protector 720, which is made of a resin material such as epoxy and which covers and protects an information storage unit, is provided on the back surface of the substrate 702.

As illustrated in FIG. 53A, the holding mechanism 345 holds the IC tag 700 having with the configuration as described above on a vertical surface 34*d* that is a downstream surface of the container front end cover 34 in the attachment direction. The holding mechanism 345 includes a holder 343, which serves as an IC tag holder and which has a base for holding the IC tag 700, and a holding portion 344, which serves as a cover portion, which holds the IC tag 700, and which is detachably attached to the holder 343. The IC tag 700 and the holding mechanism 345 are arranged in an obliquely upper right space of the container front end cover 34 when viewed from the container front side along the rotation axis of the toner container 32. Specifically, the holding mechanism 345 is arranged on the container front end cover 34 by using the obliquely upper right space that becomes a dead space when the toner container 32 is arranged in tandem with the other toner containers 32 of the other colors. Therefore, it becomes possible to provide a compact-size toner replenishing device that enables the cylindrical toner containers 32 to be arranged adjacent to one another. Incidentally, in the obliquely upper left space of the container front end cover 34. the container gear 301 and the container driving gear 601 of the main body are arranged.

The substrate 702 of the IC tag 700 is sandwiched by the holder 343 of the holding mechanism 345 and the holding portion 344 configured as described above, so that the IC tag 700 is held such that the metallic pads 710*a* to 710*c* and the earth terminal 703 face the connector 800.

Figure 55:
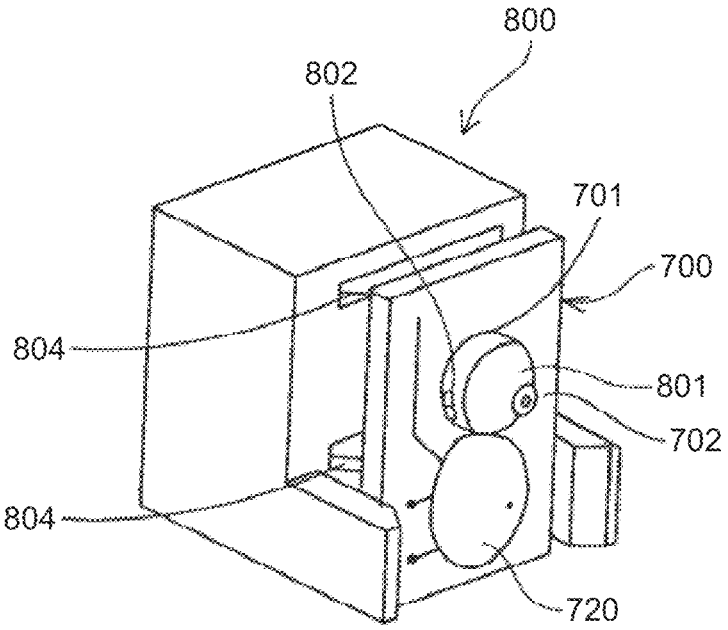
FIG. 55 is an explanatory perspective view illustrating configurations and a contact state of the information storage device and a reading means.

As illustrated in FIG. 53B and FIG. 55, the connector 800 includes a positioning pin 801, three apparatus main-body terminals 804, and an apparatus main-body earth terminal 802. The three apparatus main-body terminals 804 are arranged so as to face the metallic pads 710*a* to 710*c*, and come into contact with the respective pads to read information from the IC tag 700 when the toner container 1032 is moved in the attachment direction Q on the gutter 74 of the toner container holder 70. The positioning pin 801 is arranged so as to face the IC tag opening 701 used for positioning, and is inserted in the IC tag opening 701 when the toner container 1032 is being moved and attached to the toner replenishing device 60 in the attachment direction Q. The positions of the IC tag 700 and the connector 800 are determined by insertion of the positioning pin 801 into the IC tag opening 701. The apparatus main-body earth terminal 802 is configured such that the positioning pin 801 comes in contact with the earth terminal 703 inserted in the IC tag opening 701.

In the present embodiment, the positioning pin 801 is inserted in the IC tag opening 701 due to the movement of the toner container 1032 in the attachment direction Q between the fifth restricted state and the sixth restricted state as described above.

Specifically, before the positioning pin 801 is inserted in the IC tag opening 701, the positions of the toner container 1032 in the vertical direction Z and the width direction W are roughly determined in the first restricted state. In the second restricted state, the movement of the container front end cover 34 in the radial direction relative to the container cover receiving section 73 is restricted by the contact between the three protrusions 341*a* and the inner surface of setting cover 608*c*. Namely, in the second restricted state, the positions of the toner container 32 in the width direction W, the vertical direction Z, and the radial direction are determined. Furthermore, in the third restricted state, the rotation restrictive rib 342*a* is entered into the groove 77*a* of the setting cover 608, so that the movement of the container front end cover 34 in a circumferential direction R is restricted. Subsequently, in the fourth restricted state, the restriction in the radial direction is released. Thereafter, in the fifth restricted state, the container opening 1033*a* is entered into the inner surface of container setting section 615*a*, so that the position of the container body 1033 relative to the toner replenishing device 60 is determined.

Therefore, when the positioning pin 801 is inserted in the IC tag opening 701, the restriction in the vertical direction, the width direction, the circumferential direction, and the radial direction is performed, so that it is possible to stabilize the relative position of the positioning pin 801 and the IC tag opening 701. As a result, in the present embodiment, it becomes possible to improve the operability in the attachment operation, prevent toner leakage, and prevent a contact failure between the IC tag 700 and the connector 800.

Fourth Embodiment

In a fourth embodiment, an explanation will be given of identification mechanism (identifier) for identifying the compatibility between each of the toner containers and the toner replenishing device.

In general, to identify the compatibility, identified portions are provided on the respective toner containers and identifying parts are provided on the toner container holder of the toner replenishing device, where the identified portions and identifying parts serve as identification mechanism and differ from type to type. If a different type of a toner container is to be attached to the toner container holder, the identified portion and the identifying part do not match with each other and are opposed to each other to prevent the toner container from being attached to the toner container holder in order to prevent erroneous attachment.

A predetermined clearance is provided between the toner container and the toner container holder to make the attachment easy. If such a clearance is not provided, attachment posture for attaching a correct toner container is severely restricted and attachment of the toner container becomes difficult. In contrast, if the clearance is too large, while the attachment becomes easier, the degree of freedom in the posture of the toner container increases and a certain force may act to allow the toner container to be attached to the toner container holder even when the posture of the toner container is incorrect. Therefore, if more than a predetermined amount of load is applied to the toner container to be attached, the toner container may be erroneously attached to the toner container holder even with a wrong combination of the identified portion and the identifying part that are not supposed to be attached to each other.

The identification mechanism provided on the toner container holder is arranged on the relatively front side of the image forming apparatus so that the compatibility can be identified at an early stage of the attachment. Therefore, the insertion hole part on which the identification mechanism is provided is molded with soft material, such as resin, in order to prevent a user from being hurt when he/she touches this part during the attachment of the toner container. Therefore, the identification mechanism provided on the insertion hole part is easily bent, so that even when a different type of the toner container is to be attached, the toner container may be moved across the identification mechanism and attached to the toner container holder.

If a different type of the toner container is attached as described above, it becomes impossible to detach the toner container, or the identified portion and the identifying part serving as the identification mechanism may be broken. When, in view of the standardization of components, the same toner containers are used even for different types, and the different types are distinguished by different combinations of the identified portions and the identifying parts. If a wrong toner container is attached to the toner container holder, toner of a different color or a different type is conveyed by the toner replenishing device. Therefore, certain components, such as a developing device or a process cartridge, of the image forming apparatus may be damaged.

Therefore, in the present embodiment, restriction mechanism (restrictor) is provided to restrict the identified portion of the toner container from moving while passing over the identifying part arranged on the toner container holder. By providing the restriction mechanism, even when an incompatible toner container is attached to and forcibly pushed into the toner container holder, the identified portion does not pass over the bent identifying part and the toner container is not attached to the wrong toner replenishing device. Therefore, it becomes possible to reliably prevent a different type of the toner container from being attached and prevent the identifying part arranged on the toner container holder from being broken.

Figure 59:
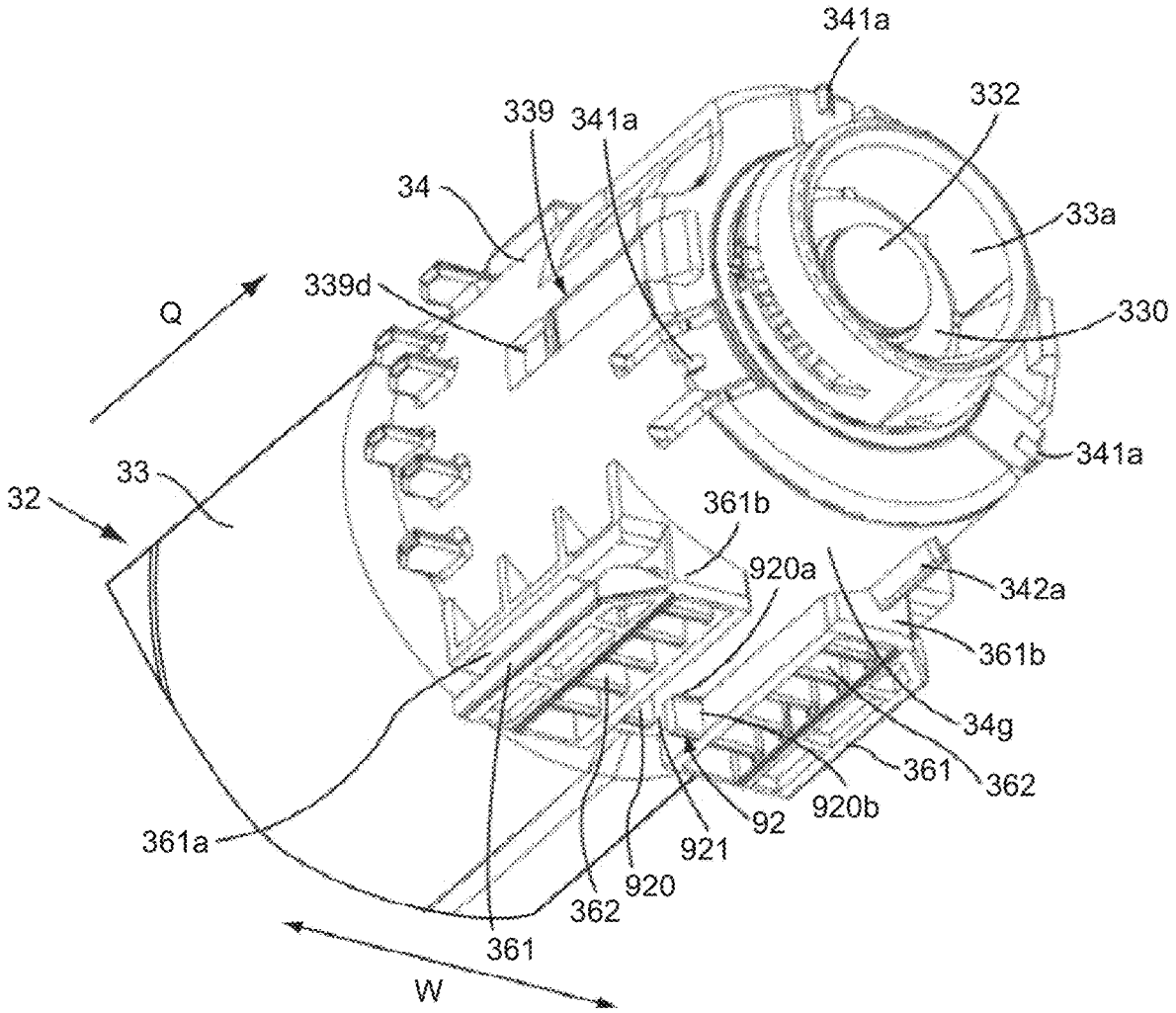
FIG. 59 is an explanatory perspective view of a front end of the powder container according to the fourth embodiment.
Figure 60:
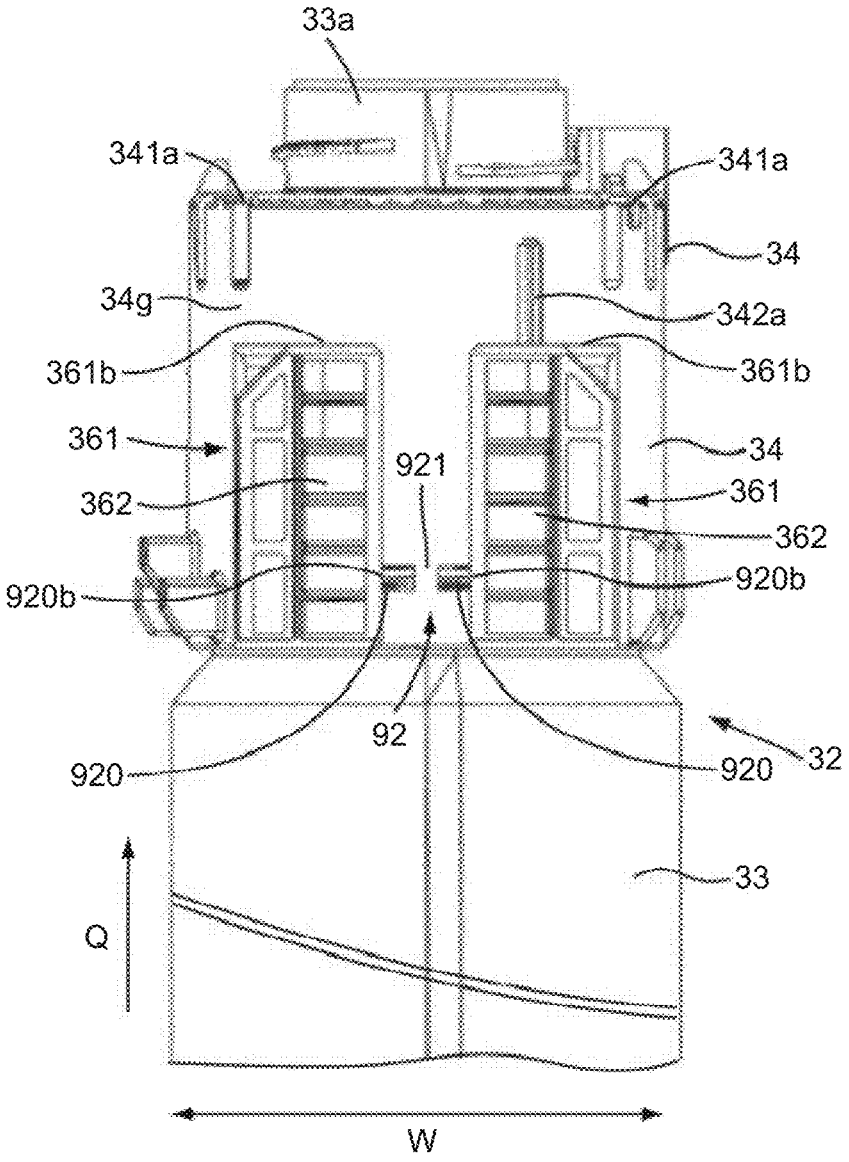
FIG. 60 is a bottom view of the front end of the powder container according to the fourth embodiment.

An incompatibility relationship between the toner container and the toner container holder will be explained in detail below with reference to drawings. FIG. 59 is an explanatory perspective view of the front end of the toner container 32. FIG. 60 is a bottom view of the front end of the toner container 32. In the present embodiment, an identified portion 92 is provided on a lower portion of the outer surface of the container front end cover 34*g* serving as a lower portion of the toner container 32. The identified portion 92 is arranged between the pair of the sliding guides 361 and 361 serving as a restrictor (vertical restrictor) located in the width direction W. It is sufficient that the identified portion 92 is located on the lower portion of the outer surface of the container front end cover 34*g* of the container front end cover 34, and the position is not limited to between the sliding guides 361 and 361. In the present embodiment, the identified portion 92 is a gap (in other word, an identified gap) 921 provided between a pair of identified protrusions 920 and 920 (in other words, an identified rib) protruding from the outer surface of the container front end cover 34, where the identified protrusions 920 and 920 serve as protrusions between the sliding guides, and the gap 921 serves as a gap between the protrusions. Alternatively, or in addition, the identified portion 92 is a gap 922 that is provided in the lower portions of the sliding guides 361 and 361 along the attachment direction so as to be a concave shape, where the gap 922 serves as a passage, a notch, a recess of the sliding guide, or a recess of the reinforcing portions. In the present embodiment, the gap 922 is provided in the reinforcing portions 362 and 362 serve as parts of the sliding guides 361 and 361. A width W1 of the gap 921, presence or absence of the gap 921, and presence or absence of the gap 922 of the sliding guide are set differently depending on a toner color, a toner type, or an apparatus model. The identified protrusions 920 are arranged on the upstream side in the attachment direction (on the rear side of the toner container) relative to front ends of the sliding guides 361*b* and 361*b*. Furthermore, each of the identified protrusions 920 is provided such that an upper part of the identified protrusion 920*a* is connected to and integrated with the container front end cover 34 and side parts the identified protrusion 920*b* and 920*b* of are connected to and integrated with each of the sliding guides 361 and 361 integrated with the container front end cover 34. Therefore, the strength of the components can be increased as compared to a configuration in which only upper portions of the components are integrated with the container front end cover 34.

Figure 61:
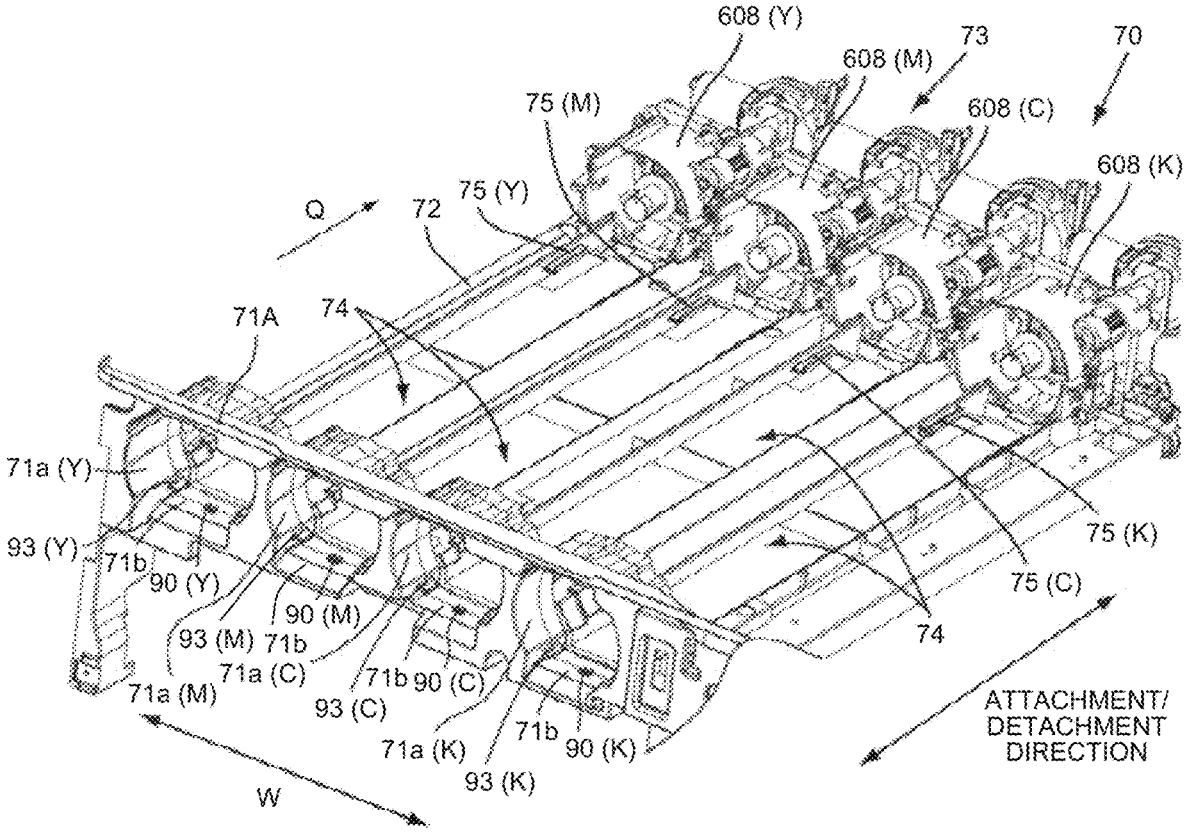
FIG. 61 is an explanatory perspective view illustrating a configuration of the container holding section employed in the fourth embodiment.

In the present embodiment, as illustrated in FIG. 61, the toner container holder 70 to and from which the toner container 32 is attached and detached includes the container cover receiving section 73, the container receiving section 72, and an insertion hole part 71A.

The insertion hole part 71A is provided with the insertion holes 71*a* (Y, M, C, K), through which the toner containers 32 for the respective colors passes when the toner containers 32 are attached and detached. The insertion holes 71*a* have shapes similar to the external shapes of the container front end covers 34 for the respective colors, and are provided such that, as illustrated in FIG. 62 and FIG. 63, a certain gap is maintained between the outer surface of container front end cover 34*b* and the inner surface of each of the insertion holes 71*a* (Y, M, C, K) when the toner container is attached and detached.

On an insertion hole base 71*b* that constitutes a lower part of each of the insertion holes 71*a*, an identifying protrusion 90 (in other words, a rib, an identifying rib), which serves as an identifying part and which is to be loosely or tightly fitted to or engaged with the identified portion 92 of the toner container 32 to identify the type of the toner container, is provided so as to protrude upward from the insertion hole base 71*b*. On lower side surfaces 71*c* and 71*c* of the insertion holes 71*a* in the width direction W, restriction ribs 93 and 93 (Y, M, C, K) serving as restriction parts are arranged. The widths and the protrusion amounts of the restriction ribs 93 and 93 (Y, M, C, K) are set such that the restriction ribs 93 and 93 can be inserted in the sliding grooves 361*a* and 361*a* of the sliding guides 361 and 361 (see FIG. 59) when the toner container 32 for each of the colors is inserted in each of the insertion holes 71*a*, so that the sliding guides 361 and 361 are allowed to slide. Therefore, the identified portion 92 provided on the lower portion 34*g* of each of the container front end covers 34 is fitted to or engaged with each of the identifying protrusions 90 while the sliding grooves 361*a* receive the respective restriction ribs 93 and the vertical movement of the container front end cover 34 is restricted. At this time, because the vertical movement is restricted, the toner container 32 is prevented from being lifted up when the identified portion 92 and the identifying protrusion 90 are fitted to or engaged with each other. Therefore, it becomes possible to prevent the toner container 32 from being continuously inserted across the identifying protrusion 90 and from being attached in a wrong position.

Incidentally, it is preferable to set the lengths of the sliding grooves 361*a* of the sliding guides 361 in the width direction W (the depths of the grooves) (see FIG. 31) such that about two-thirds or more of the lengths of the restriction ribs 93 in the width direction W (the height of the ribs) can be inserted. If the lengths of the centers 361*d* of the sliding grooves in the width direction W (the depths of the grooves) (see FIG. 31) are shorter than two-thirds of the lengths of the restriction ribs 93 in the width direction W (the heights of the ribs) such that the lengths of the groove inclined portions 361*f* become relatively longer, the strength of the sliding guides 361 can be increased, but only front ends of the restriction ribs 93 are inserted in the sliding grooves 361*a* and the restriction in the vertical direction becomes weaker. Therefore, the rear end of the toner container 32 is lifted up with respect to the restriction ribs 93. Consequently, even when a wrong toner container is inserted, the toner container may erroneously be attached across the identifying protrusion 90.

Figure 62:
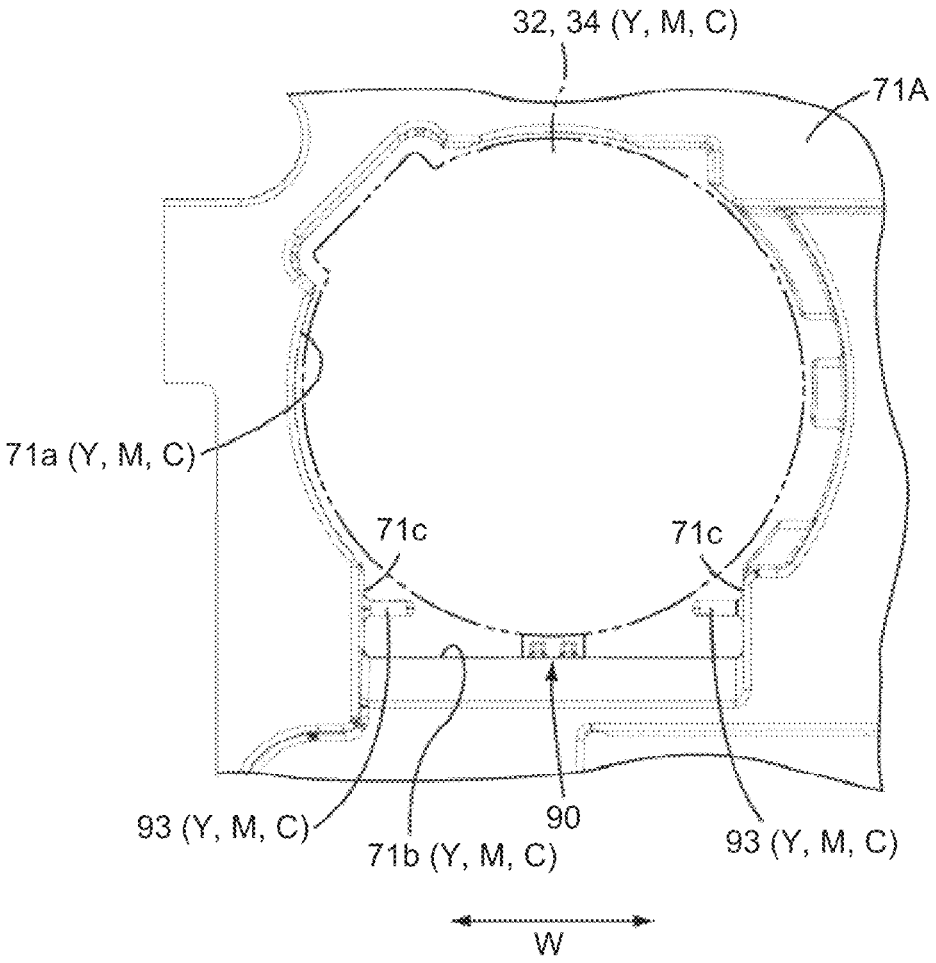
FIG. 62 is an enlarged front view illustrating a configuration of an insertion hole of the container holding section.
Figure 63:
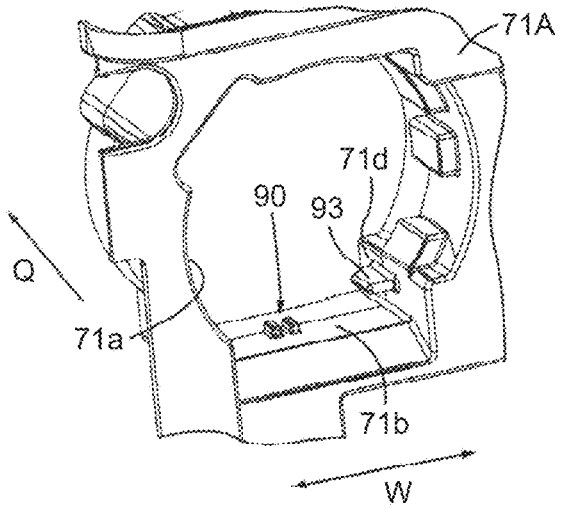
FIG. 63 is an explanatory enlarged perspective view illustrating the configuration of the insertion hole of the container holding section.

As illustrated in FIG. 62, the restriction ribs 93 (Y, M, C) on each of the insertion holes 71*a* (Y, M, C), in which the toner containers 32 (Y, M, C) are inserted, are provided so as to protrude in opposite directions from the lower side surfaces 71*c* and 71*c* at the same height as the guide rails 75 (Y, M, C) provided on the container cover receiving section 73.

In contrast, as illustrated in FIG. 63, the restriction ribs 93K on the insertion hole 71*a* (K), in which the toner container 32K is inserted, are provided such that the bottom surfaces are located at the same height as the guide rails 75 (K) arranged on the container cover receiving section 73 (see FIG. 28). Incidentally, the lengths of the restriction ribs 93 (K) in the height direction differ from the lengths of the guide rails 75 (K) in the height direction such that the lengths of the guide rails 75(K) are longer than those of the restriction ribs 93 (K). Therefore, even when any of the toner containers 32 (Y, M, C) that are smaller in size than the toner container 32 (K) is erroneously inserted in the insertion hole 71*a* (K) that is greater in size than the insertion holes 71*a* (Y, M, C), and if the toner container 32 is continuously inserted across the identifying protrusion 90, the guide rails 75 (K) abut against the sliding guides 361 (Y, M, C) of each of the toner containers 32 (Y, M, C), so that further insertion can be restricted and erroneous attachment can be prevented. Furthermore, the guide rails 75 (Y, M, C, K) and the restriction ribs 93 (Y, M, C, K) may be integrated with each other.

While the lengths of the restriction ribs 93K in the height direction are shorter than the lengths of the sliding grooves 361*a* in the same direction, base ends of the restriction ribs 93K at the protruding positions on the lower side surfaces 71*c* and 71*c* are provided so as to pass by the positions closer to the lower inner surfaces of the sliding grooves 361*a*, than the upper inner surfaces of the sliding grooves 361*a* when the toner container 32 is inserted. Therefore, when the restriction ribs 93 are inserted in the sliding grooves 361*a*, gaps between the bottom surfaces of the restriction ribs 93 and the lower inner surfaces of the sliding grooves 361*a* are reduced. Therefore, even when the toner container 32 is erroneously inserted, it becomes possible to prevent the toner container 32 from being lifted up and continuously inserted across the identifying protrusion 90.

Figure 64:
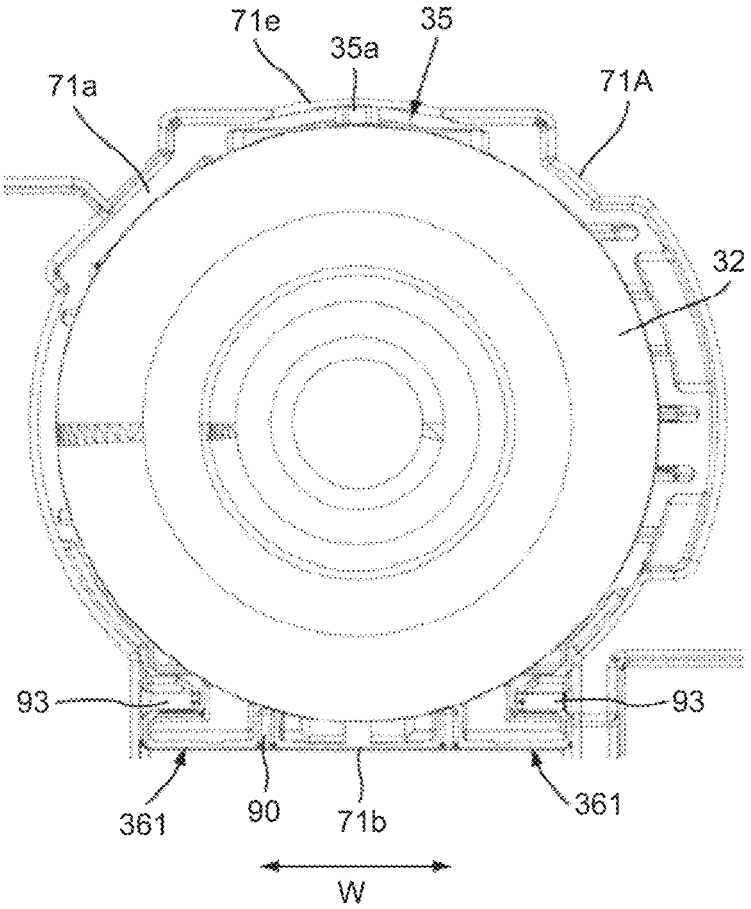
FIG. 64 is an enlarged view illustrating a state in which the powder container is inserted in the insertion hole of the container holding section.

Furthermore, as another restrictor of the present embodiment, the top portion of upward guide 35*a* arranged on the container front end cover 34 of the toner container 32 is used. As illustrated in FIG. 64, the top portion of upward guide 35*a* comes in contact with a ceiling surface 71*e*, which is an upper surface of the insertion hole part 71A and which faces the identifying protrusion 90 in the vertical direction, so that the vertical movement of the toner container can be restricted. Therefore, it becomes possible to further prevent the toner container 32 from being lifted up and from being continuously inserted across the identifying protrusion 90. Incidentally, because the inclined surfaces of upward guide 35*c* are provided on the upward guide 35 (see FIG. 22), when the toner container 32 is to be detached from the toner container holder 70, the toner container 32 is moved in the detachment direction through the insertion hole part 71A along the slopes of the inclined surfaces of upward guide 35*c*. Therefore, the operability in the detachment operation can be improved.

A relationship between the identifying protrusion 90 and the identified portion 92 will be explained below. In the present embodiment, in the case of the compatible toner container 32 that is attachable to the insertion hole 71*a*, as illustrated in FIG. 65B for example, the width W1 of the gap 921 is set to be wider than a width W2 of the identifying protrusion 90 of the insertion hole 71*a*, in the case of the incompatible toner container 32 that is not insertable in the insertion hole 71*a*, as illustrated in FIG. 65A, the width W1 of the gap 921 is set to be narrower than the width W2 of the identifying protrusion 90 of the insertion hole 71*a*.

Therefore, when an operator inserts the toner container 32 in the insertion hole 71*a*, the restriction ribs 93 and 93 illustrated in FIG. 61 to FIG. 63 are first entered into the sliding grooves 361*a* and 361*a* of the sliding guides 361 and 361 as illustrated in FIG. 59 and FIG. 60. Therefore, the vertical movement of the toner container 32 (the container front end cover 34) is restricted. At this time, the operator cannot move the toner container in the attachment direction Q if the restriction ribs 93 and 93 cannot be entered into the sliding grooves 361*a* and 361*a*; therefore, the toner container 32 can be maintained in a correct posture.

If the toner container 32 is pushed in the attachment direction Q in the restricted state, the identified portion 92 approaches the identifying protrusion 90. At this time, if the toner container 32 being attached is the attachable toner container 32, as illustrated in FIG. 65B, the width W1 of the gap 921 of the identified portion 92 is wider than the width W2 of the identifying protrusion 90. Therefore, the movement of the toner container 32 in the attachment direction Q is not restricted and the gap 921 passes by the identifying protrusion 90, so that the container front end cover 34 is moved on the container receiving section 72 and set in the container cover receiving section 73.

Figure 65A:
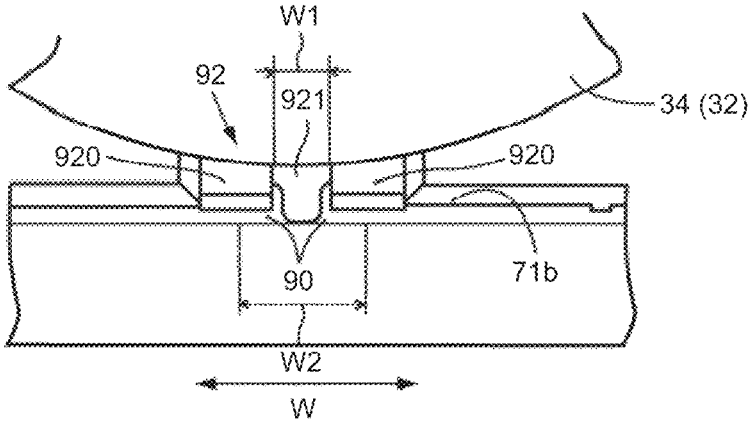
FIG. 65A is an enlarged view for explaining configurations and an unattachable state of an identified portion and an identifying part according to the fourth embodiment.
Figure 65B:
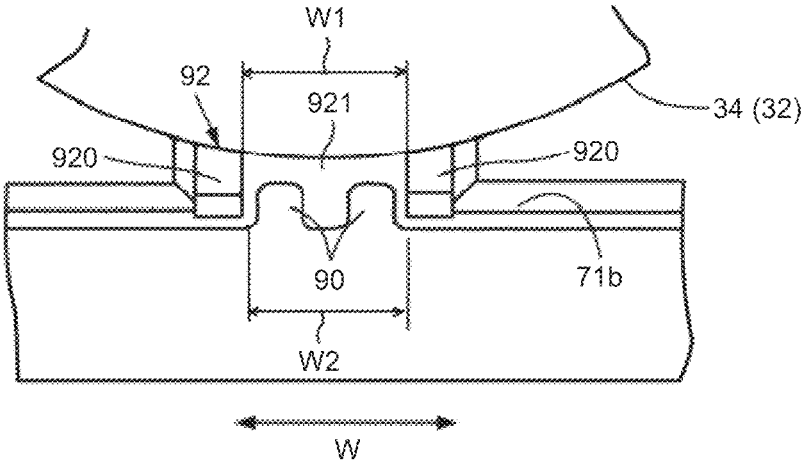
FIG. 65B is an enlarged view for explaining the configurations and a attachable state of the identified portion and the identifying part.

In contrast, if the toner container 32 being attached is the unattachable toner container 32, as illustrated in FIG. 65A, the width W1 of the gap 921 of the identified portion 92 is narrower than the width W2 of the identifying protrusion 90. Therefore, the identified protrusions 920 of the identified portion 92 come in contact with the identifying protrusion 90 of the insertion hole 71*a*. Therefore, the movement of the toner container 32 in the attachment direction Q is restricted and the gap 921 cannot pass over the identifying protrusion 90, so that it becomes possible to prevent the unattachable and incompatible toner container 32 from being attached.

Even if the unattachable toner container 32 is forcibly pushed in the attachment direction Q, the vertical movement of the toner container 32 (the container front end cover 34) is restricted by the sliding grooves 361*a* and 361*a* and the restriction ribs 93 and 93. Therefore, it becomes possible to prevent the identified portion 92 from passing over the identifying protrusion 90, enabling to more reliably prevent the unattachable and incompatible toner container 32 from being attached.

Furthermore, in the present embodiment, whether the gap 921 is allowed to pass over the identifying protrusion 90 is controlled according to the width W1 of the gap 921 of the toner container 32 and the presence or absence of the gap 922 of the sliding guide. Namely, the compatibility and the incompatibility can be determined by adjusting the width W1 or determining the presence or absence of the gap 922 of the sliding guide according to the position or the numbers of the identifying protrusions 90. Therefore, it becomes possible to prevent a wrong toner container from being attached to the toner replenishing device (the toner container holder 70) by a simple structure without negative influence on the operability.

A combination of the identified portion 92 and the identifying protrusion 90 will be explained below.

As illustrated in FIG. 65A, the gap 921 of the identified portion 92 with the narrower width W1 cannot pass over an identifying part including the two identifying protrusions 90 (unattachable).

Figure 65C:
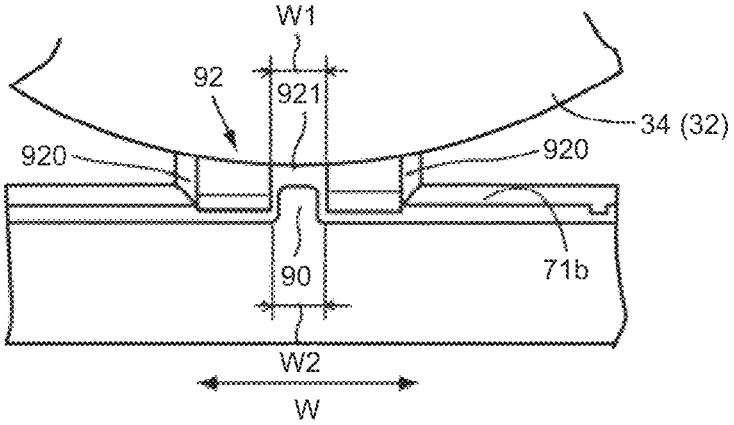
FIG. 65C is an enlarged view for explaining another example of the attachable state.

As illustrated in FIG. 65C, the gap 921 of the identified portion 92 with the narrower width W1 can pass over the identifying protrusion 90 including the single identifying protrusion 90 (attachable).

As illustrated in FIG. 65B, the gap 921 of the identified portion 92 with the wider width W1 can pass over the identifying protrusion 90 regardless of whether the number of the identifying protrusions 90 is one or two (attachable).

Figure 66:
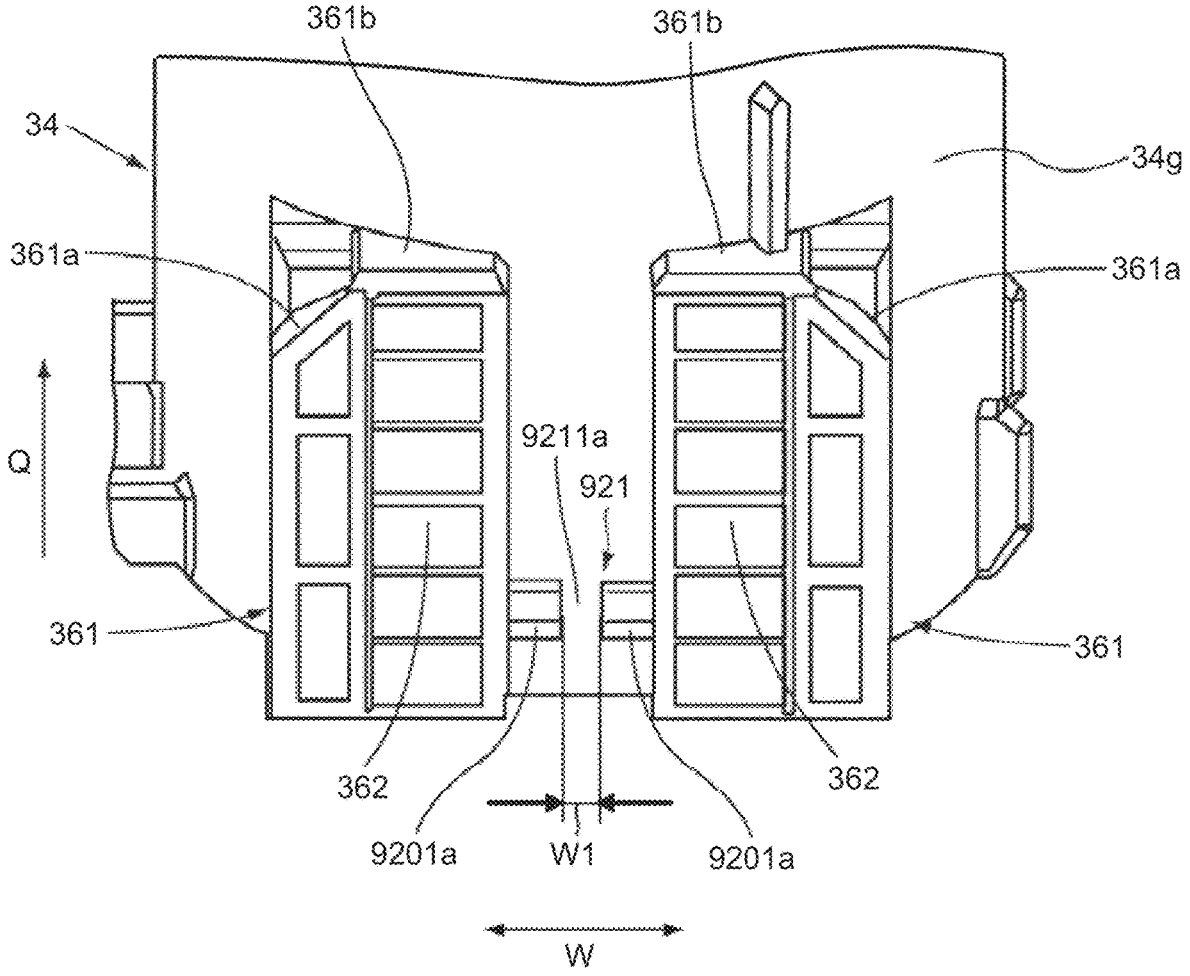
FIG. 66 is an enlarged bottom view illustrating a first example of the identified portion provided on the powder container.
Figure 67A:
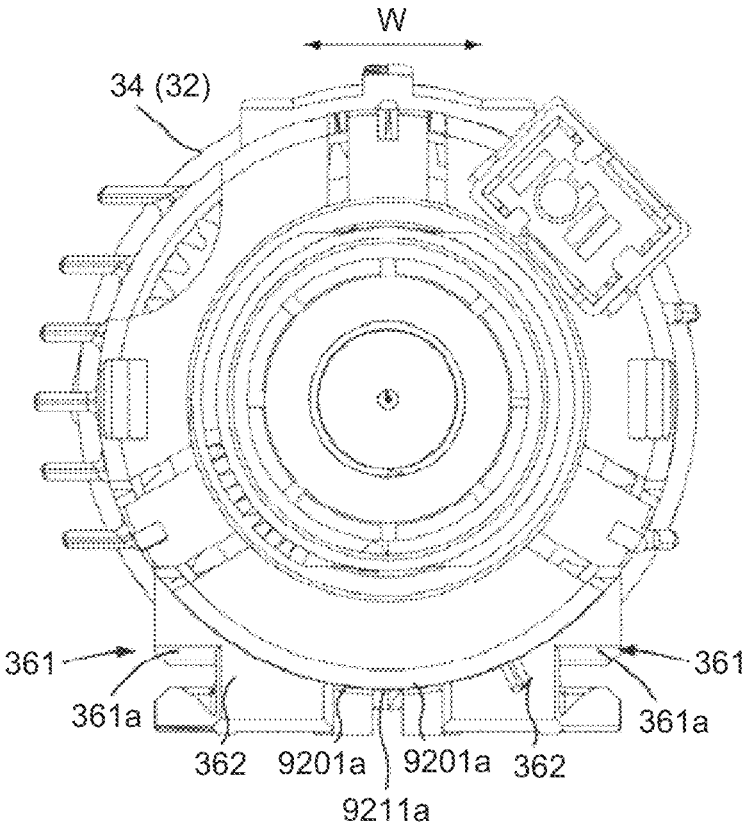
FIG. 67A is a front view illustrating the first example of the identified portion provided on the powder container.
Figure 67B:
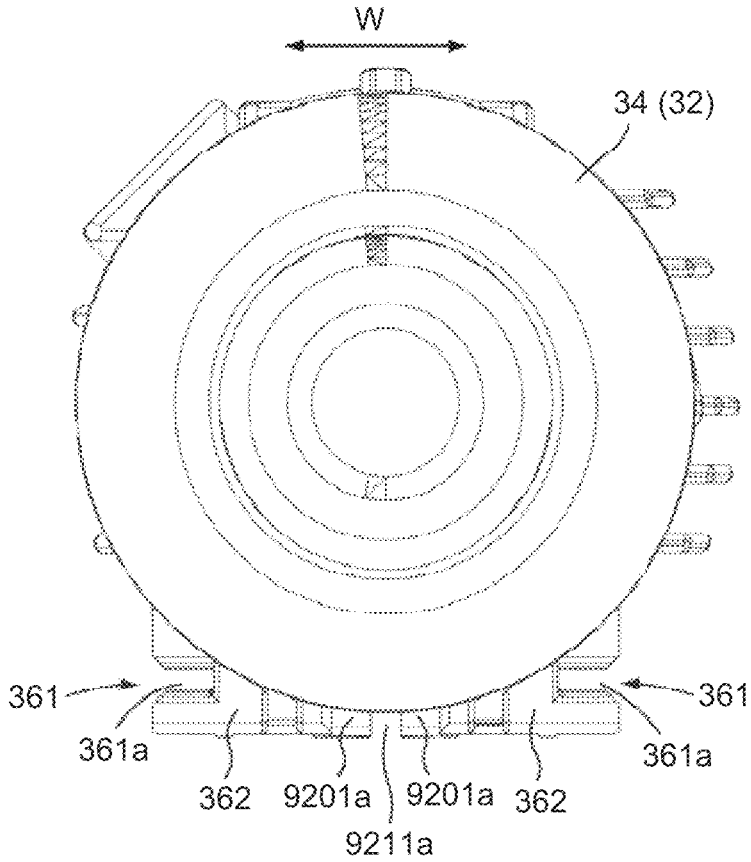
FIG. 67B is a back view illustrating the first example of the identified portion provided on the powder container.

The configurations and dimensions of the identified portion 92 and the identifying protrusion 90 will be explained in detail below with reference to FIG. 66 to FIG. 77. Incidentally, in the following, different reference numerals will be assigned to the gap 921 and the gap 922 of the sliding guide in different examples. FIG. 66 to FIG. 75B are diagrams illustrating the configurations of the gap 921 provided on the container front end cover 34. FIG. 66, FIG. 67A, and FIG. 67B illustrate a first example, in which a gap 9211.*a* with a width of 3 mm is provided between identified protrusions 9201*a* and 9201*a*, which serve as a pair of identified portions or protrusions between the sliding guides and which are arranged on the lower portion 34*g* of the container front end cover 34.

Figure 68:
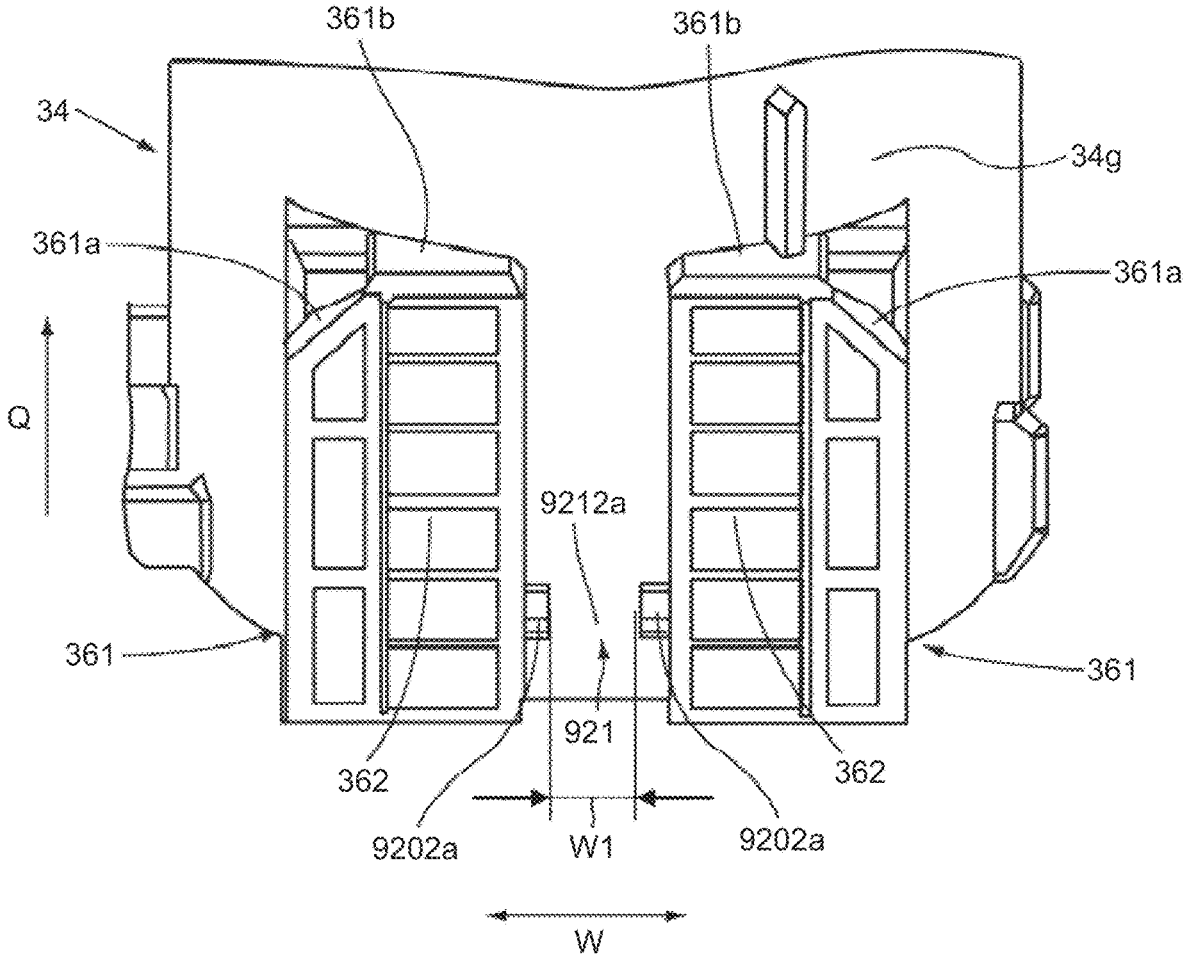
FIG. 68 is an enlarged bottom view illustrating a second example of the identified portion provided on the powder container.
Figure 69A:
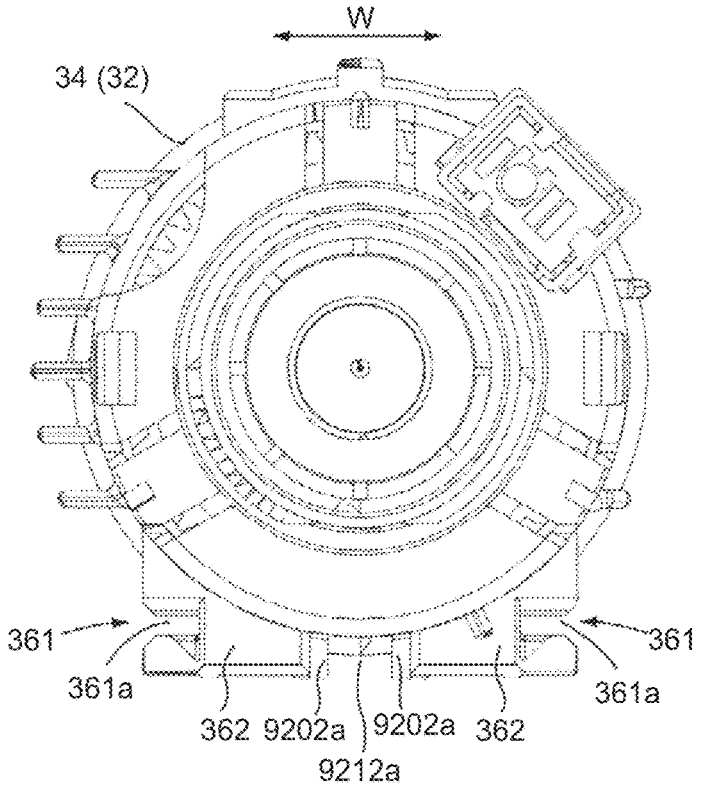
FIG. 69A is a front view illustrating the second example of the identified portion provided on the powder container.
Figure 69B:
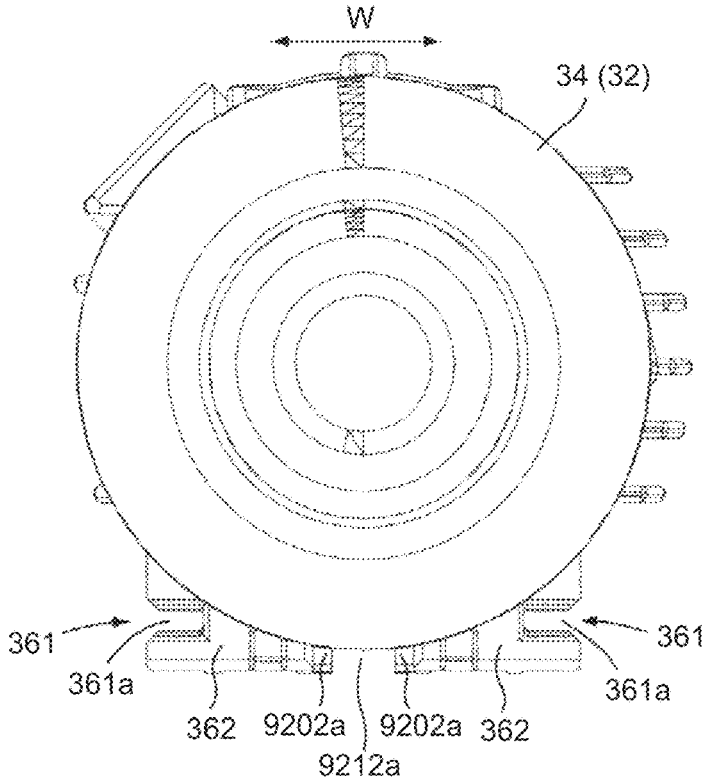
FIG. 69B is a back view illustrating the second example of the identified portion provided on the powder container.

FIG. 68, FIG. 69A, and FIG. 69B illustrate a second example, in which a gap 9212*a* with a width of 7 mm is provided between identified protrusions 9202*a* and 9202*a*, which serve as a pair of identified portions or protrusions between the sliding guides and which are arranged on the lower portion 34*g* of the container front end cover 34.

Figure 70:
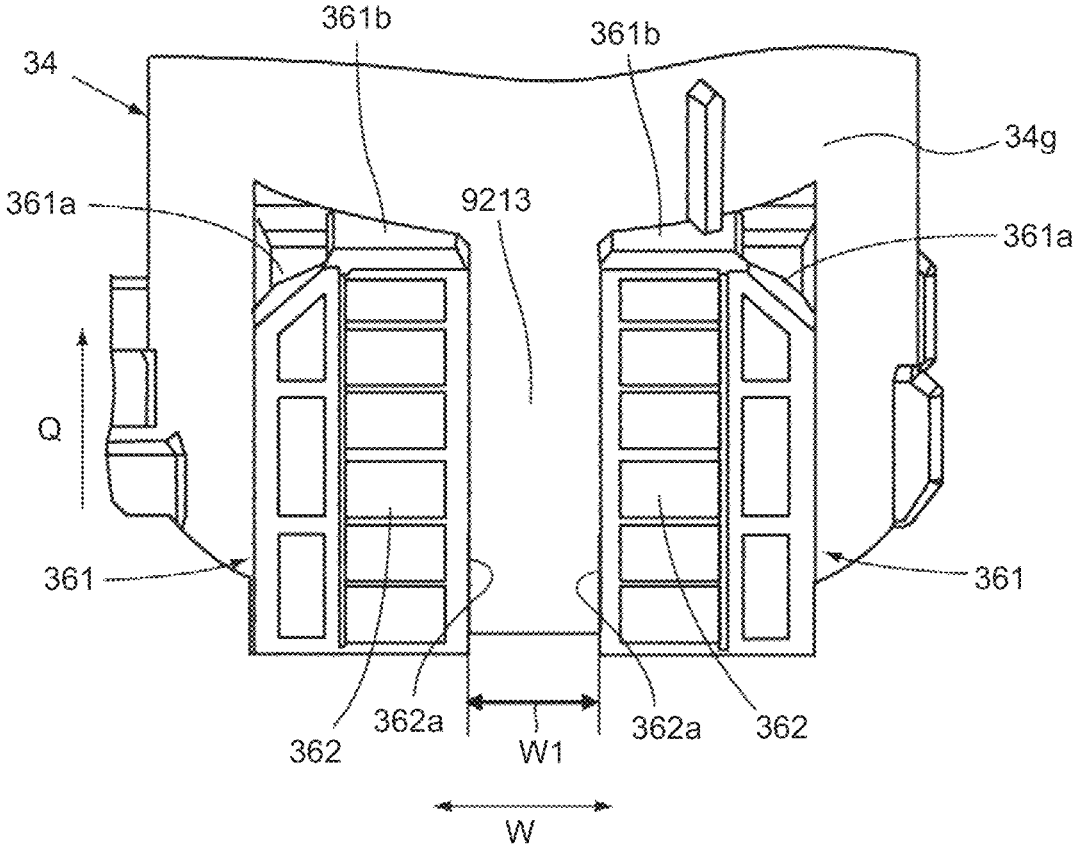
FIG. 70 is an enlarged bottom view illustrating a third example of the identified portion provided on the powder container.
Figure 71A:
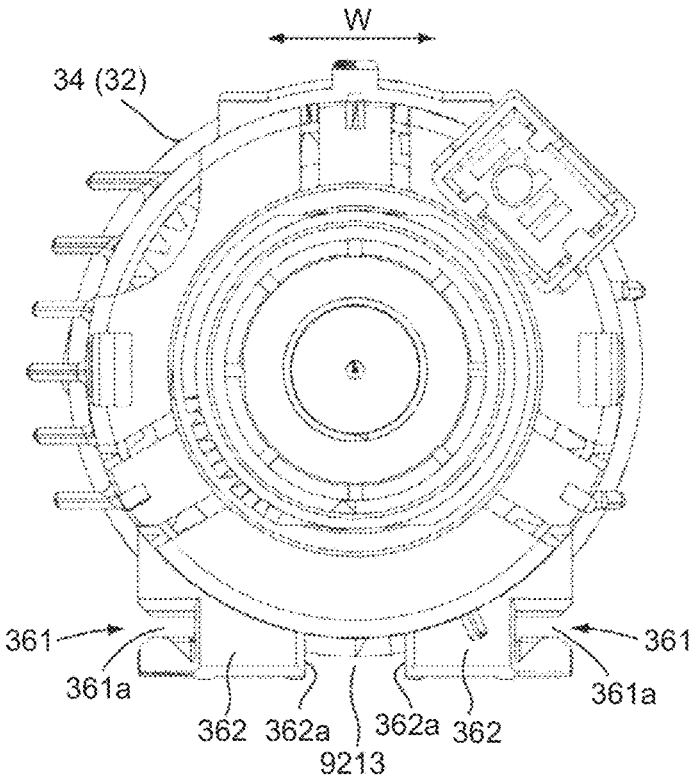
FIG. 71A is a front view illustrating the third example of the identified portion provided on the powder container.
Figure 71B:
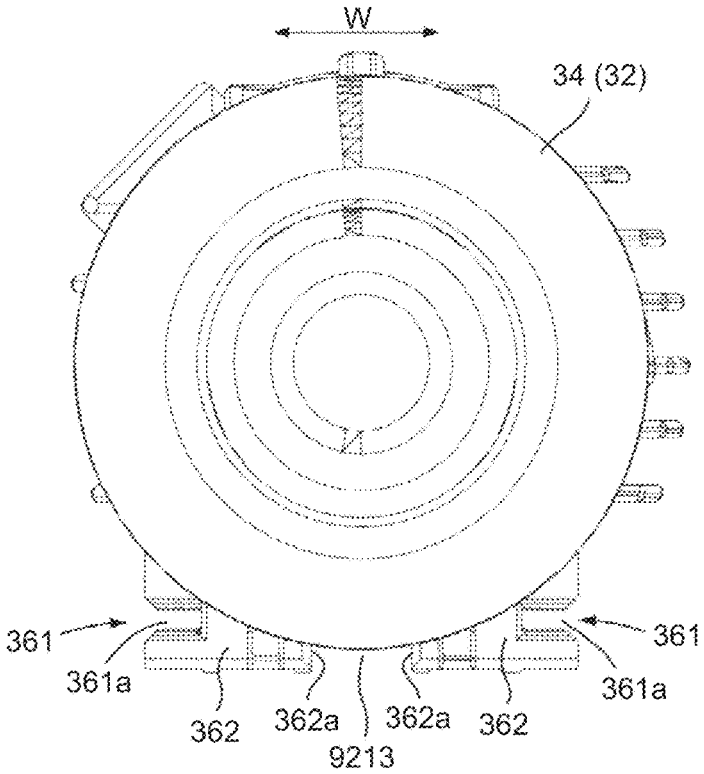
FIG. 71B is a back view illustrating the third example of the identified portion provided on the powder container.

FIG. 70, FIG. 71A, and FIG. 71B illustrate a third example, in which the identified protrusions 920 are not provided but a gap 9213, which is a passage between the sliding guides, is provided between the sliding guides 361 and 361 such that a width between side surfaces 362*a* and 362*a* of the sliding guides 361 and 361 in the attachment direction is set to be 11 mm.

Figure 72:
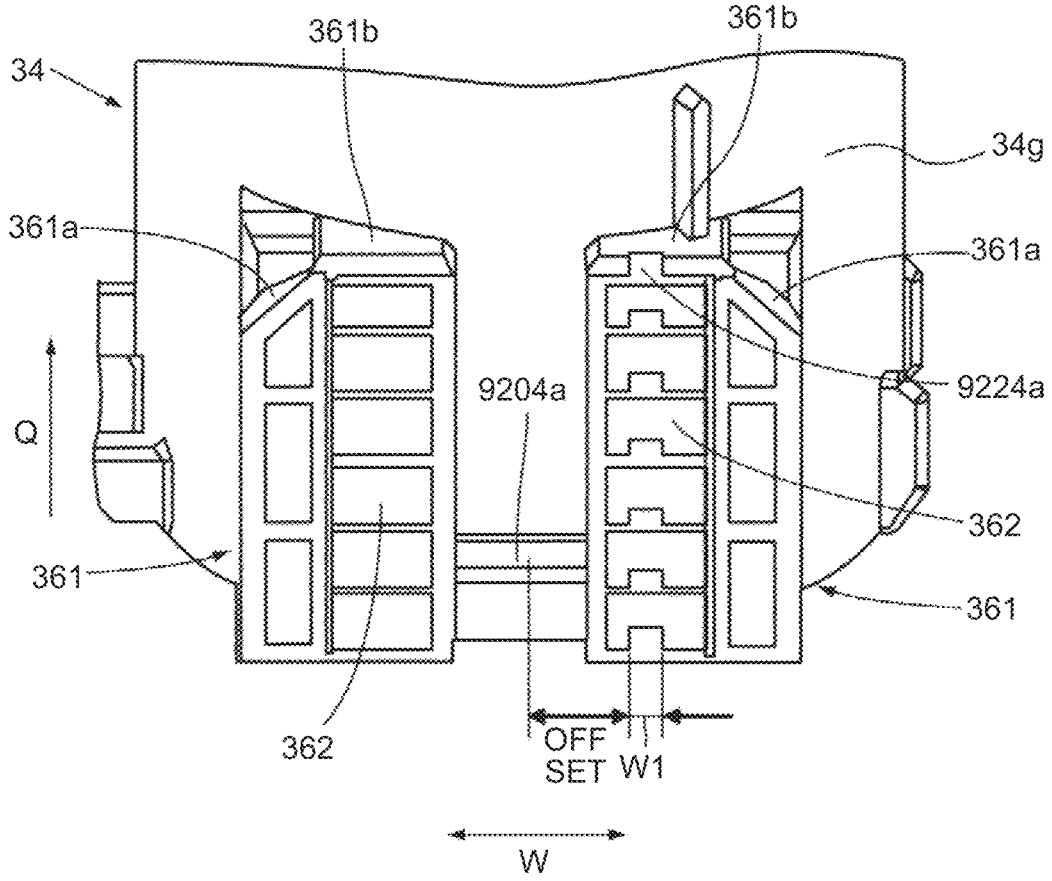
FIG. 72 is an enlarged bottom view illustrating a fourth example of the identified portion provided on the powder container.
Figure 73A:
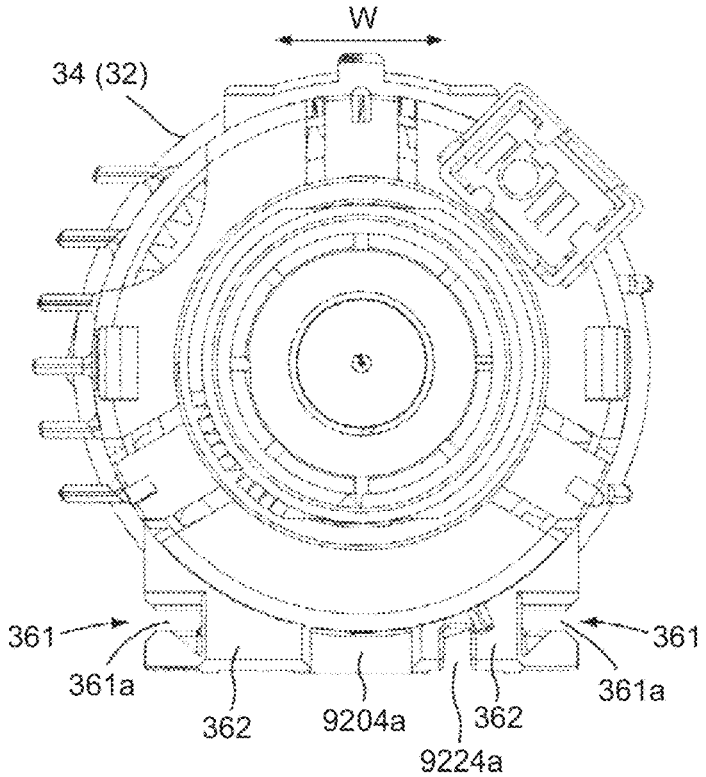
FIG. 73A is a front view illustrating the fourth example of the identified portion provided on the powder container.
Figure 73B:
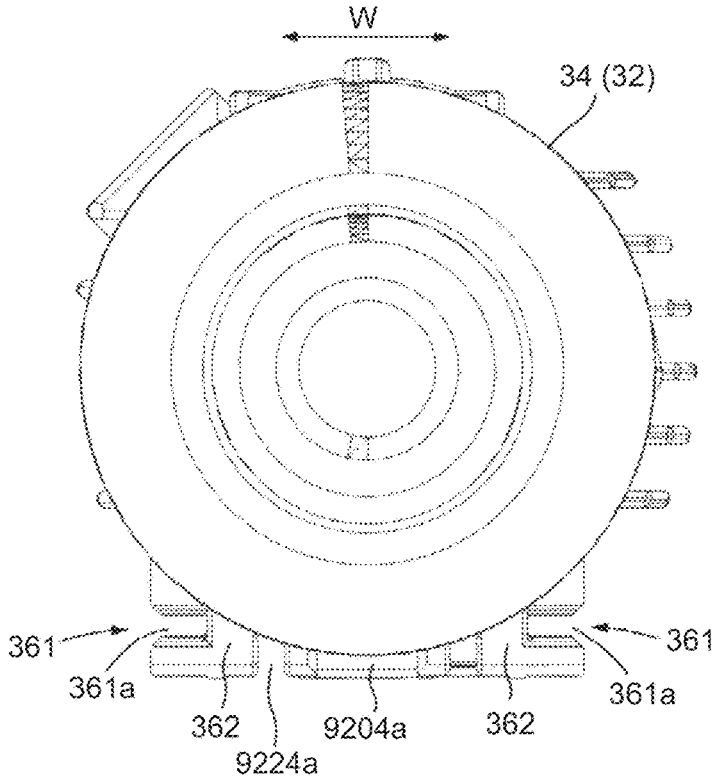
FIG. 73B is a back view illustrating the fourth example of the identified portion provided on the powder container.

FIG. 72, FIG. 73A, and FIG. 73B illustrate a fourth example, in which a gap 9224*a*, which is a passage, a notch, or a recess of the sliding guide and which has a width of 3 mm from an offset position shifted by 9 mm from the center of the lower portion 34*g* of the container front end cover 34, is provided on the sliding guide 361 in the attachment direction Q on the right side in the attachment direction Q. Furthermore, in the fourth example, an identified protrusion 9204*a*, which serves as an identified portion or a protrusion between the sliding guides, is provided between the sliding guides 361 and 361.

Figure 74A:
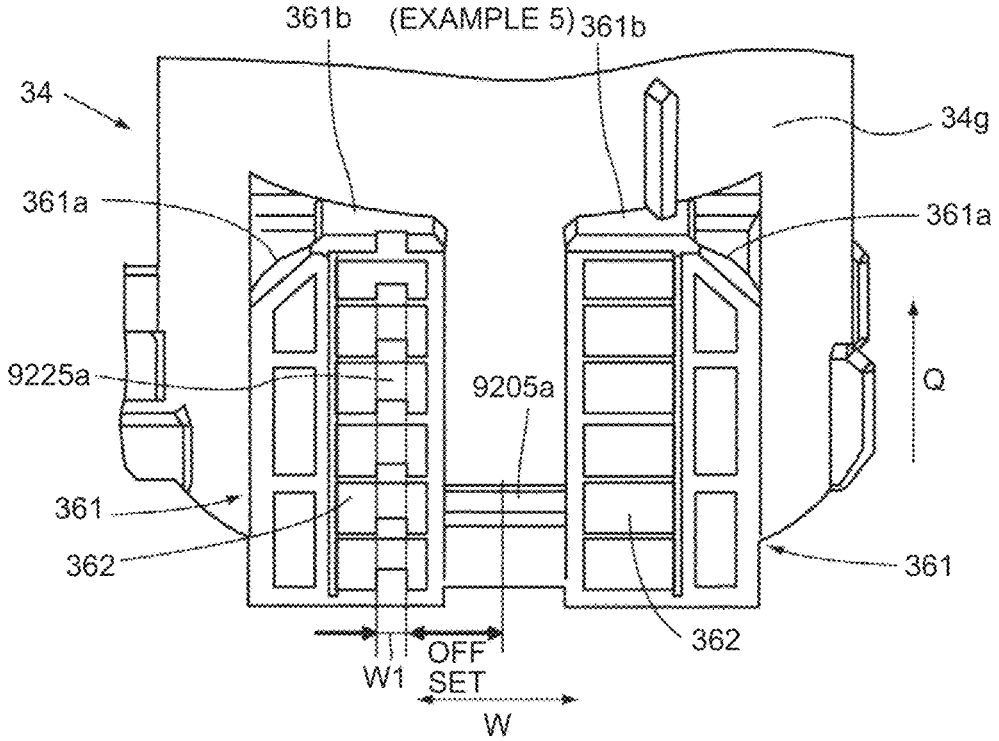
FIG. 74A is an enlarged bottom view illustrating a fifth example of the identified portion provided on the powder container.
Figure 75A:
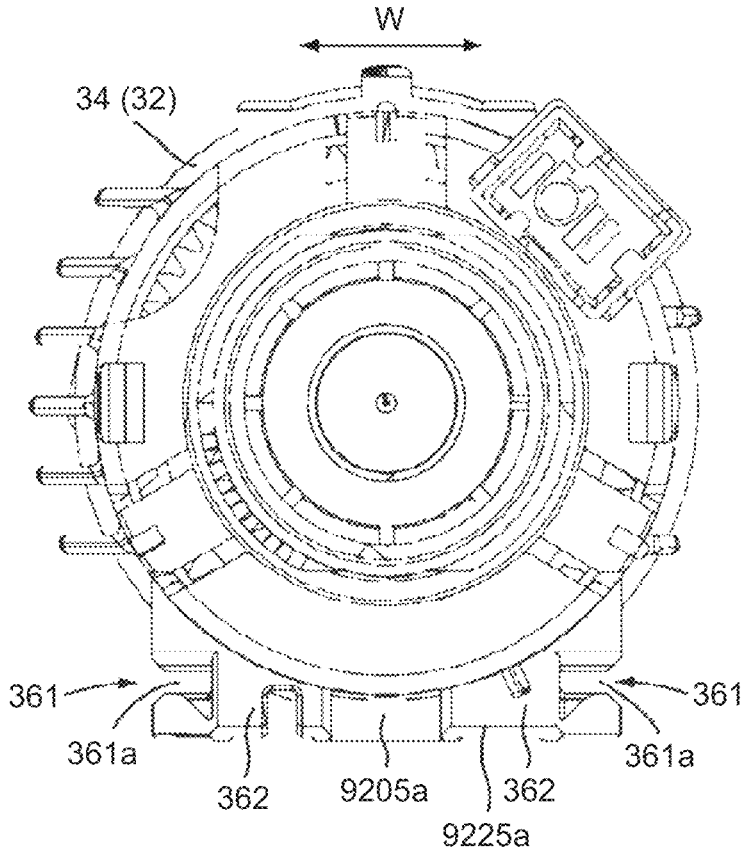
FIG. 75A is a front view illustrating the fifth example of the identified portion provided on the powder container.
Figure 75B:
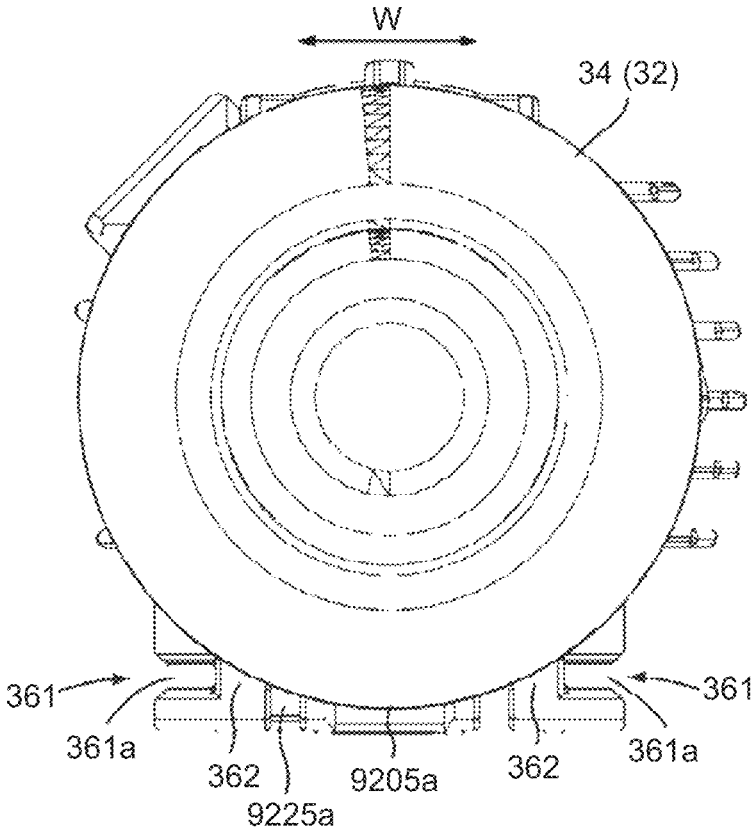
FIG. 75B is a back view illustrating the fifth example of the identified portion provided on the powder container.

FIG. 74A, FIG. 75A, and FIG. 75B illustrate a fifth example, in which a gap 9225*a*, which is a passage, a notch, or a recess of the reinforcing portion and which has a width of 3 mm from an offset position shifted by 9 mm from the center of the lower portion 34*g* of the container front end cover 34, is provided on the sliding guide 361 in the attachment direction Q on the left side in the attachment direction Q. Furthermore, in the fifth example, an identified protrusion 9205*a*, which serves as an identified portion or a protrusion between the sliding guides, is provided between the sliding guides 361 and 361. Incidentally, the depth of each of the gaps is set to be 5 mm, and the height (protrusion amount) of each of the identifying protrusions 90 is set to be 2.5 mm.

In FIG. 72 and FIG. 74A, the gap 9224*a* or the gap 9225*a* is provided on the single sliding guide 361 located on the right side or the left side in the attachment direction Q. However, the configurations of the gaps 9224*a* and 9225*a* of the sliding guides are not limited to these examples.

Figure 74B:
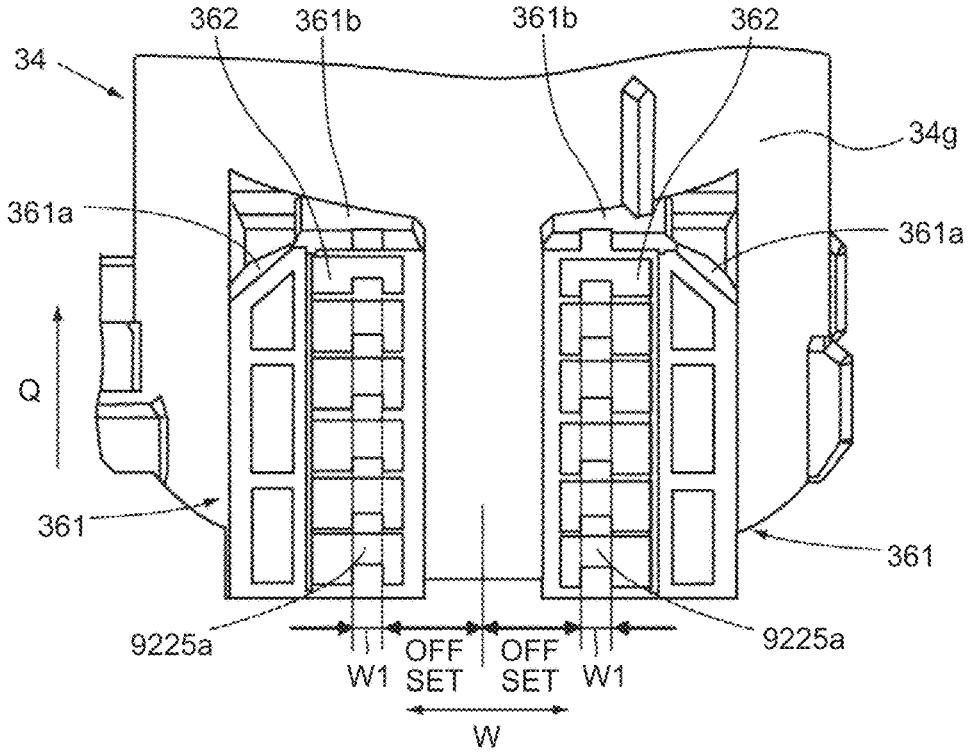
FIG. 74B is an enlarged bottom view illustrating another example of the identified portion provided on the powder container.

For example, as illustrated in FIG. 74B, it may be possible to provide the gaps 9225*a*, each having a width of 3 mm from the offset position shifted by 9 mm from the center of the lower portion 34*g* of the container front end cover 34, on the respective sliding guides 361 and 361 in the attachment direction Q on the right and left sides in the attachment direction Q. Furthermore, the identified protrusion 9204*a* or the identified protrusion 9205*a* may be provided between the sliding guides 361 and 361 as illustrated in FIG. 72 or FIG. 74A or may not be provided between the sliding guides 361 and 361 as illustrated in FIG. 74B.

Figures 76, 77:
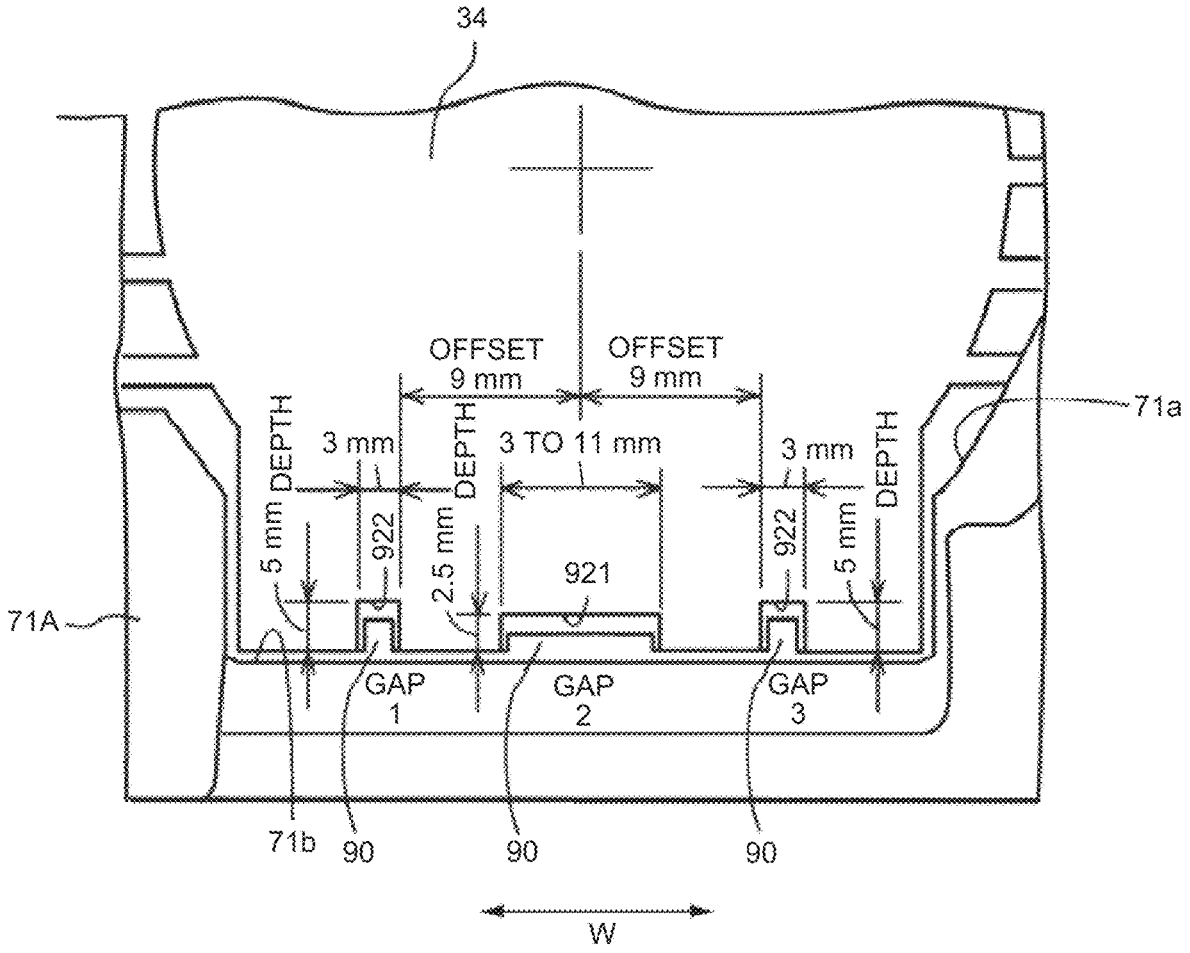
FIG. 76 is an enlarged view illustrating relationships between the identified portions of the first to the fifth examples on the powder container and the identifying portion, and the dimensions of the identified portions.
FIG. 77 is a diagram illustrating relationships between presence or absence of the identified portions of the first to the fifth examples on the powder container and the dimensions of the identified portions.

FIG. 76 is an enlarged view illustrating the relationships and the dimensions of the gap 921, the gap 922 of the sliding guide, and the identifying protrusion 90 with a width narrower than those of the gaps. FIG. 77 illustrates the relationships of the widths of the first to the fifth examples.

Fifth Embodiment

A fifth embodiment of the identified portion 92 will be explained below with reference to FIG. 78 to FIG. 81. The fifth embodiment is the same as the fourth embodiment in terms of the width W1 of the gap 921 and the presence or absence of the gap of sliding guide 922, but differs from the fourth embodiment in terms of the configuration of the identified portion 92 when viewed from the bottom side. Therefore, FIG. 78 to FIG. 81 illustrate the bottom views of the identified portion according to the fifth embodiment, and the front view and the back view are omitted.

Figure 78:
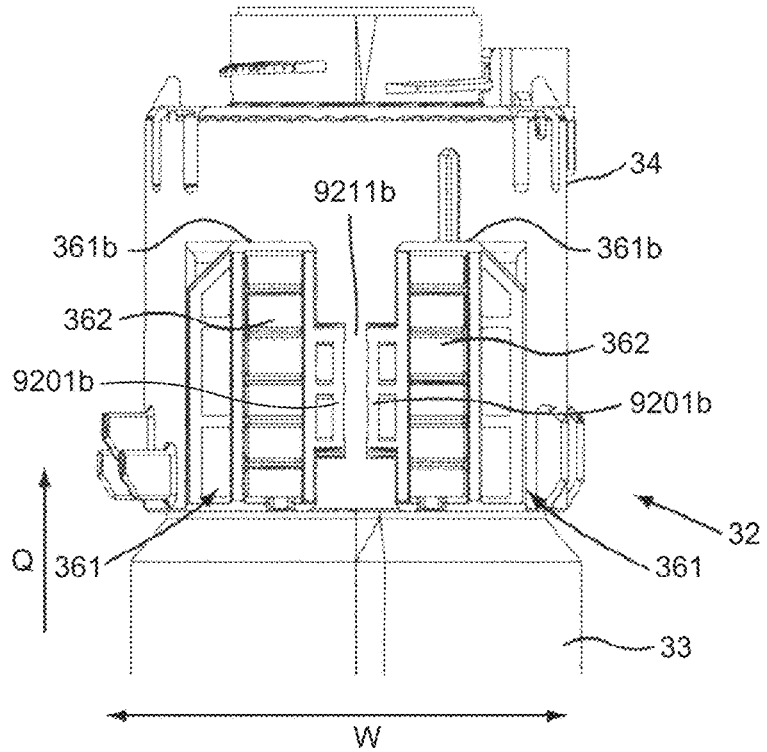
FIG. 78 is an enlarged bottom view illustrating a modification example of the first example of the fifth embodiment.
Figure 79:
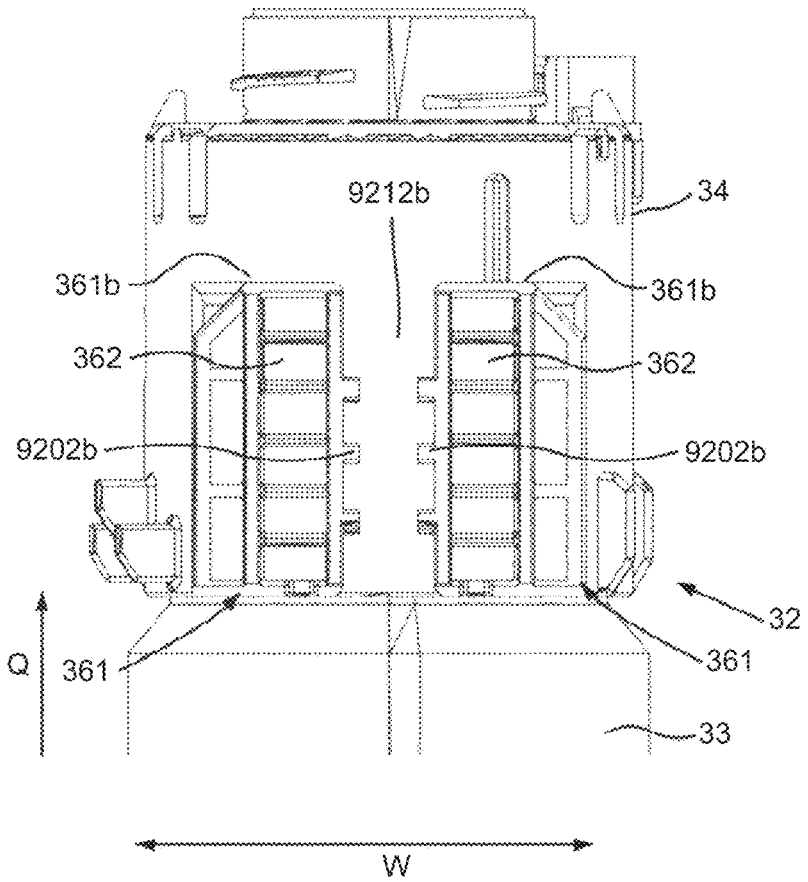
FIG. 79 is an enlarged bottom view illustrating a modification example of the second example of the fifth embodiment.
Figure 80:
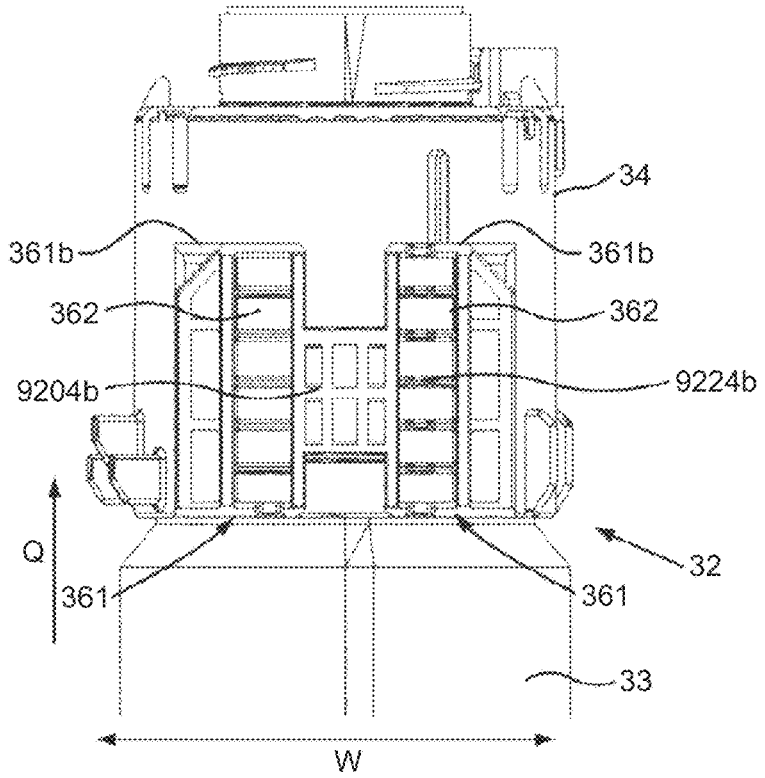
FIG. 80 is an enlarged bottom view illustrating a modification example of the fourth example of the fifth embodiment.
Figure 81:
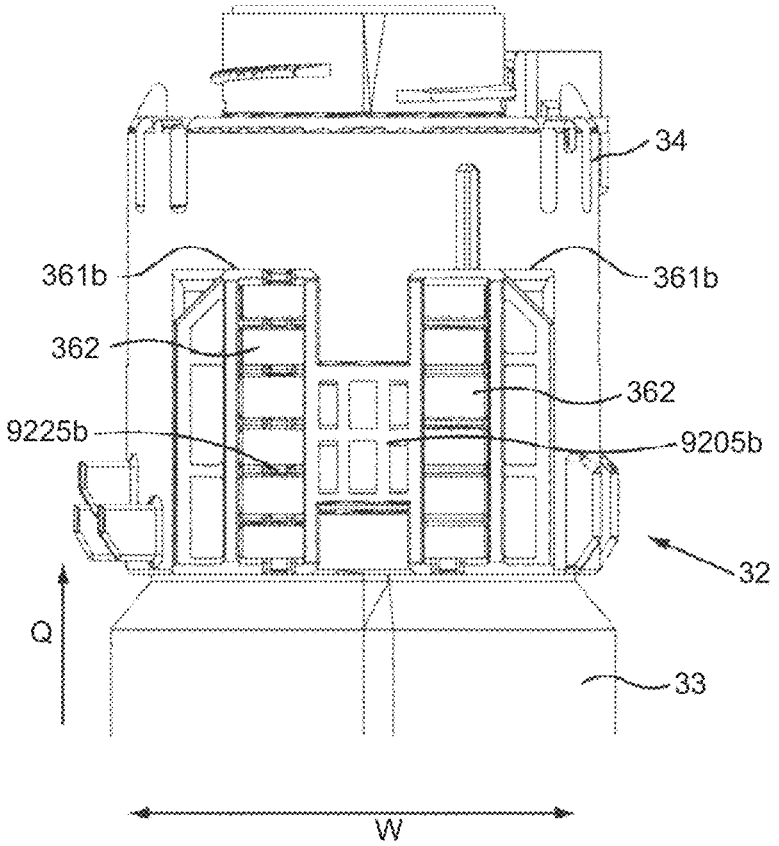
FIG. 81 is an enlarged bottom view illustrating a modification example of the fifth example of the fifth embodiment.

FIG. 78 illustrates a modification example of the first example, FIG. 79 illustrates a modification example of the second example, FIG. 80 illustrates a modification example of the fourth example, and FIG. 81 illustrates a modification example of the fifth example.

In FIG. 78, 9201*b* and 9201*b* denote protrusions between sliding guides serving as identified protrusions, and 9211*b* denotes a gap, which serves as an identified gap, or a gap between the protrusions, provided between the protrusions 9201*b* and 9201*b*.

In FIG. 79, 9202*b* and 9202*b* denote protrusions between sliding guides serving as identified protrusions, and 9212*b* denotes a gap, which is an identified gap, or a gap between the protrusions, provided between the protrusions9202*b* and 9202*b*.

In FIG. 80, 9224*b* denotes a gap, which is a passage, a notch, or a recess of the sliding guide 361 in the attachment direction Q on the right side in the attachment direction Q, and a 9204*b* denotes a protrusion between sliding guides serving as an identified protrusion.

In FIG. 81, 9225*b* denotes a gap, which is a passage, a notch, or a recess of the sliding guide 361 in the attachment direction Q on the left side in the attachment direction Q, and 9205*b* denotes a protrusion between sliding guides serving as an identified protrusion.

In the fifth embodiment illustrated in FIG. 78 to FIG. 81, as compared to the fourth embodiment, each of the protrusions between sliding guides 9201*b*, 9202*b*, 9204*b*, and 9205*b* is extended to a position on the downstream side (near the front end of the toner container) in the attachment direction relative to the centers of the sliding guides 361 and 361 in the longitudinal direction. Specifically, each of the protrusions between sliding guides 9201*b*, 9202*b*, 9204*b* and 9205*b* is arranged such that one end thereof is located near the front ends of sliding guides 361*b* and 361*b*. Because the end of each of the protrusions between sliding guides 9201*b*, 9202*b*, 9204*b* and 9205*b* is located near the front ends of sliding guides 361*b*, when a wrong toner container 32 is attached, a wall surface of each of the protrusions between sliding guides 9201*b*, 9202*b*, 9204*b* and 9205*b* on the downstream side in the attachment direction is fitted to the identifying protrusion 90 immediately after the toner container 32 is entered into the insertion hole 71*a* of the insertion hole part 71. If, contrary to the present embodiment, the identified protrusion is provided on a container rear side of the sliding guides 361 so as to be located distant from the front ends between sliding guides 361*b*, the identified portion 92 comes in contact with the identifying protrusion 90 after the front ends between sliding guides 361*b* are entered into the gutter 74 across the insertion hole base 71*b*. As described above, the insertion hole part 71 is likely to be touched by an operator and is therefore made of a material that is softer and more flexible than those of the container receiving section 72 and the gutter 74 arranged on the rear side relative to the insertion hole part 71 in the attachment direction. Therefore, if the toner container 32 is pushed in the attachment direction while the rear side of the toner container is being moved in the vertical direction, the contact portion between the front ends of sliding guides 361*b* and the gutter 74 that is hard to bend acts as a fulcrum to cause the insertion hole base 71*b* or the identifying protrusion 90 protruding from the insertion hole base 71*b* to bend. If the identifying protrusion 90 is bent, the identified portion 92 can easily pass over the identifying protrusion 90, so that the toner container 32 may be attached in a wrong position.

Figure 82A:
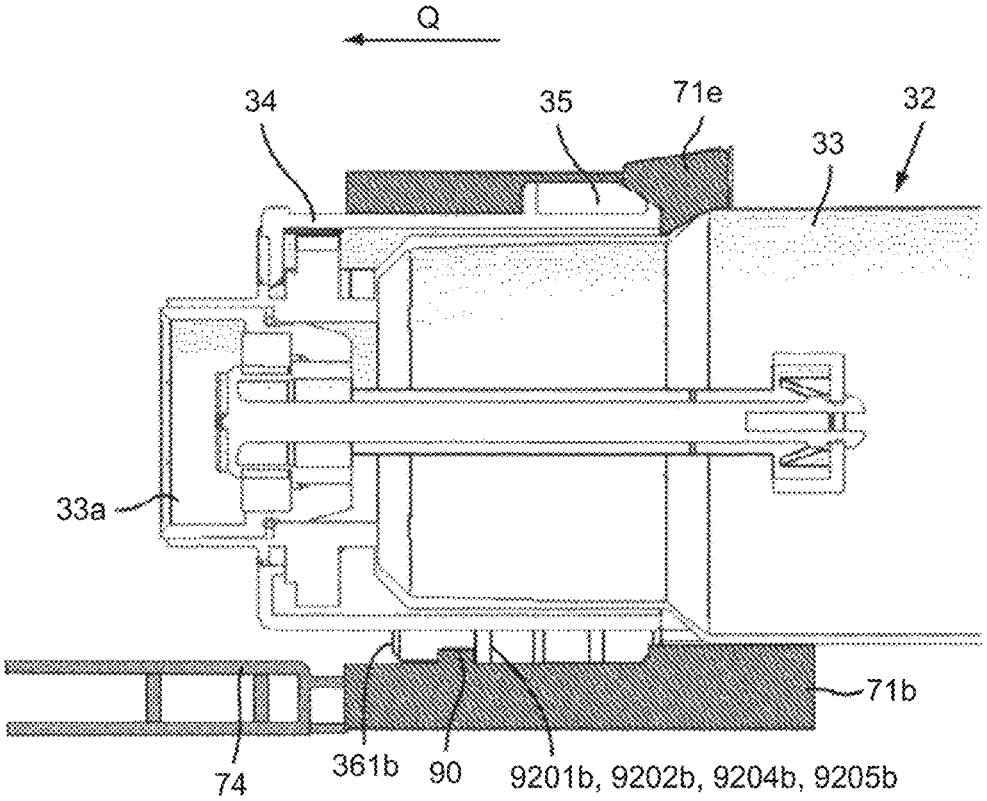
FIG. 82A is a lateral partial cross-sectional view illustrating an unattachable state of an identified portion and an identifying part according to the fifth embodiment.

In contrast, according to the present embodiment, as illustrated in FIG. 82A, each of the protrusions between sliding guides (identified portions) 9201*b*, 9202*b*, 9204*b* and 9205*b* comes in contact with the identifying protrusion 90 when the front ends of sliding guides 361*b* are located on the insertion hole base 71*b* before being entered into the gutter 74. Therefore, even when the toner container 32 is pushed in the attachment direction while the rear end of the toner container 32 is being moved in the vertical direction during the attachment operation of the toner container 32, because the contact position between the front ends of sliding guides 361*b* and the insertion hole base 71*b* acts as a fulcrum, the identifying protrusions 90 is bent in accordance with the vertical movement of the toner container 32. Therefore, each of the protrusions between sliding guides 9201*b*, 9202*b*, 9204*b* and 9205*b* can hardly pass over the identifying protrusion 90, so that it becomes possible to reliably prevent the toner container 32 from being attached in a wrong position.

Figure 82B:
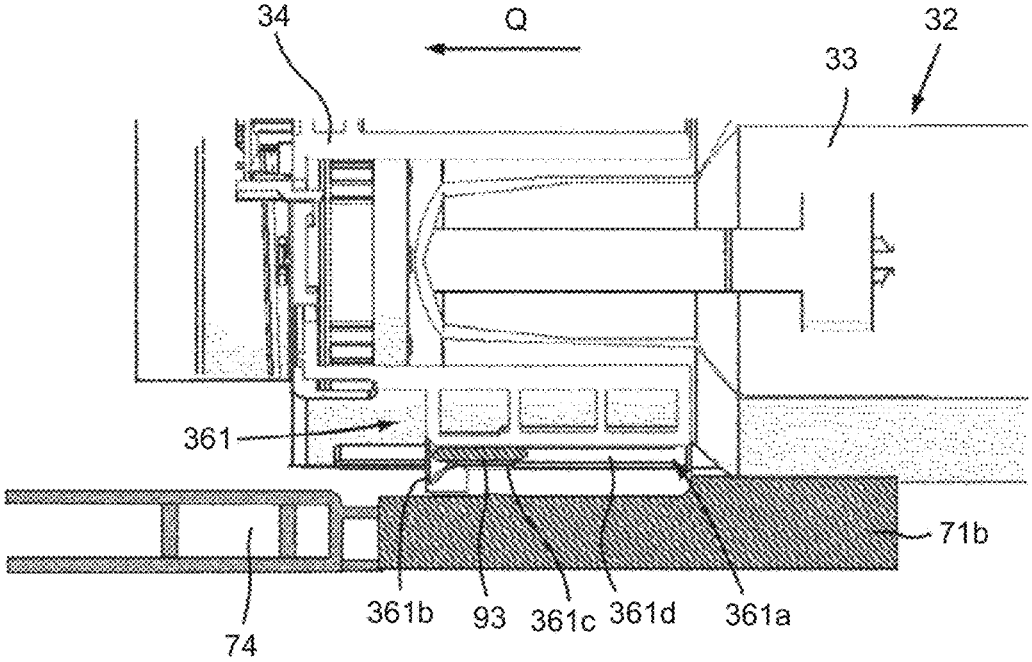
FIG. 82B is a planer partial cross-sectional view illustrating a relationship of a restriction rib and the sliding guide when the identified portion and the identifying part are engaged with each other.

Furthermore, according to the present embodiment, in the state illustrated in FIG. 82A, each of the protrusions between sliding guides 9201*b*, 9202*b*, 9204*b* and 9205*b* comes in contact with the identifying protrusion 90 at a position at which the fronts of sliding groove 361*c*, each having a narrow clearance gap between the upper surface and the lower surface thereof, of the sliding guides 361 sandwich the respective restriction ribs 93 as illustrated in FIG. 82B.

Therefore, each of the protrusions between the sliding guides 9201*b*, 9202*b*, 9204*b* and 9205*b* and the identifying protrusion 90 come in contact with each other while the vertical restriction by the sliding guides 361 and the restriction ribs 93 is intensified. Therefore, each of the protrusions between the sliding guides 9201*b*, 9202*b*, 9204*b* and 9205*b* and the identifying protrusion 90 come in contact with each other while the vertical movement of the toner container 32 is restricted, so that it becomes possible to reliably prevent each of the protrusions between sliding guides 9201*b*, 9202*b*, 9204*b* and 9205*b* from passing over the identifying protrusions 90 and prevent the toner container 32 from being attached in a wrong position.

As described above, by setting the locations of the identifying protrusion 90 and setting the locations, the dimensions, and the presence or absence of each of the protrusion between the sliding guides, the gap between the protrusions, and the gap of the sliding guide according to toner colors, toner components, and apparatus models, as well as by restricting the vertical movement by the sliding guides 361 and 361 and the restriction ribs 93, it becomes possible to increase variations of the incompatibility relationships between the toner container 32 and the toner container holder 70 while ensuring good operability, rather than the incompatibility relationships based on simple engagement/disengagement of protrusions. Therefore, it becomes possible to more reliably prevent an unattachable toner container from being attached.

The configurations of the identifying protrusion 90, the identified portion 92, and the restriction ribs 93 are not applied to only the first embodiment, but applied to the relationship between the container front end cover 34 of the toner container and the insertion hole 71*a* in the second and the third embodiments. Even in these cases, the same advantageous effects as those of the present embodiment can be obtained.

Sixth Embodiment

In a sixth embodiment, another example of the radial restrictor of the toner container 32 with respect to the toner replenishing device 60 as described in the first to the fifth embodiments will be explained.

Figure 83:
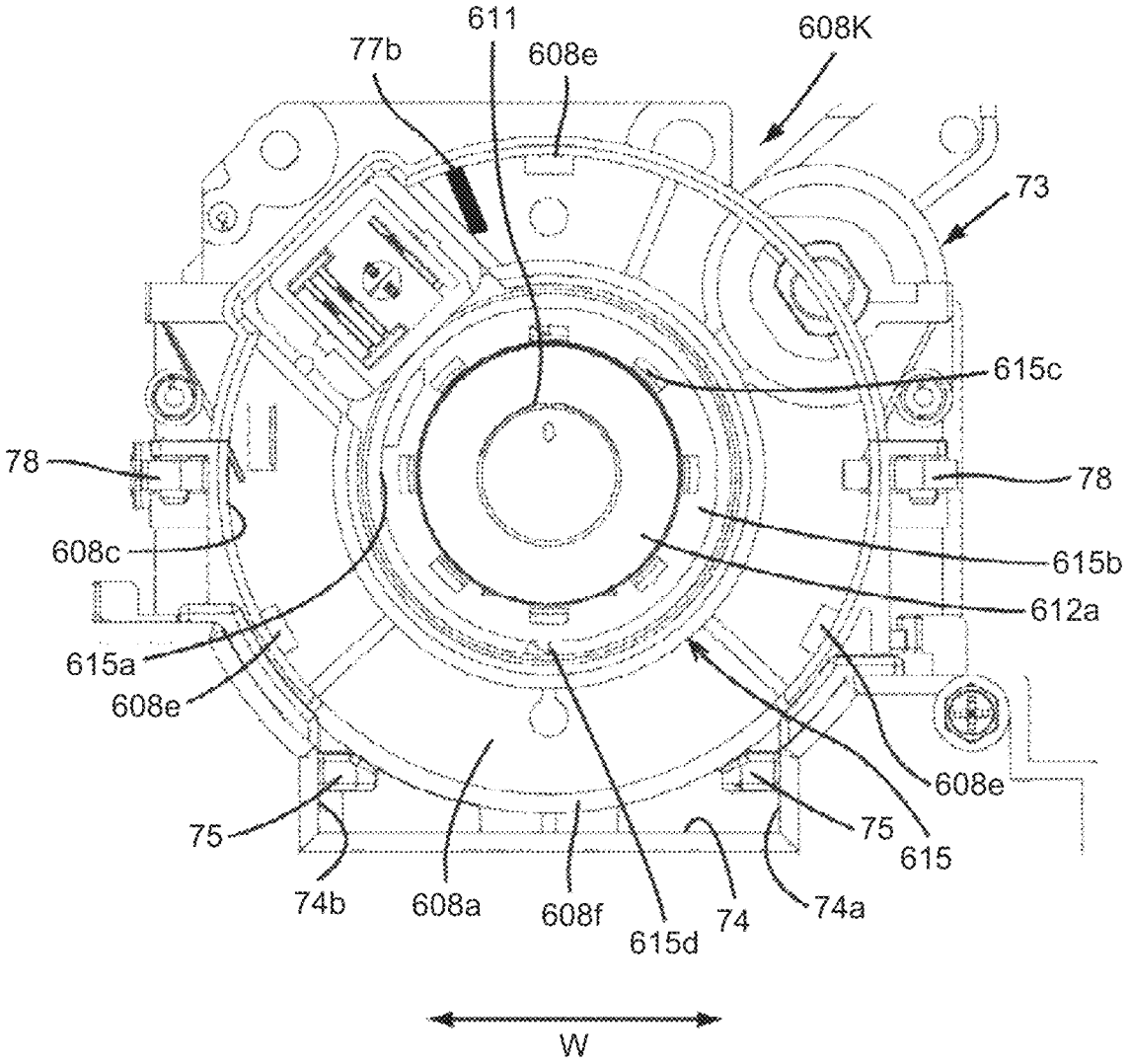
FIG. 83 is a diagram illustrating a configuration of a setting cover in which setting cover protrusions according to a sixth embodiment are provided.

As illustrated in FIG. 83, setting cover protrusions 608*e* protruding inward from the inner surface of setting cover 608*c* are provided at three evenly-spaced positions in the circumferential direction on the setting cover 608. When the container front end cover 34 is entered into the container cover receiving section 73, the outer surface of the container front end cover 34 comes in contact with the setting cover protrusions 608*e*, so that the movement of the toner container 32 is guided and the radial position is determined. The container front end cover 34 includes recesses that can face the setting cover protrusions 608*e*. When the toner container 32 is pushed to a predetermined position in the attachment direction Q in the toner replenishing device 60, the recesses are located opposite the setting cover protrusions 608*e*. Accordingly, the radial restriction of the container front end cover 34 by the outer surface of the container front end cover 34 and the setting cover protrusions 608*e* is released.

While the toner container 32 is explained as an example in the sixth embodiment, the present embodiment may be applied to the toner container 1032 of the second embodiment as illustrated in FIG. 50, in which a spiral groove is not provided on the outer surface of the container body 1033 and the conveyor having the scooping function is provided inside the container body.

Seventh Embodiment

In a seventh embodiment, another example of the circumferential restrictor of the toner container 32 with respect to the toner replenishing device 60 will be explained.

Figure 84:
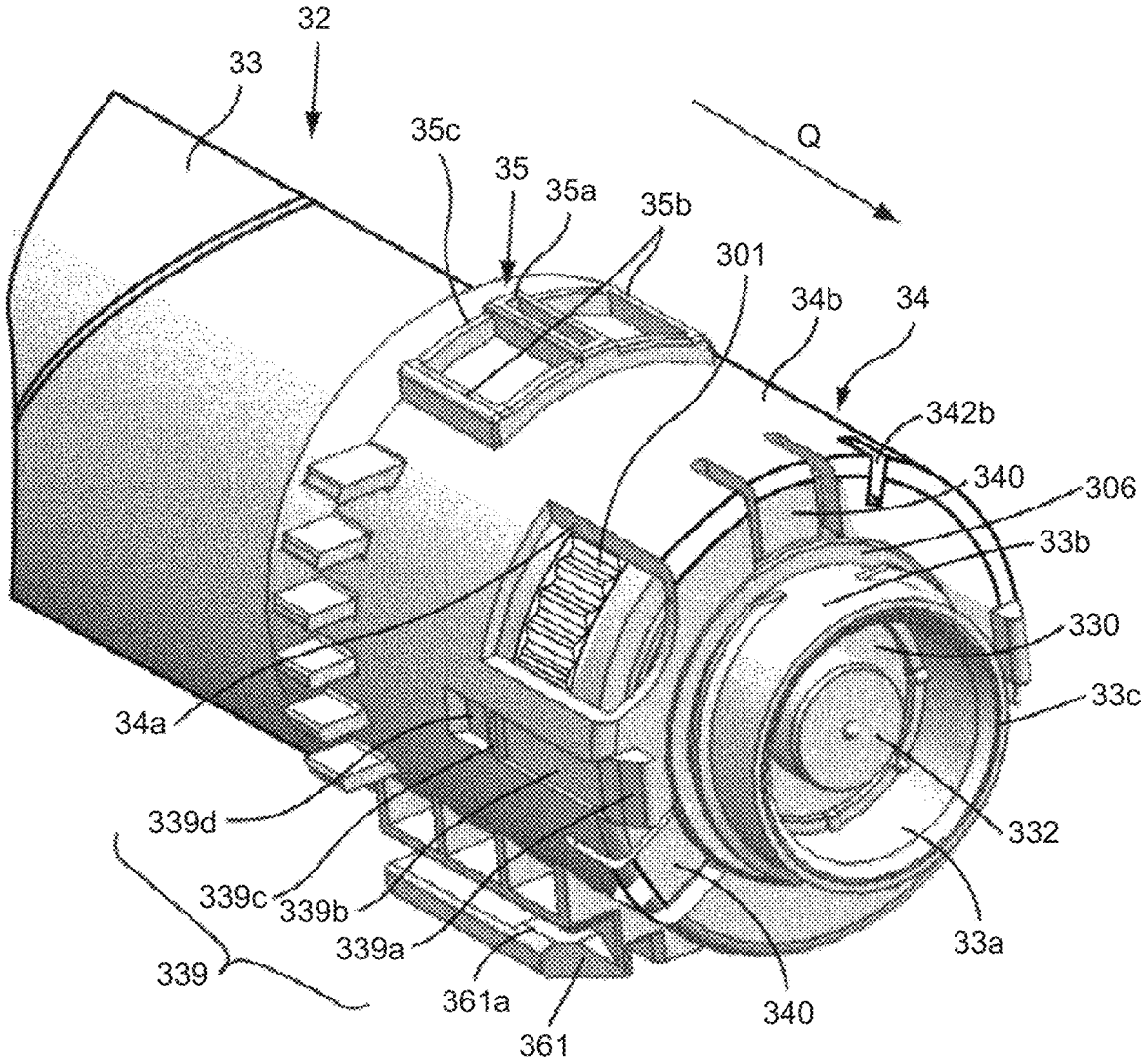
FIG. 84 is a diagram illustrating a configuration of the container front end cover including a rotation restrictive concave according to a seventh embodiment.

As illustrated in FIG. 84, the container front end cover 34 is provided with a circumferential restricting groove serving as a circumferential restrictor on the outer surface thereof. The circumferential restricting groove is provided inward from the outer surface of container front end cover 34*b*. Hereinafter, the circumferential restricting groove is referred to as a rotation restrictive concave 342*b* serving as a guiding portion or a circumferential positioner. The rotation restrictive concave 342*b* is arranged so as to be entered into a convex 77*b*, which serves as a convex of a main-body side and which is provided on the setting cover 608 illustrated in FIG. 83, when the toner container 32 is attached to the toner replenishing device 60.

In the following, the order of restriction and release of all of the positioners of the sixth and seventh embodiments with respect to the toner replenishing device 60 will be explained with reference to FIGS. 85A to 85D and FIGS. 86A to 86E. The order is basically the same as the order as illustrated in FIGS. 38A to 38D and FIGS. 44A to 44E, except that the configurations of the setting cover protrusions 608*e*, the rotation restrictive concave 342*b*, and the convex 77*b* of the setting cover are different. Therefore, in the following, the explanation will be simplified appropriately.

Figure 85A:
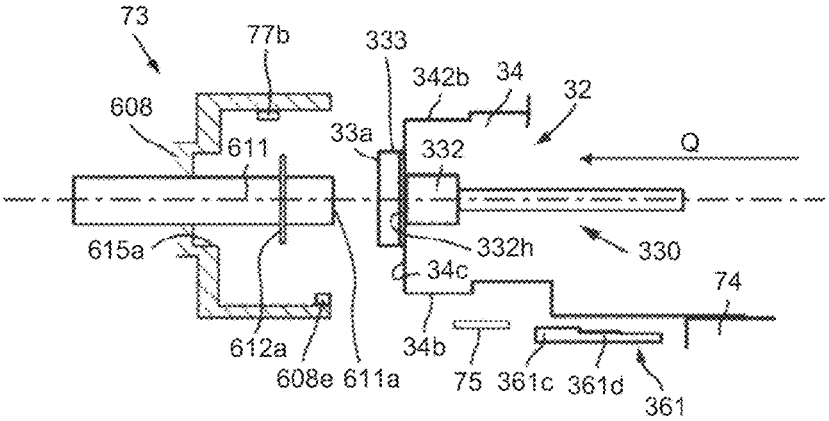
FIG. 85A is a schematic diagram illustrating the powder container on the container holding section when the powder container starts to move.

As illustrated in FIG. 85A, when a user places the toner container 32 on the gutter 74 of the container receiving section 72 of the toner container holder 70 and pushes the toner container 32 in the attachment direction Q (performs attachment operation), the toner container 32 slides on the gutter 74. At this time, as illustrated in FIG. 22, the toner container 32 slides while the side portions of upward guide 35*b* of the toner container 32 come in contact with the projections 76*a* provided from the ceiling surface 76 facing the gutter 74. Therefore, the toner container 32 can be pushed in the attachment direction Q while the movement of the toner container 32 in the vertical direction Z is restricted. Furthermore, the movement in the vertical direction is restricted not by the top portion of upward guide 35*a* on the top of the upward guide 35 but by the side portions of upward guide 35*b* provided on the both sides of the top portion of upward guide 35*a*. Therefore, even when the toner container 32 is deviated in the horizontal direction during the pushing operation, the toner container 32 can reliably brought into contact with the ceiling surface 76 side.

Figure 85B:
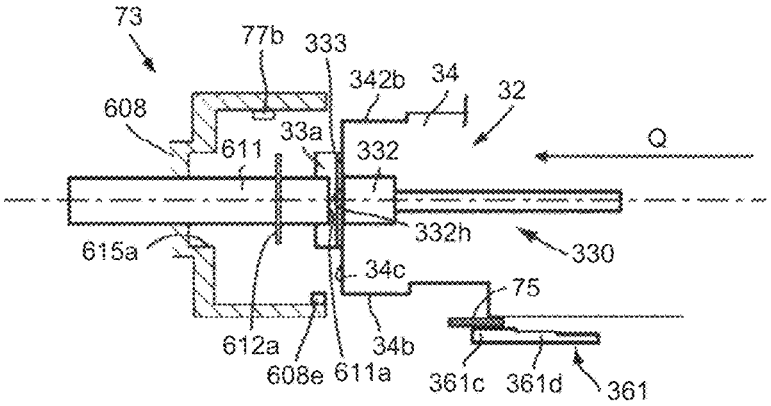
FIG. 85B is a schematic diagram illustrating a first restricted state obtained by the vertical restrictors.

On the toner replenishing device 60 side, as illustrated in FIG. 85B, the fronts of sliding grooves 361*c*, serving as the first guides, are entered into the most upstream side of the respective guide rails 75 and 75 in the attachment direction Q. Therefore, the positions in the width direction W perpendicular to the attachment direction Q and in the vertical direction Z are roughly determined (a first restricted state).

Figure 85C:
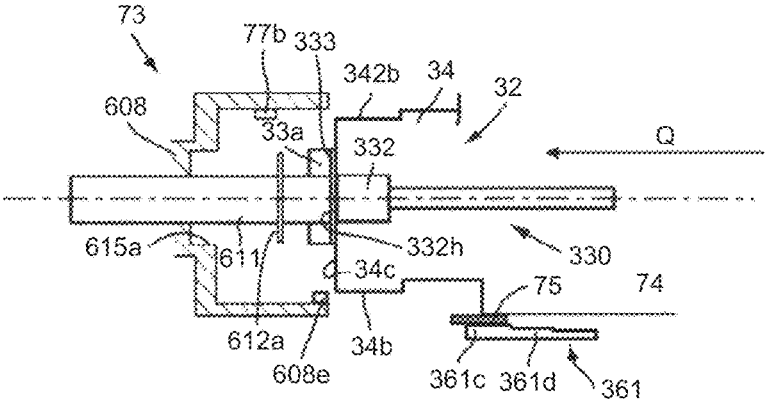
FIG. 85C is a schematic diagram illustrating a state in which the conveying nozzle and the container shutter come in contact with each other.
Figure 85D:
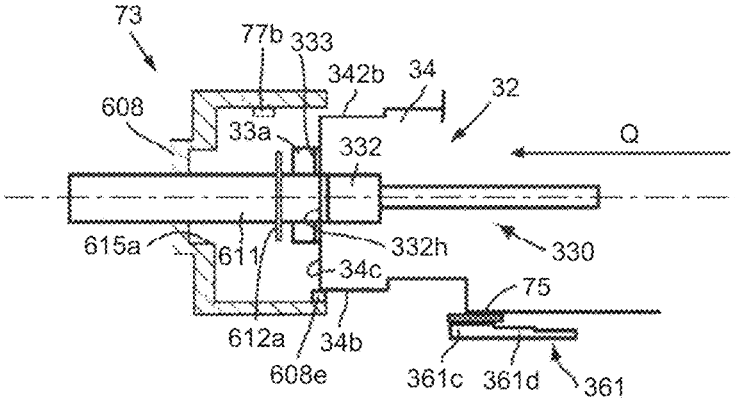
FIG. 85D is a schematic diagram illustrating a second restricted state obtained by radial restrictors.

When the toner container 32 in the first restricted state is further pushed in the attachment direction Q, as illustrated in FIG. 85C, the end surface of container shutter 332*h* and the front end of conveying nozzle 611*a* come in contact with each other. When the toner container 32 is further pushed in the attachment direction Q, a second restricted state as illustrated in FIG. 85D is obtained, in which the front end of the container front end cover 34 is entered into the container cover receiving section 73. Due to the entrance of the front end of the container front end cover 34 into the container cover receiving section 73, the outer surface of container cover 34*b* comes in contact with, from the inner side, the selling cover protrusions 608*e* provided on the inner surface of setting cover 608*c*. Due to the contact between the outer surface of container cover 34*b* and the setting cover protrusions 608*e* of the inner surface of setting cover 608*c*, the movement of the toner container 32 is guided and the radial movement is restricted.

Figure 86A:
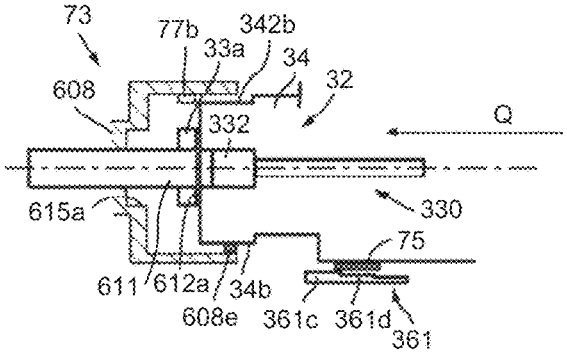
FIG. 86A is a schematic diagram illustrating the powder container on the container holding section when the nozzle shutter flange and the container seal come in contact with each other.
Figure 86B:
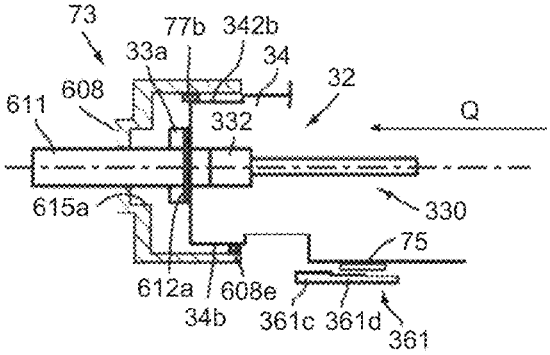
FIG. 86B is a schematic diagram illustrating a third restricted state obtained by the circumferential restricting groove.

When the toner container 32 in the second restricted state is further pushed in the attachment direction Q, the container seal 333 and the nozzle shutter flange 612*a* come in contact with each other as illustrated in FIG. 86A. When the toner container 32 in this state is further pushed in the attachment direction Q, a third restricted state as illustrated in FIG. 86B is obtained. In the third restricted state, the fronts of sliding grooves 361*c* come off from the guide rails 75, and the vertical direction Z is restricted by the centers of sliding grooves 361*d*, serving as second guides, as illustrated in FIG. 44B. Furthermore, the rotation restrictive concave 342*b* provided on the outer surface of container cover 34*b* of the front end of the container front end cover 34 is entered into the convex 77*b* provided on the setting cover 608. Therefore, the container front end cover 34 and the setting cover 608 (the container cover receiving section 73) are integrated and the movement of the container front end cover 34 in the circumferential direction R is restricted, so that the container front end cover 34 does not rotate with the rotation of the container body 33.

Figure 86C:
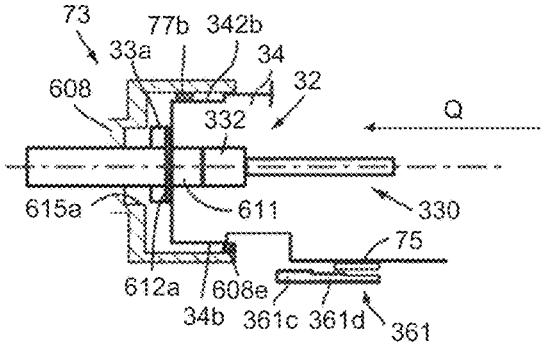
FIG. 86C is a schematic diagram illustrating a fourth restricted state obtained by the radial restrictors.

When the toner container 32 in the third restricted state is further pushed in the attachment direction Q, a fourth restricted state as illustrated in FIG. 86C is obtained, in which the recesses provided on the container front end cover 34 are located opposite the setting cover protrusions 608*e*. Therefore, the radial restriction of the container front end cover 34 by the outer surface of the container front end cover 34 and the setting cover protrusions 608*e* is released.

Figure 86D:
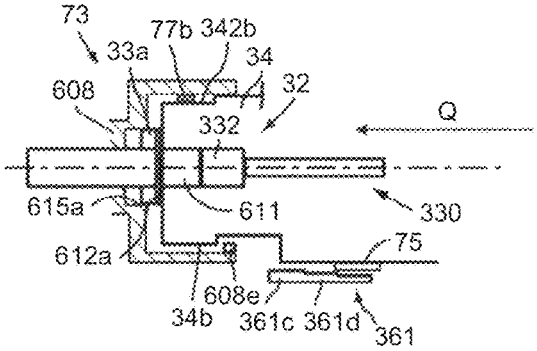
FIG. 86D is a schematic diagram illustrating a fifth restricted state in which the container opening is entered into the container setting section.

When the toner container 32 in the fourth restricted state is further pushed in the attachment direction Q, a fifth restricted state as illustrated in FIG. 86D is obtained, in which the container opening 33*a* is entered into the inner surface of container setting section 615*a* (the setting cover 608) and the container body 33 is rotatably supported inside the inner surface of container setting section 615*a*. At this time, the circumferential position of the container front end cover 34 is restricted by the rotation restrictive concave 342*b* and the convex of setting cover 77*b*, so that the container opening 33*a* and the container setting section 615 can mate with each other such that the respective centers coincide with each other. Therefore, it becomes possible to prevent toner leakage from the container shutter 332 due to insertion of the container opening 33*a* into the container setting section 615 in a deviated manner. Furthermore, when the container opening 33*a* is entered into the inner surface of container setting section 615*a*, the radial restriction by the outer surface of container cover 34*b* and the setting cover protrusions 608*e* is already released, so that the circumferential restriction by the rotation restrictive concave 342*b* is not interfered.

Figure 86E:
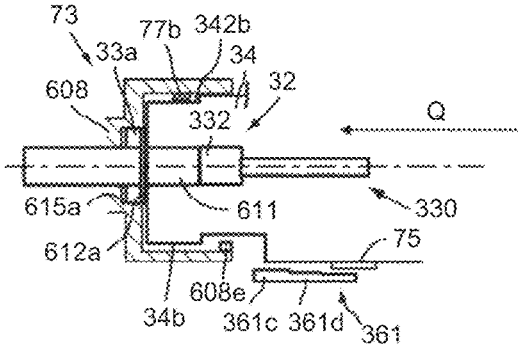

When the toner container 32 in the fifth restricted state is further pushed in the attachment direction Q, a sixth restricted state as illustrated in FIG. 86E is obtained. In the sixth restricted state, the container opening 33*a* is entered further into the inner surface of container setting section 615*a*, and the replenishing device engaging members 78 and 78 are entered into and fitted to the respective engaged openings 339*d* of the container engaged portions 339 and 339 (see FIG. 49). Therefore, the toner container 32 is prevented from moving in the longitudinal direction (the rotation axis direction) and is maintained in the setting position.

As described above, if the rotation restrictive portion of the container front end cover 34 has a convex shape with respect to the outer surface of container cover 34*b*, and if impact or a force is applied to the convex portion because of dropping or the like, stress is concentrated and the rotation restrictive portion may be damaged. However, as in the present embodiment, if the rotation restrictive portion is provided as the rotation restrictive concave 342*h* that has a concave shape with respect to the outer surface of the container front end cover 34*b*, the rotation restrictive portion does not come in contact with a floor at the time of dropping for example. Therefore, it becomes possible to prevent the rotation restrictive portion from being damaged.

Figure 87A:
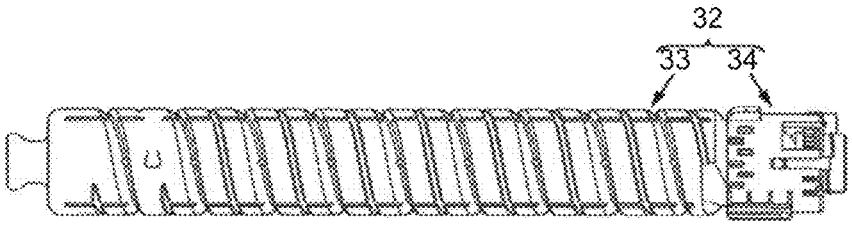
Figure 87B:
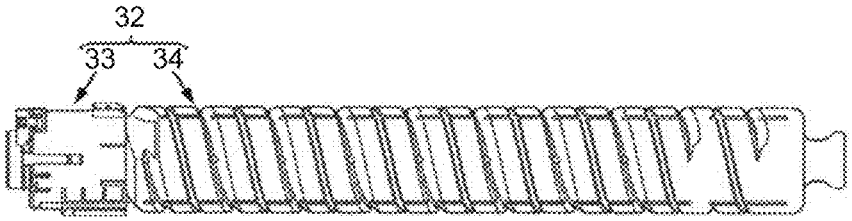
Figure 87C:
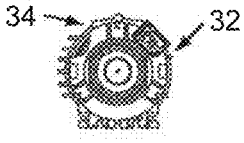
Figure 87D:
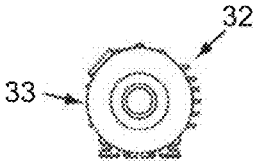
Figure 87E:
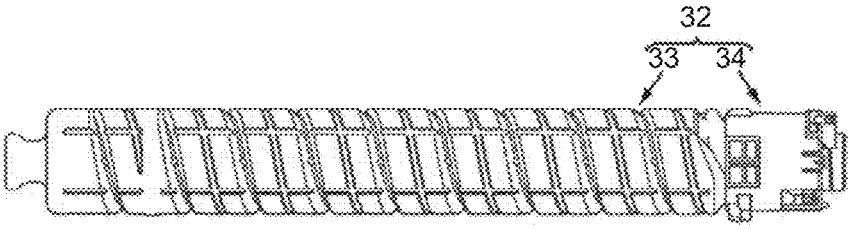
Figure 87F:
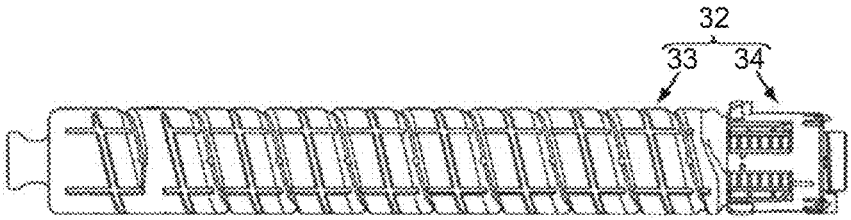
Figure 88A:
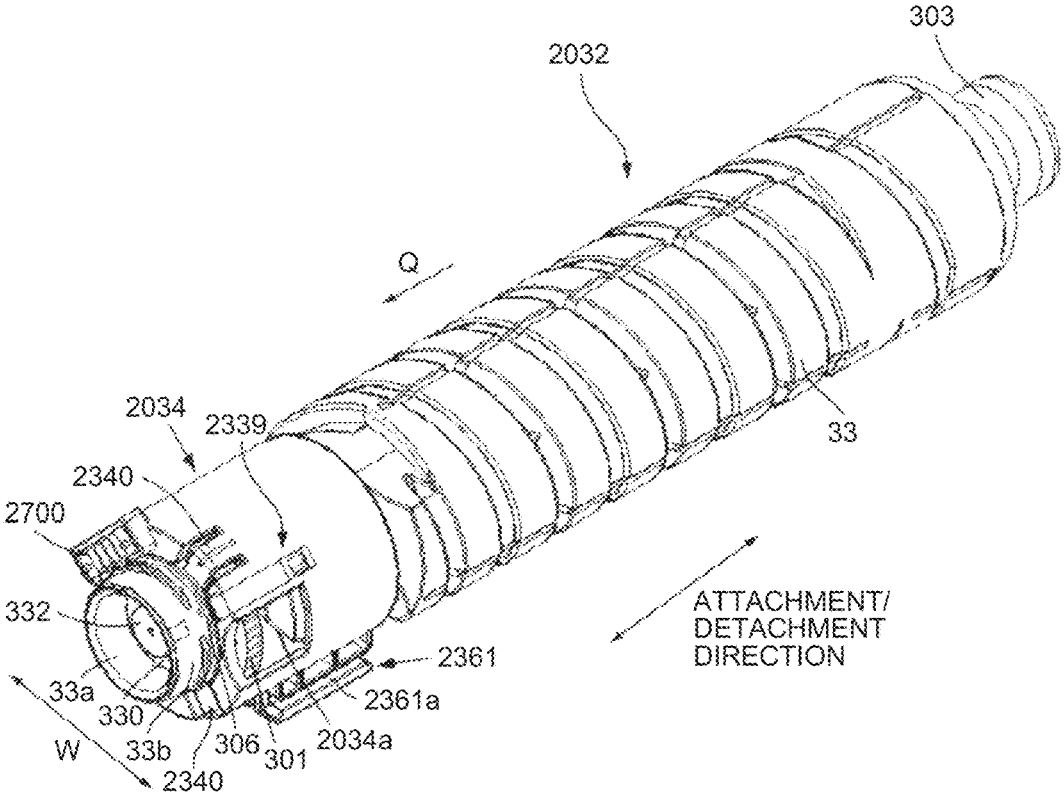
Figure 88B:
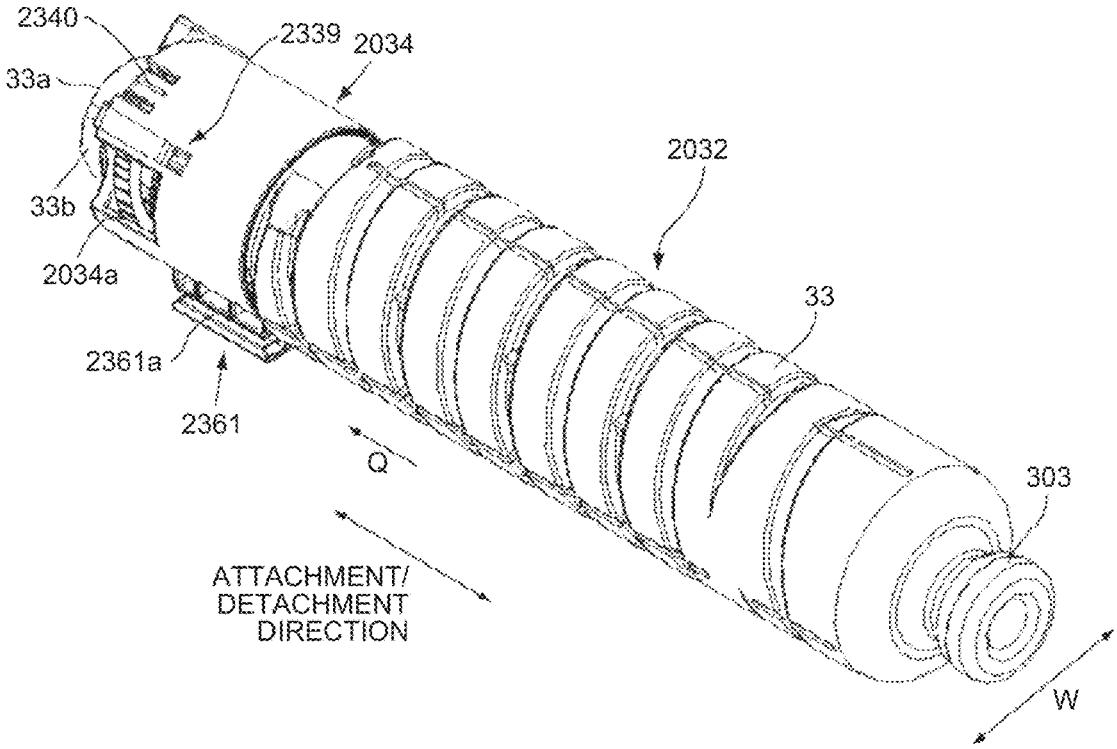

FIGS. 87A to 87F are six diagrams illustrating the entire configuration of the toner container as a powder container including the IC chip 700 according to the present embodiment. The toner container 32 illustrated in FIGS. 87A to 87F includes the container body 33 provided with a spiral groove, and the container front end cover 34 serving as a cover portion on which the IC chip 700 is provided. FIG. 87A is a right side view, FIG. 87B is a left side view, FIG. 87C is a front view, FIG. 87D is a back view, FIG. 87E is a plan view, and FIG. 87F is a bottom view.

Eighth Embodiment

In an eighth embodiment, the configuration of a cover portion of a toner container serving as a powder container differs from the configuration of the container front end cover 34 serving as the cover portion as described above, and the configuration of a container holding section to which the toner container is attached differs from the configuration of the toner container holder 70 serving as the container holding section as described above. Furthermore, the configuration of identification mechanism for identifying the compatibility between the toner container and the toner container holder (the toner replenishing device 60) differs from the configuration of the identification mechanism as described above. Therefore, in the eighth embodiment, the configurations of the cover portion, the container holding section, and the identification mechanism will be mainly explained. The container body 33 or 1033 and the other components having the same configurations as those described above will be denoted by the same reference numerals and the same explanation will be omitted appropriately.

As illustrated in FIG. 88A, FIG. 88B, FIG. 89, FIG. 90, FIG. 91A, and FIG. 91B, a toner container 2032 serving as a powder container according to the present embodiment includes the container body 33 for storing toner as a powder for image formation, and a container front end cover 2034 serving as a container cover attached to the outer surface of the container body 33. The container body 33 is rotatable held by the container front end cover 2034.

The container front end cover 2034 is provided in a cylindrical shape such that one end is opened and the container opening 33*a* of the container body 33 protrudes from a front end of container cover 2034*c* in the attachment direction. A gear exposing opening 2034*a* is arranged on an outer surface of container front end cover 2034*b* so that a part of the container gear 301 of the container body 33 can be exposed when the container front end cover 2034 is attached to the container body 33.

Cover hooks 2340, which are engaged with the cover hook stoppers 306 of the container body 33, are arranged at three positions in the circumferential direction on the front end of container front end cover 2034*c* in the attachment direction. Therefore, the container body 33 and the container front end cover 2034 can rotate relative to each other.

Container engaged portions 2339 and 2339 are provided on the outer surface of container front end cover 2034*b* to determine the position of the toner container 2032 relative to a toner container holder 2070 (the toner replenishing device 60) illustrated in FIG. 92 to FIG. 94 in the axial direction. The replenishing device engaging members 78 and 78 are engaged with the respective container engaged portions 2339 and 2339 when the toner container 2032 is attached to the toner container holder 2070 (the toner replenishing device 60).

Figure 89:
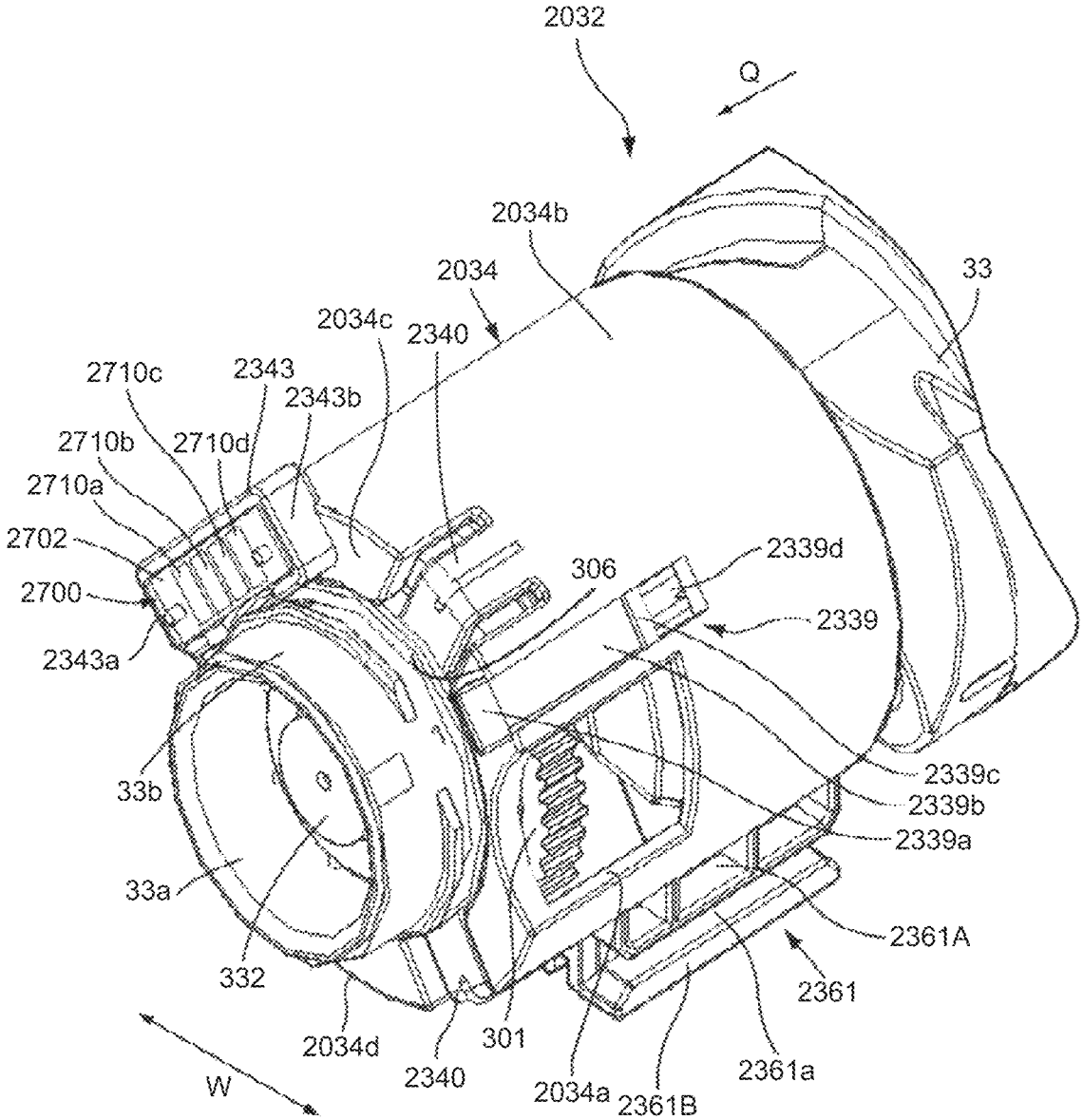

The function and the configuration of each of the container engaged portions 2339 and 2339 are the same as those of the container engaged portions 339 explained above with reference to FIG. 7 and FIGS. 29A and 29B. Specifically, as illustrated in FIG. 89, each of the container engaged portions 2339 includes a guiding protrusion 2339*a* a guiding groove 2339*b*, a bump 2339*c*, and an engaged opening 2339*d* serving as a guiding portion, an axial restrictor, an axial regulator, an axial positioner, or an axial guide. Two sets of the container engaged portions 2339 are arranged on left and right sides of the container front end cover 2034, respectively, where one set of the container engaged portion 2339 includes the guiding protrusion 2339*a*, the guiding groove 2339*b*, the bump 2339*c*, and the engaged opening 2339*d* as described above. Incidentally, the container engaged portions 2339 differ from the container engaged portions 339 in that the container engaged portions 2339 and 2339 are arranged on the container front end cover 2034 so as to face each other and be inclined with respect to the horizontal line passing through the center of the container opening 33*a*, while the container engaged portions 339 and 339 are located in approximately horizontal direction on the container front end cover 34. Specifically, the engaged openings 2339*d* and 2339*d* are arranged on left and right sides across the center of the container opening 33*a* such that one of the engaged openings 2339*d* is located above the gear exposing opening 2034*a* and the other one of the engaged openings 2339*d* is located below the gear exposing opening 2034*a*. Each of the guiding protrusions 2339*a* is arranged on the container front end of the container front end cover 2034 so as to be located on a vertical plane perpendicular to the longitudinal direction of the toner container 2032 and on an inclined line passing through the rotation axis of the container body 33. Each of the guiding protrusions 2339*a* includes an inclined surface connected to each of the guiding grooves 2339*b* so as to come in contact with the replenishing device engaging members 78 and guide the replenishing device engaging members 78 to the guiding grooves 2339*b* when the toner container 2032 is attached. Each of the guiding grooves 2339*b* is a groove recessed from the side surface of the container front end cover 2034.

The width of each of the guiding grooves 2339*b* is set to be slightly wider than the width of each of the replenishing device engaging members 78 such that the replenishing device engaging members 78 do not come off from the guiding grooves 2339*b*. The container rear ends of the guiding grooves 2339*b* are not directly connected to the respective engaged openings 2339*d* but are terminated, and are located at the same height as the side surfaces of the container front end cover 34. Namely, the outer surface of container front end cover 2034*b* with a width of about 1 mm is exposed between each of the guiding grooves 2339*b* and each of the quadrangular the engaged openings 2339*d*, and this portion serves as the bump 2339*c*. The replenishing device engaging members 78 pass over the bumps 2339*c* and fall in the engaged openings 2339*d*, so that the toner container 2032 and the toner container holder 2070 (the toner replenishing device 60) are engaged with each other. This state is the setting position (setting state) of the toner container 2032.

Figure 90:
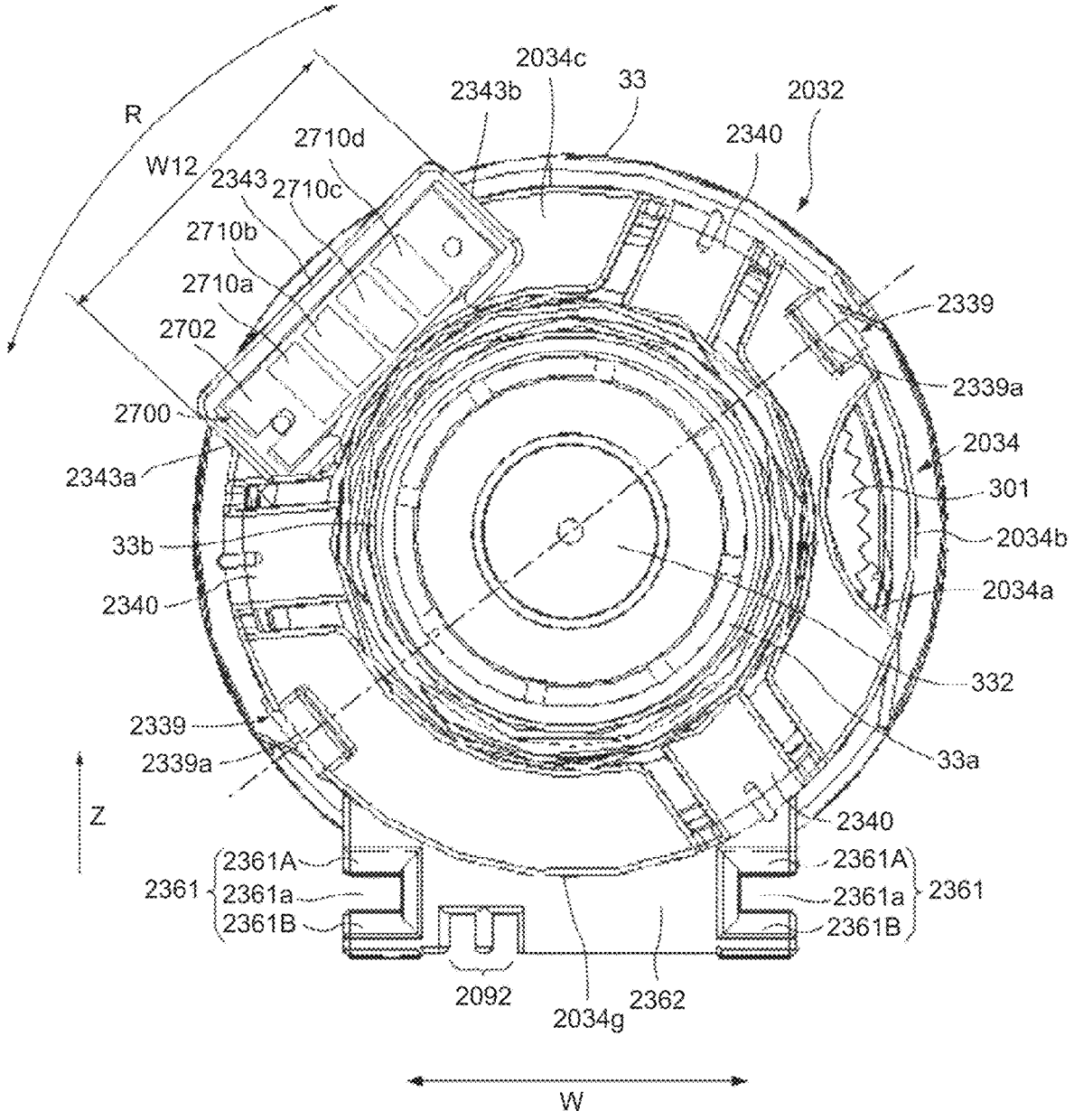

As illustrated in FIG. 90, the container shutter 332 is located in the center of a segment connecting the two container engaged portions 2339 on a virtual plane perpendicular to the rotation axis. If the container shutter 332 is not located on the segment connecting the two container engaged portions 2339, the following situations may occur. Specifically, due to the biasing forces of the container shutter spring 336 and the nozzle shutter spring 613, a moment of force acts to rotate the toner container 2032 about the segment, where the moment arm is a distance from the segment to the container shutter 332. Due to the action of the moment of force, the toner container 2032 may be inclined with respect to the toner container holder 2070 (the toner replenishing device 60). In this case, an attachment load on the toner container 2032 increases, so that a load is applied to the nozzle receiver 330 that holds and guides the container shutter 332. In particular, if the toner container 2032 is new and adequately filled with toner, and when the toner container 2032 is pushed from the rear side so as to insert the conveying nozzle 611 protruding in the horizontal direction, a moment of force acts to rotate the toner container 2032 with the weight of toner added. Therefore, a load is applied to the nozzle receiver 330 in which the conveying nozzle 611 is inserted, and the nozzle receiver 330 may be deformed or broken in the worst case. In contrast, in the toner container 2032 according to the present embodiment, the container shutter 332 is located on the segment connecting the two container engaged portions 2339. Therefore, it becomes possible to prevent the toner container 2032 from being inclined with respect to the toner container holder 2070 (the toner replenishing device 60) due to the biasing forces of the container shutter spring 336 and the nozzle shutter spring 613 that act at the position of the container shutter 332.

As illustrated in FIG. 88A, FIG. 88B, FIG. 89, FIG. 90, and FIG. 91A, an IC tag 2700 and a holder 2343 are provided on the container front end cover 2034, where the IC tag 2700 serves as an IC chip, an information storage medium, or an information storage device of the toner container 2032, and the holder 2343 serves as an IC tag holder for the IC tag 2700. The IC tag 2700 employs a contact-type communication system.

As illustrated in FIG. 89, FIG. 90, and FIG. 91A, in the IC tag 2700, multiple rectangular metallic pads (metallic plates) such as a first metallic pad 2710*a* to a fourth metallic pad 2710*d* are arranged side by side on the surface of a rectangular substrate 2702. The fourth metallic pad 2710*d* is an earth terminal for grounding (earth). An information storage unit is provided on the back surface of the substrate 2702.

The IC tag 2700 as described above is held on the container front end cover 2034 by the holder 2343 such that the first metallic pad 2710*a* to the fourth metallic pad 2710*d* are located on the downstream side in the attachment direction. The holder 2343 is arranged on the container front end cover 2034 so as to protrude in the attachment direction Q relative to a vertical surface 2034*d*.

In the present embodiment, the holder 2343 functions as a circumferential restrictor of the toner container 2032, and is therefore integrally molded with the container front end cover 2034 so that the relative position with respect to the container front end cover 2034 can be managed easily. However, as long as the relative position of the holder 2343 and the container front end cover 2034 can be managed, the holder 2343 may be provided separately from the container front end cover 2034 and may be integrally mounted on the container front end cover 2034 by connecting means, such as bonding, welding, or joining. In this case, it becomes possible to simplify the shape of the container front end cover 2034, so that processing costs can be reduced.

The holder 2343 is arranged in an approximately middle position between the container engaged portions 2339 and 2339 facing each other on the container front end cover 2034 so as to be approximately parallel to the inclined segment connecting the container engaged portions 2339 and 2339. Therefore, the gear exposing opening 2034*a* is provided in an approximately horizontal position that is different from the position of the gear exposing opening 34*a* provided on the container front end cover 34. Both side surfaces 2343*a* and 2343*b*, which serve as guiding portions, both surfaces of the holder, circumferential restrictor, circumferential regulators, circumferential positioners, or circumferential guides for restricting movement of the container front end cover 2034 in the vertical direction, and which are located in the longitudinal direction of the holder 2343.

The holder 2343 is arranged in an obliquely upper left space of the container front end cover 2034 when viewed from the container front side along the rotation axis of the toner container 2032. Specifically, the holder 2343 is arranged on the container front end cover 2034 by using the obliquely upper left space that becomes a dead space when the toner container 2032 is arranged in tandem with the other toner containers 2032 of the other colors. Therefore, it becomes possible to provide the compact-size toner replenishing device 60 that enables the cylindrical toner containers 2032 to be arranged adjacent to one another.

As mainly illustrated in FIG. 90, the container front end cover 2034 includes a guiding portion that guides the container opening 33*a* to the container setting section 615 as illustrated in FIG. 92 and FIG. 93 by restricting the toner container 2032 being attached from moving in directions other than the attachment direction when the toner container 2032 is attached to the printer 100 (the main body of the image forming apparatus).

As illustrated in FIG. 90, FIG. 91A, and FIG. 91B, a pair of sliding guides 2361 and 2361 are provided on both side surfaces of a lower portion 2034*g* of the container front end cover 2034, where the sliding guides 2361 and 2361 serve as a pair of guiding portions, vertical restrictors, vertical regulators, vertical positioners, or vertical guides for restricting movement of the container front end cover 2034 in the vertical direction, and the lower portion 2034*g* serves a lower portion of the outer surface of the container front end cover. Each of the sliding guides 2361 and 2361 includes an upper surface 2361A serving as an upper guide and a lower surface 2361B serving as a lower guide, each extending along the longitudinal direction of the container body 33. Sliding grooves 2361*a* and 2361*a* are provided between the upper surfaces 2361A and the lower surfaces 2361B, respectively. Each of the sliding grooves 2361*a* is provided parallel to the rotation axis of the container body 33 such that each of guide rails 2075 and 2075 as a pair as illustrated in FIG. 92, FIG. 93, FIG. 94 can be sandwiched in the vertical direction.

Specifically, the upper surfaces 2361A and the lower surfaces 2361B sandwich the respective guide rails 2075 in the vertical direction, so that the sliding guides 2361 and 2361 function as positioners of the container front end cover 2034 in the vertical direction Z and the width direction W perpendicular to the attachment/detachment direction when the toner container 2032 is attached to the printer 100 (the main body of the image forming apparatus), to thereby restrict the movement of the toner container 2032 in the vertical direction Z and the width direction W.

Namely, the container front end cover 2034 includes, as the guiding portions for guiding the container opening 33*a* to a container cover receiving section 2073 when the toner container 2032 is attached to the printer 100 (the main body of the image forming apparatus), the pair of the sliding guides 2361 and 2361 serving as vertical restrictors, the both side surfaces 2343*a* and 2343*b* of the holder 2343 serving as circumferential restrictors, and the container engaged portions 2339 with the engaged openings 2339*d* serving as axial restrictors.

The configuration of the toner container holder 2070 (the toner replenishing device 60) will be explained below with reference to FIG. 92, FIG. 93, and FIG. 94.

The toner container holder 2070 to which the toner container 2032 is attached is arranged in the printer 100 (the main body of the image forming apparatus), in place of the toner container holder 70 illustrated in FIG. 1. In the present embodiment, the toner container holder 2070 to which the single toner container 2032 is attached will be described. Specifically, a monochrome image forming apparatus includes the single toner container holder 2070 in the printer 100 (the main body of the image forming apparatus), and a multicolor image forming apparatus includes the same number of the toner container holders 2070 as the number of colors in the printer 100 (the main body of the image forming apparatus). The toner container 2032 set in the toner container holder 2070 supplies, at a replenishing timing, toner to a developing device corresponding to the color of the toner contained in the toner container.

In the present embodiment, the toner replenishing device 60 includes the toner container holder 2070, the conveying nozzle 611 serving as a conveyor, the conveying screw 614 serving as an apparatus main-body conveyor arranged inside the conveying nozzle 611. a container rotating part 2091 serving as a driving part, and a toner dropping passage. When a user performs attachment operation to push the toner container 2032 in the attachment direction Q and the toner container 2032 is moved inside the toner container holder 2070 of the printer 100 (the main body of the image forming apparatus, the conveying nozzle 611 of the toner replenishing device 60 is inserted from a front side of the toner container 2032 in the attachment direction Q along with the attachment operation. Therefore, the toner container 2032 and the conveying nozzle 611 communicate with each other.

The toner container holder 2070 mainly includes the container cover receiving section 2073, a container receiving section 2072, and an insertion hole part 2071 illustrated in FIG. 97. The container cover receiving section 2073 is a section for holding the container front end cover 2034 and the container body 33 of the toner container 2032. The container receiving section 2072 is a section for holding the container body 33 of the toner container 2032. The insertion hole part 2071 is provided with an insertion hole 2071*a* serving as an insertion opening used in the attachment operation of the toner container 2032 as illustrated in FIG. 97. When a main-body cover arranged on the front side of the copier 500 (the front side in the direction normal to the sheet of FIG. 2) is opened, the insertion hole part 2071 of the toner container holder 2070 is exposed. Then, attachment/detachment operation of the toner container 2032 (attachment/detachment operation with the longitudinal direction of the toner containers 2032 taken as an attachment/detachment direction) is performed from the front side of the copier 500 while the toner container 2032 is oriented with its longitudinal direction being parallel to the horizontal direction. Incidentally, a setting cover 2608 is a part of the container cover receiving section 2073 of the toner container holder 70.

The container receiving section 2072 is provided such that its longitudinal length becomes approximately the same as the longitudinal length of the container body 33Y. The container cover receiving section 2073 is arranged on a container front side of the container receiving section 2072 in the longitudinal direction (attachment/detachment direction), and the insertion hole part 2071 is arranged on one end of the container receiving section 2072 in the longitudinal direction. The toner container 2032 is able to move on the container receiving section 2072 in a sliding manner. Therefore, along with the attachment operation of the toner container 2032, the container front end cover 2034 first passes through the insertion hole part 2071, slides on the container receiving section 2072 for a while, and is finally attached to the container cover receiving section 2073.

As illustrated in FIG. 95, while the container front end cover 2034 is attached to the container cover receiving section 2073, the container rotating part 2091 including the driving motor 603 and multiple gears inputs rotation drive to the container gear 301 provided in the container body 33 via the container driving gear 601 serving as an apparatus main-body gear. Therefore, the container body 33 is rotated in the arrow A direction in FIG. 95. With the rotation of the container body 33, the spiral groove 302 provided with a spiral shape on the inner surface of the container body 33 conveys toner stored in the container body 33 along the longitudinal direction of the container body 33. The conveyed toner is supplied from the container front end cover 2034 side, which is on the other end of the toner container 2032, to the inside of the conveying nozzle 611 via the nozzle hole 610 serving as a powder receiving hole provided on the conveying nozzle 611. Subsequently, the conveying screw 614 arranged inside the conveying nozzle 611 rotates when the rotation drive is input to the conveyor screw gear 605 of the container rotating part 2091 serving as a driving part, so that the toner supplied in the conveying nozzle 611 is conveyed. Then, the toner is replenished to the developing device 50 (the second developer accommodating section 54) via the toner dropping passage connected to the downstream end of the conveying nozzle 611 in the conveying direction.

The toner container 2032 is replaced with a new one at the end of its lifetime (when the container becomes empty because almost all of the contained toner is consumed). When the toner container 2032 is to be replaced, an operator can grip the gripper 303, which is arranged on one end of the toner container 2032 opposite the container front end cover 2034 in the longitudinal direction, to pull out and detach the attached toner container 2032.

The configuration of the container rotating part 2091 will be explained below. The container rotating part 2091 includes, similarly to the container rotating part 91Y, the container driving gear 601 and the conveyor screw gear 605. As illustrated in FIG. 92 and FIG. 95, when the driving motor 603 fixed to the mounting frame 602 is driven and the output gear 603*a* is rotated, the conveyor screw gear 605 rotates (see FIG. 92). The container driving gear 601 rotates by receiving the rotation of the output gear 603*a* from the conveyor screw gear 605 via the multiple coupled gears 604.

As illustrated in FIG. 92, FIG. 93, and FIG. 94, the setting cover 2608 is arranged on the container cover receiving section 2073. The conveying nozzle 611 is arranged in the center of the setting cover 2608. As illustrated in FIG. 94, the conveying nozzle 611 is arranged so as to protrude from the end surface of container setting section 615*b* on the downstream side in the attachment direction of the toner container 2032 toward the upstream side in the attachment direction inside the container cover receiving section 2073. The container setting section 615 serving as the container receiving section stands in the protruding direction of the conveying nozzle 611, that is, toward the upstream side in the attachment direction of the toner container 2032, so as to surround the conveying nozzle 611. Specifically, the container setting section 615 is arranged at the base of the conveying nozzle 611 and serves as a positioner to determine the position of the container opening 33*a*. When the container opening 33*a* is inserted in and mated to the container setting section 615, the radial position of the container opening 33*a* is determined.

As illustrated in FIG. 94, at the base of the conveying nozzle 611 located on the downstream side in the attachment direction when viewed from the attachment direction, the container setting section 615 is provided, to which the container opening 33*a* is fitted when the toner container 2032 is attached to the toner container holder 2070. The container setting section 615 is located at the base of the conveying nozzle 611, and includes the end surface of container setting section 615*b* on the downstream side in the attachment direction of the toner container 2032 relative to the inner surface of container setting section 615*a* in which the container opening 33*a* is inserted. On the end surface of container setting section 615*b*, the spring fixing parts 615*c* protruding from the end surface of container setting section 615*b* to the upstream side in the attachment direction of the toner container 2032 are provided at eight evenly-spaced positions along the outer periphery of the nozzle shutter spring 613. By placing the spring fixing parts 615*c* so as to cover the outer periphery of the nozzle shutter spring 613, it becomes possible to restrict the radial movement of the nozzle shutter spring 613. Therefore, it becomes possible to prevent the toner container 2032 from being set while the nozzle shutter spring 613 is deviated in the radial direction and prevent the nozzle shutter spring 613 from being caught between the end surface of container setting section 615*b* and the front end 33*c* of the container opening 33*a*, enabling to prevent a failure to attach the toner container 2032 to the toner replenishing device 60.

When the toner container 2032 is attached to the toner container holder 2070, the outer surface of container opening 33*b* of the toner container 2032 slidably mates with the inner surface of container setting section 615*a*.

By the mating the inner surface 615*a* of the container setting section 615 and the outer surface of container opening 33*b* of the toner container 32 to each other, the position of the toner container 2032 relative to the toner container holder 2070 in the radial direction perpendicular to the longitudinal direction of the toner container 2032 is determined. Furthermore, when the toner container 2032 rotates, the outer surface of container opening 33*b* functions as a rotational shaft and the inner surface of container setting section 615*a* functions as a bearing. At this time, the outer surface of container opening 33*b* comes in sliding contact with the contact surfaces 615*d* as parts of the inner surface of container setting section 615*a* and the radial position of the toner container 2032 relative to the toner container holder 2070 is determined.

As illustrated in FIG. 94, the setting cover 2608 is provided with holes 2608*d* and 2608*d* so as to face each other in the width direction W and allow the replenishing device engaging members 78 and 78 to move back and forth from the outer surface of the setting cover 2608 to an inner surface of setting cover 2608*c* side. The holes 2608*d* and 2608*d* are inclined with respect to the horizontal direction so as to face the container engaged portions 2339 and 2339 when the toner container 2032 is attached. The replenishing device engaging members 78 and 78 are biased from the outer side to the inner side of the setting cover 2608 by biasing means, such as the torsion coil springs 782.

The setting cover 2608 includes a connector 2800, which serves as a reading means for reading information from the IC tag 2700 by coming into contact with the IC tag 2700 when the toner container 2032 is attached, and includes a guiding part 2801 for housing the connector 2800. The guiding part 2801 is a rectangular space that is arranged so as to protrude in the radial direction from the surface of the setting cover 2608 and that extends in the insertion direction from the side opposite the front surface of the container front end cover 2034. The size of the guiding part 2801 is set so that the guiding part 2801 can house the connector 2800 and the holder 2343 of the IC tag 2700. The guiding part 2801 serves as a circumferential restrictor.

As illustrated in FIG. 94, the connector 2800 includes four apparatus main-body terminals (a first apparatus main-body terminal 2804*a* to a fourth apparatus main-body terminal 2804*d*) that can come in contact with the first metallic pad 2710*a* to the fourth metallic pad 2710*d*, respectively. Incidentally, the fourth apparatus main-body terminal 2804*d* serves as an earth terminal of the main body that can come in contact with the fourth metallic pad 2710*d* serving as an earth terminal. The connector 2800 is arranged on the inner rear side of the guiding part 2801 on the downstream side in the attachment direction Q. The connector 2800 comes in contact with the pads of the IC tag 2700 and reads information from the IC tag 2700 when the toner container 2032 is moved in the attachment direction Q on a gutter 2074 serving as a container mounting section of the toner container holder 2070.

As illustrated in FIG. 96, on inner surfaces of wall 2801.*c* and 2801*d* serving as an inner surface that protrude from the surface of the setting cover 2608 (the container cover receiving section 2073) and that are located in the radial direction indicated by an arrow R, positioners 2802 and 2803 are provided so as to protrude from the inner surfaces of wall 2801*c* and 2801*d* to the inside of a space. The positioners 2802 and 2803 are provided on the inner surfaces of wall 2801*c* and 2801*d* so as to extend in the attachment direction Q such that one ends of positioners 2802*a* and 2803*a* are located on the upstream side in the attachment direction of the toner container 2032 and other ends of positioners 2802*b* and 2803*b* are located on the downstream side in the attachment direction. The positioners 2802 and 2803 may be integrated with the inner surfaces of wall 2801*c* and 2801*d*, or may be provided as separate bodies and integrally mounted on the inner surfaces of wall 2801*c* and 2801*d* by bonding, welding, or the like. When the IC tag 2700 is entered into the guiding part 2801 at the time of attachment of the toner container 2032, the both side surfaces 2343*a* and 2343*b* of the holder 2343 come in contact with the positioners 2802 and 2803 as described above. In the present embodiment, the positioners 2802 and 2803 are provide such that a space between the positioners 2802 and 2803 is reduced along the attachment direction Q. Therefore, as the toner container 2032 is moved further in the attachment direction Q, the both side surfaces 2343*a* and 2343*b* of the holder 2343 and the positioners 2802 and 2803 are more tightly connected, so that the circumferential movement of the holder 2343 between the positioners 2802 and 2803 is further restricted. Specifically, portions from the one ends of positioners 2802*a* and 2803*a* to centers of positioners 2802*c* and 2803*c* are provided as flat inclined surfaces such that the space between the positioners 2802 and 2803 is reduced, and the other ends of positioners 2802*b* and 2803*b* are provided with semicircular shapes and located parallel to each other. A width W10 between the one ends of positioners 2802*a* and 2803*a* is wider than a width W12 between the both side surfaces 2343*a* and 2343*b* of the holder 2343 (see FIG. 90). A width W11 between the other ends of positioners 2802*b* and 2803*b* is set to be the same as or slightly narrower than the width W12 between the both side surfaces 2343*a* and 2343*b* of the holder 2343.

As illustrated in FIG. 92, the container receiving section 2072 is provided with the gutter 2074 serving as a container mounting section extending from the insertion hole part 71 to the container cover receiving section 2073 along the longitudinal direction of the container body 33. The toner container 2032 is able to move on the gutter 2074 in a sliding manner in the longitudinal direction (the attachment/detachment direction).

On side surfaces of gutter 2074*a* and 2074*b*, which are opposite surfaces arranged in the width direction W, guide rails 2075 and 2075 serving as guiding parts are arranged so as to face each other. The guide rails 2075 protrude in the width direction W from the side surfaces of gutter 2074*a* and 2074*b*, extend in the longitudinal direction, and are arranged from one end of container receiving section 2072*a* to the front of the container cover receiving section 2073. The guide rails 2075 and 2075 have functions to guide the container opening 33*a* to the container setting section 615 serving as a container receiving section by being fitted to the sliding guides 2361 serving as guiding portions when the toner container 2032 is attached to the printer 100 (the main body of the image forming apparatus).

Incidentally, each of the guide rails 2075 is divided into four sections in the longitudinal direction in the present embodiment; however, each of the guide rails 2075 may be a single continuous rail in the longitudinal direction. The guide rails 2075 are provided so as to be parallel to the rotation axis of the container body 33 when the toner container 2032 is attached to the toner container holder 2070.

Identification mechanism will be explained below.

The identification mechanism of the present embodiment enable to identify a combination of the toner container and the toner container holder according to toner colors, toner types, print speed, or apparatus models.

As illustrated in FIG. 91A and FIG. 91B, an identified portion 2092 constituting the identification mechanism for identifying the compatibility is provided between the sliding guides 2361 and 2361 on the lower portion 2034*g* of the outer surface of container front end cover 2034*b*. A reinforcing portion 2362 is integrally provided between the sliding guides 2361 and 2361 in an integrally connected manner. The reinforcing portion 2362 is provided along the whole length of the sliding guides 2361 and 2361 in the attachment/detachment direction to prevent the sliding guides 2361 from being damaged when the toner container 2032 is dropped. The identified portion 2092 is provided on the sliding guide. Specifically, the identified portion 2092 is provided on the reinforcing portion 2362. In the present embodiment, the identified portion 2092 is provided as grooves extending in the attachment/detachment direction.

As illustrated in FIG. 92, FIG. 94, FIG. 97, in a position located on the downstream side in the attachment direction Q relative to the insertion hole 2071*a* on the gutter 2074, two identifying protrusions 2090 are provided so as to protrude upward from the gutter 2074, where the identifying protrusions 2090 serve as identifying parts constituting the identification mechanism and are to come in contact with the identified portion 2092 of the toner container 2032, and the gutter 2074 serves as the container mounting section of the container receiving section 2072. In the present embodiment, the identifying protrusions 2090 are provided as two protrusions. However, the widths, the heights, the positions, and the number of the identifying protrusions 2090 are changed depending on the widths, the heights, the positions, and the number of the grooves of the identified portion 2092 to distinguish the combinations of the toner container and the toner container holder from one another.

The identifying protrusions 2090 are located on the downstream side in the attachment direction Q relative to front edges of guide rails 2075*a* and 2075*a* on the one end 2072*a* of the container receiving section 2072 such that the identifying protrusions 2090 can come in contact with the identified portion 2092 after the guide rails 2075 and 2075 are inserted in the sliding grooves 2361*a* and 2361*a*. The arrangement of the identifying protrusions 2090 is not limited to the example illustrated in FIG. 92. The identifying protrusions 2090 may be located on the further downstream position than the position in FIG. 92 in the attachment direction Q or may be located on the insertion hole 2071*a* side. However, it is preferable to locate the identifying protrusions 2090 such that they come in contact with the identified portion 2092 after the guide rails 2075 and 2075 are inserted in the sliding grooves 2361*a* and 2361*a*.

With this configuration, when a wrong toner container is attached, the identifying protrusions 2090 come in contact with the identified portion 2092 of the toner container 2032 after the guide rails 2075 and the sliding guides 2361 are adequately fitted to each other. Therefore, the identified portion 2092 and the identifying protrusions 2090 come in contact with each other after the position of the toner container 2032 in the up-down direction (vertical direction) is determined in the attachment operation. As a result, it becomes possible to stably and more accurately bring the identified portion and the identifying protrusions into contact with each other.

The order of restriction and release of all of the positioners of the eighth embodiment with respect to the toner container holder 2070 (the toner replenishing device 60) will be explained below with reference to FIGS. 99A to 99D, FIGS. 100A and 100E, and so on.

As illustrated in FIG. 99A, when a user places the toner container 2032 on the gutter 2074 of the container receiving section 2072 of the toner container holder 2070 and pushes the toner container 2032 in the attachment direction Q (performs attachment operation), the toner container 2032 slides on the gutter 2074. Subsequently, the guide rails 2075 and 2075 are respectively entered into the sliding grooves 2361*a* of the sliding guides 2361 of the toner container 2032, so that the positions in the width direction W perpendicular to the attachment direction Q and in the vertical direction Z are roughly determined (the first restricted state).

When the toner container 2032 in the first restricted state is further pushed in the attachment direction Q, and if the toner container 2032 being attached is a wrong toner container, the identified portion 2092 comes in contact with the identifying protrusions 2090 as illustrated in FIG. 99B and FIG. 98. In this case, if the shapes or positions of the identified portion 2092 and the identifying protrusions 2090 do not match with each other, the movement of the toner container 2032 in the attachment direction Q is prevented, so that it becomes possible to prevent attachment of a different type of the toner container 2032. Furthermore, the first restricted state is maintained at this time therefore, even if a different type of the toner container 2032 is forcibly pushed, it is possible to prevent the identified portion 2092 from passing over the identifying protrusions 2090 because the position in the vertical direction Z is roughly determined. Therefore, it becomes possible to prevent attachment of a different type of the toner container 2032.

If the shapes of the identified portion 2092 and the identifying protrusions 2090 match with each other and the identifying protrusions 2090 allow the identified portion 2092 to move, the toner container 2032 is further moved in the attachment direction Q. Therefore, as illustrated in FIG. 99C, the end surface 332*h* of the container shutter and the front end 611*a* of the conveying nozzle 611 come in contact with each other.

When the toner container 2032 is further pushed in the attachment direction Q, a second restricted state as illustrated in FIG. 99D is obtained, in which the holder 2343 located in the attachment direction Q relative to the vertical surface 2034*d* of the container front end cover 2034 is entered into the guiding part 2801 that includes the connector 2800. At this time, because the position in the vertical direction Z is roughly determined by the sliding grooves 2361*a* of the sliding guides 2361, the holder 2343 is entered into the guiding part 2801 while its position in the vertical direction Z is roughly determined. The entered state is illustrated in detail in FIG. 101A and FIG. 102A. Therefore, the movement of the side surfaces 2343*a* and 2343*b* of the holder 2343 in the circumferential direction R is roughly determined by inner surfaces of wall 2801*c* and 2801*d* of the guiding part 2801.

When the toner container 2032 in the second restricted state is further pushed in the attachment direction Q, the container seal 333 and the nozzle shutter flange 612*a* come in contact with each other as illustrated in FIG. 100A, and the holder 2343 is further moved inside the guiding part 2801 as illustrated in FIG. 100B. This state is illustrated in FIG. 101B. At this time, the side surfaces 2343*a* and 2343*b* of the holder 2343 move on the flat surfaces tapered from the one ends of positioners 2802*a* and 2803*a* arranged on the inner surfaces of guiding part 2801*c* and 2801*d* toward the centers of positioners 2802*c* and 2803*c*, respectively, so that the side surfaces 2343*a* and 2343*b* move in the attachment direction Q while their movement in the radial direction R is gradually restricted.

When the toner container 2032 is further moved in the attachment direction, as illustrated in FIG. 100C, FIG. 101C, and FIG. 102B, the side surfaces 2343*a* and 2343*b* of the holder 2343 are located between the other ends of positioners 2802*b* and 2803*b*, where the width is narrowest (a third restricted state). Specifically, in the third restricted state, the movement in the radial direction R is completely restricted by the holder 2343 and the guiding part 2801 while the restriction in the vertical direction Z by the sliding grooves 2361*a* and the guide rails 2075 is maintained. Therefore, the container front end cover 2034 and the setting cover 2608 (the container cover receiving section 2073) are integrated, and the container front end cover 2034 is restricted from moving in the circumferential direction R and is prevented from rotating with the rotation of the container body 33.

When the toner container 2032 in the third restricted state is further pushed in the attachment direction Q, a fourth restricted state as illustrated in FIG. 100D is obtained, in which the container opening 33*a* is entered into the inner surface of container setting section 615*a* (the setting cover 2608) and the container body 33 is rotatably supported inside the inner surface of container setting section 615*a*. At this time, the position of the container front end cover 2034 in the circumferential direction R is restricted by the holder 2343 and the guiding part 2801, so that the container opening 33*a* and the container setting section 615 can mate with each other such that the respective centers coincide with each other. Therefore, it becomes possible to prevent toner leakage from the container shutter 332 due to insertion of the container opening 33*a* into the container setting section 615 in a deviated manner. Furthermore, in this state, each of the pads of the IC tag 2700 comes in contact with a corresponding one of the apparatus main-body terminals of the connector 2800, and information is read from the IC tag 2700. Namely, when the IC tag 2700 and the connector 2800 come in contact with each other, the positions in the vertical direction Z and the radial direction R are determined; therefore, a contact failure is less likely to occur and communication can be performed stably.

When the toner container 2032 in the fourth restricted state is further pushed in the attachment direction Q. a fifth restricted state as illustrated in FIG. 100E is obtained. In the fifth restricted state, the container opening 33*a* is entered further into the inner surface of container setting section 615*a*, and the replenishing device engaging members 78 and 78 are entered into and engaged with the respective engaged openings 2339*d* of the container engaged portions 2339 and 2339 (see FIG. 49). Therefore, the toner container 2032 is prevented from moving in the longitudinal direction (the rotation axis direction) and is maintained in the setting position. While the engaged openings 339*d* are illustrated in FIG. 49, the dimensions and the configurations of the engaged openings 339*d* and the engaged openings 2339*d* are the same with each other; therefore, the states of the engaged openings 2339*d* are the same as those of the engaged openings 339*d*.

As described above, if the rotation of the container front end cover 2034 is restricted by the fitting between the guiding part 2801 housing the connector 2800 and the holder 2343 holding the IC tag 2700 on the outer surface of container cover 2034*b*, the container opening 33*a* and the container setting section 615 can be fitted to each other such that the respective centers coincide with each other. Therefore, it becomes possible to prevent toner leakage from the container shutter 332 due to insertion of the container opening 33*a* into the container setting section 615 in a deviated manner. Furthermore, the positioning of the IC tag 2700 is not needed and rough positioning is satisfactory.

As in the present embodiment, if the IC tag 2700 is arranged in an approximately middle position between the pair of the container engaged portions 2339 and 2339 engaged with the replenishing device engaging members 78 and 78 on the outer surface of container front end cover 2034*b*, the following advantageous effects can be obtained. Specifically, as for the movement of the IC tag 2700, the movement in the radial direction is acceptable but the movement in the circumferential direction R is not preferable because the circumferential movement may cause a contact failure. If the IC tag 2700 is arranged in the approximately middle position between the pair of the replenishing device engaging members 78 and 78, a force is equally applied from the both sides in the circumferential direction R, so that the movement in the circumferential direction R can be prevented and a contact failure between the IC tag 2700 and the connector 2800 can be prevented, which is a preferable configuration.

Furthermore, in the present embodiment, the replenishing device engaging members 78 and 78 and the container engaged portions 2339 and 2339 are inclined with respect to the horizontal direction. Therefore, it becomes possible to reduce the protrusion amount of the container front end cover 2034 in the horizontal direction from the outer surface of container cover 2034*b* as compared to a configuration in which the replenishing device engaging members 78 and 78 and the container engaged portions 2339 and 2339 are arranged in the horizontal direction. Consequently, it becomes possible to save a space of the container holding section for each of the colors. As a result, it becomes possible to effectively use the space of the printer 100 (the main body of the image forming apparatus), enabling to reduce the size of the image forming apparatus. Furthermore, if multiple toner containers are attached as in a color image forming apparatus, it becomes possible to reduce a mounting space in the horizontal direction, enabling to further reduce the size of the image forming apparatus.

Moreover, according to the present embodiment, the identified portion 2092 is provided, which is provide on the lower portion 2034*g* of the container front end cover 2034 in the lower portion of the toner container 2032 and which can pass over the identifying protrusions 2090. Furthermore, the pair of the sliding guides 2361 and 2361 are provided, which serve as vertical restrictors for restricting the movement of the toner container 2032 in the vertical direction Z by receiving the pair of the guide rails 2075 and 2075 when the identified portion 2092 passes through the insertion hole 2071*a*. Therefore, it becomes possible to reliably prevent attachment of a wrong type of the toner container 2032.

FIGS. 103A to 103F are six diagrams illustrating the entire configuration of the toner container 2032 as a powder container including the IC tag 2700 according to the eighth embodiment. The toner container 2032 illustrated in FIGS. 103A to 103F includes the container body 33 provided with a spiral groove, and the container front end cover 2034 serving as a cover portion on which the IC tag 2700 is provided. FIG. 103A is a right side view, FIG. 103B is a left side view, FIG. 103C is a front view, FIG. 103D is a back view, FIG. 103E is a plan view, and FIG. 103F is a bottom view.

In the eighth embodiment, the container body 33 including the spiral groove is used as the container body. However, it may be possible to employ a toner container 3032 as illustrated in FIG. 104 that includes, as the container body, the container body 1033 without the spiral groove as illustrated in FIG. 50, and includes the container front end cover 2034.

As examples of the identified portion 2092 provided on the container front end cover 2034 of the toner container 2032, first to fifteenth examples as illustrated in FIGS. 105A to 105H to FIGS. 108A to 108E may be employed. Among FIGS. 105A to 105H to FIGS. 108A to 108F, figures denoted by symbols A, C, E, and G illustrate front views of the container front end cover 2034, and figures denoted by symbols B, D, F, and H illustrate bottom views of the container front end cover 2034.

In FIGS. 105A to 105H to FIGS. 108A to 108F, the reinforcing portion 2362 that is provided on and connected to the sliding guides 2361 and 2361 in the attachment direction is divided into six parts in the width direction W. For convenience sake, the divided parts will be referred to as blocks 1 to 6 from the leftmost side in the attachment direction Q. Furthermore, gaps 9235*a* provided on the respective blocks of the reinforcing portion are referred to as gaps 1 to 6. In Table 1 below, presence and absence of the gaps 9235*a* in the respective blocks are illustrated. In Table 1, "Yes" indicates that the gap 9235*a* is provided, and "No" indicates that the gap 9235*a* is not provided.

FIGS. 105A and 105B illustrate the first example.
FIGS. 105C and 105D illustrate the second example.
FIGS. 105E and 105F illustrate the third example.
FIGS. 105G and 105H illustrate the fourth example.
FIGS. 106A and 106B illustrate the fifth example.
FIGS. 106C and 106D illustrate the sixth example.
FIGS. 106E and 106F illustrate the seventh example.
FIGS. 106G and 106H illustrate the eighth example.
FIGS. 107A and 107B illustrate the ninth example.
FIGS. 107C and 107D illustrate the tenth example.
FIGS. 107E and 107F illustrate the eleventh example.
FIGS. 107G and 107H illustrate the twelfth example.
FIGS. 108A and 108B illustrate the thirteenth example.
FIGS. 108C and 108D illustrate the fourteenth example.
FIGS. 108E and 108F illustrate the fifteenth example.

In the first example illustrated in FIGS. 105A and 105B, the gaps 9235*a* of the sliding guide are provided on the adjacent blocks 1 and 2.

In the second example illustrated in FIGS. 105C and 105D, the gaps 9235*a* of the sliding guide are provided on the blocks 1 and 3.

In the third example illustrated in FIGS. 105E and 105F, the gaps 9235*a* of the sliding guide are provided on the blocks 1 and 4.

In the fourth example illustrated in FIGS. 105G and 105H, the gaps 9235*a* of the sliding guide are provided on the blocks 1 and 5.

In the fifth example illustrated in FIGS. 106A and 106B, the gaps 9235*a* of the sliding guide are provided on the blocks 1 and 6.

In the sixth example illustrated in FIGS. 106C and 106D, the gaps 9235*a* of the sliding guide are provided on the adjacent blocks 2 and 3.

In the seventh example illustrated in FIGS. 106E and 106F, the gaps 9235*a* of the sliding guide are provided on the blocks 2 and 4.

In the eighth example illustrated in FIGS. 106E and 106H, the gaps 9235*a* of the sliding guide are provided on the blocks 2 and 5.

In the ninth example illustrated in FIGS. 107A and 107B, the gaps 9235*a* of the sliding guide are provided on the blocks 2 and 6.

In the tenth example illustrated in FIGS. 107C and 107D, the gaps 9235*a* of the sliding guide are provided on the adjacent blocks 3 and 4.

In the eleventh example illustrated in FIGS. 107E and 107F, the gaps 9235*a* of the sliding guide are provided on the blocks 3 and 5.

In the twelfth example illustrated in FIGS. 107G and 107H, the gaps 9235*a* of the sliding guide are provided on the blocks 3 and 6.

In the thirteenth example illustrated in FIGS. 108A and 108B, the gaps 9235*a* of the sliding guide are provided on the adjacent blocks 4 and 5.

In the fourteenth example illustrated in FIGS. 108C and 108D, the gaps 9235*a* of the sliding guide are provided on the blocks 4 and 6.

In the fifteenth example illustrated in FIGS. 108E and 108F, the gaps 9235*a* of the sliding guide are provided on the adjacent blocks 5 and 6.

Even when the configuration is made as illustrated in the first to the fifteenth examples, if the gaps 9235*a* of the sliding guide of the identified portion 2092 do not correspond to the identifying protrusions 2090 provided on the gutter 2074, the identified portion 2092 cannot pass over the identifying protrusions 2090. Therefore, it becomes possible to prevent attachment of an incompatible toner container 2032.

The presence and absence of the gaps 9235*a* of the reinforcing portion according to the first to the fifteenth examples are illustrated in Table 1 below.

TABLE 1

| | Block 1 Gap 1 | Block 2 Gap 2 | Block 3 Gap 3 | Block 4 Gap 4 | Block 5 Gap 5 | Block 6 Gap 6 |
|---|---|---|---|---|---|---|
| Example 1 | YES | YES | NO | NO | NO | NO |
| Example 2 | YES | NO | YES | NO | NO | NO |
| Example 3 | YES | NO | NO | YES | NO | NO |
| Example 4 | YES | NO | NO | NO | YES | NO |
| Example 5 | YES | NO | NO | NO | NO | YES |
| Example 6 | NO | YES | YES | NO | NO | NO |
| Example 7 | NO | YES | NO | YES | NO | NO |
| Example 8 | NO | YES | NO | NO | YES | NO |
| Example 9 | NO | YES | NO | NO | NO | YES |
| Example 10 | NO | NO | YES | YES | NO | NO |
| Example 11 | NO | NO | YES | NO | YES | NO |
| Example 12 | NO | NO | YES | NO | NO | YES |
| Example 13 | NO | NO | NO | YES | YES | NO |
| Example 14 | NO | NO | NO | YES | NO | YES |
| Example 15 | NO | NO | NO | NO | YES | YES |

Ninth Embodiment

In a ninth embodiment, a configuration of a container body serving as a powder storage of a toner container serving as a powder container differs from those of the container bodies 33 and 1033. Therefore, the configuration of the container body will be mainly explained in the present embodiment, and the container front end cover 34 and other components having the same configurations as described above will be denoted by the same reference numerals and symbols and explanation thereof will be omitted appropriately.

As illustrated in FIG. 109, a toner container 4032 serving as a powder container according to the present embodiment includes a container body 4033 for storing toner as a powder for image formation, and a container front end cover 34 serving as a container cover attached to the outer surface of the container body 4033. The container body 4033 is rotatably held by the container front end cover 34. When the toner container 4032 is attached to the toner replenishing device 60 in the same manner as described above, the conveying nozzle 611 serving as a conveyor, inside which the conveying screw 614 is arranged, is inserted in the toner container 4032 so that toner can be replenished. The toner container 4032 is supported by the container front end cover 34 such that the rotation axis of the container body 4033 is oriented in the horizontal direction.

As illustrated in FIG. 110, the container body 4033 is in the form of an approximate cylinder and rotates about a central axis of the cylinder as a rotation axis. A gripper 4303 is provided on the container rear end of the toner container 4032 in the longitudinal direction (attachment/detachment direction), and an opening 4033*a* serving as a container opening is provided on the container front end to which the container front end cover 34 is attached. In the opening 4033*a*, the nozzle receiver 330 serving as a conveyor receiver capable of receiving the conveying nozzle 611 is inserted and disposed. The container gear 301 to which a driving force is transmitted is provided on the surface of the opening 4033*a* side. In the present embodiment, when the toner container 4032 is attached to the toner replenishing device 60 and the container driving gear 601 meshes with the container gear 301 to transmit a rotation driving force, the container body 4033 rotates in the arrow A direction in FIG. 110.

The container body 4033 is provided of multiple portions with different external shapes from the container rear side to the container front side. Specifically, the container body 4033 includes a rear cylindrical portion 4033A1 connected to the gripper 4303 located on the container rear end, a front cylindrical portion 4033A2 connected to the opening 4033*a* located on the container front end, and a middle cylindrical portion 4033A3 located between the rear cylindrical portion 4033A1 and the front cylindrical portion 4033A2. An inclined portion 4033A4 is provided between the rear cylindrical portion 4033A1 and the rear end of the middle cylindrical portion 4033A3, and an inclined portion 4033A5 is provided between the front cylindrical portion 4033A2 and a front end of the middle cylindrical portion 4033A3. The middle cylindrical portion 4033A3 is provided such that the diameter is increased from one end on the inclined portion 4033A4 side to the other end on the inclined portion 4033A5 side. The inclined portion 4033A4 is provided such that the diameter is reduced from the rear cylindrical portion 4033A1 to the middle cylindrical portion 4033A3, and the inclined portion 4033A5 is provided such that the diameter is reduced from the middle cylindrical portion 4033A3 to the front cylindrical portion 4033A2. In FIG. 110, first to fourth cut portions are portions cut along planes perpendicular to a rotation axis indicated by a chain line. The first cut portion represents a cross-section of the rear cylindrical portion 4033A1, the second cut portion represents a cross-section of the middle cylindrical portion 4033A3, the third cut portion represents a cross-section of a periphery of the inclined portion 4033A5, and the fourth cut portion represents a cross-section of the front cylindrical portion 4033A2.

As illustrated in FIG. 111, assuming that the outer diameter of the rear cylindrical portion 4033A1 is denoted by d11, the outer diameter of the rear end of the middle cylindrical portion 4033A3 is denoted by d12, the outer diameter of the front end of the middle cylindrical portion 4033A3 is denoted by d13, and the outer diameter of the front cylindrical portion 4033A2 is denoted by d14, the container body 4033 is provided such that the outer diameter d11>the outer diameter d12<the outer diameter d13>the outer diameter d14. The thickness of the container body 4033 is uniform in all of the portions, so that the internal shape of the container body 4033 has the same magnitude relation as that of the external shape.

The container body 4033 includes multiple conveyors from the rear cylindrical portion 4033A1 toward the front cylindrical portion 4033A2. The conveyors are recessed from the surface of the container body 4033 to the inner side of the container so as to be provided as grooves when viewed from the surface of the container and as protrusions when viewed from the inner side of the container. Hereinafter, the conveyors are described as the protrusions.

First protrusions 4101*a* and 4101*b* serving as first conveyors are provided on the rear cylindrical portion 4033A1 so as to extend toward the middle cylindrical portion 4033A3. As illustrated in FIG. 112A, the first protrusions 4101*a* and 4101*b* are out of phase with each other by 180 degrees in the rotation direction (arrow A direction) of the container body 4033. As illustrated in FIG. 113A, the first protrusions 4101*a* and 4101*b* are long enough to reach the middle cylindrical portion 4033A3 from the rear cylindrical portion 4033A1 via the inclined portion 4033A4. Each of the first protrusions 4101*a* and 4101*b* is twisted so as to form a spiral that turns clockwise being a reverse direction of the rotation direction of the container body 4033, and applies a force in the arrow F1 direction illustrated in FIG. 111 and FIG. 113A to the contained toner when the container body 4033 rotates in the arrow A direction. Incidentally, FIG. 113A illustrates only the first protrusion 4101*a*.

As illustrated in FIG. 110, second protrusions 4102*a*, 4102*b*, 4102*c*, and 4102*d* serving as second conveyors are provided on the middle cylindrical portion 4033A3 so as to extend along the entire length in the longitudinal direction. As illustrated in FIG. 112B, the second protrusions 4102*a*, 4102*b*, 4102*c*, and 4102*d* are out of phase with one another by 90 degrees in the rotation direction (arrow A direction) of the container body 4033. It may be possible to provide three second protrusions that are out of phase with one another by 120 degrees.

The second protrusions 4102*a*, 4102*b*, 4102*c*, and 4102*d* on the middle cylindrical portion 4033A3 are provided so as to be inclined upward from the inclined portion 4033A4 toward the inclined portion 4033A5. Therefore, when the container body 4033 rotates in the arrow A direction, as illustrated in FIGS. 113A and 113B, the second protrusions 4102*a* to 4102*d* apply forces toward the front cylindrical portion 4033A2 (in the arrow F2 direction) while stirring the contained toner.

Third protrusions 4103*a* and 4103*b* serving as third conveyors are provided from the middle cylindrical portion 4033A3 to the front cylindrical portion 4033A2. As illustrated in FIG. 112C, each of the third protrusions 4103*a* and 4103*b* is provided at a single position so as to be out of phase with each other by 180 degrees in the rotation direction (arrow A direction) of the container body 4033 and provided as singly. The third protrusions 4103*a* and 4103*b* are provided such that the protrusions are increased in size on the middle cylindrical portion 4033A3 as illustrated in FIGS. 112C and 113B, and are decreased in size toward the front cylindrical portion 4033A2 as illustrated in FIGS. 112D and 113B. As illustrated in FIG. 112D, the third protrusions 4103*a* and 4103*b* are long enough to reach the front cylindrical portion 4033A2 from the middle cylindrical portion 4033A3 via the inclined portion 4033A5. Each of the third protrusions 4103*a* and 4103*b* is twisted so as to form a spiral that turns clockwise being a reverse direction of the rotation direction of the container body 4033. and applies a force in the arrow F3 direction to the contained toner when the container body 4033 rotates in the arrow A direction. Incidentally, FIG. 113B illustrates only the third protrusion 4103*a*.

The second protrusions 4102*a*, 4102*b*, 4102*c*, and 4102*d* and the third protrusions 4103*a* and 4103*b* are arranged such that the respective end portions lap over (overlap with) each other in the attachment/detachment direction (longitudinal direction). Furthermore, as illustrated in FIG. 114, the third protrusions 4103*a* and 4103*b* are provided so as to overlap with the nozzle hole 610 serving as the powder receiving hole of the conveying nozzle 611 when the conveying nozzle 611 is inserted in the container body 4033.

While the toner container 4032 including the container body 4033 configured as described above is attached to the toner replenishing device 60 and the conveying nozzle 611 is inserted in the container body 4033 as illustrated in FIG. 114, the container body 4033 rotates in the arrow A direction. Therefore, the toner in the rear cylindrical portion 4033A1 of the container body 4033 is moved in the arrow F1 direction along the first protrusions 4101*a* and 4101*b*, and is conveyed from the rear cylindrical portion 4033A1 to the middle cylindrical portion 4033A3 via the inclined portion 4033A4.

The conveyed toner and toner that has been located in the middle cylindrical portion 4033A3 are moved in the arrow F2 direction by the second protrusions 4102*a* to 4102*d*, and moved toward the front cylindrical portion 4033A2 along the second protrusions 4102*a* to 4102*d*.

In this case, because the third protrusions 4103*a* and 4103*b* are arranged so as to overlap with the second protrusions 4102*a* to 4102*d* in the middle cylindrical portion 4033A3, the toner conveyed by the second protrusions 4102*a* to 4102*d* can reliably be transferred to the third protrusion 4103*a*. Meanwhile, explanation in connection with the third protrusion 4103*b* will be omitted. The transferred toner is moved in the arrow F3 direction by the third protrusions 4103*a* and 4103*b*, passes over the inclined portion 4033A5, and is conveyed to the front cylindrical portion 4033A2. In this case, a front end 4103*a*1 of the third protrusion 4103*a* and a front end 4103*b*1 (not illustrated) of the third protrusion 4103*b* overlap with the nozzle hole 610 of the conveying nozzle 611. Therefore, the toner moved in the arrow F2 direction by the third protrusions 4103*a* and 4103*b* can reliably be conveyed to the nozzle hole 610.

While the two first protrusions and the two third protrusions are provided in the ninth embodiment, it is sufficient to provide at least one first protrusion and one third protrusion.

While the first to the ninth embodiments are described in detail above, they are mere examples. Any configurations made by combinations of arbitrary embodiments as described above fall within the scope of the present invention.

Tenth Embodiment

In a tenth embodiment, a mechanism that improves the operability for attaching and detaching the toner container 32 as described above to and from the toner replenishing device 60 will be explained.

The toner container described in Japanese Patent Application Laid-open No. 2012-133349 as described above includes a rotatable cylindrical powder storage, a nozzle receiver attached to the powder storage, an opening arranged on the nozzle receiver, and an opening/closing member that is biased to a closing position at which the opening is closed and that opens the opening along with insertion of a conveying nozzle of a powder replenishing device. When a toner container is set in a container holding section of the powder replenishing device and moved in the attachment direction, the conveying nozzle is inserted in the nozzle receiver of the toner container with the movement of the toner container, and the opening/closing member is moved to the opening position to open the opening and discharge toner. Furthermore, the conveying nozzle of the powder replenishing device is provided with a nozzle hole, which is opened and closed by a nozzle shutter and which receives toner. The nozzle shutter is biased in a direction in which the nozzle hole is closed, and opens the nozzle hole when the conveying nozzle is inserted in the nozzle receiver of the toner container, so that the toner discharged from the toner container can be supplied into the conveying nozzle.

The powder replenishing device includes a replenishing device engaging member that maintains an attached state when the toner container is attached. By engaging the replenishing device engaging member with the toner container, the attached state of the toner container is maintained.

Japanese Patent No. 4,958,325 discloses a replenishing device engaging member that maintains an opening/closing member for opening and closing an opening arranged in a bottom portion of the toner container when the toner container is attached to the powder replenishing device.

In the configuration described in Japanese Patent Application Laid-open No. 2012-133349, when the toner container is set in the powder replenishing device, a force to bias the opening/closing member of the toner container in the closing direction and a force to bias the nozzle shutter of the conveying nozzle in the closing direction act in a direction in which the toner container is detached from (pushed out of) the powder replenishing device. Therefore, when a user pushes the toner container in the attachment direction to attach the toner container to the powder replenishing device, he/she attaches the toner container against the force in the detachment direction. In contrast, when the toner container is pulled out to be detached, a force in the detachment direction acts as an assist force. Therefore, a difference between the operating force for attachment and the operating force for detachment is increased, which may give the user a feeling that something is wrong in the attachment/detachment operation. Furthermore, the force in the detachment direction acts on the toner container in the attached state. Therefore, the replenishing device engaging member that maintains the toner container in the attached state needs to have a holding force to keep holding the toner container against the force in the detachment direction, so that a force to bias and hold the replenishing device engaging member toward the toner container also increases. Therefore, when the user pulls out the toner container in the detachment direction from the attached state, he/she pulls out the toner container against the holding force of the replenishing device engaging member, but after the toner container is pulled out, the toner container moves in the detachment direction with the aid of the force in the detachment direction. This may also give the user an uncomfortable feeling in the attachment/detachment operation.

Therefore, in the present embodiment, it is configured such that, when the toner container is to be attached to the container holding section, a first rotational moment to rotate the replenishing device engaging member to attach the toner container is greater than a second rotational moment to rotate the replenishing device engaging member to detach the toner container. Therefore, a difference between the operating force for attachment and the operating force for detachment to attach and detach the toner container to and from the powder replenishing device can be reduced, so that the attachment/detachment operability can be improved.

A function to maintain the toner container 32 in the attached state in the toner container holder 70 will be explained in detail below with reference to FIG. 115, FIG. 116, and FIG. 57. FIG. 115, FIG. 116, and FIG. 57 illustrate top cross-sectional views of the toner container 32 and the container cover receiving section 73 of the toner container holder 70 taken in the horizontal direction. FIG. 115 is a diagram for explaining a state in which the toner container 32 is being moved in the attachment direction Q. FIG. 116 is a diagram for explaining a state in which the toner container 32 has reached the container cover receiving section 73 and the conveying nozzle 611 is entered in the container body 33 by pushing open the container shutter 332 inside the receiving opening 331 of the toner container 32. FIG. 57 illustrates the attached state in which the left and right engaging members 78 have passed over the bumps 339*c* and entered into the engaged openings 339*d* to hold the toner container 32 in an attached position.

Each of the tip parts 78*c* of the engaging members 78 on the left and right sides includes a first inclined surface 78*f* that comes in contact with the container engaged portion 339 when the toner container 32 is moved in the attachment direction Q, and a second inclined surface 78*e* that comes in contact with the container engaged portion 339 when the toner container 32 in the engaged state is moved in a detachment direction Q1. The first inclined surface 78*f* and the second inclined surface 78*e* define an approximately triangular cross section in the figures, and a tip portion defined by those surfaces is referred to as a top portion P2. As illustrated in FIG. 115, each of the engaging members 78 is mounted on the setting cover 608 so as to rotate about the shaft 781 extending in the direction normal to the sheet of FIG. 115. In each of the engaging members 78, the spring press part 78*g* receives a biasing force of the torsion coil spring 782, and the rotation stopper 78*h* near the spring press part 78*g* is brought into contact with the setting cover notch 608*h* of the setting cover 608. Therefore, the positions of the engaging members 78 in the engaging direction R1 are restricted such that the top portions P2 (see FIG. 115) serving as the top portions of the approximate triangles protrude from the inner surface of setting cover 608*c* so as to face each other. In the explanation below, the positions of the engaging members 78 in the rotation direction illustrated in FIG. 115 are assumed as the initial positions.

In each of the left and right container engaged portions 339 of the toner container 32, the guiding protrusion 339*a*, the guiding groove 339*b*, the bump 339*c*, and the engaged opening 339*d* are arranged, as guiding portions, in this order from the container front side as described above. Each of the humps 339*c* includes a first contact surface 339*f* that is an inclined surface connected from the guiding groove 339*b*, and a second contact surface 339*e* that is an inclined surface connected to the engaged opening 339*d* (adjacent to the engaged opening 339*d*). The first contact surfaces 339*f* and the second contact surfaces 339*e* define approximately triangular cross sections in the figures. Each of the bumps 339*c* is provided on the container cover 34 such that the top portion of the approximate triangle as described above protrudes outward.

As illustrated in FIG. 115, a user pushes the new toner container 32 in the attachment direction Q to attach the toner container 32. Accordingly, the container front end of the container shutter 332 comes in contact with the front end of the conveying nozzle 611 (the end on the upstream side in the attachment direction Q). When the toner container 32 is further pushed in the attachment direction Q, the container shutter 332 moves to the rear side of the toner container 32 and the conveying nozzle 611 starts to be entered into the toner container 32. At this time, the user who is operating the toner container 32 gradually feels a reaction force (restoring force) against a compression force of the container shutter spring 336 as the conveying nozzle 611 is entered further into the toner container 32.

Incidentally, the shutter hooks 332*a* of the container shutter 332 on the container rear end may include a step to be hooked on the outer wall surface of the shutter rear end supporting portion 335. In this configuration, when releasing the hooked state of the shutter hooks 332*a*, the user operating the toner container 32 slightly feels a force (reaction force) to push the toner container 32 back in the opposite direction (the detachment direction Q1) of the attachment direction Q before the container shutter 332 starts moving to the rear side of the toner container 32.

When the toner container 32 is further pushed in the attachment direction Q, the guiding protrusions 339*a* of the toner container 32 come in contact with the first inclined surfaces 78*f* of the left and right engaging members 78. Each of the guiding protrusions 339*a* serving as guiding portions includes the guiding inclined surface 339*a*1 that is an inclined surface continuing from the central axis side to the outer periphery side of the container cover 34 (see FIG. 117). and causes the left and right engaging members 78 to rotate about the shafts 781 (in the releasing direction R2) so as to be pushed opened from the initial positions against the biasing forces of the torsion coil springs 782 when the toner container 32 is gradually pushed in the attachment direction Q.

At this time, the user operating the toner container 32 feels a reaction force (a force due to the restoring forces of the torsion coil springs 782) of the force that pushes open the left and right engaging members 78 against the biasing forces of the torsion coil springs 782 that cause the left and right engaging members 78 to move back to the initial positions, in addition to the reaction force against the compression force of the container shutter spring 336. However, because the guiding protrusions 339*a* include the guiding inclined surfaces 339*a*1 that gradually push open the engaging members 78, it is possible to reduce an uncomfortable operational feeling as compared to a configuration in which the guiding protrusions 339*a* having the guiding inclined surfaces 339*a*1 are not provided.

In contrast, if the front end of the container cover 34 is provided as corner portions without providing the guiding inclined surfaces 339*a*1, the user feels, at a time, a strong reaction force in the direction Q1 in which the toner container 32 is pushed back when the engaging members 78 and the container cover 34 come in contact with each other, and may erroneously recognize that the attachment is completed because of the reaction force. Therefore, it is preferable to provide the guiding protrusions 339*a* having the guiding inclined surfaces 339*a*1 as in the present embodiment. Incidentally, if the guiding protrusions 339*a* protrude to the container front side as in the present embodiment, it becomes easy to catch the tip parts 78*c* of the engaging members 78. However, it may be possible to provide only the guiding inclined surfaces 339*a*1 without protrusions toward the container front side.

FIG. 116 illustrates a state, in which the toner container 32 is further pushed in the attachment direction Q from the contact positions between the first inclined surfaces 78*f* of the engaging members 78 and the guiding protrusions 339*a*. The container cover 34 of the toner container 32 is entered further into the setting cover 608. At this time, the top portions P2 of the tip parts 78*c* of the engaging members 78 come in contact with the guiding grooves 339*b* of the container cover 34. The guiding grooves 339*b* are smoothly connected from the guiding inclined surfaces 339*a*1 of the guiding protrusions 339*a*, and are provided along the longitudinal direction of the toner container 32. The attachment direction Q and the longitudinal direction of the toner container 32 approximately match with each other; therefore, when the top portions of the tip parts 78*c* and the guiding grooves 339*b* are in contact with each other, the engaging members 78 are not rotated further in the releasing direction R2. Therefore, the user operating the toner container 32 does not feel the reaction force against the biasing forces of the torsion coil springs 782 that close the left and right engaging members 78 toward the initial positions.

In contrast, in the state illustrated in FIG. 116, the nozzle shutter flange 612*a* of the nozzle shutter 612 arranged on the outer periphery of the conveying nozzle 611 comes in contact with the container front ends of the nozzle shutter positioning ribs 337*a* arranged on the inner periphery of the nozzle receiver 330. Therefore, when the toner container 32 is further pushed in the attachment direction Q, the nozzle shutter 612 starts to be pushed in the attachment direction Q because of the contact with the nozzle shutter positioning ribs 337*a*. At this time, the user operating the toner container 32 feels the reaction force (restoring force) against the compression force of the nozzle shutter spring 613, in addition to the reaction force (restoring force) against the compression force of the container shutter spring 336.

When the toner container 32 in the state illustrated in FIG. 116 is further pushed in the attachment direction Q. the first inclined surfaces 78*f* of the tip parts 78*c* of the engaging members 78 and the first contact surface 339*f* of the bumps 339*c* come in contact with each other, respectively. When the toner container 32 is further pushed in the attachment direction Q from the contact positions between the first inclined surfaces 78*f* and the first contact surfaces 339*f*, the first inclined surfaces 78*f* of the left and right engaging members 78 are pressed by the first contact surfaces 339*f* and rotated outward about the shaft 781 (in the releasing direction R2) from the contact positions between the top portions of the tip parts 78*c* and the guiding grooves 339*b* in the direction perpendicular to the attachment direction Q, against the biasing forces of the torsion coil springs 782. At this time, the user operating the toner container 32 feels a reaction force (a force due to the restoring forces of the torsion coil springs 782) of the force that pushes open the left and right engaging members 78 outward from the contact positions between the top portions of the tip parts 78*c* and the guiding grooves 339*b* against the biasing forces of the torsion coil springs 782 that closes the left and right engaging members 78 toward the initial positions, in addition to the reaction force against the compression force of the container shutter spring 336 and the reaction force against the compression force of the nozzle shutter spring 613.

When the toner container 32 is further pushed in the attachment direction Q, the reaction force against the force that pushes open the left and right engaging members 78 outward becomes maximum at a position at which the top portions of the approximate triangles of the bumps 339*c* come in contact with the top portions P2 of the approximate triangles of the tip parts 78*c* (the opposed position).

When the toner container 32 is further pushed in the attachment direction Q and passes through the above-described position, the first inclined surfaces 78*f* of the tip parts 78*c* and the first contact surfaces 339*f* of the bumps 339*c* are separated from each other, so that the force that pushes open the left and right engaging members 78 outward stops acting on the engaging members 78, and the engaging members 78 rotate about the shafts 781 (in the engaging direction R1) due to the biasing forces of the torsion coil springs 782 (a restoring force against compression). At this time, because the engaged openings 339*d* are provided on the outer surface of the container cover 34 so as to be located on the trajectories of the movement of the top portions P2 of the approximately triangular tip parts 78*c* around the shaft 781, the top portions P2 of the approximately triangular tip parts 78*c* of the engaging members 78 are entered into the engaged openings 339*d* and the engaging members 78 are moved back to the initial positions as illustrated in FIG. 57, so that the toner container 32 is completely attached to the toner container holder 70.

The user operating the toner container 32 feels that the reaction force does not act immediately after the reaction force against the force that pushes open the left and right engaging members 78 outward becomes maximum, so that he/she can recognize that the attachment of the toner container 32 to the toner container holder 70 is completed. Meanwhile, a feeling that the user feels from when the top portions P2 of the tip parts 78*c* pass over the bumps 339*c* of the container engaged portions 339 and reach the engaged openings 339*d* is a so-called click feeling.

In the attached state of the toner container 32 as illustrated in FIG. 57, the reaction force (restoring force) against the compression force of the container shutter spring 336 and the reaction force (restoring force) against the compression force of the nozzle shutter spring 613 are applied to the toner container 32. However, the engaged openings 339*d* of the container engaged portions 339 of the container cover 34 are engaged with the engaging members 78, and the engaging members 78 receive a resultant force of the reaction forces as described above (hereinafter, the resultant force is referred to as a "restoring spring force"), so that the toner container 32 is held in the toner container holder 70. Specifically, as illustrated in FIG. 57, the second inclined surfaces 78*e* of the tip part 78*c* of the engaging members 78 come in contact with the second contact surfaces 339*e* of the bumps 339*c* connected to the front ends of the engaged openings 339*d* of the container engaged portions 339, and therefore, the reaction force against the compression force of the container shutter spring 336 and the reaction force against the compression force of the nozzle shutter spring 613 are applied. However, the engaging members 78 can be maintained in the initial positions because of the biasing forces of the torsion coil springs 782, so that the toner container 32 can be maintained in the attached state.

Next, a case will be explained below, in which the user detaches the toner container 32 in the detachment direction Q1 from the attached state illustrated in FIG. 57 to replace the toner container 32. When the user pulls the toner container maintained in the attached state as illustrated in FIG. 57 by gripping the gripper 303 (see FIG. 6), a force to pull out the toner container 32 is applied to the toner container 32 by the user, in addition to the reaction force against the compression force of the container shutter spring 336 and the reaction force against the compression force of the nozzle shutter spring 613 as described above. At this time, the second inclined surfaces 78*e* of the engaging members 78 receive these forces via the second contact surfaces 339*e* of the toner container 32. When the biasing forces of the torsion coil springs 782 applied to the engaging members 78 are greater than the above-described forces, the toner container 32 can be maintained in the attached state. In contrast, when the user increases the pulling force and the above-described forces become greater than the biasing forces of the torsion coil springs 782, the engaging members 78 are rotated about the shaft 781 in the opening direction (the releasing direction R2).

When the user further pulls the toner container 32 in the detachment direction Q, he/she needs to apply the greatest puling force immediately before the top portions of the approximately triangular bumps 339*c* reach the positions facing the top portions P2 of the tip parts 78*c*. At the positions at which the top portions of the approximately triangular bumps 339*c* face the top portions P2 of the tip parts 78*c*, the reaction force against the force the pushes open the left and right engaging members 78 outward becomes maximum. When the toner container 32 passes through this position, the second inclined surfaces 78*e* of the tip parts 78*c* and the second contact surfaces 339*e* of the bumps 339*c* are separated from each other, so that the force that pushes open the left and right engaging members 78 does not act on the engaging members 78, and the engaging members 78 rotate about the shafts 781 (in the engaging direction R1) due to the biasing forces of the torsion coil spring 782 (a restoring force against compression). Subsequently, the tip parts 78*c* of the engaging members 78 come in contact with the guiding grooves 339*b* of the container cover 34. At this time, the reaction force against the compression force of the container shutter spring 336 and the reaction force against the compression force of the nozzle shutter spring 613 act in the same direction so as to accelerate the movement of the toner container 32 in the detachment direction Q1. With the assist by these forces, the user can detach the toner container 32 from the toner container holder 70 and take the toner container 32 from the front side of the copier 500 (the front side in the direction normal to the sheet of FIG. 2).

As described above, when the toner container 32 is in the attached state, the reaction force (restoring force) against the compression force of the container shutter spring 336 and the reaction force (restoring force) against the compression force of the nozzle shutter spring 613 act on the toner container 32 in the detachment direction Q1 opposite to the attachment direction Q. Therefore, the spring pressure (pressure (load) by the spring) of the torsion coil springs 782 that bias the engaging members 78 to the initial positions is set to be greater than the reaction forces so as to be able to hold the toner container.

Therefore, when the toner container 32 is pushed in the attachment direction Q from the state illustrated in FIG. 115 to the attached state illustrated in FIG. 57 to attach the toner container 32, the restoring forces of the two springs such as the container shutter spring 336 and the nozzle shutter spring 613 and the biasing forces of the torsion coil springs 782 that bias the engaging members 78 to the initial positions act in the detachment direction Q1 opposite to the attachment direction Q that is the moving direction of the toner container 32. Therefore, the user pushes the toner container 32 in the attachment direction Q against the above forces.

In contrast, when the toner container 32 is pulled in the detachment direction Q1, while the toner container 32 is pulled against the biasing forces of the torsion coil springs 782 that bias the engaging members 78 to the initial positions similarly to the attachment operation, the restoring forces of the two springs such as the container shutter spring 336 and the nozzle shutter spring 613 act as an assist force in the detachment direction Q1 that is the moving direction of the toner container 32.

Therefore, a difference between the operating force to attach the toner container 32 to the toner container holder 70 and the operating force to detach the toner container 32 from the toner container holder 70 is increased, and this may give the user an uncomfortable feeling in the attachment/detachment operation.

Therefore, in the present embodiment, the shapes of the engaging members 78 and the shapes of the container engaged portions 339 are conceived so that a difference between the user's operating force for attachment and the user's operating force for detachment can be reduced. Specifically, the engaging members 78 and the container engaged portions 339 are configured such that the first rotational moment to rotate the engaging members 78 in the releasing direction R2 due to a force in the attachment direction Q applied by the user to attach the toner container 32 becomes greater than the second rotational moment to rotate the engaging members 78 in the releasing direction R2 due to a force in the detachment direction Q1 applied by the user to detach the toner container 32.

With this configuration, it becomes possible to more easily rotate the engaging members 78 when the toner container 32 is attached as compared when the toner container 32 is detached. Furthermore, the rotation of the engaging members 78 becomes heavier when the toner container 32 is detached as compared when the toner container 32 is attached.

Therefore, when the user attaches the toner container 32, he/she applies a force against the restoring forces of the two springs such as the container shutter spring 336 and the nozzle shutter spring 613 in the detachment direction Q1 to move the toner container 32 toward the toner container holder 70, but receives less forces from the engaging members 78 that act due to the attachment. In contrast, when the user pulls the toner container 32, the restoring forces of the two springs such as the container shutter spring 336 and the nozzle shutter spring 613 in the detachment direction Q1 act as an assist force, but the forces received from the engaging members 78 that act due to the detachment are increased relative to the forces received during the attachment of the toner container 32.

As described above, it becomes possible to reduce a difference in the user's operating force between attachment and detachment of the toner container 32 to and from the toner container holder 70 of the toner replenishing device 60. Therefore, it becomes possible to improve the attachment/detachment operability.

A relationship between forces applied to the engaging members 78 will be explained below with reference to FIG. 117 to FIG. 120. FIG. 117 illustrates a state in which the guiding protrusion 339*a* comes in contact with the engaging member 78 due to the pushing in the attachment direction Q. FIG. 118 illustrates a state immediately before the attached state is obtained due to the pushing in the attachment direction Q. In FIG. 117, the guiding protrusion 339*a*, the guiding inclined surface 339*a*1, the guiding groove 339*b*, and the engaging member 78 on one side (on the left side viewed from the container front end to the container rear end) are illustrated. In FIG. 118, the guiding groove 339*b*, the bump 339*c*, the engaged opening 339*d*, and the engaging member 78 on one side (on the left side viewed from the container front end to the container rear end) are illustrated.

FIG. 119 illustrates the attached state of the toner container 32. FIG. 120 illustrates a state in which the toner container 32 in the attached state is detached in the detachment direction Q1. In FIG. 119 and FIG. 120, the guiding groove 339*b*, the bump 339*c*, the engaged opening 339*d*, and the engaging member 78 on one side (on the left side viewed from the container front end to the container rear end) are illustrated.

A relationship of rotational moments generated on the engaging members 78 when the toner container 32 is set in the attachment direction Q will be explained below with reference to FIG. 117 and FIG. 118. In this case, a restoring spring force F that is a resultant force of the reaction force (restoring force) against the compression force of the container shutter spring 336 and the reaction force (restoring force) against the compression force the nozzle shutter spring 613 acts on the toner container 32 in the detachment direction Q1. Furthermore, in FIG. 117, U1 represents a force applied by a user to push the toner container 32 in the attachment direction Q while the guiding inclined surfaces 339*a*1 of the guiding protrusions 339*a* of the container cover 34 and the top portions P2 of the tip parts 78*c* of the engaging members 78 are in contact with each other. Moreover, a setting force S1 to set the toner container 32 in the attachment direction Q is represented by S1=U1−F because the restoring spring force F as described above acts in the detachment direction Q1 opposite to the attachment direction Q.

It is necessary to rotate the engaging members 78 in the releasing direction R2 such that the left and right guiding inclined surfaces 339*a*1 of the toner container 32 push open the left and right engaging members 78 by the setting force S1 to set the toner container 32 in the attachment direction Q.

First, a rotational moment M1 serving as a third rotational moment that acts in the releasing direction R2 will be described below. In FIG. 117, a normal force S1*n* due to the setting force S1 acts on the engaging members 78. Specifically, because the top portion P2 of the tip part 78*c* of the engaging member 78 is in contact with the guiding inclined surface 339*a*1, the normal force S1*n* acts in a direction perpendicular to the tangent at the contact point between the top portion P2 of the tip part 78*c* and the guiding inclined surface 339*a*1 (i.e., in a direction connecting the contact point and the center of the R-surface). The normal force S1*n* acts as the rotational moment in the releasing direction R2.

In this case, the normal force S1*n* can be represented as a component of the setting force S1 in the direction perpendicular to the tangent at the contact point between the top portion P2 of the tip part 78*c* and the guiding inclined surface 339*a*1. Therefore, the normal force S1*n* is represented as follows:

$$S1n = S1 \cos \theta 1$$

where θ1 is an angle between the direction in which the normal force S1*n* acts and the attachment direction Q in which the setting force S1 acts ($0<\theta 1\leq\pi/2$).

Furthermore, because the two engaging members 78 are provided on the left and right sides of the toner container 32, a force that acts on each of the left and right engaging members 78 is represented as ½×S1*n*.

Therefore, the rotational moment M1 to rotate each of the engaging members 78 in the releasing direction R2 such that the left and right guiding inclined surfaces 339*a*1 of the toner container 32 push open the left and right engaging members 78 as illustrated in FIG. 117 is represented as follows:

$$M1 = \tfrac{1}{2} \times S1n \times L1 = \tfrac{1}{2} \times S1 \cos \theta 1 \times L1$$

where the releasing direction R2 is clockwise in the figure.

Incidentally, L1 is a distance between a first line and a second line. The first line is perpendicular to the tangent at the contact point between the top portion P2 of the tip part 78*c* and the guiding inclined surface 339*a*1. The second line passes through the rotation center P1 of the shaft 781 serving as a fulcrum and is parallel to the line perpendicular to the tangent. That is, L1 is the length of a moment arm of ½×S1*n*.

In contrast, the engaging member 78 is biased by a spring force Fsp of the torsion coil spring 782 in the engaging direction.

As for a rotational moment M2 that acts in the engaging direction R1, similarly to the above, the rotational moment M2 is represented as follows:

$$M2=Fsp\times L2$$

where the engaging direction is counterclockwise in the figure.

Incidentally, L2 is a distance between a third line and a fourth line. The third line passes through a position (the spring press part 78*g*) at which the spring force of the torsion coil spring 782 acts. The fourth line passes through the rotation center P1 and is parallel to the line passing through the spring press part. That is, L2 is the length of a moment arm of the spring force Fsp.

Therefore, to move the toner container 32 in the attachment direction Q toward the toner container holder 70, the rotational moment M1 that acts in the releasing direction R2 needs to be greater than the rotational moment M2 that acts in the engaging direction R1.

Namely, it is necessary to satisfy a relationship of ½×S1 COS θ1×L1>Fsp×L2.

In this case, because S1=U1−F, the force U1 to push the toner container 32 in the attachment direction Q is represented as follows by solving the above relational expression for U1 by assigning S1=U1−F to the relational expression.

$$U1>(2/\cos\theta1)\times(L2/L1)\times Fsp+F \quad (1)$$

Furthermore, the reaction force that acts on the toner container 32 due to the contact between the guiding inclined surface 339*a*1 and the top portion P2 of the engaging member 78 has the same magnitude as that of the normal force of ½×S1*n* and acts in the opposite direction of the normal force of ½×S1*n*. Therefore, a component of force in the detachment direction Q1 is represented as ½×S1*n* COS θ1. Accordingly, a reaction force Cf1 perceived by a user who causes the toner container 32 to move in the attachment direction Q in the state illustrated in FIG. 117 is the same as a sum of the restoring spring force F and the component of force and is represented as Cf1=F+½×S1*n* COS θ1, where the reaction force Cf1 acts in the detachment direction Q1. The reaction force Cf1 becomes minimum when θ1=π/2. This is when the contact state is obtained such that θ1 becomes a right angle with respect to the attachment direction Q, that is, when the top portion P2 of the tip part 78*c* of the engaging member 78 is in contact with the guiding groove 339*b* of the container engaged portion 339.

Next, a relationship of rotational moments that act on the engaging members 78 when the top portions P2 of the tip parts 78*c* of the engaging members 78 pass over the bumps 339*c* of the toner container 32 will be explained below with reference to FIG. 118.

In the present embodiment, the humps 339*c* in the form of protrusions are provided on the container cover 34 to give a click feeling to indicate completion of attachment when the toner container 32 is attached to the toner container holder 70. Assuming that, similarly to the above descriptions with reference to FIG. 117, a force applied by a user to push the toner container 32 in the attachment direction Q is denoted by U2 and the restoring spring force in the detachment direction Q1 is denoted by F, a setting force S2 to set the toner container 32 in the attachment direction Q is represented by S2=U2−F.

It is necessary to rotate the engaging members 78 in the releasing direction R2 such that the bumps 339*c* (the first contact surfaces 339*f*) of the toner container 32 can pass over the tip parts 78*c* (the first inclined surfaces 78*f*) of the engaging members 78 by the setting force S2 to set the toner container 32 in the attachment direction Q.

First, a rotational moment M3 serving as the first rotational moment that rotates the engaging members 78 in the releasing direction R2 will be described below.

The first contact surface 339*f* of the bump 339*c* is in contact with the first inclined surface 78*f* of the engaging member 78. Therefore, a force S2*n* that is a component of the setting force S2 in the direction perpendicular to the first inclined surface 78*f* of the engaging member 78 acts as the rotational moment M3 in the releasing direction R2.

In this case, the force S2*n* as a component of the setting force S2 is represented as follows:

$$S2n=S2\cos\theta2$$

where θ2 is an angle between the direction perpendicular to the first inclined surface 78*f* and the attachment direction Q in which the setting force S2 acts.

The engaging members 78 are provided in two positions, in particular, on the left and right sides of the toner container 32. Therefore, a force that acts on each of the first inclined surfaces 78*f* is represented as ½×S2*n*.

Therefore, the rotational moment M3 in the releasing direction R2 when the toner container 32 is attached in the attachment direction Q as illustrated in FIG. 118 is represented as follows:

$$M3=\tfrac{1}{2}\times S2n\times L3=\tfrac{1}{2}\times S2\cos\theta2\times L3$$

where the releasing direction R2 is clockwise in the figure.

Incidentally, L3 is a distance between a fifth line and a sixth line. The fifth line is perpendicular to the first inclined surface 78*f* and is drawn from the contact point between the first contact surface 339*f* and the first inclined surface 78*f*. The sixth line passes through the rotation center PI of the shaft 781 serving as a fulcrum and is parallel to the line perpendicular to the first inclined surface. That is, L3 is the length of a moment arm of the force of ½×S2*n*.

Furthermore, a rotational moment M4 that acts in the engaging direction R1 is the same as the rotational moment M2 and is represented as follows:

$$M4=Fsp\times L2$$

where the engaging direction R1 is counterclockwise in the figure.

Therefore, to set the toner container 32, the relationship of the moments needs to be set such that the rotational moment that acts in the engaging direction R1 becomes grater than the rotational moment that acts in the releasing direction R2, in other words, such that M3>M4. Therefore, the relationship of ½×S2 COS θ2×L3>Fsp×L2 is satisfied.

In this case, because S2=U2−F, the force U2 to push the toner container 32 in the attachment direction Q is represented as follows by solving the above relational expression for U2 by assigning S2=U2−F to the relational expression.

$$U2>(2/\cos\theta2)\times(L2/L3)\times Fsp+F \quad (2)$$

Furthermore, the reaction force that acts on the toner container 32 due to the contact between the first contact surface 339*f* of the bump 339*c* and the first inclined surface 78*f* of the engaging member 78 has the same magnitude as that of the normal component of ½×S2*n* and acts in the opposite direction of the normal component of ½×S2*n*. Therefore, a component of force in the detachment direction Q1 is represented as ½×S2*n* COS θ2. Accordingly, a reaction force Cf2 perceived by the user who causes the toner container 32 to move in the attachment direction Q in the state illustrated in FIG. 118 is the same as a sum of the restoring spring force F and the component of force and is represented as Cf2=F+½×S2*n* COS θ2, where the reaction force C12 acts in the detachment direction Q1.

The reaction force Cf2 is greater than the reaction force Cf1 as described above. The user first feels the reaction force Cf2, and immediately after this, feels that the reaction force Cf2 stops acting because the tip parts 78*c* of the engaging members 78 are entered into the engaged openings 339*d*. Therefore, the user can recognize that the attachment of the toner container 32 to the toner container holder 70 is completed. As described above, by causing the user to feel a difference in the reaction force such that the reaction force is increased once and is immediately reduced, so that a so-called click feeling is given to the user.

Incidentally, the rotational moment M1 serving as the third rotational moment to rotate the engaging members 78 in the releasing direction R2 is greater than the rotational moment M3 serving as the first rotational moment to rotate the engaging members 78 in the releasing direction R2.

Next, a relationship of rotational moments that act on the engaging members in the attached state, in which the second inclined surfaces 78*e* of the tip parts 78*c* of the engaging members 78 and the second contact surfaces 339*e* of the bumps 339*c* of the toner container 32 are in contact with each other, will be explained below with reference to FIG. 119.

In the attached state, the restoring spring force F that is a resultant force of the restoring force against the compression force of the container shutter spring 336 and the restoring force against the compression force of the nozzle shutter spring 613 acts on the toner container 32 in the detachment direction Q1.

The condition to prevent the toner container 32 from being pushed out in the detachment direction Q1 due to the restoring spring force F is that the engaging member 78 does not rotate clockwise (in the releasing direction R2) about the shaft 781 serving as the fulcrum in the attached state illustrated in FIG. 119. Therefore, it is sufficient that the rotational moment about the fulcrum of the engaging member 78 acts counterclockwise the engaging direction R1). In the case of the left engaging member 78, the opposite is applied; therefore, it is sufficient that the rotational moment about the shaft 781, as a fulcrum, of the engaging member 78 acts clockwise (in the engaging direction).

First, a rotational moment MS that acts in the releasing direction is described below. The second inclined surface 78*e* of the engaging member 78 is in contact with the second contact surface 339*e* of the bump 339*c*. Therefore, a force Fn, which is a component of the restoring spring, force F and perpendicular to the second inclined surface 78*e* of the engaging member 78, acts as the rotational moment M5 in the releasing direction R2.

In this case, the force Fn as the component of the restoring spring force F is represented as follows:

$$Fn=F \cos \theta 3$$

where θ3 is an angle between the direction perpendicular to the second inclined surface 78*e* and the detachment direction Q1 in which the restoring spring force F acts.

The engaging members 78 are provided in two positions, in particular, on the left and right sides of the toner container 32. Therefore, a force that acts on each of the second inclined surfaces 78*e* is represented as ½×Fn.

Therefore, the rotational moment MS1*n* the releasing direction R2 in the attached state illustrated in FIG. 119 is represented as follows:

$$M4=\tfrac{1}{2}\times Fn\times L4=\tfrac{1}{2}\times F \cos \theta 3\times L4$$

where the releasing direction R2 is clockwise in the figure.

Incidentally, L4 is a distance between a seventh line and a eighth line. The seventh line is perpendicular to the second inclined surface 78*e* and is drawn from the contact point between the second contact surface 339*e* and the second inclined surface 78*e*. The eighth line passes through the rotation center PI of the shaft 781 serving as the fulcrum and is parallel to the line perpendicular to the second inclined surface. That is, L4 is the length of a moment arm of the force of ½×Fn.

Furthermore, a rotational moment M6 that acts in the engaging direction R1 is the same as the rotational moment M2 or M4 and is represented as follows:

$$M6=Fsp\times L2$$

where the engaging direction R1 is counterclockwise in the figure.

Therefore, to maintain the attached state in which the toner container 32 is held in the attached position in the toner replenishing device 60. the relationship of the moments needs to be set such that the rotational moment M6 that acts in the engaging direction R1 becomes greater than the rotational moment MS that acts in the releasing direction R2. Therefore, the relationship of ½×F COS θ3×L4<Fsp×L2 is satisfied.

Next, a relationship of rotational moments generated on the engaging members 78 when the user pulls out the toner container 32 in the detachment direction Q1 will be explained below with reference to FIG. 120. First, a rotational moment M7 serving as the second rotational moment to rotate the engaging members 78 in the releasing direction R2 will be described below.

Assuming that a force applied by a user to pull out the toner container 32 in the detachment direction Q1 is denoted by 153, because the restoring spring force F also acts in the same direction, a pulling force S3 to pull out the toner container 32 in the detachment direction Q1 is represented as S3=U3+F.

A force S3*n*, which is a component of the pulling force S3 and perpendicular to the second inclined surface 78*e* of the engaging member 78 (i.e., a component in the direction perpendicular to the tangent at the contact point between the second inclined surface 78*e* of the engaging member 78 and the second contact surface 339*e* of the container engaged portion 339), acts as the rotational moment M7 in the releasing direction R2.

Incidentally, it is necessary to adjust the slope of the second inclined surface 78*e* of the engaging member 78 and the second contact surface 339*e* of the container engaged portion 339 such that the rotation center PI of the engaging member 78 is not located on the direction in which the force S3*n* acts.

In this case, the force S3*n* as the component of the pulling force S3 is represented as follows:

$$S3n=S3 \cos \theta 3$$

where θ3 is an angle between the direction perpendicular to the second inclined surface 78*e* and the detachment direction Q1 in which the pulling force S3 acts.

The engaging members 78 are provided in two positions, in particular, on the left and right sides of the toner container 32. Therefore, a force that acts on each of the second inclined surfaces 78*e* is represented as ½×S3*n*.

Therefore, the rotational moment M7 in the releasing direction R2 to pull out the toner container 32 in the detachment direction Q1 in the state illustrated in FIG. 119 is represented as follows:

$$M7=\tfrac{1}{2}\times S3n\times L4=\tfrac{1}{2}\times S3 \cos \theta 3\times L4$$

where the releasing direction R2 is clockwise in the figure.

Incidentally, L4 is a distance between the seventh line and the eighth line. The seventh line is perpendicular to the second inclined surface 78*e* and is drawn from the contact point between the second contact surface 339*e* and the second inclined surface 78*e*. The eighth line passes through the rotation center P1 of the shaft 781 serving as the fulcrum and is parallel to the line perpendicular to the second inclined surface. That is, L4 is the length of the moment arm of the force of ½×S3*n*.

Furthermore, a rotational moment M8 that acts in the engaging direction R1 is the same as the rotational moment M2, M4, or M6 and is represented as follows:

$$M8=Fsp\times L2$$

where the engaging direction R1 is counterclockwise in the figure.

Therefore, to pull out the toner container 32 in the detachment direction Q1, the relationship of the moments needs to be set such that the rotational moment M7 that acts in the releasing direction R2 becomes greater than the rotational moment M8 that acts in the engaging direction R1, in other words, such that M7>M8. Therefore, the relationship of ½×S3 COS θ3×L4>Fsp<L2 is satisfied.

In this case, because S3=U3+F, the force U3 to pull out the toner container 32 in the detachment direction Q1 is represented as follows by solving the above relational expression for U3 by assigning S3=U3+F to the relational expression.

$$U3>(2/\cos\theta 3)\times(L2/L4)\times Fsp-F \quad (3)$$

Furthermore, the reaction force that acts on the toner container 32 due to the contact between the second contact surface 339*e* of the bump 339*c* and the second inclined surface 78*e* of the engaging member 78 has the same magnitude as that of the normal component of ½×S3*n* and acts in the opposite direction of the normal component of ½×S3*n*. Therefore, a component of force in the detachment direction Q1 is represented as −½×S3*n* COS θ3. Accordingly, a reaction force Cf3 perceived by the user who causes the toner container 32 to move in the detachment direction Q1 in the state illustrated in FIG. 120 is the same as a sum of the restoring spring force F and the component force and is represented as Cf3=F−½×S3*n* COS θ3, where the reaction force Cf3 acts in the detachment direction Q1.

Incidentally, the rotational moment M3 serving as the first rotational moment to rotate the engaging members 78 in the releasing direction R2 is greater than the rotational moment M7 serving as the second rotational moment to rotate the engaging members 78 in the releasing direction R2.

As described above, when pushing the toner container 32 in the attachment direction Q, the user first applies the pushing force U1 to the toner container 32, and subsequently applies the pushing force U2. Furthermore, when pulling out the toner container 32 in the detachment direction Q1, the user applies the pulling force U3 to the toner container 32.

The lower limit of the pushing force U1 is obtained by Expression (1) as described above, the lower limit of the pushing force U2 is obtained by Expression (2) as described above, and the lower limit of the pulling force U3 is obtained by Expression (3) as described above.

Furthermore, the relationship of the magnitudes of the rotational moments is set as follows:

$$M5<M2=M4=M6=M8<M7<M1<M3 \quad (4)$$

The relationship of the magnitudes of the operating forces and the reaction forces are set as follows.

$$F<U1<U2 \quad (5)$$

$$U2\approx U3 \quad (6)$$

$$Cf1<Cf2 \quad (7)$$

By setting all of the parameters θ1, θ2, θ3, L2, L3, L4, Fsp, and F used in Expressions (4) to (7) such that Expressions (4) to (7) can be satisfied simultaneously, and in particular, by increasing a difference between the rotational moment M3 to rotate the engaging members 78 at the time of attachment and the rotational moment M7 to rotate the engaging members 78 at the time of detachment, it becomes possible to reduce a difference between the operating force U2 and the operating force U3 used to attach and detach the powder container to and from the powder replenishing device. As a result, it becomes possible to improve the attachment/detachment operability.

Each of the parameters θ1, θ2, θ3, L1, L2, L3, L4, Fsp, and F can be set as desired by appropriately setting the spring pressure of the container shutter spring 336 and the shapes of the container engaged portions 339 of the container cover 34 of the toner container 32, and by selling the spring force of the nozzle shutter spring 613, the shapes of the engaging members 78, and the spring pressure of the torsion coil spring 782 of the toner replenishing device 60.

FIG. 121 illustrates an example of the engaging members according to the present embodiment.

In FIG. 121, the engaging member 78 is illustrated such that the longitudinal direction thereof is oriented parallel to the attachment direction Q and the detachment direction Q1.

In FIG. 121, inclined angles θ4 and θ5 that are respective angles of the second inclined surface 78*e* and the first inclined surface 78*f* of the tip part 78*c*, on which a contact point (the point of action) of the container engaged portion 339 moves, is set to 45° with respect to the direction perpendicular to the longitudinal direction of the engaging members 78. Furthermore, a length L5 from the top portion P2 of the tip part 78*c* to the rotation center P1 in the attachment/detachment direction is set to 12.37 mm. Moreover, a length L6 from the top portion P2 of the tip part 78*c* to the rotation center P1 in the width direction W (the direction perpendicular to the attachment direction Q and the detachment direction Q1) is set to 8.5 mm.

In this case, because θ2=51°, θ3=45°, L2=13.2 mm, L3=13.5 mm, L4=5.7 mm, Fsp=5 Newton (N), and F=10, U2>25.5 N based on Expression (2), and U3>22.7 N based on Expression (3).

Therefore, it becomes possible to reduce a difference between the pushing force U2. and the pulling force U3 to be applied to the toner container 32 by the user, and to approximately equalize the pushing force U2 and the pulling force U3.

As a result, it becomes possible to reduce a difference in the operating force between attachment and detachment of the toner container 32 to and from the toner replenishing device 60 (the toner container holder 70), enabling to improve the operability.

More specifically, it is preferable to set the user's operating force to attach and detach the toner container containing 400 to 500 grams of toner to 50 N or less, and it is more preferable to set the operating force to 30 N or less. Furthermore, if a difference between the user's operating force to attach the toner container 32 to the toner container holder 70 and the user's operating force to detach the toner container 32 from the toner container holder 70 is set to 3 N or less, it becomes possible to reduce an uncomfortable feeling that may be perceived by the user in the detachment operation.

Incidentally, because the toner container 32 of the present embodiment includes the container shutter spring 336 and the nozzle shutter spring 613, if the toner container 32 is to be attached to the toner container holder 70 against the resultant force (the restoring spring force F) of the forces of the springs as described above, the user's operating forces U1 and U2 in the attachment direction Q are increased by the resultant force (the restoring spring force F).

Furthermore, the resultant force (the restoring spring force F) acts even in the attached sate in which the toner container 32 is set in the toner container holder 70. Therefore, to reliably hold the toner container 32, it is necessary to cause the engaging members 78 serving as the replenishing device engaging members to apply a relatively large holding force to the toner container 32.

However, if the holding force of the engaging members 78 in the attached state is increased as described above, it becomes necessary to further increase the user's operating forces U1 and U2 in the attachment direction Q. Furthermore, to achieve the click feeling to allow the user to recognize completion of the setting, it is necessary to ensure a difference in the user's operating force before and after the tip parts 78*c* of the engaging members 78 pass over the bumps 339*c*. Therefore, it becomes necessary to increase the user's operating force U2 relative to the user's operating force U1.

Therefore, the container cover 34 of the present embodiment includes the guiding inclined surfaces 339*a*1 and the bumps 339*c* serving as a force converting portion that generate forces to rotate the engaging members 78 in the releasing direction R2 about the shafts 781 against the rotational moments M2, M4, M6, and M8 in the engaging direction R1 of the engaging members 78.

Specifically, when the toner container 32 is moved in the attachment direction Q toward the toner container holder 70, the guiding inclined surfaces 339*a*1 and the first inclined surfaces 78*f* of the engaging members 78 come in contact with each other. The contact points on the first inclined surfaces 78*f* of the engaging members 78 due to the contact serve as the points of action to rotate the engaging members 78 in the releasing direction R2 about the shafts 781. And the distance in the direction perpendicular to the rotational force, from the centers PI of the shafts 781 to a line passing through the points of action, serves as the arms L1 of the rotational moments M1 of the engaging members 78 about the shafts 781.

Similarly, when the first contact surfaces 339*f* and the first inclined surfaces 78*f* come in contact with each other, the contact points on the first inclined surfaces 78*f* of the engaging members 78 due to the contact serve as the points of action to rotate the engaging members 78 in the releasing direction R2 about the shafts 781. And distances in the direction perpendicular to the rotational force, from the centers P1 of the shafts 781 to the points of action, serve as the arms L3 of the rotational moments M3 of the engaging members 78 about the shafts 781.

When the toner container 32 is moved from the toner container holder 70 in the detachment direction Q1, the second contact surfaces 339*e* and the second inclined surfaces 78*e* of the engaging members 78 come in contact with each other. The contact points on the second inclined surfaces 78*e* of the engaging members 78 due to the contact serve as the points of action to rotate the engaging members 78 in the releasing direction R2 about the shafts 781. And distances in the direction perpendicular to the rotational force, from the centers P1 of the shafts 781 to the points of action, serve as the arms L4 of the rotational moments M7 of the engaging members 78 about the shafts 781.

In the present embodiment, the guiding inclined surfaces 339*a*1, the first contact surfaces 339*f*, and the second contact surfaces 339*e*, all of which serve as force transducers, are provided in the container cover 34, and the first inclined surfaces 78*f* and the second inclined surfaces 78*e* are provided in the engaging members 78 serving as the replenishing device engaging members. Therefore, the positions of the points of action to attach the toner container 32 to the toner container holder 70 are different from the positions of the points of action to detach the toner container 32 from the toner container holder 70.

Therefore, the lengths L1, L3, and L4 of the arms of the rotational moments of the engaging members 78 about the shafts 781 are different from one another such that L1>L3>L4, so that the engaging members 78 can be rotated by a smaller force when the toner container 32 is attached, and the engaging members 78 are rotated by a greater force when the toner container 32 is detached as compared when the toner container 32 is attached. Consequently, it becomes possible to reduce a difference in the user's operating force between the attachment and detachment of the toner container 32 to and from the toner container holder 70 of the toner replenishing device 60 serving as the powder replenishing device. As a result, it becomes possible to improve the attachment/detachment operability.

In the present embodiment, the toner container 32 including the container body 33 provided with the spiral groove 302 and including the container cover 34 rotatably attached to the container body 33 is described as an example of the powder container; however, the configuration is not limited thereto. For example, the container body may include a conveyor, such as a screw, inside the container. Furthermore, it may be possible to mount the IC tag (IC chip) 700, which serves as an information storage device, on the container cover 34 and mount the connector 800, which serves as a reader to read information by coming into contact with the IC tag, on the toner replenishing device 60.

In the tenth embodiment, the container body 33 including the spiral groove is used as the container body. However, as the container body, it may be possible to mount the container engaged portions 339 of the present embodiment on the toner container 1032 of the other embodiments illustrated in FIG. 50 and FIGS. 51A to 51D. Namely, the engaging members 78 and the container engaged portions 339 are configured such that the first rotational moment M3 to rotate the engaging members 78 in the releasing direction R2 due to the force in the attachment direction Q applied by the user to attach the toner container 1032 becomes greater than the second rotational moment M7 to rotate the engaging members 78 in the releasing direction R2 due to the force in the detachment direction Q1 applied by the user to detach the toner container 1032. Therefore, similarly to the tenth embodiment, it becomes possible to reduce a difference in the user's operating force between attachment and detachment of the toner container 1032 serving as the powder container to and from the toner container holder 70 of the toner replenishing device 60 serving as the powder replenishing device. As a result, it becomes possible to improve the attachment/detachment operability.

According to the present invention, the container gear is arranged so as to mesh with the apparatus main-body gear at a position closer to the opening than the powder receiving hole in the longitudinal direction when the powder container is attached to the image forming apparatus. The opening is to mate with the container receiving section. This makes it becomes possible to improve the performance to transfer the powder from the powder container to the toner replenishing device and to reduce a load on the conveying nozzle or the nozzle receiver due to the drive transmitted by the gear.

While the first to the tenth embodiments are described in detail above, they are mere examples. Any configurations made by combinations of arbitrary embodiments as described above fall within the scope of the invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The present invention further includes the following aspects.

Aspect A-1

A powder container to be attached to a powder replenishing device with a longitudinal direction of the powder container oriented in a horizontal direction, the powder replenishing device including:

a conveying nozzle to which the powder container is attached and which conveys powder;

a powder receiving hole that is provided on the conveying nozzle and receives the powder from the powder container;

a nozzle opening/closing member to open and close the powder receiving hole;

a biasing member to bias the nozzle opening/closing member so as to close the powder receiving hole; and a replenishing device engaging member that biases a side of the powder container to hold the powder container in the powder replenishing device, that includes a first inclined surface to come in contact with the powder container when the powder container is attached to the powder replenishing device, that includes a second inclined surface to come in contact with the powder container when the powder container is detached from the powder replenishing device, and that is provide rotatably with respect to a shaft that is arranged on the upstream side in the powder-container attachment direction relative to the first inclined surface and the second inclined surface, the powder container comprising:

a rotary conveyor that conveys the powder from one end in the longitudinal direction to other end at which a container opening is arranged;

a nozzle receiver that is arranged in the container opening and that receives the conveying nozzle; and a container engaged portion including:

a first contact surface that comes in contact with the first inclined surface when the powder container is attached to the powder replenishing device; and a second contact surface that comes in contact with the second inclined surface when the powder container is detached from the powder replenishing device, wherein the nozzle receiver includes a contact portion that comes in contact with the nozzle opening/closing member and that is biased, the first contact surface generates a first rotational moment on the replenishing device engaging member by a contact with the first inclined surface when the powder container is attached to the powder replenishing device, the second contact surface generates a second rotational moment on the replenishing device engaging member by a contact with the second inclined surface when the powder container is detached from the powder replenishing device, and the first rotational moment is greater than the second rotational moment.

Aspect A-2

A powder container to be attached to a powder replenishing device with a longitudinal direction of the powder container oriented in a horizontal direction, the powder replenishing device including:

a conveying nozzle to which the powder container is attached and which conveys powder;

a powder receiving hole that is provided on the conveying nozzle and receives the powder from the powder container;

a nozzle opening/closing member to open and close the powder receiving hole;

a biasing member to bias the nozzle opening/closing member so as to close the powder receiving hole; and two replenishing device engaging members, each biasing an opposite side of the powder container to hold the powder container, each including a first inclined surface that is inclined upward from an upstream side to a downstream side in a powder-container attachment direction so as to come in contact with the powder container when the powder container is attached to the powder replenishing device, each including a second inclined surface that has a top portion adjoined from the first inclined surface and that is inclined upward from an upstream side to a downstream side in a powder-container detachment direction so as to come in contact with the powder container when the powder container is detached from the powder replenishing device, and each being provided rotatably with respect to a shaft that is arranged on the upstream side in the powder-container attachment direction relative to the first inclined surface and the second inclined surface, the powder container comprising:

a rotary conveyor to convey the powder from one end in the longitudinal direction to other end at which a container opening is arranged;

a nozzle receiver which is arranged in the container opening and which receives the conveying nozzle; and a container engaged portion including:

a first contact surface that comes in contact with the first inclined surfaces when the powder container is attached to the powder replenishing device;

a second contact surface that comes in contact with the second inclined surfaces when the powder container is detached from the powder replenishing device, and a top portion between the first contact surface and the second contact surface, wherein the nozzle receiver includes a contact portion that comes in contact with the nozzle opening/closing member and that is biased, the first contact surface of the container engaged portion is an inclined surface that is inclined upward from the downstream side to the upstream side in the powder-container attachment direction, that applies a force to the first inclined surfaces of the replenishing device engaging members by contacts with the first inclined surfaces when the powder container is attached to the powder replenishing device, and that generates, at positions of the contacts with the first inclined surfaces, a first rotational moment with an arm corresponding to a distance between a straight line drawn from the first contact surface in a direction in which the force is applied to the first inclined surfaces and a straight line drawn from the shaft so as to be parallel to the straight line drawn from the first contact surface, and the second contact surface of the container engaged portion is an inclined surface that is inclined downward from the upstream side to the downstream side in the powder-container detachment direction starting from the top portion between the first contact surface and the second contact surface, that applies a force to the second inclined surfaces by contacts with the second inclined surfaces when the powder container is detached from the powder replenishing device, and that generates, at positions of the contacts with the second inclined surfaces, a second rotational moment with an arm corresponding to a distance between a straight line drawn from the second contact surface in a direction in which the force is applied to the second inclined surfaces and a straight line drawn from the shaft so as to be parallel to the straight line drawn from the second contact surface, and an inclined angle of each of the first contact surface and the second contact surface with respect to the powder-container attachment and detachment directions is set such that the first rotational moment becomes greater than the second rotational moment, wherein the positions of the contacts are set so that the arm of the first rotational moment and the arm of the second rotational moment differ in length from each other.

Aspect A-3

The powder container according Aspect A-2, wherein the container engaged portion includes an engaged opening engaged with the replenishing device engaging member, and the engaged opening is adjacent to the second contact surface.

Aspect A-4

The powder container according to Aspect A-3, wherein the engaged opening is a through hole.

Aspect A-5

The powder container according to any one of Aspects A-2 to A-4, wherein the nozzle receiver includes:

a container opening/closing member to open and close a nozzle insertion opening to guide the conveying nozzle to the inside of the container body, and a container biasing member to bias the container opening/closing member so as to close the nozzle insertion opening.

Aspect A-6

The powder container according to any one of Aspects A-2 to A-5, further comprising a container cover that is arranged on the other end of the container body, wherein the container cover includes the container engaged portion.

Aspect A-7

The powder container according to Aspect A-6, wherein the container engaged portion includes a guiding portion on a container front side relative to the first contact surface, and the guiding portion includes an inclined surface inclined from a central axis of the container cover to an outer periphery of the container cover.

Aspect A-8

The powder container according to Aspect A-7, wherein the inclined surface of the guiding portion applies a force to the first inclined surface of the replenishing device engaging member by a contact with the first inclined surface when the powder container is attached to the powder replenishing device, and generates, at a position of the contact with the first inclined surface, a third rotational moment with an arm corresponding to a distance between a straight line drawn from the inclined surface of the guiding portion in a direction in which the force is applied to the first inclined surface and a straight line drawn from the shaft so as to be parallel to the line drawn from the inclined surface, an inclined angle of the inclined surface of the guiding portion with respect to the powder-container attachment and detachment directions is set such that the third rotational moment becomes greater than the first rotational moment, and a position of the contact between the inclined surface of the guiding portion and the first inclined surface differs from the position of the contact between the first contact surface and the first inclined surface so that the arm of the third rotational moment and the arm of the first rotational moment differ in length from each other.

Aspect A-9

The powder container according to Aspect A-7 or A-8, wherein the container engaged portion includes, on an outer surface of the container cover, a guiding groove that is adjoined from the inclined surface and that extends in the longitudinal direction.

Aspect A-10

The powder container according to any one of Aspects A-6 to A-9, further comprising a container body to store therein the powder to be supplied to the powder replenishing device to form an image, wherein the container body is held so as to rotate relative to the container cover.

Aspect A-11

The powder container according to Aspect A-10, wherein the rotary conveyor is a spiral rib provided on an inner surface of the container body.

Aspect A-12

The powder container according to any one of Aspects A-6 to A-9, further comprising a container body to store therein the powder to be supplied to the powder replenishing device to form an image, wherein the container body is held so as not to rotate relative to the container cover.

Aspect A-13

The powder container according to Aspect A-12, wherein the rotary conveyor is integrated with the nozzle receiver.

Aspect A-14

An image forming apparatus comprising:

the powder container according to any one of Aspects A-2 to A-6 and A-9 to A-13;

an image forming unit that forms an image on an image bearer by using the powder conveyed from the powder container; and a powder replenishing device to convey the powder from the powder container to the image forming unit.

Aspect A-15

The image forming apparatus according to Aspect A-14, further comprising a container holding section to and from which the powder container is attached and detached, wherein the replenishing device engaging member is rotatably supported by the shaft provided in the container holding section and includes a pressing unit that applies a rotational moment in a container holding direction to the replenishing device engaging member.

Aspect A-16

The image forming apparatus according to Aspect A-14 or A-15, wherein a length of an arm of a first rotational moment to rotate the replenishing device engaging member in a releasing direction at a point of action on the first inclined surface to which a force is applied by a contact with the first contact surface of the container cover when the powder container is attached is longer than a length of an arm of a second rotational moment to rotate the replenishing device engaging member in the releasing direction at a point of action on the second inclined surface to which a force is applied by a contact with the second contact surface of the container cover when the powder container is detached.

Aspect A-17

An image forming apparatus comprising:

the powder container according to Aspect A-7 or A-8;

an image forming unit that forms an image on an image bearer by using the powder conveyed from the powder container; and a powder replenishing device to convey the powder from the powder container to the image forming unit.

Aspect A-18

The image forming apparatus according to Aspect A-17, further comprising a container holding section to and from which the powder container is attached and detached, wherein the replenishing device engaging member is rotatably supported by the shaft provided in the container holding section and includes a pressing unit that applies a rotational moment in a container holding direction to the replenishing device engaging member.

Aspect A-19

The image forming apparatus according to Aspect A-17 or A-18, wherein a length of an arm of a first rotational moment to rotate the replenishing device engaging member in a releasing direction at a point of action on the first inclined surface to which a force is applied by a contact with the first contact surface of the container cover when the powder container is attached is longer than a length of an arm of a second rotational moment to rotate the replenishing device engaging member in the releasing direction at a point of action on the second inclined surface to which a force is applied by a contact with the second contact surface of the container cover when the powder container is detached.

Aspect A-20

The image forming apparatus according to any one of Aspects A-17 to A-19, wherein a length of an arm of a third rotational moment to rotate the replenishing device engaging member in the releasing direction at a point of action on the first inclined surface to which a force is applied by a contact with the inclined surface of the guiding portion when the powder container is attached is longer than the length of the arm of the first rotational moment.

Aspect A-21

A powder container to be attached to a powder replenishing device with a longitudinal direction of the powder container oriented in a horizontal direction, the powder replenishing device including:

a conveying nozzle to which the powder container is attached and which conveys powder;

a powder receiving hole that is provided on the conveying nozzle and receives the powder from the powder container;

a nozzle opening/closing member to open and close the powder receiving hole;

a biasing member to bias the nozzle opening/closing member so as to close the powder receiving hole; and two replenishing device engaging members, each biasing an opposite side of the powder container to hold the powder container, each including a first inclined surface that is inclined upward from an upstream side to a downstream side in a powder-container attachment direction so as to come in contact with the powder container when the powder container is attached to the powder replenishing device, each including a second inclined surface that has a top portion adjoined from the first inclined surface and that is inclined upward from an upstream side to a downstream side in a powder-container detachment direction so as to come in contact with the powder container when the powder container is detached from the powder replenishing device, and each being provided rotatably with respect to a shaft that is arranged on the upstream side in the powder-container attachment direction relative to the first inclined surface and the second inclined surface, the powder container comprising:

a rotary conveyor to convey the powder from one end in the longitudinal direction to other end at which a container opening is arranged;

a nozzle receiver which is arranged in the container opening and which receives the conveying nozzle; and a container engaged portion including:

a first contact surface that comes in contact with the first inclined surfaces when the powder container is attached to the powder replenishing device;

a second contact surface that comes in contact with the second inclined surfaces when the powder container is detached from the powder replenishing device, and a top portion between the first contact surface and the second contact surface, wherein the nozzle receiver includes a contact portion that comes in contact with the nozzle opening/closing member and that is biased, the second contact surface of the container engaged portion is an inclined surface that is inclined downward from the upstream side to the downstream side in the powder-container detachment direction starting from the top portion between the first contact surface and the second contact surface, that applies a force to the second inclined surfaces by contacts with the second inclined surfaces when the powder container is detached from the powder replenishing device, and that generates, at positions of the contacts with the second inclined surfaces, a second rotational moment with an arm corresponding to a distance between a straight line drawn from the second contact surface in a direction in which the force is applied to the second inclined surfaces and a straight line drawn from the shaft so as to be parallel to the straight line drawn from the second contact surface, the first contact surface is an inclined surface that is provided on the downstream side in the powder-container attachment direction relative to the second contact surface, that is inclined upward from the downstream side to the upstream side in the powder-container attachment direction, that applies a force to the first inclined surfaces of the replenishing device engaging members by contacts with the first inclined surfaces when the powder container is attached to the powder replenishing device, and that generates, at positions of the contacts with the first inclined surfaces, a first rotational moment greater than the second rotational moment by being set so that a length of an arm of the first rotational moment is longer than a length of the arm of the second rotational moment, the length of the arm of the first rotational moment corresponding to a distance between a straight line drawn from the first contact surface in a direction in which the force is applied to the first inclined surfaces and a straight line drawn from the shaft so as to be parallel to the straight line drawn from the first contact surface.

Aspect B-1

A powder container comprising:

a container body to store therein powder to be supplied to a powder replenishing device to form an image;

a rotary conveyor that is arranged inside the container body and conveys the powder from one end to other end in a longitudinal direction of the container body, the other end being an end on which a container opening is arranged;

a nozzle receiver that is arranged in the container opening and that guides a conveying nozzle to an inside of the container body, the conveying nozzle being provided to the powder replenishing device and configured to convey the powder in the container body; and a container cover that is provided on the other end of the container body and that is engaged with a replenishing device engaging member to hold the powder container in the powder replenishing device, wherein the nozzle receiver includes:

an opening/closing member that opens and closes a nozzle insertion opening being an entrance to guide the conveying nozzle to the inside of the container body, and that enables a powder receiving hole arranged on the conveying nozzle to receive the powder from the powder container; and a biasing member to bias the opening/closing member in a direction in which the nozzle insertion opening is closed, the direction being opposite to the direction in which the nozzle opening/closing member closes the powder receiving hole, and the container cover includes a container engaged portion including:

a first contact surface that comes in contact with a first inclined surface of the replenishing device engaging member biased from a side of the powder container when the powder container is attached to the powder replenishing device and a second contact surface that comes in contact with a second inclined surface of the replenishing device engaging member biased from the side of the powder container when the powder container is detached from the powder replenishing device, the container engaged portion is configured such that:

the first contact surface generates a first rotational moment on the replenishing device engaging member by the contact with the first inclined surface when the powder container is attached to the powder replenishing device, the second contact surface generates a second rotational moment on the replenishing device engaging member by the contact with the second inclined surface when the powder container is detached from the powder replenishing device, and the first rotational moment is greater than the second rotational moment.

Aspect B-2

The powder container according to Aspect B-1, wherein the container cover includes, in the following order from a container front side, a guiding inclined surface that is inclined from a central axis of the container cover to an outer periphery of the container cover, a guiding groove that is connected from the guiding inclined surface and that extends in the longitudinal direction, a first contact surface that is connected from the guiding groove and protrudes from the central axis of the container cover to the outer periphery of the container cover, and a second contact surface connected from the first contact surface to an engaged opening engaged with the replenishing device engaging member.

Aspect B-3

The powder container according to Aspect B-1 or B-2, wherein a minimum force to be applied to the powder container by an operator When the powder container is attached to the powder replenishing device is set to be 50 Newton or less.

Aspect B-4

The powder container according to any one of Aspects B-1 to B-3, wherein a difference between a minimum force applied to the powder container by an operator when the powder container is attached to the powder replenishing device and a minimum force applied to the powder container by the operator when the powder container is detached from the powder replenishing device is set to be 3 Newton or less.

Aspect C-1

A powder container to contain powder used for forming an image and to be attached to an image forming apparatus that includes:

an insertion hole in which the powder container is inserted in a horizontal direction; and a rib that protrudes upward at the insertion hole and is provided in a different shape or position according to a type of the image forming apparatus, the powder container comprising:

a gap that is provided in a lower portion of the powder container to pass over the rib; and a restrictor to restrict movement of the powder container in a vertical direction when the gap passes over the rib at the insertion hole.

Aspect C-2

The powder container according to Aspect C-1, wherein the restrictor is a sliding guide provided on an outer surface of the powder container, and the movement of the powder container in the vertical direction is restricted when a restriction rib provided at the insertion hole is entered into the sliding guide.

Aspect C-3

The powder container according to Aspect C-1, wherein the restrictor is an upward guide provided to an upper portion of the powder container, and the movement of the powder container in the vertical direction is restricted when the upward guide comes in contact with a ceiling surface of the insertion hole.

Aspect C-4

The powder container according to Aspect C-2, wherein the gap is provided between a pair of the sliding guides.

Aspect C-5

The powder container according to Aspect C-4, wherein the gap is defined by a pair of container ribs protruding from the sliding guides, and whether the gap is allowed to pass over the rib at the insertion hole is identified based on a distance between the container ribs.

Aspect C-6

The powder container according to Aspect C-4, wherein the gap is provided on lower surfaces of the sliding guides along a powder-container attachment direction, and whether the gap is allowed to pass over the rib at the insertion hole is identified based on presence or absence of the gap.

Aspect C-7

The powder container according to Aspect C-5, wherein the container rib extends to a position on a downstream side in the powder-container attachment direction relative to centers of the sliding guides in a longitudinal direction.

Aspect C-8

The powder container according to Aspect C-4, wherein each of the sliding guides includes an upper guide and a lower guide extending along a longitudinal direction of the powder container such that a clearance gap is provided between the upper guide and the lower guide, wherein a front end of the clearance gap on the downstream side in the powder-container attachment direction is narrower than a center of the clearance gap on an upstream side in the powder-container attachment direction, and whether the gap is allowed to pass over the protrusion is identified while the restriction rib is inserted in the front end of the gap.

Aspect C-9

An image forming apparatus comprising:

a powder container according to any one of Aspects C-1 to C-8; and an image forming unit that forms an image on an image bearer by using powder conveyed from the powder container.

Aspect C-10

A powder container to contain powder used for forming an image and to be attached to an image forming apparatus that includes:

an insertion hole in which the powder container is inserted in a horizontal direction; and a protrusion that protrudes upward at the insertion hole and is provided in a different shape or position according to a type of the image forming apparatus, the powder container comprising:

a gap that is provided in a lower portion of the powder container to pass over the protrusion; and a restrictor to restrict movement of the powder container in a vertical direction when the gap passes over the protrusion at the insertion hole, wherein the gap is provided between a pair of the restrictors provided on an outer surface of the powder container.

Aspect C-11

The powder container according to Aspect C-10, wherein the gap is defined by a pair of container protrusions protruding from the restrictors, and whether the gap is allowed to pass over the protrusion at the insertion hole is determined based on a distance between the container protrusions.

Aspect C-12

The powder container according to Aspect C-10, wherein the gap is provided on lower surfaces of the restrictors, and whether the gap is allowed to pass over the protrusion at the insertion hole is determined based on presence or absence of the gap.

Aspect C-13

The powder container according to Aspect C-11, wherein the container protrusion extends to a position on a downstream side in the powder-container attachment direction relative to centers of the restrictors in a longitudinal direction.

Aspect C-14

The powder container according to any one of Aspects C-10 to C-13, wherein the restrictor is a sliding guide extending along a longitudinal direction of the powder container.

Aspect C-15

The powder container according to Aspect C-14, wherein the sliding guide includes a sliding groove provided to be parallel to a rotational axis of the powder container.

Aspect C-16

The powder container according to Aspect C-15, wherein the movement of the powder container in the vertical direction is restricted when a restriction rib provided at the insertion hole is entered into the sliding groove.

Aspect C-17

The powder container according to Aspect C-15 or C-16, wherein the sliding groove is defined by an upper guide and a lower guide, a front side of the sliding groove on the downstream side in the powder-container attachment direction is narrower than a rear side of the sliding groove on an upstream side in the powder-container attachment direction, and whether the gap is allowed to pass over the protrusion is identified while the restriction rib is inserted in the front side of the sliding groove.

Aspect C-18

The powder container according to Aspect C-15 or C-16, wherein the gap is provided on lower surface of the sliding guide, and whether the gap is allowed to pass over the protrusion at the insertion hole is identified based on presence or absence of the gap.

Aspect C-19

The powder container according to Aspect C-18, wherein the sliding guide includes a reinforcing portion that is connected to and integrated with the sliding guide, and the gap is provided on lower surface of the reinforcing portion.

Aspect C-20

The powder container according to any one of Aspects C-10 to C-19, further comprising:

a container body to store therein the powder; and a container cover to cover the container body, wherein the restrictor is provided to the container cover.

Aspect C-21

The powder container according to any one of Aspects C-1 to C-20, wherein the powder container contains toner as the powder.

Aspect C-22

The powder container according to any one of Aspects C-1 to C-21, further comprising:

an upward guide provided to an upper portion of the powder container, wherein the movement of the powder container in the vertical direction is restricted when the upward guide comes in contact with a ceiling surface of the insertion hole.

Aspect C-23

An image forming apparatus comprising:

the powder container according to any one of Aspects C-1 to C-22; and an image forming unit that forms an image on an image bearer by using powder conveyed from the powder container.

Aspect C'-1

A powder container to contain powder used for forming an image and to be attached to an image forming apparatus that includes:

an insertion hole in which the powder container is inserted in a horizontal direction; and an identifying part that protrudes upward at the insertion hole and is provided in a different shape or position according to a type of the image forming apparatus, the powder container comprising:

a identified portion that is provided in a lower portion of the powder container and is allowed to pass over the identifying part; and a restrictor to restrict movement of the powder container in a vertical direction when identified portion passes over the identifying part at the insertion hole, wherein the identified portion is provided between a pair of the restrictors provided on an outer surface of the powder container.

Aspect C"-1

A powder container to contain powder used for forming an image and to be attached to an image forming apparatus that includes:

an insertion hole in which the powder container is inserted in a horizontal direction; and an identifying part that protrudes upward at the insertion hole and is provided in a different shape or position according to a type of the image forming apparatus, the powder container comprising:

an identified portion that is provided in a lower portion of the powder container and is allowed pass over the identifying part; and a restrictor to restrict movement of the powder container in a vertical direction when the identified portion passes over the identifying part at the insertion hole.

Aspect C"-2

The powder container according to Aspect C"-1, wherein the restrictor is a pair of a vertical restrictors provided on an outer surface of the powder container, and the movement of the powder container in the vertical direction is restricted when a restriction rib provided at the insertion hole is entered into the vertical restrictor.

Aspect C"-3

The powder container according to Aspect C""-2, wherein the identified portion is provided between a pair of the vertical restrictors.

Aspect C"-4

The powder container according to Aspect C"-3, wherein the identified portion is defined by a pair of container protrusion protruding from the vertical restrictors, and whether the identified portion is allowed to pass over the identifying part at the insertion hole is identified based on a distance between the container protrusions.

Aspect C"-5

The powder container according to Aspect C"-3, wherein the identified portion is provided on lower surfaces of the vertical restrictors along a powder-container attachment direction, and whether the identified portion is allowed to pass over the identifying part at the insertion hole is identified based on presence or absence of identified portion.

Aspect C"-6

The powder container according to Aspect C"-4, wherein the container protrusion extends to a position on a downstream side in the powder-container attachment direction relative to centers of the vertical restrictors in a longitudinal direction,

REFERENCE SIGNS LIST

26 FEED TRAY
27 FEED ROLLER
28 REGISTRATION ROLLER PAIR
29 DISCHARGE ROLLER PAIR
30 STACK SECTION
32(Y, C, K), 1032, 2032, 3032 TONER CONTAINER (POWDER CONTAINER)
33, 1033 CONTAINER BODY (POWDER STORAGE)
33*a* OPENING (CONTAINER OPENING)
33*b* OUTER SURFACE OF CONTAINER OPENING
33*c* FRONT END OF CONTAINER OPENING
34, 2034 CONTAINER FRONT END COVER (CONTAINER COVER)
34*a*, 2034*a* GEAR EXPOSING OPENING
34*b*, 2034*b* OUTER SURFACE OF CONTAINER COVER
34*c*, 2034*c* FRONT END IN ATTACHMENT DIRECTION
34*d*, 2034*d* VERTICAL SURFACE (DOWNSTREAM SURFACE IN ATTACHMENT DIRECTION)
34*g*, 2034*g* LOWER PORTION (LOWER PORTION OF OUTER PERIPHERY OF CONTAINER FRONT COVER)
35 UPWARD GUIDE
35*a* TOP POTION OF UPWARD GUIDE
35*b* SIDE PORTION OF UPWARD GUIDE
35*c* INCLINED SURFACE OF UPWARD GUIDE
41(Y, M, C, K) PHOTOCONDUCTOR (IMAGE BEARER)
42(Y, M, C, K) PHOTOCONDUCTOR CLEANING DEVICE (CLEANING DEVICE)
42*a* CLEANING BLADE
44(Y, M, C, K) CHARGING ROLLER (CHARGING DEVICE)
46(Y, C, K) IMAGE FORMING SECTION
47 EXPOSING DEVICE
48 INTERMEDIATE TRANSFER BELT
49(Y, M, C, K) PRIMARY-TRANSFER BIAS ROLLER
50(Y, M, C, K) DEVELOPING DEVICE (DEVELOPING MEANS)
51(Y, M, C, K) DEVELOPING ROLLER (DEVELOPER BEARER)
52(Y, M, C, K) DOCTOR BLADE (DEVELOPER REGULATING PLATE)
53(Y, M, C, K) FIRST DEVELOPER ACCOMMODATING SECTION
54(Y, M, C, K) SECOND DEVELOPER ACCOMMODATING SECTION
55(Y, M, C, K) DEVELOPER CONVEYING SCREW
56(Y, M, C, K) TONER DENSITY SENSOR
60(Y, C, K) TONER REPLENISHING DEVICE (POWDER REPLENISHING DEVICE)
64(Y, M, C, K) TONER DROPPING PASSAGE
70, 2070 TONER CONTAINER HOLDER (CONTAINER HOLDING SECTION)
71, 71A, 2071 INSERTION HOLE PART
71*a*, 2071*a* INSERTION HOLE (INSERTION OPENING)
71*b* INSERTION HOLE BASE
71*c* LOWER SIDE SURFACE (LOWER SIDE SURFACE OF INSERTION HOLE)
71*e* CEILING SURFACE (CEILING SURFACE OF INSERTION HOLE)
72, 2072 CONTAINER RECEIVING SECTION
73, 2073 CONTAINER COVER RECEIVING SECTION
74, 2074 GUTTER (CONTAINER MOUNTING SECTION)
74*a*, 74*b*, 2074*a*, 2074*b* SIDE SURFACE OF GUTTER (SIDE SURFACE)
74*c* MOUNTING SURFACE

75, 2075 GUIDING RAIL
76 CEILING SURFACE (OPPOSITE SURFACE OF MOUNTING SURFACE)
76*a* PROJECTION FROM CEILING SURFACE (PROJECTION)
77*a* GROOVE OF SETTING COVER (GROOVE)
77*b* CONVEX OF SETTING COVER (CONVEX)
78 ENGAGING MEMBER, REPLENISHING DEVICE ENGAGING MEMBER
78*a* ONE END OF ENGAGING MEMBER (ONE END)
78*b* OTHER END OF ENGAGING MEMBER (OTHER END)
78*c* TIP PART
78*e* FIRST INCLINED SURFACE
78*f* SECOND INCLINED SURFACE
78*g* SPRING PRESS PART
78*h* ROTATION STOPPER
79*a* THROUGH HOLE OF SETTING COVER (THROUGH HOLE)
79*b* RECESS OF SETTING COVER (RECESS)
82 SECONDARY-TRANSFER BACKUP ROLLER
85 INTERMEDIATE TRANSFER DEVICE
86 FIXING DEVICE
89 SECONDARY TRANSFER ROLLER
90, 2090 IDENTIFYING PROTRUSION (IDENTIFYING RIB IDENTIFYING PART)
91, 2091 CONTAINER ROTATING PART (DRIVING PART)
92, 2092 IDENTIFYIED PORTION
93 RESTRICTION RIB (RESTRICTION PART)
100 PRINTER (COPIER MAIN BODY, IMAGE FORMING APPARATUS MAIN BODY)
200 SHEET FEEDER
301, 1301 CONTAINER GEAR
302 SPIRAL GROOVE (ROTARY CONVEYOR)
303 GRIPPER
304 SCOOPING PORTION
304*a* SPIRAL RIB OF SCOOPING PORTION
304*g* SCOOPING RIB
304*f* SCOOPING WALL SURFACE
304*h* CONVEX OF SCOOPING PORTION
305 FRONT END OPENING
306 COVER HOOK STOPPER (COVER HOOK RESTRICTOR)
306*a* OUTER EDGE OF COVER HOOK RESTRICTOR
330, 1330 NOZZLE RECEIVER (CONVEYOR RECEIVER)
331, 1331 RECEIVING OPENING (NOZZLE INSERTION OPENING)
333*a* INNER SURFACE OF NOZZLE INSERTION OPENING
332, 1332 CONTAINER SHUTTER (OPENING/CLOSING MEMBER)
332*a* SHUTTER HOOK
332*b* GUIDING ROD SLIDING PORTION
332*c* FRONT CYLINDRICAL PORTION (CLOSURE)
332*d* SLIDE AREA
332*e* GUIDING ROD
332*g* GUIDING ROD SLIDING PORTION
332*f* CANTILEVER
332*h* END SURFACE OF CONTAINER SHUTTER (END SURFACE OF FRONT CYLINDRICAL PORTION)
333 CONTAINER SEAL (SEAL)
334 CONTAINER SHUTTER SUPPORTER (SUPPORTER)
335 SHUTTER REAR END SUPPORTING PORTION (SHUTTER REAR PORTION)
335*a* SHUTTER SIDE SUPPORTING PORTION (SHUTTER SIDE PORTION)
335*b*, 1335*b* OPENING OF SHUTTER SUPPORTING PORTION (SHUTTER SIDE OPENING)
335*d* REAR END OPENING (THROUGH HOLE)
336, 1336 CONTAINER SHUTTER SPRING (BIASING MEMBER)
337 NOZZLE RECEIVER ATTACHMENT PORTION
337*a* NOZZLE SHUTTER POSITIONING RIB (ABUTTING PORTION, CONVEX PORTION)
337*b* SEAL JAM PREVENTING SPACE
339, 2339 CONTAINER ENGAGED PORTION
339*a*, 2339*a* GUIDING PROTRUSION
339*a*1 GUIDING INCLINED SURFACE
339*a*2 TIP OF CONTAINER FRONT SIDE
339*b*, 2339*b* GUIDING GROOVE
339*c*, 2339*c* BUMP
339*d*, 2339*d* ENGAGED OPENING (GUIDING PORTION, AXIAL RESTRICTOR, AXIAL POSIIONER)
339*e* FIRST CONTACT SURFACE
339*f* SECOND CONTACT SURFACE
340, 2340 COVER HOOK
340*b* INNER SURFACE OF COVER FRONT END
341*a* PROTRUSION (GUIDING PORTION, RADIAL RESTRICTOR, RADIAL POSITIONING PORTION, RADIAL POSITIONER)
342*a* ROTATION RESTRICTIVE RIB (ROTATION RESTRICTIVE PORTION, GUIDING PORTION, CIRCUMFERENTIAL RESTRICTOR, CIRCUMFERENTIAL RESTRICTING PORTION, CIRCUMFERENTIAL POSITIONER)
342*b* ROTATION RESTRICTIVE CONCAVE (GUIDING PORTION, CIRCUMFERENTIAL RESTRICTING GROOVE, CIRCUMFERENTIAL POSITIONER)
343, 2343 HOLDER (IC TAG HOLDER)
344 HOLDING PORTION (COVER PORTION)
345 HOLDING MECHANISM
361, 2361 SLIDING GUIDE (GUIDING PORTION, VERTICAL RESTRICTOR, VERTICAL POSITIONER)
361A, 2361A UPPER SURFACE (UPPER GUIDE)
361B, 2361B LOWER SURFACE (LOWER GUIDE)
361*a*, 2361*a* SLIDING GROOVE
361*b* FRONT END OF SLIDING GUIDE
361*c* FRONT OF SLIDING GROOVE (FIRST GUIDE)
361*d* CENTER OF SLIDING GROOVE (SECOND GUIDE)
361*e* REAR OF SLIDING GROOVE
361*g* RECESS SURFACE OF SLIDING GROOVE
361*f* GROOVE INCLINED PORTION
362, 2362 REINFORCING PORTION
400 SCANNER (SCANNER SECTION)
500 COPIER (IMAGE FORMING APPARATUS)
600 POSITIONING PORTION (GUIDING PORTION)
601 CONTAINER DRIVING GEAR
602 MOUNTING FRAME
603 DRIVING MOTOR (APPARATUS MAIN-BODY GEAR)
603*a* OUTPUT GEAR
604 COUPLED GEAR
605 CONVEYOR SCREW GEAR
607 NOZZLE HOLDER
608, 2608 SETTING COVER
608*a* RECESS SURFACE (FIRST BACK SURFACE)

608*b* MOUNTING PART
608*c* INNER SURFACE OF SETTING COVER (INNER SURFACE OF CONTAINER COVER RECEIVING SECTION)
608*d*, 2608*d* HOLE
608*e* SETTING COVER PROTRUSION
608*f* EDGE OF SETTING COVER
608*g* SUPPORTING PART OF ENGAGING MEMBER
608*h* SETTING COVER NOTCH
610 NOZZLE HOLE (POWDER RECEIVING HOLE)
611 CONVEYING NOZZLE (CONVEYING PIPE)
611*a* FRONT END OF CONVEYING NOZZLE (END SURFACE)
612 NOZZLE SHUTTER (NOZZLE OPENING/CLOSING MEMBER)
612*a* FLANGE (NOZZLE SHUTTER FLANGE)
612*f* BIASED SURFACE OF NOZZLE SHUTTER FLANGE
613 NOZZLE SHUTTER SPRING (BIASING MEMBER)
614 CONVEYING SCREW (APPARATUS MAIN-BODY CONVEYOR)
615 CONTAINER SETTING SECTION (CONTAINER RECEIVING SECTION)
615*a* INNER SURFACE OF CONTAINER SETTING SECTION
615*b* END SURFACE OF CONTAINER SETTING SECTION (SECOND BACK SURFACE)
615*d* CONTACT SURFACE
615*c* SPRING FIXING PART
700, 2700 IC TAG (IC CHIP, INFORMATION STORAGE MEDIUM)
701 IC TAG OPENING (TERMINAL OPENING)
702, 2702 SUBSTRATE
703, 2703 EARTH TERMINAL (GROUND TERMINAL)
705 EARTH TERMINAL PROJECTION
710, 2710 METALLIC PAD
710*a*, 2710*a* FIRST METALLIC PAD
710*b*, 2710*b* SECOND METALLIC PAD
710*c*, 2710*c* THIRD METALLIC PAD
2710*d* FORTH METALLIC PAD
720 HOLDING MEMBER
781 SHAFT (FULCRUM)
782 TORSION COIL SPRING
783 PIN
800, 2800 CONNECTOR (READING MEANS)
801 POSITIONING PIN
802 EARTH TERMINAL OF MAIN BODY
804 TERMINAL
920, 9201*a*, 9202*a*, 9204*a*, 9205*a* IDENTIFYIED PRTORUSION (IDENTIFIED RIB, PROTRUSION BETWEEN SLIDING GUIDES)
920*a* UPPER PART OF IDENTIFYIED RIB
920*b* SIDE PART OF IDENTIFYIED RIB
921, 9211*a*, 9211*b*, 9212*a*, 9212*b* GAP BETWEEN IDENTIFYIED RIBS (IDENTIFYIED GAP, GAP BETWEEN PROTRUSIONS)
922, 9224*a*, 9224*b*, 9225*a*, 9225*b*, 9235*a* GAP OF REINFORCING PORTION (PASSAGE (NOTCH, RECESS) OF REINFORCING PORTION)
9213 GAP BETWEEN SLIDING GUIDES (PASSAGE BETWEEN SLIDING GIDE)
9201*b*, 9202*b*, 9204*b*, 9205*b* PROTRUSION BETWEEN SLIDING GUIDES
1035 REAR COVER (REAR CAP)
1035*a* REAR SIDE BEARING
1036 FRONT SIDE BEARING
1302 CONVEYING BLADE
1330*a* OUTER SURFACE OF NOZZLE RECEIVER
1330*b* CONVEYING BLADE HOLDER
1332*a* CONTACT PORTION
1332*b* SHUTTER SUPPORTING PORTION
1332*c* HOOK PORTION
1335*c* DOWNSTREAM SIDE PART IN ROTATION DIRECTION
2075*a* FRONT EDGE OF GUIDING RAIL
2343*a*, 2343*b* BOTH SIDE SURFACES (GUIDING PORTION, CIRCUMFERENTIAL RESTRICTOR, BOTH SURFACES OF HOLDER, CIRCUMFERENTIAL POSITIONER)
2801 GUIDING PART
2801*a*, 2801*b* WALL
2801*c*, 2801*d* INNER SURFACE (INNER SURFACE OF WALL)
2802, 2803 POSITIONER
2802*a*, 2803*a* ONE END OF POSITIONER
2802*b*, 2803*b* OTHER END OF POSITIONER
2802*c*, 2803*c* CENTER OF POSITIONER
2804*a* FIRST APPARATUS MAIN-BODY TERMINAL
2804*b* SECOND APPARATUS MAIN-BODY TERMINAL
2804*c* THIRD APPARATUS MAIN-BODY TERMINAL
2804*d* FORTH APPARATUS MAIN-BODY TERMINAL
2805 APPARATUS MAIN-BODY TERMINAL
H1, H2, H3 DISTANCE BETWEEN UPPER GUIDE AND LOWER GUIDE
L LASER LIGHT
P RECORDING MEDIUM
Q ATTACHMENT DIRECTION
Q1 DETACHMENT DIRECTION
G DEVELOPER

What is claimed is:

1. A powder container to contain powder, comprising:
a container body to contain the powder, the container body having an axis of rotation;
a container cover at one end of the powder container in a longitudinal direction which is parallel to the axis of rotation, the container body being rotatable with respect to the container cover;
a shutter having an end surface, the shutter being slidable along the axis of rotation and the axis of rotation passes through the shutter;
a pair of first protrusions, disposed at the container cover, which extends along the longitudinal direction and protrudes in a lateral direction;
a second protrusion, disposed at the container cover, which protrudes away from the axis of rotation; and
a third protrusion, disposed at the container cover and different from the pair of first protrusions and the second protrusion, which protrudes away from the axis of rotation.

2. The powder container according to claim 1, wherein:
the third protrusion is on a virtual plane which includes an entirety of the axis of rotation, and
the virtual plane is between the pair of first protrusions.

3. The powder container according to claim 1, wherein:
an end of each of the first protrusions on a shutter side in the longitudinal direction is closer to the shutter when the shutter is in a closed position than an end of the third protrusion on the shutter side in the longitudinal direction when the shutter is in the closed position.

4. The powder container according to claim 1, wherein:
the third protrusion includes a top section, and
the top section extends parallel to the axis of rotation.

5. The powder container according to claim 4, further comprising:
a gear at the one end,
wherein the top section protrudes in a radial direction of the toner container further than the gear from the axis of rotation.

6. The powder container according to claim 2, wherein:
the container cover includes a pair of parts to be engaged with a powder replenishing device,
the pair of parts includes a hole, and
the virtual plane is between the pair of parts.

7. The powder container according to claim 4, further comprising:
a receiving opening at the one end of the powder container; and
a space at the one end of the powder container, the axis of rotation passing through the space and the receiving opening, the space being at least partially defined by a cylindrical wall and extending to a position of the receiving opening in the longitudinal direction,
wherein the receiving opening is closer to a center of the powder container along the longitudinal direction than the space.

8. The powder container according to claim 1, wherein:
the second protrusion is further radially outward from the axis of rotation than a radially outer portion of a cylindrical wall of the powder container.

9. The powder container according to claim 1, wherein:
the second protrusion is diagonally below the axis of rotation, when the powder container is in an installed orientation.

10. The powder container according to claim 1, wherein:
the first protrusion includes a lower side, and
the second protrusion includes a surface oriented obliquely relative to the lower side.

11. The powder container according to claim 1, wherein:
a tip of the second protrusion which is most radially outward from the axis of rotation is closer to the axis of rotation than a tip of the first protrusion which is most radially outward from the axis of rotation.

12. The powder container according to claim 1, further comprising:
a substrate including terminals,
wherein a tip of the substrate which is most radially outward from the axis of rotation is further from the axis of rotation than a tip of the second protrusion which is most radially outward from the axis of rotation.

13. The powder container according to claim 1, further comprising:
a space at the one end of the powder container, the axis of rotation passing through the space and a receiving opening, the space being at least partially defined by a cylindrical wall and extending to a position of the receiving opening in the longitudinal direction; and
a gear at the one end, the gear being disposed relative to the longitudinal direction between the space and the first protrusion.

14. The powder container according to claim 2, further comprising:
a substrate including terminals,
wherein when the powder container is in an installed orientation, the substrate and the second protrusion are on a same side of the virtual plane which includes the entirety of the axis of rotation.

15. The powder container according to claim 1, further comprising:
a space at the one end of the powder container, the axis of rotation passing through the space and a receiving opening, the space being at least partially defined by a cylindrical wall and extending to a position of the receiving opening in the longitudinal direction,
wherein relative to the longitudinal direction, the second protrusion is between the first protrusion and the space.

16. The powder container according to claim 1, wherein:
a distance the first protrusion extends in the longitudinal direction is longer than a distance the first protrusion projects in the lateral direction.

17. The powder container according to claim 1, wherein:
the first protrusion and the second protrusion are integral with a same structure.

18. The powder container according to claim 1, wherein:
the container cover includes a reinforcing portion, and
the first protrusion and the second protrusion are connected to the reinforcing portion.

19. The powder container according to claim 15, wherein:
the container cover includes a reinforcing portion, and
the second protrusion protrudes from the reinforcing portion in a direction away from a center of the powder container along the longitudinal direction.

20. The powder container according to claim 1, wherein:
the first protrusion is a lower guide,
the powder container further comprising:
an upper guide; and
a groove between the upper guide and the lower guide.

21. The powder container according to claim 1, wherein:
the first protrusion and the second protrusion are disposed at heights which are below a height of the axis of rotation when the powder container is installed.

22. The powder container according to claim 1, further comprising:
a receiving opening to receive a nozzle which transports the powder out of the powder container.

23. The powder container according to claim 1, further comprising:
a cylindrical wall attachable to a container receiving section of a main body of an image forming apparatus, the container receiving section surrounding a nozzle.

24. The powder container according to claim 19, wherein:
the receiving opening is positioned inside a cylindrical wall of the powder container in a direction orthogonal to the longitudinal direction when viewed along the longitudinal direction.

25. The powder container according to claim 9, wherein:
the receiving opening is to communicate with an interior of the powder container.

26. The powder container according to claim 1, wherein:
a protrusion direction of the second protrusion is oblique to a protrusion direction of the first protrusion.

27. The powder container according to claim 20, wherein:
wherein the second protrusion is at a same height as the groove in a direction perpendicular to the longitudinal direction.

28. The powder container according to claim 1, further comprising:
a cylindrical wall at the one end of the powder container.

29. The powder container according to claim 19, wherein the powder container comprises:
two first protrusions;
two reinforcing portions, each corresponding to one of the first protrusions; and
only one second protrusion.

30. A powder container to contain powder, comprising:

a container body to contain the powder, the container body having an axis of rotation;

a container cover at one end of the powder container in a longitudinal direction which is parallel to the axis of rotation, the container body being rotatable with respect to the container cover;

a shutter having an end surface, the shutter being slidable along the axis of rotation and the axis of rotation passes through the shutter;

a receiving opening at the one end of the powder container, a space at the one end of the powder container, the axis of rotation passing through the space, the space being at least partially defined by a cylindrical wall and extending to a position of the receiving opening in the longitudinal direction of the powder container;

the receiving opening being closer to a center of the powder container along the longitudinal direction than the space, the axis of rotation passing through the receiving opening;

a first means for restricting vertical movement of the powder container in a vertical direction when the powder container is in an installed position, the vertical direction being perpendicular to the longitudinal direction; and means for restricting rotational movement of the container cover; and a second means for restricting vertical movement of the powder container in the vertical direction, the second means for restricting vertical movement being disposed higher than the first means for restricting vertical movement when the powder container is in the installed position.

31. The powder container according to claim 30, wherein:

the means for restricting rotational movement protrudes in a radially outward direction away from the axis of rotation and away from the container cover when viewed along the longitudinal direction, wherein with respect to the longitudinal direction, and the means for restricting rotational movement is further from a longitudinal center of the powder container than the first means for restricting vertical movement.

32. A powder container to contain powder, comprising:

a container body to contain the powder, the container body having an axis of rotation;

a container cover at one end of the powder container in a longitudinal direction which is parallel to the axis of rotation, the container body being rotatable with respect to the container cover;

a shutter having an end surface;

a pair of first protrusions, disposed at the container cover, which extends along the longitudinal direction and protrudes in a lateral direction;

a second protrusion, disposed at the container cover, which protrudes away from the axis of rotation; and a third protrusion, disposed at the container cover and different from the pair of first protrusions and the second protrusion, which protrudes away from the axis of rotation, wherein:

the third protrusion includes an inclined surface, and the inclined surface slopes downwardly towards an end of the powder container which is opposite to the one end of the powder container along the axis of rotation, when the powder container is in an installed orientation.

* * * * *